US008658984B2

(12) United States Patent
Makarov et al.

(10) Patent No.: US 8,658,984 B2
(45) Date of Patent: Feb. 25, 2014

(54) CHARGED PARTICLE ANALYSERS AND METHODS OF SEPARATING CHARGED PARTICLES

(75) Inventors: Alexander A. Makarov, Bremen (DE); Anastassios Giannakopulos, Bremen (DE)

(73) Assignee: Thermo Fisher Scientific (Bremen) GmbH, Bremen (DE)

( * ) Notice: Subject to any disclaimer, the term of this patent is extended or adjusted under 35 U.S.C. 154(b) by 0 days.

(21) Appl. No.: 13/375,187

(22) PCT Filed: May 27, 2010

(86) PCT No.: PCT/EP2010/057342

§ 371 (c)(1),
(2), (4) Date: Jan. 4, 2012

(87) PCT Pub. No.: WO2010/136534

PCT Pub. Date: Dec. 2, 2010

(65) Prior Publication Data

US 2012/0091332 A1 Apr. 19, 2012

(30) Foreign Application Priority Data

May 29, 2009 (GB) ..... 0909233.9

(51) Int. Cl.
*H01J 3/16* (2006.01)

(52) U.S. Cl.
USPC ..... 250/396 R; 250/282; 250/287

(58) Field of Classification Search
USPC ..... 250/396 R
See application file for complete search history.

(56) References Cited

U.S. PATENT DOCUMENTS 6,013,913 A * 1/2000 Hanson ..... 250/287
6,657,190 B2 12/2003 Hansen et al.

(Continued)

FOREIGN PATENT DOCUMENTS

DE 10 2007 024 858 A1 10/2008
GB 2 080 021 A 1/1982

(Continued)

OTHER PUBLICATIONS

H. Wollnik, "Mass Separators," Nuclear Instruments and Methods in Physics Research A258 (1987), pp. 289-296.

(Continued)

*Primary Examiner* — Phillip A Johnston
(74) *Attorney, Agent, or Firm* — Charles B. Katz

(57) ABSTRACT

A method of separating charged particles using an analyzer is provided, the method comprising: causing a beam of charged particles to fly through the analyzer and undergo within the analyzer at least one full oscillation in the direction of an analyzer axis (z) of the analyzer whilst orbiting about the axis (z) along a main flight path; constraining the arcuate divergence of the beam as it flies through the analyzer; and separating the charged particles according to their flight time. An analyzer for performing the method is also provided. At least one arcuate focusing lens is preferably used to constrain the divergence, which may comprise a pair of opposed electrodes located either side of the beam. An array of arcuate focusing lenses may be used which are located at substantially the same z coordinate, the arcuate focusing lenses in the array being spaced apart in the arcuate direction and the array extending at least partially around the z axis, thereby constraining the arcuate divergence of the beam a plurality of times as it flies through the analyzer.

51 Claims, 65 Drawing Sheets

(56) References Cited

U.S. PATENT DOCUMENTS

| | | | | |
|---|---|---|---|---|
| 6,888,130 | B1 | 5/2005 | Gonin | |
| 6,949,738 | B2 | 9/2005 | Yamaguchi et al. | |
| 7,196,324 | B2 | 3/2007 | Verentchikov | |
| 7,326,925 | B2 | 2/2008 | Verentchikov et al. | |
| 7,385,187 | B2 | 6/2008 | Verentchikov et al. | |
| 7,439,520 | B2 * | 10/2008 | Vestal | 250/396 ML |
| 7,994,473 | B2 | 8/2011 | Koester | |
| 2001/0011703 | A1 | 8/2001 | Franzen | |
| 2005/0242279 | A1 | 11/2005 | Verentchikov | |
| 2005/0258364 | A1 | 11/2005 | Whitehouse et al. | |
| 2007/0029473 | A1 | 2/2007 | Verentchikov | |
| 2007/0176090 | A1 | 8/2007 | Verentchikov | |
| 2007/0194223 | A1 | 8/2007 | Sato et al. | |
| 2011/0017907 | A1 | 1/2011 | Makarov et al. | |

FOREIGN PATENT DOCUMENTS

| | | | |
|---|---|---|---|
| GB | 2441681 | B | 11/2010 |
| GB | 2441728 | B | 11/2010 |
| SU | 1247973 | A1 | 7/1986 |
| SU | 1716922 | A1 | 1/1991 |
| WO | WO 02/078046 | A2 | 10/2002 |
| WO | WO 2005/001878 | A2 | 1/2005 |
| WO | WO 2006/102430 | A2 | 9/2006 |
| WO | WO 2008/102430 | A2 | 9/2006 |
| WO | WO 2007/044696 | A1 | 4/2007 |
| WO | 2007/104992 | A2 | 9/2007 |
| WO | 2008/047891 | A2 | 4/2008 |
| WO | 2008/071921 | A2 | 6/2008 |

OTHER PUBLICATIONS

Wollnik et al., "TOFI: An Isochronous Time-of-Flight Mass Spectrometer," Nuclear Instruments and Methods in Physics Research A258 (1987), pp. 331-334.

V. P. Ivanov et al., "Time-of-Flight Mass Analyzer for Dust Impact Ion Source," Proceedings of IV International Seminar, Manufacturing of Scientific Spae Instrumentation, Instruments for Studying Space Plasma and Cosmic Rays (USSR, Frunze (1989)).

H. Wollnik, "Energy-isochronous time-of-flight mass analyzers," Int. J. Mass. Spectrom. Ion Processes 131 (1994), pp. 387-407.

Wollnik et al., "Time-of-Flight Mass Spectrometers with Multiply Reflected Ion Trajectories," Int. J. Mass. Spectrom. Ion Processes, 96 (1990), pp. 267-274.

Toyoda et al., "Construction of a new multi-turn time-of-flight mass spectrometer," J. Mass Spectrom. 35 (2000), pp. 163-167.

Casares et al., "Multipass time-of-flight mass spectrometers with high resolving powers," Int. J. Mass. Spectrom. 206 (2001), pp. 267-273.

Alexander Makarov, "Practical Aspects of Trapped Ion Mass Spectrometry, vol. IV, Theory and Instrumentation," Edited by Raymond E. March and John F. J. Todd, CRC Press 2010, pp. 251-272.

* cited by examiner

CHARGED PARTICLE ANALYSERS AND METHODS OF SEPARATING CHARGED PARTICLES

FIELD OF THE INVENTION

This invention relates to charged particle analysers and methods of separating and analysing charged particles, for example using time of flight mass spectrometry.

BACKGROUND

Time of flight (TOF) mass spectrometers are widely used to determine the mass to charge ratio of charged particles on the basis of their flight time along a path. The charged particles, usually ions, are emitted from a pulsed source in the form of a packet, and are directed along a prescribed flight path through an evacuated space to impinge upon or pass through a detector. In its simplest form, the path follows a straight line and in this case ions leaving the source with a constant kinetic energy reach the detector after a time which depends upon their mass, more massive ions being slower. The difference in flight times between ions of different mass depends upon the length of the flight path, amongst other things; longer flight paths increasing the time difference, which leads to an increase in mass resolution. When high mass resolution is required it is therefore desirable to increase the flight path length. However, increases in a simple linear path length lead to an enlarged instrument size, increasing manufacturing cost and requiring more laboratory space to house the instrument.

Various solutions have been proposed to increase the path length whilst maintaining a practical instrument size, by utilising more complex flight paths. Many examples of charged particle mirrors or reflectors have been described, as have electric and magnetic sectors, some examples of which are given by H. Wollnik and M. Przewloka in the Journal of Mass Spectrometry and Ion Processes, 96 (1990) 267-274, and G. Weiss in U.S. Pat. No. 6,828,553. In some cases two opposing reflectors or mirrors direct charged particles repeatedly back and forth between the reflectors or mirrors; offset reflectors or mirrors cause ions to follow a folded path; sectors direct ions around in a ring or a figure of "8" racetrack. Herein the terms reflector and mirror are used interchangeably. Many such configurations have been studied and will be known to those skilled in the art.

There are essentially two possible types of flight path: an open flight path and a closed flight path. In an open flight path, the ions do not follow a repeated path and as a result, in an open flight path ions of different mass to charge ratio therefore can never overlap whilst travelling in the same direction upon the same flight path. However, in a closed flight path, the ions do follow a repeated path and return to the same point in the flight path after a given time, to proceed upon the flight path once again, whereby ions of different mass to charge may overlap whilst following the same path. A particular advantage of having an open flight path, e.g. the simple linear flight path, is the theoretically unlimited mass range able to be analysed from each ion packet emitted from the pulsed source. In the case of a closed flight path, e.g. as in directly opposing mirror time of flight instruments, and all designs in which ions repeatedly follow a given flight path, this advantage is lost as, during the flight, the packet becomes a train of packets of different mass to charge particles, the length of which train increases during the flight time. On increasing the flight time, the front of this train of packets may eventually fold around and catch up with the rear on the repeated path, packets of different mass to charge particles then arriving at the detector at the same time. Detection in such a case would yield an overlapping mass spectrum, which would require some form of deconvolution. This has led in practice to a reduced mass range, or a limit on the length of the flight path that can be utilised, or both, in analysers of this type. To avoid this, it is desirable to retain the unlimited mass range available from time of flight instruments that utilise an open or non-repeated path. However, reflecting time of flight geometries that produce a folded path and multiple sector designs have the disadvantage that they require multiple high-tolerance ion optical components, adding cost and complexity, as well as generally being larger in size.

In addition to these considerations, for high mass resolution it is important that charged particles of the same mass to charge ratio emitted from a finite volume within the pulsed source and having trajectories with varying angular divergence all reach the detector at the same time. This may be termed temporal focusing on initial angle and position. A relatively wide range of angular divergence (up to few degrees) and spatial spread (submillimeter to several tens of mm) should be accepted by the time of flight analyser, all particles accepted being brought to a time focus at the detector, which is to say, ions of the same mass to charge ratio arrive at the detector at the same time regardless of their initial angular divergence or spatial position at the source. For high resolution, reflectors and sectors that are utilised to increase the flight path length must be designed such that this temporal focusing is higher than to first order, preferably the focusing should be to third order or higher.

Still further to these considerations, time focusing of particles having different energies must also be achieved for high mass resolution. Energy spreads up to several tens of percent of the nominal beam energy might have to be accommodated for particles emitted by some types of pulsed ion source, requiring TOF analysers where the time of flight is energy independent to high order. A variety of designs has been proposed for both reflectors and sectors that have improved time focusing for particles of differing energies. Some reflectors having improved time focusing for particles of differing energies include grids to better control the electric field within the reflector, however such reflectors are less suitable for multi-reflection systems, as ions are lost through collisions with the grids at each reflection, and the overall transmission of the system after multiple reflections is compromised.

For reflectors, it has been noted that application of a linear electric reflection field, yielding harmonic charged particle motion, produces perfect time focusing for particles of varying energies. Examples have been proposed by W. S. Crane and A. P. Mills in Rev. Sci. Instrum. 56(9), 1723-1726 (1985), Y. Yoshida in U.S. Pat. No. 4,625,112 and U. Andersen et.al. in Rev. Sci. Instrum. 69(4) 1650-1660 (1998), and others. The linear field produces a force upon the charged particles which increases linearly with increasing distance into the reflector. Higher energy particles travel faster but also travel further into the reflection field and spend the same time within it as do lower energy particles. Such a linear field is formed with a parabolic electrical potential. Confusingly, many prior art publications refer to the field as parabolic rather than the potential; a parabolic field does not result in harmonic motion. Difficulties exist with the use of such parabolic potential reflectors, however, as they tend to produce strong divergence of ion beams in directions orthogonal to the axis of reflection. This makes 2 or more reflections in such mirrors simply impractical. The quality of focusing in such fields also degrades as longer field-free regions are introduced between an ion source and entrance to such a mirror.

For multiple reflection systems the angular divergence of the charged particle beam must be constrained to conserve high transmission. Spatial focusing in the plane perpendicular to the direction of time-of-flight separation requires the presence of a strong (usually accelerating) lens on the entrance to the mirror as well as a field-free drift space prior to the entrance to the mirror, such as is contemplated in GB2,080,021. The use of multiple reflectors or multiple sectors requires sophisticated design and high tolerance manufacturing for each of the several reflectors or sectors, resulting in increased complexity and cost, as well as typically a larger instrument size. The construction could be made simpler and easier to control if the mirrors were planar, as proposed in SU1,725,289. Divergence in the shift direction parallel to the mirror's extension could be limited by using periodic lenses as proposed by A. Verentchikov et.al. in U.S. Pat. No. 7,385,187. However, such lenses themselves cause beam aberrations unless they are quite weak and can limit the quality of the final time focus and hence limit mass resolution.

For all such systems, high focusing voltages are required to get high quality of spatial and temporal focusing. More importantly in practice, the substantial non-linearity of the reflecting field even near the turning points in all mirrors of this type drastically reduces the tolerance to space charge, as described in WO06129109.

L. N. Gall et.al. in SU1247973 proposed an alternative parabolic potential arrangement in which charged particles are reflected in a structure having two coaxial electrodes, particles travelling between the two, orbiting the inner electrode. The electric field between the electrodes has independent components in the directions of the longitudinal (Z) axis and the radial (r) axis, which is to say that the force on the charged particle in the longitudinal direction is independent of the radial position of the particle. The presence of concentric electrodes produces a logarithmic potential term in r, and a parabolic potential term is present in Z. However the single reflecting embodiment described by Gall et.al. has a limited flight path length. Gall et.al. provide no teaching on how such a field could be utilised in a multi-reflecting structure. A further single-reflecting example utilising this type of field, but using separate potentials applied to a ring structure, was also given by V.P. Ivanov et.al. in Proc. $4^{th}$ Int. Seminar on the Manufacturing of Scientific Space Instruments, Frunze, 1990, IKI AN, Moscow, 1990, vol. 2, 65-69. Both these single reflecting TOF instruments have limited mass resolution, the latter demonstrating only a resolving power of 40. The main problem with these systems relates to the precise definition of the field, especially at the points of ion injection and ejection. This problem stems from the necessity to avoid any field-free drift spaces within such a system in order to have axial field strictly linear along the entire ion path.

There remains a need for a compact, high resolution, unlimited mass range TOF which embodies perfect or near perfect angular and time focusing characteristics with a minimum of high tolerance components.

A brief glossary of terms used herein for the invention is provided below for convenience; a fuller explanation of the terms is provided at relevant places elsewhere in the description.

Analyser electrical field (also termed herein analyser field): The electric field within the analyser volume between the inner and outer field-defining electrode systems of the mirrors, which is created by the application of potentials to the field-defining electrode systems. The main analyser field is the analyser field in which the charged particles move along the main flight path.

Analyser volume: The volume between the inner and outer field-defining electrode systems of the two mirrors. The analyser volume does not extend to any volume within the inner field-defining electrode system, nor to any volume outside the inner surface of the outer field-defining electrode system.

Angle of orbital motion: The angle subtended in the arcuate direction as the orbit progresses.

Arcuate direction: The angular direction around the longitudinal analyser axis z. FIG. 1 shows the respective directions of the analyser axis z, the radial direction r and the arcuate direction ø, which thus can be seen as cylindrical coordinates.

Arcuate focusing: Focusing of the charged particles in the arcuate direction so as to constrain their divergence in that direction.

Asymmetric mirrors: Opposing mirrors that differ either in their physical characteristics (size and/or shape for example) or in their electrical characteristics or both so as to produce asymmetric opposing electrical fields.

Beam: The train of charged particles or packets of charged particles some or all of which are to be separated.

Belt electrode assembly: A belt-shaped electrode assembly extending at least partially around the analyser axis z.

Charged particle accelerator: Any device that changes either the velocity of the charged particles, or their total kinetic energy either increasing it or decreasing it.

Charged particle deflectors: Any device that deflects the beam.

Detector: All components required to produce a measurable signal from an incoming charged particle beam.

Ejector: One or more components for ejecting the charged particles from the main flight path and optionally out of the analyser volume.

Equator, or equatorial position of the analyser: The midpoint between the two mirrors along the analyser axis z, i.e. the point of minimum absolute electrical field strength in the direction of the analyser axis z.

External ejection trajectory: The trajectory outside the analyser volume taken by the beam on ejection from the analyser.

External injection trajectory: The trajectory outside the analyser volume taken by the beam on injection into the analyser.

Field-defining electrode systems: Electrodes that, when electrically biased, generate, or contribute to the generation of, or inhibit distortion of the analyser field within the analyser volume.

Injector: One or more components for injecting the charged particles onto the main flight path through the analyser.

Internal ejection trajectory: The trajectory inside the analyser volume taken by the beam on ejection from the main flight path.

Internal injection trajectory: The trajectory inside the analyser volume taken by the beam on injection prior to joining the main flight path.

Main flight path: The stable trajectory that is followed by the charged particles for the majority of the time that the particles are being separated. The main flight path is followed predominantly under the influence of the main analyser field.

m/z: Mass to charge ratio

Offset lens embodiments: Embodiments in which the arcuate focusing lenses are displaced from the equatorial position of the analyser.

Principal beam: the beam path taken by ions having the nominal beam energy and no beam divergence.

Receiver: Any charged particle device that forms all or part of a detector or device for further processing of the charged particles.

SUMMARY OF THE INVENTION

According to an aspect of the invention, there is provided a method of separating charged particles using an analyser, the method comprising:

causing a beam of charged particles to fly through the analyser and undergo within the analyser at least one full oscillation in the direction of an analyser axis (z) of the analyser whilst orbiting about the axis (z) along a main flight path;

constraining the arcuate divergence of the beam as it flies through the analyser; and separating the charged particles according to their flight time.

The analyser preferably comprises two opposing mirrors each mirror comprising inner and outer field-defining electrode systems elongated along the axis z, the outer system surrounding the inner, whereby when the electrode systems are electrically biased the mirrors create an electrical field comprising opposing electrical fields along z. The absolute strength along z of the electrical field is at a minimum at a plane z=0. The inner and outer field-defining electrode systems define therebetween an analyser volume. In such embodiments, as the beam orbits around the axis z it orbits within the analyser volume, i.e. around the inner field-defining electrode system of each mirror.

Preferably, the method comprises causing the beam of charged particles to undergo within the analyser at least one full oscillation in the direction of an analyser axis (z) whilst orbiting around the z axis within the analyser volume, by reflecting from one mirror to the other a plurality of times. As the beam is reflected in a mirror there is thereby defined a maximum turning point within a mirror. If the strength along z of the electrical field at the maximum turning point is X then preferably the absolute strength along z of the electrical field is less than |X|/2 for not more than ⅔ of the distance along z between the plane z=0 and the maximum turning point in each mirror;

The method preferably further comprises ejecting at least some of the charged particles having a plurality of m/z from the analyser or detecting the at least some of charged particles having a plurality of m/z, the ejecting or detecting being performed after the particles have undergone the same number of orbits around the axis z. For this purpose, an ejector or at least part of a detector is preferably located within the analyser volume for respectively ejecting out of the analyser volume or detecting within the analyser volume at least some charged particles from the beam, the at least some particles having a plurality of m/z, the ejecting or detecting being performed after the at least some particles have undergone the same number of orbits around the axis z. Preferably, within the plurality of m/z there is a maximum m/z value, $m/z_{max}$ and a minimum m/z value, $m/z_{min}$, such that $m/z_{max}/m/z_{min}$ is preferably at least 3. In other preferred embodiments, the ratio $m/z_{max}/m/z_{min}$ may be at least 5, at least 10 or at least 20. The ejection and detection steps are described in more detail below.

Preferably, the absolute strength along z of the electrical field is less than |X|/2 for not more than ½ of the distance along z between the plane z=0 and the maximum turning point in each mirror.

Preferably, the absolute strength along z of the electrical field is less than |X|/2 for not less than ⅓ of the distance along z between the plane z=0 and the maximum turning point in each mirror.

Preferably, the absolute strength along z of the electrical field is less than |X|/2 for between ⅔ and ⅓ (i.e. from ⅔ to ⅓) of the distance along z between the plane z=0 and the maximum turning point in each mirror. More preferably, the absolute strength along z of the electrical field is less than |X|/2 for between 0.6 and 0.4, still more preferably between 0.55 and 0.45 and even still more preferably between 0.52 and 0.42 of the distance along z between the plane z=0 and the maximum turning point in each mirror. Most preferably, the absolute strength along z of the electrical field is less than |X|/2 for approximately ½ of the distance along z between the plane z=0 and the maximum turning point in each mirror.

Preferably, the absolute strength along z of the electrical field is less than |X|/2 for between (i) ⅔ and 0.6, (ii) 0.6 and 0.55, (iii) 0.55 and 0.5, (iv) 0.5 and 0.45, (v) 0.45 and 0.4, or (vi) 0.4 and ⅓ of the distance along z between the plane z=0 and the maximum turning point in each mirror.

Preferably, the absolute strength along z of the electrical field is less than |X|/3 for not more than ⅓ of the distance along z between the plane z=0 and the maximum turning point.

More preferably, the absolute strength along z of the electrical field is more than |X|/2 for not more than ⅔ (preferably not more than ½) of the distance along z between the plane z=0 and the maximum turning point in each mirror.

More preferably, the absolute strength along z of the electrical field is more than |X|/2 for not more than ⅔ (preferably not more than ½) and not less than ⅓ of the distance along z between the plane z=0 and the maximum turning point in each mirror.

Preferably, the absolute strength along z of the electrical field is more than |X|/2 for between ⅔ and ⅓ (i.e. from ⅔ to ⅓) of the distance along z between the plane z=0 and the maximum turning point in each mirror. More preferably, the absolute strength along z of the electrical field is more than |X|/2 for between 0.6 and 0.4, still more preferably between 0.55 and 0.45 and even still more preferably between 0.52 and 0.42 of the distance along z between the plane z=0 and the maximum turning point in each mirror. Most preferably, the absolute strength along z of the electrical field is more than |X|/2 for approximately ½ of the distance along z between the plane z=0 and the maximum turning point in each mirror.

Most preferably, the absolute strength along z of the electrical field is more than |X|/2 for approximately ½ of the distance along z between the plane z=0 and the maximum turning point in each mirror.

Preferably, the absolute strength along z of the electrical field is more than 2|X|/3 for not more than ⅓ of the distance along z between the plane z=0 and the maximum turning point.

Preferably, the absolute strength along z of the electrical field is more than |X|/2 for between (i) ⅔ and 0.6, (ii) 0.6 and 0.55, (iii) 0.55 and 0.5, (iv) 0.5 and 0.45, (v) 0.45 and 0.4, or (vi) 0.4 and ⅓ of the distance along z between the plane z=0 and the maximum turning point in each mirror.

Preferably, the beam undergoes at least one oscillation of substantially simple harmonic motion in the direction of the z axis as it reflects from one mirror to the other.

Preferably, the at least some of the charged particles do not follow substantially the same path within the analyser more than once, i.e. do not follow a closed path.

Preferably, the oscillation of substantially simple harmonic motion in the direction of the z axis is at an oscillating frequency and the orbiting around the z axis is at an orbiting frequency, the ratio of the orbiting frequency to the oscillating frequency being between 0.71 and 5.0.

Preferably, the electrical field is substantially linear along at least a portion of the length of the analyser volume along z. Preferably, the electrical field is substantially linear along at least half of the length along z between the maximum turning points in each mirror. More preferably, the electrical field is substantially linear along at least two thirds of the length along z between the maximum turning points in each mirror.

Preferably, as the particles fly through the analyser orbiting around the z axis within the analyser volume, they reflect from one mirror to the other more than once (i.e. a plurality of times).

Preferably, the charged particles fly with substantially constant velocity along z less than half, more preferably less than a third, of the overall time of the oscillation in the direction of the z axis.

The analyser most preferably comprises at least one arcuate focusing lens for constraining the arcuate divergence of the beam of charged particles within the analyser. The method thus most preferably comprises passing the beam of charged particles through the at least one arcuate focusing lens to constrain the arcuate divergence of the beam. The at least one focusing lens is described in more detail below.

According to another aspect of the present invention there is provided a method of separating charged particles comprising the steps of:

providing an analyser comprising two opposing mirrors each mirror comprising inner and outer field-defining electrode systems elongated along an axis z, the outer system surrounding the inner, whereby when the electrode systems are electrically biased the mirrors create an electrical field comprising opposing electrical fields along z; and at least one arcuate focusing lens for constraining the arcuate divergence of a beam of charged particles within the analyser;

causing a beam of charged particles to fly through the analyser, reflecting from one opposing mirror to the other at least once whilst orbiting around the axis z and passing through the at least one arcuate focusing lens; and separating the charged particles according to their flight time.

According to still another aspect of the invention, there is provided a charged particle analyser comprising two opposing mirrors each mirror comprising inner and outer field-defining electrode systems elongated along an axis z, the outer system surrounding the inner, whereby when the electrode systems are electrically biased the mirrors create an electrical field comprising opposing electrical fields along z; and at least one arcuate focusing lens for constraining the arcuate divergence of a beam of charged particles within the analyser whilst the beam orbits around the axis z.

In some preferred embodiments, the method comprises measuring the flight times through the analyser of the at least some of the charged particles after the particles have undergone the same number of orbits around the axis z. Preferably, the charged particle analyser is for separating charged particles according to their flight times through the analyser. As used herein the term flight time means the flight time (i.e. in a time unit, e.g. seconds) or a value representing the flight time (e.g. in a unit other than a time unit or a unitless value). Further preferably, the method comprises constructing a mass spectrum from the measured flight times, e.g. by converting the flight times into m/z values. Herein the term mass spectrum means any spectrum in a domain related to the mass, e.g. mass, mass to charge (m/z), time, etc. The mass spectrum is preferably constructed using a computer, e.g. a computer which receives a detection signal produced by a detector as it detects the at least some particles which have undergone the same number of orbits around the axis z. From the detection signal the flight times may be deduced, e.g. by the computer.

In some embodiments, the method may comprise isolating selected particles of one or more m/z in the analyser volume by ejecting from the analyser all other particles in the beam than the selected particles.

Preferably, the analyser comprises at least one belt electrode assembly located within the analyser volume at least partially surrounding the inner field-defining electrode system of one or both the mirrors.

Preferably, the at least one belt electrode assembly is substantially concentric with the z axis.

Preferably, the at least one belt electrode assembly is substantially concentric with the inner and outer field-defining electrode systems of one or both the mirrors.

Preferably, the at least one belt electrode assembly is located at a position along z offset from the z=0 plane, i.e. the centre of the belt electrode assembly is offset from the z=0 plane.

Preferably, the at least one belt electrode assembly supports one or more deflector electrodes and/or one or more arcuate focusing lenses.

Preferably, the deflector electrodes are at least part of a charged particle injector and/or ejector.

In one aspect, the invention comprises passing the beam of charged particles through at least one arcuate focusing lens as it flies through the analyser volume orbiting around the z axis reflecting from one mirror to the other. Preferably, the at least one arcuate focusing lens causes a perturbation to the electrical field in at least the arcuate direction.

The invention comprises constraining the arcuate divergence of the beam as it flies through the analyser. Preferably, the constraining of the arcuate divergence is by providing an electric field perturbation in at least an arcuate direction. The at least one arcuate focusing lens may be used for this purpose. Thus, preferably, the analyser comprises at least one arcuate focusing lens for constraining the arcuate divergence of a beam of charged particles within the analyser whilst the beam orbits around the z axis, i.e. whilst the beam undergoes the at least one full oscillation in the direction of an analyser axis (z).

Preferably, the method comprises constraining the arcuate divergence of the beam a plurality of times as it flies through the analyser. For example, the method preferably comprises passing the beam through the at least one arcuate focusing lens a plurality of times (e.g. through the arcuate focusing lens a plurality of times where there is only one arcuate focusing lens or through each lens one or more times where there is more than one arcuate focusing lens). Preferably, the apparatus comprises a plurality of arcuate focusing lenses.

Preferably, the constraining of the arcuate divergence of the beam and/or the passing of the beam through the at least one arcuate focusing lens is performed before the beam becomes larger than the dimension of the focusing lens in the arcuate direction.

Preferably, the beam has its arcuate divergence constrained and/or passes through an arcuate focusing lens after substantially each oscillation between the mirrors, more preferably after substantially each reflection from the mirrors.

Preferably, the plurality of arcuate focusing lenses form an array of arcuate focusing lenses located at substantially the same z coordinate. Herein an array means two or more. More preferably, the array of arcuate focusing lenses is located at substantially the same z coordinate, which is at or near z=0 but most preferably offset from z=0. The array of arcuate focusing lenses preferably extends at least partially around the z axis in the arcuate direction, more preferably substantially around the z axis in the arcuate direction.

The arcuate focusing lenses are spaced apart in the arcuate direction. The spacing apart of the plurality of arcuate focusing lenses in the arcuate direction may be either regular or irregular, but is preferably regular, i.e. periodic.

Preferably, each of the at least arcuate focusing lenses is formed from an electrode held at a potential, e.g. so as to provide an electric field perturbation in at least an arcuate direction, e.g. an electric field perturbation in three dimensions (3D).

In some preferred embodiments, when the electrode systems are electrically biased the mirrors create an electrical field comprising opposing electrical fields along z; wherein the opposing electrical fields are different from each other.

In some preferred embodiments, the beam undergoes a first angle of orbital motion about the z axis whilst it travels through a first of the mirrors and the beam undergoing a second angle of orbital motion whilst it travels through a second of the mirrors, the first angle of orbital motion being different from the second angle of orbital motion. Preferably, one of the angles of orbital motion is $a1=\pi \cdot n$ radians, where n=an integer. Preferably, where one of the angles of orbital motion is $a1=\pi \cdot n$ radians, the other angle is $a2=a1+/-\delta$, where $|\delta| \ll \pi$. Preferably, one or both of the inner and outer field-defining electrode systems of one of the mirrors are of different dimensions to the corresponding one or both of the inner and outer field-defining electrode systems of the other mirror. Preferably, one or both of the inner and outer field-defining electrode systems of one of the mirrors is held at a different set of one or more electrical potentials to the corresponding one or both of the inner and outer field-defining electrode systems of the other mirror. In addition to causing the beam of charged particles to fly through the analyser, preferably along a main flight path, the invention preferably further includes directing the beam of charged particles along at least one of:

an external injection trajectory;

an internal injection trajectory;

an internal ejection trajectory;

an external ejection trajectory.

The term internal in relation to internal injection trajectory and internal ejection trajectory herein means located within the analyser volume. The term external in relation to external injection trajectory and external ejection trajectory herein means located outside the analyser volume The invention preferably further comprises changing the beam direction and/or kinetic energy of the particles in the beam at or prior to the transition between any or all of the trajectories or between one or more of the trajectories and the main flight path.

The invention preferably comprises changing the beam direction and/or kinetic energy as aforementioned using one or more of:

a beam deflector;

an electrostatic sector;

a charged particle mirror;

any part of one or more arcuate focusing lenses; and switching the analyser electric field to a different potential in part or all the analyser.

The invention may comprise injecting the beam of charged particles along an external injection trajectory and/or an internal injection trajectory.

In some preferred embodiments, described in more detail below, the beam may not be injected along an internal injection trajectory of any substantial length. In such cases, the beam may join the main flight path substantially directly after it enters the analyser volume. In more preferred types of embodiments, the beam is injected, e.g. from an external injection trajectory, into the analyser volume through an injection deflector, which is preferably an electrical sector or mirror (i.e. ion mirror), wherein the exit aperture of the deflector (preferably electrical sector or mirror) lies at the commencement point of the main flight path. In such embodiments, the entrance aperture of the deflector (preferably electrical sector or mirror) lies outside the analyser volume. The injection deflector preferably deflects the beam upon injection in at least the radial direction r, more preferably to decrease an inward radial velocity of the beam. The beam preferably commences the main flight path at or near the z=0 plane, e.g. the beam is injected from outside the analyser volume to a point at or near the z=0 plane where it commences the main flight path.

The beam is preferably deflected in at least the radial direction r at the point where the beams meets the main flight path, more preferably to decrease an inward radial velocity of the beam.

In other embodiments, some of which are also preferred, the beam is injected along an internal injection trajectory and then onto the main flight path.

In some preferred types of embodiments, at least a portion (in some cases all) of the internal injection trajectory is traversed by the charged particles not under the influence of the main analyser electrical field. In such embodiments, for example at least a portion (in some cases all) of the internal injection trajectory may be shielded from the influence of the main analyser field or the main analyser field may be switched off while the particles traverse the internal injection trajectory, the shielding of the internal injection trajectory being the preferred method to avoid any problems associated with the rapid switching of large voltages.

In other preferred types of embodiments, the internal injection trajectory is traversed by the charged particles under the influence of the main analyser electrical field. This has the advantage that shielding of the internal injection trajectory from the main analyser field or switching of the potentials to create the main analyser field when the beam reaches the main flight path is not required. In such cases, the length of the internal injection trajectory is preferably kept as short as possible. This may be achieved, for example, by having the outer field-defining electrode system of one or both mirrors with a waisted-in (i.e. reduced diameter) portion in the vicinity of the point (point P) where the beam joins the main flight path and injecting the beam into the analyser volume through the waisted-in portion (e.g. through an aperture therein). This keeps the length of the internal injection trajectory short due to the reduced diameter of the analyser volume in the vicinity of point P and the corresponding closer proximity of the outer field-defining electrode to the main flight path.

Preferably, the point P where the internal injection trajectory meets the main flight path is located at or near the z=0 plane. Accordingly, the waisted-in portion of the outer field-defining electrode system of one or both mirrors is preferably located at or near the z=0 plane. Preferably, the z=0 plane falls within the waisted-in portion.

The beam may or may not be but preferably is deflected at the point P, which deflection may be in one or more of the z direction, radial r direction and arcuate direction. The beam is preferably deflected in at least the radial direction r at point P, e.g. where the internal injection trajectory is at a different radial distance (radius) from the z axis than the main flight path. In some preferred embodiments, the beam is preferably deflected in at least the z direction at point P. In some more preferred embodiments the beam is preferably deflected in at least the radial r and z directions or at least the radial r and arcuate directions at point P.

The beam is preferably deflected by a deflector as it is injected onto the main flight path, more preferably by an electrical sector, wherein the exit aperture of the deflector (preferably sector) lies at the commencement point of the main flight path.

The internal injection trajectory may be straight or non-straight (e.g. curved) or may comprise at least one straight portion and at least one non-straight portion.

The internal injection trajectory preferably passes through at least one belt electrode assembly, more preferably an outer belt electrode assembly.

Preferably, the internal injection trajectory is located at or near the z=0 plane and more preferably in such cases the internal injection trajectory is directed radially inwardly toward the main flight path. However, in some embodiments, the internal injection trajectory may be substantially offset from the z=0 plane. In some types of such embodiments, the internal injection trajectory may commence in one mirror at a distance in the z direction (z distance) from the z=0 plane greater than the z distance from said plane of the maximum turning point of the beam in the mirror. In such embodiments, the internal injection trajectory may or may not be at substantially the same radial distance (radius) from the z axis as the main flight path but preferably is at substantially the same radius.

In some preferred types of embodiments, the internal injection trajectory is at a different radial distance (radius) from the z axis than the main flight path. In such embodiments, the beam is preferably deflected in at least the radial direction r at the point P where the internal injection trajectory meets the main flight path. In preferred embodiments, the internal injection trajectory is directed radially inwardly toward the main flight path and a deflection at or near point P decreases the inward radial velocity of the charged particles.

In some preferred embodiments wherein the internal injection trajectory is at a different radial distance (radius) from the z axis than the main flight path, the internal injection trajectory comprises a spiral or non-circular path. Preferably, the spiral path is of decreasing radius toward the main flight path, i.e. where the internal injection trajectory is at greater radial distance from the z axis than the main flight path. However, the spiral path may be of increasing radius toward the main flight path, i.e. where the internal injection trajectory is at smaller radial distance from the z axis than the main flight path. In addition to comprising a spiral path, the internal injection trajectory may in such cases comprise a non-spiral path, e.g. leading to the spiral path with the spiral path leading to the main flight path. The spiral or non-circular path of the internal injection trajectory is preferably traversed by the beam under the influence of an analyser field, which is more preferably the main analyser field.

In some preferred embodiments, at least a portion of an injector for injecting the charged particles into the analyser volume is located outside the analyser volume adjacent the waisted-in portion described above but preferably within a maximum radial distance from the axis z of the outer field defining electrode system (i.e. of the non-waisted-in portion) of at least one of the mirrors. In some preferred embodiments, the injector comprises a pulsed ion source which is located outside the analyser volume adjacent the waisted-in portion but preferably within a maximum radial distance from the axis z of the outer field defining electrode system of at least one of the mirrors.

In some preferred embodiments, when the charged particles are at or near point P the injection method comprises changing the kinetic energy of the charged particles. More preferably in such cases, the method of injecting comprises decreasing the kinetic energy of the charged particles at or near point P.

In one preferred method, the invention comprises injecting charged particles along an internal injection trajectory onto a main flight path at a point P in the charged particle analyser, the method comprising injecting the charged particles along the internal injection trajectory to the point P at least a portion of the internal injection trajectory being traversed by the charged particles not under the influence of the main analyser electrical field. The following preferably apply to this preferred method: preferably, the method comprises deflecting the charged particles at point P to change their velocity in the direction of the z axis; preferably, the method of injecting charged particles does not comprise deflecting the charged particles in a radial direction; preferably, the main analyser electrical field is switched off until the charged particles reach point P; preferably, the at least a portion of the internal injection trajectory is shielded from the main analyser electrical field, e.g. by one or more belt electrode assemblies located between the inner and outer field-defining electrode systems of one or both mirrors; preferably, the internal injection trajectory is substantially straight; preferably, the internal injection trajectory passes through at least one belt electrode assembly located between the inner and outer field-defining electrode systems of one or both mirrors; in some embodiments, the internal injection trajectory is substantially offset from the z=0 plane, the internal injection trajectory preferably commencing at a point of the analyser which is at greater z than the maximum turning point of the beam in a mirror.

In another preferred method of injecting charged particles onto the main flight path inside the analyser, the method comprises injecting the charged particles onto the main flight path from an internal injection trajectory which is at a different radial distance from the z axis than the main flight path. The following preferably apply to this preferred method: preferably, the internal injection trajectory at a different distance from the z axis than the main flight path comprises a spiral or non-circular path leading onto the main flight path; preferably, the spiral path of the internal injection trajectory is of decreasing radius toward the main flight path; in addition to the spiral path, the internal injection trajectory may comprise a non-spiral path leading to the spiral path; preferably, the charged particles travel along the internal injection trajectory at a different distance from the z axis than the main flight path, more preferably the spiral path, in the presence of an analyser field which is the same as or different to the main analyser field, but more preferably, is the main analyser field; preferably, the method comprises deflecting the beam to change the velocity of the charged particles in the direction of the z axis at or near commencing the spiral or non-circular internal injection trajectory; preferably, the method comprises deflecting the beam to change the velocity of the charged particles in the radial direction at or near commencing the spiral or non-circular internal injection trajectory; preferably, the method comprises deflecting the beam to change the velocity of the charged particles in the radial direction at or near commencing the main flight path from the internal injection trajectory which is at a different distance from the z axis than the main flight path; preferably, the method comprises injection of the charged particles through the outer electrode system towards the internal injection trajectory.

In yet another preferred method of injecting charged particles along an internal injection trajectory onto the main flight path at a point P in the charged particle analyser, the method comprises injecting along the internal injection trajectory and when the charged particles are at or near point P changing the kinetic energy of the charged particles. The following preferably apply to this preferred method: the particles may travel the internal injection trajectory in the presence of an analyser field (an injection analyser field) which is the same as or different from the main analyser field; preferably, the method of injecting comprises decreasing the kinetic energy of the charged particles at or near point P.

In still another preferred method of injecting charged particles onto the main flight path at a point P along an internal injection trajectory, the method comprises injecting along the internal injection trajectory in the presence of the main analyser field and when the charged particles are at or near point P deflecting the charged particles to change their velocity in the radial (r) direction. The following preferably apply to this preferred method: preferably, the internal injection trajectory leads radially inward towards the main flight path and the deflection at or near point P decreases the inward radial velocity of the charged particles; preferably, the internal injection trajectory passes through at least one belt electrode assembly located between the inner and outer field-defining electrode systems of one or both mirrors; preferably, the internal injection trajectory is located at or near the z=0 plane; preferably, point P is located at or near the z=0 plane; preferably, the outer field-defining electrode system of one or both mirrors comprises a waisted-in portion, which more preferably is located at or near the z=0 plane; preferably, the inward extent of the waisted-in portion lies in close proximity to the outer belt electrode assembly; in some preferred embodiments, at least a portion of an injector for injecting the charged particles into the analyser volume is located outside the analyser volume adjacent the waisted-in portion and within a maximum distance from the axis z of the outer field defining electrode system of at least one of the mirrors; in some preferred embodiments, the injector comprises a pulsed ion source which is located outside the analyser volume adjacent the waisted-in portion and within a maximum distance from the axis z of the outer field defining electrode system of at least one of the mirrors; in some preferred embodiments, the at least a portion of the internal injection trajectory is shielded from the main analyser electrical field by one or more belt electrode assemblies located between the inner and outer field-defining electrode systems of one or both mirrors.

In some preferred embodiments, the invention comprises an injector for injecting the beam of charged particles into the analyser volume; wherein the outer field-defining electrode system of one or both mirrors comprises a waisted-in portion and at least a portion of the injector is located outside the analyser volume adjacent the waisted-in portion. Preferably, at least a portion of the injector is located outside the analyser volume adjacent the waisted-in portion and within a maximum distance from the axis z of the outer field defining electrode system of at least one of the mirrors. Preferably, the waisted-in portion is located at or near the z=0 plane. Preferably, the inward extent of the waisted-in portion lies in close proximity to the outer belt electrode assembly. More preferably, the inward extent of the waisted-in portion supports the outer belt electrode assembly. More preferably still, the outer belt electrode assembly in that embodiment supports the at least one arcuate focusing lens. Preferably, the waisted-in portion has portions of the outer field-defining electrode system of greater diameter on either side in the direction of z. Preferably, the at least a portion of the injector comprises a charged particle deflector which is located outside the analyser volume adjacent the waisted-in portion and within a maximum distance from the axis z of the outer field defining electrode system of at least one of the mirrors. In some preferred embodiments, the injector comprises a pulsed ion source which is located outside the analyser volume adjacent the waisted-in portion and within a maximum distance from the axis z of the outer field defining electrode system of at least one of the mirrors. Preferably, the analyser comprises one or more belt electrode assemblies located between the inner and outer field-defining electrode systems of one or both mirrors, which are adjacent the waisted-in portion.

The analyser most preferably comprises a deflector, more preferably an electric sector, located for deflecting the beam onto the main fight path such that the beam emerges from the deflector directly on the main flight path. The deflector (preferably sector) is preferably located such that the exit aperture of the deflector (preferably sector) lies at the same radius from the z axis as the main flight path, i.e. the exit aperture of the deflector (preferably sector) will be at the commencement point of the main flight path. The deflector (preferably sector) is preferably located at or near the z=0 plane. In operation, at least a portion of the beam preferably travels from the main flight path, optionally along either or both of an internal ejection trajectory and an external ejection trajectory, and proceeds to a charged particle processing device. The charged particle processing device preferably comprises one or more of:

a detector;
a post acceleration device;
an ion storage device;
a collision or reaction cell;
a fragmentation device;
a mass analysis device; and
the analyser of the invention (e.g. at least a portion of the beam remains in the analyser, or is ejected from and then is returned to the analyser, and proceeds through the analyser again for further processing, e.g. a further round of mass separation).

The invention may comprise ejecting the beam of charged particles along an external ejection trajectory and/or an internal ejection trajectory.

In some preferred embodiments, described in more detail below, the beam (i.e. at least some of the charged particles of the beam) may not be ejected along an internal ejection trajectory of any substantial length. In such cases, the beam may leave the main flight path substantially directly as it leaves the analyser volume. In more preferred types of such embodiments, the beam is ejected, e.g. to an external ejection trajectory, from the analyser volume through an ejection deflector, which is preferably an electrical sector or mirror (i.e. ion mirror), wherein the entry aperture of the deflector (preferably sector or mirror) lies on the main flight path. In such embodiments, the exit aperture of the deflector (preferably electrical sector or mirror) lies outside the analyser volume. The ejection deflector preferably deflects the beam upon ejection in at least the radial direction r, more preferably to increase an outward radial velocity of the beam.

The beam preferably leaves the main flight path at or near the z=0 plane, e.g. the beam is ejected out of the analyser volume from the main flight path at a point at or near the z=0 plane.

The beam is preferably deflected in at least the radial direction r at the point where the beams leaves the main flight path, more preferably to increase an outward radial velocity of the beam.

In other embodiments, some of which are also preferred, the beam is ejected along an internal ejection trajectory from the main flight path.

In some preferred types of embodiments, at least a portion (in some cases all) of the internal ejection trajectory is traversed by the charged particles not under the influence of the main analyser electrical field. In such embodiments, for example at least a portion (in some cases all) of the internal ejection trajectory may be shielded from the influence of the main analyser field or the main analyser field may be switched off while the particles traverse the internal ejection trajectory, the shielding of the internal ejection trajectory being the preferred method to avoid any problems associated with the rapid switching of large voltages.

In other preferred types of embodiments, the internal ejection trajectory is traversed by the charged particles under the influence of the main analyser electrical field. This has the advantage that shielding of the internal ejection trajectory from the main analyser field or switching of the potentials to cease the main analyser field when the beam reaches the main flight path is not required. In such cases, the length of the internal ejection trajectory is preferably kept as short as possible. This may be achieved, for example, by having the outer field-defining electrode system of one or both mirrors with a waisted-in (i.e. reduced diameter) portion in the vicinity of the point (point E) where the beam leaves the main flight path and ejecting the beam out of the analyser volume through the waisted-in portion (e.g. through an aperture therein). This keeps the length of the internal ejection trajectory short due to the reduced diameter of the analyser volume in the vicinity of point E and the corresponding closer proximity of the outer field-defining electrode to the main flight path.

In some cases the point E may be substantially the same point as the point P described above, e.g. where the beam is injected to the same point on the main flight path at which it is subsequently ejected from. Preferably, the outer field-defining electrode system of one or both mirrors has a waisted-in portion in the vicinity of the point where the beam is injected into and/or ejected out of the analyser volume, the beam being injected into and/or ejected out of the analyser volume through one or more apertures in the waisted-in portion.

Preferably, the point E where the internal ejection trajectory meets the main flight path is located at or near the z=0 plane. Accordingly, the waisted-in portion of the outer field-defining electrode system of one or both mirrors is preferably located at or near the z=0 plane.

The beam may or may not be but preferably is deflected at the point E, which deflection may be in one or more of the z direction, radial r direction and arcuate direction. The beam is preferably deflected in at least the radial direction r at point E, e.g. where the internal ejection trajectory is at a different radial distance (radius) from the z axis than the main flight path. In some preferred embodiments, the beam is preferably deflected in at least the z direction at point E. In some more preferred embodiments the beam is preferably deflected in at least the radial r and z directions or at east the radial r and arcuate directions at point E.

The beam is preferably deflected by a deflector as it is ejected from the main flight path, more preferably by an electrical sector, wherein the entrance aperture of the deflector (preferably sector) lies on the main flight path.

The internal ejection trajectory may be straight or curved or may comprise at least one straight portion and at least one curved portion.

The internal ejection trajectory preferably passes through at least one belt electrode assembly, more preferably an outer belt electrode assembly.

Preferably, the internal ejection trajectory is located at or near the z=0 plane and more preferably in such cases the internal ejection trajectory is directed radially outwardly from the main flight path. However, in some embodiments, the internal ejection trajectory may be substantially offset from the z=0 plane. In some types of such embodiments, the internal ejection trajectory end in one mirror at a distance in the z direction (z distance) from the z=0 plane greater than the z distance from said plane of the maximum turning point of the beam in the mirror. In such embodiments, the internal ejection trajectory may or may not be at substantially the same radial distance (radius) from the z axis as the main flight path but preferably is at substantially the same radius.

In some preferred types of embodiments, the internal ejection trajectory is at a different radial distance (radius) from the z axis than the main flight path. In such embodiments, the beam is preferably deflected in at least the radial direction r at the point E where the internal ejection trajectory meets the main flight path. In preferred embodiments, the internal ejection trajectory is directed radially outwardly from the main flight path and a deflection at or near point E increases the outward radial velocity of the charged particles.

In some preferred embodiments wherein the internal ejection trajectory is at a different radial distance (radius) from the z axis than the main flight path, the internal ejection trajectory comprises a spiral or non-circular path. Preferably, the spiral path is of increasing radius from the main flight path, i.e. where the internal ejection trajectory is at greater radial distance from the z axis than the main flight path. However, the spiral path may be of decreasing radius from the main flight path, i.e. where the internal ejection trajectory is at smaller radial distance from the z axis than the main flight path. In addition to comprising a spiral path, the internal ejection trajectory may in such cases comprise a non-spiral path, e.g. leading from the spiral path with the spiral path leading from the main flight path. The spiral or non-circular path of the internal ejection trajectory is preferably traversed by the beam under the influence of an analyser field, which is more preferably the main analyser field.

In some preferred embodiments, when the charged particles are at or near point E the ejection method comprises changing the kinetic energy of the charged particles. More preferably in such cases, the method of ejecting comprises increasing the kinetic energy of the charged particles at or near point E.

Outside the analyser volume the beam may continue on an external ejection trajectory to a processing device.

In one preferred method, the invention comprises ejecting charged particles along an internal ejection trajectory from the main flight path at a point E in the charged particle analyser, at least a portion of the internal ejection trajectory being traversed not under the influence of the main analyser electrical field. The following preferably apply to this preferred method: preferably, the method of ejecting comprises selecting charged particles of a range of m/z and ejecting the selected particles for further processing; preferably, the method of ejecting comprises deflecting the charged particles at point E to change their velocity in the direction of the z axis (either to increase or decrease the velocity); preferably, the method of ejecting does not comprise deflecting the charged particles in a radial direction; preferably, in the method of ejecting the main analyser electrical field is switched off after the charged particles reach point E; preferably, at least a portion of the internal ejection trajectory is shielded from the main analyser electrical field by one or more belt electrodes located between the inner and outer field-defining electrode systems; preferably, the internal ejection trajectory is substantially straight.

In another preferred method of ejecting charged particles from the analyser, the method comprises ejecting the charged particles from an internal ejection trajectory at a different distance from the z axis than the main flight path. The following preferably apply to this preferred method: preferably, in the method of ejecting the main analyser electrical field is substantially linear along at least a portion of the length of the analyser volume along z; preferably, in the method of ejecting, the internal ejection trajectory comprises a spiral or non-circular path leading from the main flight path; preferably, the spiral internal ejection trajectory is of increasing radius leading from the main flight path; preferably, the charged particles travel along the internal ejection trajectory in the presence of an analyser field; preferably, the charged particles travel along the internal ejection trajectory in the presence of an analyser field which is the main analyser field; preferably, there is a deflection to change the velocity of the charged particles in the direction of the z axis at or near commencing the internal ejection trajectory; preferably, there is a deflection to change the velocity of the charged particles in the radial direction at or near commencing the internal ejection trajectory; preferably, there is a deflection to change the velocity of the charged particles in the radial direction at or near commencing the internal ejection trajectory; preferably, the ejection leads the particles out of the analyser through the outer electrode system, e.g. to an external ejection trajectory.

In yet another preferred method of ejecting charged particles along an internal ejection trajectory from the main flight path, the method comprises when the charged particles are at or near point E changing the kinetic energy of the charged particles and ejecting along the internal ejection trajectory. The following preferably apply to this preferred method: the charged particles may be ejected along the internal ejection trajectory in the presence of an ejection analyser field the same as or different from the main analyser field; preferably, in the method of ejecting, the main analyser field is substantially linear along at least a portion of the length of the analyser volume along z preferably, the ejection analyser field is the same as the main analyser field; preferably, the method of ejecting comprises increasing the kinetic energy of the charged particles at or near point E.

In still another preferred method of ejecting charged particles from the main flight path, the method comprises when the charged particles are at or near point E deflecting the charged particles to change their velocity in the radial (r) direction and ejecting the charged particles along the internal ejection trajectory in the presence of (i.e. under the influence of) the main analyser field. The following preferably apply to this preferred method: in preferred embodiments, the internal ejection trajectory leads radially outward from the main flight path and the deflection at or near point E increases the outward radial velocity of the charged particles; preferably, the internal ejection trajectory is located at or near the z=0 plane; preferably, point E is located at or near the z=0 plane; preferably, the internal ejection trajectory passes through at least one belt electrode assembly located between the inner and outer field-defining electrode systems of one or both mirrors; preferably, in the method of ejecting, the outer field-defining electrode system of one or both mirrors comprises a waisted-in portion and the charged particles are ejected out of the analyser volume through the waisted-in portion; pore preferably, the waisted-in portion is located at or near the z=0 plane; preferably, the in the method of ejecting, the inward extent of the waisted-in portion lies in close proximity to the outer belt electrode assembly; more preferably, the inward extent of the waisted-in portion supports the outer belt electrode assembly. More preferably still, the outer belt electrode assembly in that embodiment supports the at least one arcuate focusing lens; preferably, the at least a portion of the internal ejection trajectory is shielded from the main analyser electrical field by one or more belt electrode assemblies located between the inner and outer field-defining electrode systems of one or both mirrors.

In some preferred embodiments, the invention comprises an ejector for ejecting the beam of charged particles from the analyser volume;

wherein the outer field-defining electrode system of one or both mirrors comprises a waisted-in portion and the ejector is operable to eject the beam through an aperture in the waisted-in portion.

The analyser most preferably comprises a deflector (e.g. as part of the ejector), more preferably an electric sector, located for deflecting the beam for ejection from the main fight path such that the beam enters the deflector directly from the main flight path. The deflector (preferably sector) is preferably located such that the entry aperture of the deflector (preferably sector) lies at the same radius from the z axis as the main flight path, i.e. the entry aperture of the deflector (preferably sector) will be at the commencement point of the main flight path. Preferably, the deflector (preferably sector) is for deflecting the beam at least radially outwardly. The deflector (preferably sector) is preferably located at or near the z=0 plane.

In some embodiments, the invention comprises detecting the particles at a point on the main flight path, i.e. with a detector that is located on the main flight path. In some other types of embodiments, the method comprises detecting the particles at a point not on the main flight path.

In some preferred embodiments, the method comprises detecting the particles by causing the particles to impinge on a detector surface (destructive detection).

In some preferred embodiments, the method comprises detecting the particles by causing the particles to pass within a detector (non-destructive detection). A preferred method of non-destructive detecting is by image current detection.

In some embodiments, a temporal focal plane of the charged particles when they are detected is substantially flat. In some embodiments, a temporal focal plane of the charged particles when they are detected is substantially curved.

In some embodiments, a temporal focal plane of the charged particles when they are detected is substantially perpendicular to the z axis.

In some preferred embodiments, a temporal focal plane of the charged particles when they are detected is at an angle substantially not perpendicular to the z axis.

In some preferred embodiments, a detector plane is substantially co-located with the temporal focal plane of the charged particles. Preferably, the detector plane is positioned at an angle to a plane of constant z (i.e. a plane normal to the z axis). Preferably, the angle is such that the detector plane is substantially co-located with the temporal focal plane of the beam, e.g. which has been rotated by a post acceleration device.

In some preferred embodiments the detection is preceded by a step of increasing the kinetic energy of the charged particles, e.g. comprising a step of post acceleration. Preferably the step of increasing the kinetic energy of the charged particles prior to detection causes a rotation of the temporal focal plane of the charged particles.

Preferably, the invention comprises detecting at a detector outside the analyser volume at least some of the particles having a plurality of m/z after they have undergone the same number of orbits around the axis z, at least a portion of the detector being positioned within the maximum distance from the analyser axis of the outer field-defining electrode system of one or both the mirrors, e.g. adjacent a waisted-in portion of the outer field-defining electrode system of one or both the mirrors. Thus preferably, the invention comprises a detector located outside the analyser volume for detecting at least some of the particles having a plurality of m/z after they have undergone the same number of orbits around the axis z; wherein the outer field-defining electrode system of one or both mirrors comprises a waisted-in portion and at least a portion of the detector is located adjacent the waisted-in portion.

Preferably, at least a portion of the detector is located adjacent the waisted-in portion and within a maximum distance from the axis z of the outer field defining electrode system of at least one of the mirrors.

Preferably, the waisted-in portion is located at or near the z=0 plane.

Preferably, the inward extent of the waisted-in portion lies in close proximity to an outer belt electrode assembly.

Preferably, the at least a portion of the detector comprises a conversion dynode which is located outside the analyser volume adjacent the waisted-in portion and more preferably within a maximum distance from the axis z of the outer field defining electrode system of at least one of the mirrors.

In some preferred embodiments, the detector comprises an electron multiplier.

The invention also provides, in other independent aspects, the following inventions (1) to (26)

(1) A method of separating charged particles comprising the steps of:

providing an analyser comprising two opposing mirrors each mirror comprising inner and outer field-defining electrode systems elongated along an axis z, the outer system surrounding the inner and defining therebetween an analyser volume, whereby when the electrode systems are electrically biased the mirrors create an electrical field within the analyser volume comprising opposing electrical fields along z, the strength along z of the electrical field being a minimum at a plane z=0;

causing a beam of charged particles to fly through the analyser, orbiting around the z axis within the analyser volume, reflecting from one mirror to the other at least once thereby defining a maximum turning point within a mirror; the strength along z of the electrical field at the maximum turning point being X and the absolute strength along z of the electrical field being less than |X|/2 for not more than ⅔ of the distance along z between the plane z=0 and the maximum turning point in each mirror;

separating the charged particles according to their flight times; and ejecting at least some of the charged particles having a plurality of m/z from the analyser or detecting the at least some of charged particles having a plurality of m/z, the ejecting or detecting being performed after the particles have undergone the same number of orbits around the axis z.

(2) A charged particle analyser comprising:

two opposing mirrors, each mirror comprising inner and outer field-defining electrode systems elongated along an axis z, the outer system surrounding the inner and defining therebetween an analyser volume, whereby in use a beam of charged particles is caused to fly through the analyser, orbiting around the z axis within the analyser volume whilst reflecting from one mirror to the other at least once thereby defining a maximum turning point within a mirror and whereby when the electrode systems are electrically biased the mirrors create an electrical field within the analyser volume comprising opposing electrical fields along z, the strength along z of the electrical field being a minimum at a plane z=0 and the strength along z of the electrical field at the maximum turning point being X and the absolute strength along z of the electrical field being less than |X|/2 for not more than ⅔ of the distance along z between the plane z=0 and the maximum turning point in each mirror; and an ejector or at least part of a detector located within the analyser volume for respectively ejecting out of the analyser volume or detecting within the analyser volume at least some charged particles from the beam, the at least some particles having a plurality of m/z, the ejecting or detecting being performed after the at least some particles have undergone the same number of orbits around the axis z (3) A method of separating charged particles comprising the steps of:

providing an analyser comprising two opposing mirrors each mirror comprising inner and outer field-defining electrode systems elongated along an axis z, the outer system surrounding the inner and defining therebetween an analyser volume, whereby when the electrode systems are electrically biased the mirrors create in the analyser volume an electrical field comprising opposing electrical fields substantially linear along at least a portion of the length of the analyser volume along z;

causing a beam of charged particles to fly through the analyser, reflecting from one mirror to the other at least once whilst orbiting around the z axis within the analyser volume;

separating the charged particles according to their flight times; and ejecting at least some of the charged particles having a plurality of m/z from the analyser or detecting the at least some of charged particles having a plurality of m/z, the ejecting or detecting being performed after the particles have undergone the same number of orbits around the axis z.

(4) A charged particle analyser comprising:

two opposing mirrors, each mirror comprising inner and outer field-defining electrode systems elongated along an axis z, the outer system surrounding the inner and defining therebetween an analyser volume, whereby when the electrode systems are electrically biased the mirrors create in the analyser volume an electrical field comprising opposing electrical fields substantially linear along at least a portion of the length of the analyser volume along z and whereby in use a beam of charged particles is caused to fly through the analyser, reflecting from one mirror to the other at least once whilst orbiting around the z axis within the analyser volume; and an ejector or at least part of a detector located within the analyser volume for respectively ejecting out of the analyser volume or detecting within the analyser volume at least some charged particles from the beam, the at least some particles having a plurality of m/z, the ejecting or detecting being performed after the at least some particles have undergone the same number of orbits around the axis z.

(5) A method of separating charged particles using an analyser, the method comprising:

causing a beam of charged particles to fly through the analyser and undergo within the analyser at least one full oscillation in the direction of a longitudinal (z) axis of the analyser whilst orbiting around the longitudinal (z) axis;

wherein the charged particles fly with substantially constant velocity along z less than half of the overall time of the oscillation;

separating the charged particles according to their flight times; and ejecting at least some of the charged particles having a plurality of m/z from the analyser or detecting the at least some of charged particles having a plurality of m/z, the ejecting or detecting being performed after the particles have undergone the same number of orbits around the axis z.

(6) A charged particle analyser comprising:

two opposing mirrors, each mirror comprising inner and outer field-defining electrode systems elongated along an axis z, the outer system surrounding the inner and defining therebetween an analyser volume, whereby when the electrode systems are electrically biased the mirrors create an electrical field within the analyser volume comprising opposing electrical fields along the z axis and whereby, in use, a beam of charged particles is caused to fly through the analyser, orbiting around the z axis within the analyser volume whilst undergoing at least one full oscillation between the mirrors in the direction of the z axis of the analyser wherein the charged particles fly with constant velocity along z less than half of the overall time of the oscillation; and an ejector or at least part of a detector located within the analyser volume for respectively ejecting out of the analyser volume or detecting within the analyser volume at least some charged particles from the beam, the at least some particles having a plurality of m/z, the ejecting or detecting being performed after the at least some particles have undergone the same number of orbits around the axis z.

(7) A method of time of flight analysis of charged particles comprising the steps of:

providing an analyser comprising two opposing mirrors each mirror comprising inner and outer field-defining electrode systems elongated along an axis z, the outer system surrounding the inner and defining therebetween an analyser volume, whereby when the electrode systems are electrically biased the mirrors create opposing electrical fields substantially linear along at least a portion of the length of the analyser volume along z;

causing a beam of charged particles to fly through the analyser, reflecting from one mirror to the other at least once whilst orbiting around the z axis between the inner and outer electrode systems;

and measuring the flight time of the charged particles after the particles have undergone the same number of orbits around the axis z.

(8) A charged particle analyser comprising two opposing mirrors each mirror comprising inner and outer field-defining electrode systems elongated along an axis z, the outer system surrounding the inner and defining therebetween an analyser volume, whereby when the electrode systems are electrically biased the mirrors create an electrical field within the analyser volume comprising opposing electrical fields along z;

and at least one belt electrode assembly located within the analyser volume at least partially surrounding the inner field-defining electrode system of one or both the mirrors.

(9) A method of separating charged particles comprising the steps of:

providing an analyser comprising two opposing mirrors each mirror comprising inner and outer field-defining electrode systems elongated along an axis z, the outer system surrounding the inner and defining therebetween an analyser volume, whereby when the electrode systems are electrically biased the mirrors create an electrical field within the analyser volume comprising opposing electrical fields along z;

and at least one belt-shaped electrode assembly located within the analyser volume at least partially surrounding the inner field-defining electrode system of one or both the mirrors; and causing a beam of charged particles to fly through the analyser, reflecting from one opposing mirror to the other at least once whilst orbiting around the Z axis; and separating the charged particles according to their flight times.

(10) A method of separating charged particles comprising the steps of:

providing an analyser comprising two opposing mirrors each mirror comprising inner and outer field-defining electrode systems elongated along an axis z, the outer system surrounding the inner, whereby when the electrode systems are electrically biased the mirrors create an electrical field comprising opposing electrical fields along z;

causing a beam of charged particles to fly through the analyser, reflecting from one opposing mirror to the other at least once; wherein the beam travels in a direction along a z axis of the analyser whilst orbiting around the z axis, the beam undergoing a first angle of orbital motion about the z axis whilst it travels through a first of the mirrors and the beam undergoing a second angle of orbital motion whilst it travels through a second of the mirrors, the first angle of orbital motion being different from the second angle of orbital motion; and separating the charged particles according to their flight time.

(11) A method of separating charged particles comprising the steps of:

providing an analyser comprising two opposing mirrors each mirror comprising inner and outer field-defining electrode systems elongated along an axis z, the outer system surrounding the inner, whereby when the electrode systems are electrically biased the mirrors create an electrical field comprising opposing electrical fields along z; wherein the opposing electrical fields are different from each other;

causing a beam of charged particles to fly through the analyser, reflecting from one opposing mirror to the other at least once; and separating the charged particles according to their flight time.

(12) A charged particle analyser comprising two opposing mirrors each mirror comprising inner and outer field-defining electrode systems elongated along an axis z, the outer system surrounding the inner, whereby when the electrode systems are electrically biased the mirrors create an electrical field comprising opposing electrical fields along z; wherein the opposing electrical fields are different from each other.

(13) A method of injecting charged particles along an internal injection trajectory onto a main flight path at a point P in a charged particle analyser, wherein the analyser comprises two opposing mirrors each mirror comprising inner and outer field-defining electrode systems elongated along an axis z, the outer system surrounding the inner and defining therebetween an analyser volume, whereby when the electrode systems are given a first set of one or more electrical potentials the mirrors create a main analyser electrical field comprising opposing electrical fields substantially linear along at least a portion of the length of the analyser volume along z, the main flight path being located in the analyser volume, the charged particles following the main flight path under the influence of the main analyser electrical field reflecting from one mirror to the other at least once whilst orbiting around the z axis, the method comprising injecting the charged particles along the internal injection trajectory to the point P at least a portion of the internal injection trajectory being traversed by the charged particles not under the influence of the main analyser electrical field.

(14) A method of injecting charged particles onto a main flight path inside an analyser, wherein the analyser comprises two opposing mirrors each mirror comprising inner and outer field-defining electrode systems elongated along an axis z, the outer system surrounding the inner and defining therebetween an analyser volume, whereby when the electrode systems are given a first set of one or more electrical potentials the mirrors create a main analyser electrical field comprising opposing electrical fields along z, the main flight path being located in the analyser volume, the charged particles following the main flight path under the influence of the main analyser electrical field reflecting from one mirror to the other at least once whilst orbiting around the z axis, the method comprising injecting the charged particles onto the main flight path from an internal injection trajectory which is at a different radial distance from the z axis than the main flight path.

(15) A method of injecting charged particles along an internal injection trajectory onto a main flight path at a point P in a charged particle analyser, wherein the analyser comprises two opposing mirrors each mirror comprising inner and outer field-defining electrode systems elongated along an axis z, the outer system surrounding the inner and defining therebetween an analyser volume, whereby when the electrode systems are electrically biased the mirrors create an analyser electrical field comprising opposing electrical fields along z, a main flight path being located in the analyser volume, the charged particles following the main flight path under the influence of a main analyser electrical field generated by applying a first set of one or more electrical potentials to the electrode systems and reflecting from one mirror to the other at least once whilst orbiting around the z axis, the method comprising injecting along the internal injection trajectory and when the charged particles are at or near point P changing the kinetic energy of the charged particles.

(16) A method of injecting charged particles onto a main flight path at a point P along an internal injection trajectory, wherein the analyser comprises two opposing mirrors each mirror comprising inner and outer field-defining electrode systems elongated along an axis z, the outer system surrounding the inner and defining therebetween an analyser volume, whereby when the electrode systems are electrically biased the mirrors create an analyser electrical field comprising opposing electrical fields along z, a main flight path being located in the analyser volume, the charged particles following the main flight path under the influence of a main analyser electrical field generated by applying a first set of one or more electrical potentials to the electrode systems and reflecting from one mirror to the other at least once whilst orbiting around the z axis, the method comprising injecting along the internal injection trajectory in the presence of the main analyser field and when the charged particles are at or near point P deflecting the charged particles to change their velocity in the radial (r) direction.

(17) A charged particle analyser comprising:

two opposing mirrors, each mirror comprising inner and outer field-defining electrode systems elongated along an analyser axis z, the outer system surrounding the inner and defining therebetween an analyser volume, whereby when the electrode systems are electrically biased the mirrors create in the analyser volume an electrical field comprising opposing electrical fields and whereby in use a beam of charged particles is caused to fly through the analyser, reflecting from one mirror to the other at least once whilst orbiting around the z axis within the analyser volume; and an injector for injecting the beam of charged particles into the analyser volume;

wherein the outer field-defining electrode system of one or both mirrors comprises a waisted-in portion and at least a portion of the injector is located outside the analyser volume adjacent the waisted-in portion.

(18) A method of ejecting charged particles along an internal ejection trajectory from a main flight path at a point E in a charged particle analyser, wherein the analyser comprises two opposing mirrors each mirror comprising inner and outer field-defining electrode systems elongated along an axis z, the outer system surrounding the inner and defining therebetween an analyser volume, whereby when the electrode systems are given a first set of one or more electrical potentials the mirrors create a main analyser electrical field comprising opposing electrical fields substantially linear along z, the main flight path being located in the analyser volume, the charged particles following the main flight path under the influence of the main analyser electrical field reflecting from one mirror to the other at least once whilst orbiting around the z axis, the method comprising ejecting the charged particles along the internal ejection trajectory from the point E at least a portion of the internal ejection trajectory being traversed in the absence of the main analyser electrical field.

(19) A method of ejecting charged particles from an analyser, wherein the analyser comprises two opposing mirrors each mirror comprising inner and outer field-defining electrode systems elongated along an axis z, the outer system surrounding the inner and defining therebetween an analyser volume, whereby when the electrode systems are given a first set of one or more electrical potentials the mirrors create a main analyser electrical field comprising opposing electrical fields along z, a main flight path being located in the analyser volume, the charged particles following the main flight path under the influence of the main analyser electrical field reflecting from one mirror to the other at least once whilst orbiting around the z axis, the method comprising ejecting the charged particles from an internal ejection trajectory at a different distance from the z axis than the main flight path.

(20) A method of ejecting charged particles along an internal ejection trajectory from a main flight path at a point E in a charged particle analyser, wherein the analyser comprises two opposing mirrors each mirror comprising inner and outer field-defining electrode systems elongated along an axis z, the outer system surrounding the inner and defining therebetween an analyser volume, whereby when the electrode systems are electrically biased the mirrors create an analyser electrical field comprising opposing electrical fields along z, a main flight path being located in the analyser volume, the charged particles following the main flight path under the influence of a main analyser electrical field generated by applying a first set of one or more electrical potentials to the electrode systems and reflecting from one mirror to the other at least once whilst orbiting around the z axis, the method comprising when the charged particles are at or near point E changing the kinetic energy of the charged particles and ejecting along the internal ejection trajectory.

(21) A method of ejecting charged particles from a main flight path at a point E along an internal ejection trajectory, wherein the analyser comprises two opposing mirrors each mirror comprising inner and outer field-defining electrode systems elongated along an axis z, the outer system surrounding the inner and defining therebetween an analyser volume, whereby when the electrode systems are electrically biased the mirrors create an analyser electrical field comprising opposing electrical fields along z, a main flight path being located in the analyser volume, the charged particles following the main flight path under the influence of a main analyser electrical field generated by applying a first set of one or more electrical potentials to the electrode systems and reflecting from one mirror to the other at least once whilst orbiting around the z axis, the method comprising when the charged particles are at or near point E deflecting the charged particles to change their velocity in the radial (r) direction and ejecting the charged particles along the internal ejection trajectory in the presence of the main analyser field.

(22) A charged particle analyser comprising:

two opposing mirrors, each mirror comprising inner and outer field-defining electrode systems elongated along an analyser axis z, the outer system surrounding the inner and defining therebetween an analyser volume, whereby when the electrode systems are electrically biased the mirrors create in the analyser volume an electrical field comprising opposing electrical fields and whereby in use a beam of charged particles is caused to fly through the analyser, reflecting from one mirror to the other at least once whilst orbiting around the z axis within the analyser volume; and an ejector for ejecting the beam of charged particles from the analyser volume;

wherein the outer field-defining electrode system of one or both mirrors comprises a waisted-in portion and the ejector is operable to eject the beam through an aperture in the waisted-in portion.

(23) A method of analysing charged particles comprising the steps of:

providing an analyser comprising two opposing mirrors each mirror comprising inner and outer field-defining electrode systems elongated along an axis z, the outer system surrounding the inner and defining therebetween an analyser volume, whereby when the electrode systems are electrically biased the mirrors create an analyser electrical field comprising opposing electrical fields along z;

causing a beam of charged particles to fly through the analyser, reflecting from one mirror to the other at least once whilst orbiting around the z axis between the inner and outer electrode systems;

separating the charged particles according to their flight times; and detecting at least some of the particles having a plurality of m/z inside the analyser volume after they have undergone the same number of orbits around the axis z.

(24) A charged particle analyser comprising:

two opposing mirrors, each mirror comprising inner and outer field-defining electrode systems elongated along an analyser axis z, the outer system surrounding the inner and defining therebetween an analyser volume, whereby when the electrode systems are electrically biased the mirrors create in the analyser volume an electrical field comprising opposing electrical fields and whereby in use a beam of charged particles is caused to fly through the analyser, reflecting from one mirror to the other at least once whilst orbiting around the z axis within the analyser volume; and a detector located inside the analyser volume for detecting at least some of the particles having a plurality of m/z after they have undergone the same number of orbits around the axis z.

(25) A method of analysing charged particles comprising the steps of:

providing an analyser comprising two opposing mirrors each mirror comprising inner and outer field-defining electrode systems elongated along an axis z, the outer system surrounding the inner and defining therebetween an analyser volume, whereby when the electrode systems are electrically biased the mirrors create an analyser electrical field comprising opposing electrical fields along z;

causing a beam of charged particles to fly through the analyser, reflecting from one mirror to the other at least once whilst orbiting around the z axis between the inner and outer electrode systems;

separating the charged particles according to their flight times; and detecting at a detector at least some of the particles having a plurality of m/z outside the analyser volume after they have undergone the same number of orbits around the axis z, at least a portion of the detector being positioned within the maximum distance from the analyser axis of the outer field-defining electrode system of one or both the mirrors.

(26) A charged particle analyser comprising:

two opposing mirrors, each mirror comprising inner and outer field-defining electrode systems elongated along an analyser axis z, the outer system surrounding the inner and defining therebetween an analyser volume, whereby when the electrode systems are electrically biased the mirrors create in the analyser volume an electrical field comprising opposing electrical fields and whereby in use a beam of charged particles is caused to fly through the analyser, reflecting from one mirror to the other at least once whilst orbiting around the z axis within the analyser volume; and a detector located outside the analyser volume for detecting at least some of the particles having a plurality of m/z after they have undergone the same number of orbits around the axis z; wherein the outer field-defining electrode system of one or both mirrors comprises a waisted-in portion and at least a portion of the detector is located adjacent the waisted-in portion.

(27) A method of isolating selected charged particles from a beam of charged particles, the method comprising the steps of:

providing an analyser comprising two opposing mirrors each mirror comprising inner and outer field-defining electrode systems elongated along an axis z, the outer system surrounding the inner and defining therebetween an analyser volume, whereby when the electrode systems are electrically biased the mirrors create an electrical field within the analyser volume comprising opposing electrical fields along z, the strength along z of the electrical field being a minimum at a plane z=0;

causing a beam of charged particles to fly through the analyser, orbiting around the z axis within the analyser volume, reflecting from one mirror to the other at least once thereby defining a maximum turning point within a mirror; the strength along z of the electrical field at the maximum turning point being X and the absolute strength along z of the electrical field being less than $|X|/2$ for not more than ⅔ of the distance along z between the plane z=0 and the maximum turning point in each mirror; wherein the beam of charged particles includes selected charged particles of one or more m/z and further charged particles; and isolating the selected charged particles in the analyser volume by ejecting the further charged particles from the analyser after the further particles have undergone the same number of orbits around the axis z.

In other aspects, the present invention provides:

a time of flight mass spectrometer comprising the charged particle analyser of the present invention;

a method of time of flight mass spectrometry comprising the method of separating charged particles using the analyser of the present invention;

a method of time of flight mass spectrometry comprising the method of ejecting charged particles of the present invention;

a method of time of flight mass spectrometry comprising the method of injecting charged particles of the present invention;

a method of time of flight mass spectrometry comprising the method of detecting charged particles of the present invention.

The present invention provides, in some embodiments, a charged particle analyser and method of separating charged particles enabling a compact, high resolution, unlimited mass range TOF mass spectrometer which embodies near-perfect angular and time focusing characteristics with a minimum of high tolerance components. In some other embodiments, the mass range may be limited in order to further increase the mass resolution.

The construction of the analyser may be made with a small number of high tolerance components. In particular, the analyser according to the present invention requires only two opposing mirrors each comprising two electrode systems. Moreover, in some embodiments, a simple construction comprising only two field-defining electrode systems can be employed in order to provide both mirrors as herein described. Accordingly, the analyser preferably has only two opposing mirrors.

Typically, the charged particles which are to be separated according to their time of flight are ions.

The term beam herein in relation to the charged particles refers to the train of charged particles or packets of charged particles some or all of which are to be separated according to their m/z value.

The charged particle analyser herein may be used only for separation of charged particles. The separated charged particles may optionally have their flight times measured. The measurement of flight time may be performed by causing the particles to impinge upon a detector whereby they cannot be further used (destructive detection) or by causing the particles to pass within a detector whereby they may be used in further processing steps (non-destructive detection). An example of non-destructive detection is the known method of image current detection. As used herein, the term pass within a detector includes the cases where a charged particle to be detected either passes through a detector or passes near to a detector. Alternatively or additionally, the separated charged particles may be directed into one or more devices for further processing such as, e.g. an ion trap, a collision cell or accumulation store.

In reference to the two opposing mirrors, by the term opposing electrical fields (optionally substantially linear along z) is meant a pair of charged particle mirrors each of which reflects charged particles towards the other by utilising an electric field, those electric fields preferably being substantially linear in at least the longitudinal (z) direction of the analyser, i.e. the electric field has a linear dependence on distance in at least the longitudinal (z) direction, the electric field increasing substantially linearly with distance into each mirror. If a first mirror is elongated along a positive direction of the z axis, and a second mirror is elongated along a negative direction of the z axis, the mirrors preferably abutting at or near the plane z=0, the electric field within the first mirror preferably increases linearly with distance into the first mirror in a positive z direction and the electric field within the second mirror preferably increases linearly with distance into the second mirror in a negative z direction. These fields are generated by the application of potentials (electrical bias) to the field-defining electrode systems of the mirrors, which preferably create parabolic potential distributions within each mirror. The opposing electric fields together form an analyser field. The analyser field is thus the electric field within the analyser volume between the inner and outer field-defining electrode systems, which is created by the application of potentials to the field-defining electrode systems of the mirrors. The analyser field is described in more detail below. The electric field within each mirror may be substantially linear along z within only a portion of each mirror. Preferably the electric field within each mirror is substantially linear along z within the whole of each mirror. The opposing mirrors may be spaced apart from one another by a region in which the electric field is not linear along z. In some preferred embodiments there may be a located in this region, i.e. where the electric field is not linear along z, the one or more belt electrode assemblies as herein described. Preferably any such region is shorter in length along z than ⅓ of the distance between the maximum turning points of the charged particle beam within the two mirrors. Preferably, the charged particles fly in the analyser volume with a constant velocity along z for less than half of the overall time of their oscillation, the time of oscillation being the time it takes for the particles to reach the same point along z after reflecting once from each mirror. As the beam of charged particles reflects from one mirror to the other at least once it thereby defines a turning point within a mirror. A turning point of the charged particle beam within a mirror is the point at which the beam reaches its maximum extent of travel along z into the mirror, i.e. after which point the beam turns around and begins to travel in the opposite direction along z toward the opposing mirror, the maximum turning point being the furthest point into the mirror reached by any of the particles. If the strength along z of the electrical field at the maximum turning point is X then preferably the absolute field strength along z of the electrical field is less than |X|/2 for not more than ⅔ of the distance along z between the plane z=0 and the maximum turning point. A linear electric field along z within one mirror is shown in the plot of electric field strength vs. axial distance of FIG. 1*b*, in which $|E_z|$ is the absolute value of the electrical field strength along z, i.e. the magnitude of the z component of the electrical field, and $z_{tp}$ is the turning point of the charged particles within the mirror. Some embodiments of the analyzer of the present invention couple two such mirrors in an opposing fashion, as already described. FIG. 1*b* illustrates a perfectly linear field extending at least between the minimum of electric field along z at the z=0 plane, and the turning point, $z_{tp}$. As the figure shows, $|E_z|$ is less than X/2 for not more than ½ of the distance along z between the plane z=0 and the maximum turning point. $|E_z|$ is also greater than or equal to X/2 for not more than ½ of the distance along z between the plane z=0 and the maximum turning point. The present invention may also be worked using an electric field which is not perfectly linear along z. FIG. 1*c* illustrates a distorted linear field in which $|E_z|$ is less than X/2 for not more than ⅔ of the distance along z between the plane z=0 and the maximum turning point, and is equal to or greater than X/2 for not less than ⅓ the distance along z between the plane z=0 and the maximum turning point. FIG. 1*d* illustrates a further distorted linear field in which $|E_z|$ is less than X/2 for not less than ⅓ of the distance along z between the plane z=0 and the maximum turning point and is equal to or greater than X/2 for not more than ⅔ the distance along z between the plane z=0 and the maximum turning point.

More preferably, the absolute field strength along z of the electrical field is less than |X|/3 for not more than ⅓ of the distance along z between the plane z=0 and the maximum turning point. Preferably, the extent of the field along z in which the field is linear exceeds the extent of the field along z in which the field is non-linear or the extent along of any field-free region.

In cases where the two opposing mirrors are the same, the segments of preferably linear electric field, e.g. as shown in FIGS. 1*b*-1*e*, will be the same within each mirror. In cases where the two opposing mirrors are dissimilar, there may exist two different segments of preferably linear electric field, one for each mirror.

Preferably the opposing mirrors abut directly so as to be joined at or near the plane z=0. Within the analyser there may be additional electrodes serving further functions, examples of which will be described below, for instance belt electrode assemblies. Such additional electrodes may be within one or both of the opposing mirrors. The presence of such electrodes may distort the electric fields within the mirrors so that they are only substantially linear along z, and/or are linear along z only along part of the z length of the mirrors. Preferably the presence of such electrodes only distorts the electric field within the one or more mirrors along a z length less than ⅓ of the distance between the turning points of the charged particle beam within the two mirrors.

In preferred embodiments, the opposing mirrors are substantially symmetrical about the z=0 plane. In other embodiments, the opposing mirrors may not be symmetrical about the z=0 plane. Each mirror comprises inner and outer field-defining electrode systems elongated along a respective mirror axis, the outer system surrounding the inner. In operation, the charged particles in the beam orbit around the respective mirror axis between the inner and outer field-defining electrode systems whilst travelling within each respective mirror. The orbital motion of the beam is a helical motion orbiting around the analyser axis z whilst travelling from one mirror to the other in a direction parallel to the z axis. The orbital motion around the analyser axis z is in some embodiments substantially circular, whilst in other embodiments it is elliptical or of a different shape. The orbital motion around the analyser axis z may vary according to the distance from the z=0 plane. The mirror axes are generally aligned with the analyser axis z. The mirror axes may be aligned with each other, or a degree of misalignment may be introduced. The misalignment may take the form of a displacement between the axes of the mirrors, the axes being parallel, or it may take the form of an angular rotation of one of the mirror axes with respect to the other, or both displacement and rotation. Preferably the mirrors axes are substantially aligned along the same longitudinal axis and preferably this longitudinal axis is substantially co-axial with the analyser axis. Preferably the mirror axes are co-axial with the analyser axis z.

The field-defining electrode systems may be a variety of shapes as will be further described below. Preferably the field-defining electrode systems are of shapes that produce a quadro-logarithmic potential distribution within the mirrors; but other potential distributions are contemplated and will be further described.

The inner and outer field-defining electrode systems of a mirror may be of different shapes. Preferably the inner and outer field-defining electrode systems are of a related shape, as will be further described. More preferably both the inner and outer field-defining electrode systems of each mirror each have a circular transverse cross section (i.e. transverse to the analyser axis z). However, the inner and outer field-defining electrode systems may have other cross sections than circular such as elliptical, hyperbolic as well as others. The inner and outer field-defining electrode systems may or may not be concentric. Preferably the inner and outer field-defining electrode systems are concentric. The inner and outer field-defining electrode systems of both mirrors are preferably substantially rotationally symmetric about the analyser axis.

One of the mirrors may be of a different form to the other mirror, in one or more of: the form of its construction, its shape, its dimensions, the matching of the forms of the shapes between inner and outer electrode systems, the concentricity between the inner and outer electrode systems, the electrical potentials applied to the inner and/or outer field-defining electrode systems or other ways. Where the mirrors are of a different form to each other the mirrors may produce opposing electrical fields which are different to each other. In some embodiments whilst the mirrors are of different construction and/or have different electrical potentials applied to the field-defining electrode systems, the electric fields produced within the two mirrors are substantially the same. In some embodiments the mirrors are substantially identical and have a first set of one or more electrical potentials applied to the inner field-defining electrode systems of both mirrors and a second set of one or more electrical potentials applied to the outer field-defining electrode systems of both mirrors. In other embodiments the mirrors differ in prescribed ways, or have differing potentials applied, in order to create asymmetry (i.e. different opposing electrical fields), which provides additional advantages as described hereinafter.

A field-defining electrode system of a mirror may consist of a single electrode, for example as described in U.S. Pat. No. 5,886,346, or a plurality of electrodes (e.g. a few or many electrodes), for example as described in WO 2007/000587. The inner electrode system of either or both mirrors may for example be a single electrode, as may the outer electrode system. Alternatively a plurality of electrodes may be used to form the inner and/or outer electrode systems of either or both mirrors. Preferably the field-defining electrode systems of a mirror consist of single electrodes for each of the inner and outer electrode systems. The surfaces of the single electrodes will constitute equipotential surfaces of the electrical fields.

The outer field-defining electrode system of each mirror is of greater size than the inner field-defining electrode system and is located around the inner field-defining electrode system. As in the Orbitrap™ electrostatic trap, the inner field-defining electrode system is preferably of spindle-like form, more preferably with an increasing diameter towards the mid-point between the mirrors (i.e. towards the equator (or z=0 plane) of the analyser), and the outer field-defining electrode system is preferably of barrel-like form, more preferably with an increasing diameter towards the mid-point between the mirrors. This preferred form of analyser construction advantageously uses fewer electrodes and forms an electric field having a higher degree of linearity than many other forms of construction. In particular, forming the parabolic potential distributions in the direction of the mirror axes within the mirrors with the use of electrodes shaped to match the parabolic potential near the axial extremes produces the desired linear electric field to higher precision near the locations at which the charged particles reach their turning points and are travelling most slowly. Greater field accuracy at these regions provides a higher degree of time focusing, allowing higher m/z resolution to be obtained. Herein, the term m/z refers to mass to charge ratio. Where the inner field defining electrode system of a mirror comprises a plurality of electrodes, the plurality of electrodes is preferably operable to mimic a single electrode of spindle-like form. Similarly, where the outer field defining electrode system of a mirror comprises a plurality of electrodes, the plurality of electrodes is preferably operable to mimic a single electrode of barrel-like form.

The inner field-defining electrode systems of each mirror are preferably of increasing diameter towards the mid-point between the mirrors (i.e. towards the equator (or z=0 plane) of the analyser. The inner field-defining electrode systems of each mirror may be separate electrode systems from each other separated by an electrically insulating gap or, alternatively, a single inner field-defining electrode system may constitute the inner field-defining electrode systems of both mirrors (e.g. as in the Orbitrap™ electrostatic trap). The single inner field-defining electrode system may be a single piece inner field-defining electrode system or two inner field-defining electrode systems in electrical contact. The single inner field-defining electrode system is preferably of spindle-like form, more preferably with an increasing diameter towards the mid-point between the mirrors. Similarly, the outer field-defining electrode systems of each mirror are preferably of increasing diameter towards the mid-point between the mirrors. The outer field-defining electrode systems of each mirror may be separate electrodes from each other separated by an electrically insulating gap or, alternatively, a single outer field-defining electrode system may constitute the outer field-defining electrode systems of both mirrors. The single outer field-defining electrode system may be a single piece outer electrode or two outer electrodes in electrical contact. The single outer field-defining electrode system is preferably of barrel-like form, more preferably with an increasing diameter towards the mid-point between the mirrors.

Preferably, the two mirrors abut near, more preferably at, the z=0 plane to define a continuous equi-potential surface. The term abut in this context does not necessarily mean that the mirrors physically touch but means they touch or lie closely adjacent to each other. Accordingly, the charged particles preferably undergo simple harmonic motion in the longitudinal direction of the analyser which is perfect or near perfect.

In one embodiment, a quadro-logarithmic potential distribution is created within the analyser. The quadro-logarithmic potential is preferably generated by electrically biasing the two field-defining electrode systems. The inner and outer field-defining electrode systems are preferably shaped such that when they are electrically biased a quadro-logarithmic potential is generated between them. The total potential distribution within each mirror is preferably a quadro-logarithmic potential, wherein the potential has a quadratic (i.e. parabolic) dependence on distance in the direction of the analyser axis z (which is the longitudinal axis) and has a logarithmic dependence on distance in the radial (r) direction. In other embodiments, the shapes of the field-defining electrode systems are such that no logarithmic potential term is generated in the radial direction and other mathematical forms describe the radial potential distribution.

As used herein, the terms radial, radially refer to the cylindrical coordinate r. In some embodiments, the field-defining electrode systems of the analyser and/or the main flight path within the analyser do not posses cylindrical symmetry, as for example when the cross sectional profile in a plane at constant z is an ellipse, and the terms radial, radially if used in conjunction with such embodiments do not imply a limitation to only cylindrically symmetric geometries.

In some embodiments the analyser electrical field is not necessarily linear in the direction of the analyser axis z but in preferred embodiments is linear along at least a portion of the length along z of the analyser volume.

All embodiments of the present invention have several advantages over many prior art multi-reflecting systems. The presence of an inner field-defining electrode system serves to shield charged particles on one side of the system from the charge present on particles on the other side, reducing the effects of space charge on the train of packets. In addition, axial spreading of the beam (i.e. spreading in the direction of the analyser axis z) due to any remaining space charge influence does not change significantly the time of flight of the particles in an axial direction—the direction of time of flight separation.

In preferred embodiments utilising opposing linear electric fields in the direction of the analyser axis, the charged particles are at all times whilst upon the main flight path travelling with speeds which are not close to zero and which are a substantial fraction of the maximum speed. In such embodiments, the charged particles are also never sharply focused except in some embodiments where they are focused only upon commencing the main flight path. Both these features thereby further reduce the effects of space charge upon the beam. The undesirable effect of self-bunching of charged particles may also be avoided by the introduction of very small field non-linearities, as described in WO06129109.

In preferred embodiments, the invention utilises a quadro-logarithmic potential concentric electrode structure as used in an Orbitrap™ electrostatic trap, in the form of a TOF separator. The Orbitrap™ is described, for example, in U.S. Pat. No. 5,886,346. In principle, both perfect angular and energy time focusing is achieved by such a structure.

An additional fundamental problem with prior art folded path reflecting arrangements utilising parabolic potential reflectors is that the parabolic potential reflectors cannot be abutted directly to one another without distorting the linear field of the reflectors to some extent, which has generally led to the introduction of a relatively long portion of relatively field free drift space between the reflectors. Furthermore, in the prior art the use of linear fields (parabolic potentials) in reflectors leads to the charged particles being unstable in a perpendicular direction to their travel. To compensate for this the prior art has used a combination of a field free region, a strong lens and a uniform field.

Either the distortion and/or the presence of field free regions makes perfect harmonic motion impossible with such prior art parabolic potential reflectors. To obtain a high degree of time focusing at the detector, the field within one or more of the reflectors must be changed to try and compensate for this, or some additional ion optical component must be introduced into the flight path. In contrast to the mirrors of some embodiments of the present invention, perfect angular and energy focusing cannot be achieved with these multi-reflection arrangements.

A preferred quadro-logarithmic potential distribution U(r, z) formed in each mirror is described in equation (1):

$$U(r, z) = \frac{k}{2}\left(z^2 - \frac{r^2}{2}\right) + \frac{k}{2}(R_m)^2 \ln\left[\frac{r}{R_m}\right] + C \tag{1}$$

where r,z are cylindrical coordinates (r=radial coordinate; z=longitudinal or axial coordinate), C is a constant, k is field linearity coefficient and $R_m$ is the characteristic radius The latter has also a physical meaning: the radial force is directed towards the analyser axis for $r<R_m$, and away from it for $r>R_m$, while at $r=R_m$ it equals 0. Radial force is directed towards the axis at $r<R_m$. In preferred embodiments $R_m$ is at a greater radius than the outer field-defining electrode systems of the mirrors, so that charged particles travelling in the space between the inner and outer field-defining electrode systems always experience an inward radial force, towards the inner field-defining electrode systems. This inward force balances the centripetal force of the orbiting particles.

When ions are moving on circular spiral of radius R in such potential distribution, their motion could be described by three characteristic frequencies of oscillation of charged particles in the potential of equation (1): axial oscillation in the z direction given in equations (2) by ω, orbital frequency of oscillation (hereinafter termed angular oscillation) around the inner field-defining electrode system in what is herein termed the arcuate direction ($\phi$) given in equations (2) by $\omega_\phi$ and radial oscillation in the r direction given in equations (2) by $\omega_r$.

$$\omega = \sqrt{\frac{e}{(m/z)} \cdot k} \tag{2}$$

$$\omega_\phi = \omega \cdot \sqrt{\frac{\left(\frac{R_m}{R}\right)^2 - 1}{2}}$$

$$\omega_r = \omega \cdot \sqrt{\left(\frac{R_m}{R}\right)^2 - 2}$$

where e is the elementary charge, m is the mass and z is the charge of the charged particles, and R is the initial radius of the charged particles. The radial motion is stable if $R<R_m/2^{1/2}$ therefore $\omega_\phi>\omega/2^{1/2}$, and for each reflection (i.e. change of axial oscillation phase by $\pi$), trajectory must rotate by more than $\pi/2^{1/2}$ radian. A similar limitation is present for potential distributions deviating from (1) and represents a significant difference from all other types of known ion mirrors.

The equations (2) show that the axial oscillation frequency is independent of initial position and energy and that both rotational and radial oscillation frequencies are dependent on initial radius, R. Further description of the characteristics of this type of quadro-logarithmic potential are given by, for example, A. Makarov, Anal. Chem. 2000, 72, 1156-1162.

Whilst a preferred embodiment utilises a potential distribution as defined by equation (1), other embodiments of the present invention need not. Embodiments utilising the opposing linear electric fields in the direction of the analyser (longitudinal) axis can use any of the general forms described by equations (3a) and (3b) in (x,y) coordinates, the equations also given in WO06129109.

$$U_g(x, y, z) = U(r, z) + W(x, y) \tag{3a}$$

$$W(x, y) = -\frac{k}{4}[x^2 - y^2]a + \left[A \cdot r^m + \frac{B}{r^m}\right]\cos\left\{m \cdot \cos^{-1}\left(\frac{x}{r}\right) + \alpha\right\} + b \cdot \ln\left(\frac{r}{D}\right) + E \cdot \exp(F \cdot x)\cos(F \cdot y + \beta) + G\exp(H \cdot y)\cos(H \cdot x + \gamma) \tag{3b}$$

where $r=\sqrt{(x^2+y^2)}$, $\alpha$, $\beta$, $\gamma$, a, A, B, D, E, F, G, H are arbitrary constants (D>0), and j is an integer. Equations (3a) and (3b) are general enough to remove completely any or all of the terms in Equation (1) that depend upon r, and replace them with other terms, including expressions in other coordinate systems (such as elliptic, hyperbolic, etc.). For a particle starting and ending its path at z=0, the time-of-flight in the potential described by equations (3a) and 3(b) corresponds to one half of an axial oscillation:

$$T = \frac{\pi}{\omega} = \pi\sqrt{\frac{(m/z)}{ek}} \tag{4}$$

The coordinate of the turning point is $z_{tp}=v_z/\omega$ where $v_z$ is axial component of velocity at z=0 and equivalent path length over one half of axial oscillation (i.e. single reflection) is $v_zT=\pi z_{tp}$. The equivalent or effective path length is therefore longer than the actual axial path length by a factor $\pi$ and is a measure representative of the path length over which time of flight separation occurs. This enhancement by the factor $\pi$ is due to the deceleration of the charged particles in the axial direction as they penetrate further into each of the mirrors. In the present invention the preferred absence of any significant length of field-free region in the axial direction produces this large enhancement and is an additional advantage over reflecting TOF analysers that utilize extended field-free regions.

The beam of charged particles flies through the analyser along a main flight path. The main flight path preferably comprises a reflected flight path between the two opposing mirrors. The main flight path of the beam between the two opposing mirrors lies in the analyser volume, i.e. radially between the inner and outer field-defining electrode systems. The two directly opposing mirrors in use define a main flight path for the charged particles to take as, in some embodiments, they undergo at least one full oscillation of motion in the direction of the analyser (z) axis between the mirrors. The two directly opposing mirrors in use define a main flight path for the charged particles to take as, in some embodiments, they preferably undergo at least one full oscillation of substantially simple harmonic motion in the direction of the analyser (z) axis of the analyser between the mirrors. As the beam of charged particles flies through the analyser along the main flight path it preferably undergoes at least one full oscillation of substantially simple harmonic motion along the longitudinal (z) axis of the analyser whilst orbiting around the analyser axis (i.e. rotation in the arcuate direction). As used herein, the term angle of orbital motion refers to the angle subtended in the arcuate direction as the orbit progresses. Accordingly, a preferred motion of the beam along its flight path within the analyser is a helical motion around the inner field-defining electrode system. Preferably, at the mid-point between the mirrors (near the z=0 plane) the beam position advances by a distance in the arcuate direction after a given number of reflections from the mirrors (e.g. one or two reflections). In this way, the beam flies along the main flight path through the analyser back and forth along the analyser axis in a helical path which steps around the analyser axis (i.e. in the arcuate direction) in the z=0 plane. The orbiting helical motion may have a circular, elliptic or other form of cross sectional shape. In preferred embodiments, the beam orbits around the inner field-defining electrode system of each mirror and thereby around the analyser axis z approximately once per reflection. Preferably the beam orbits around the analyser axis slightly more or slightly less than once per reflection in one or both mirrors, and the position of the beam at the z=0 plane advances around the analyser axis in one direction. In this way multiple reflections in both mirrors may be made before the beam starts to follow substantially the same path within the analyser, many orbits of the beam having occurred before the beam reaches the point on the z=0 plane at which it started upon the main flight path. Any fraction or multiple of whole revolutions of the beam in the arcuate direction in the z=0 plane may be utilised per reflection as required provided it exceeds $\pi/2^{1/2}$ radian. Before the beam has completed one whole revolution in the arcuate direction in the z=0 plane, the beam may be ejected so that the beam does not follow substantially the same path within the analyser more than once. Alternatively, the beam may be allowed to complete one whole revolution in the arcuate direction in the z=0 plane and begin again along substantially the same path within the analyser (i.e. the beam repeats substantially the same path within the analyser once again, or more than once). In one type of embodiment of the present invention therefore, the beam of charged particles does not follow substantially the same path within the analyser more than once (i.e. the flight path is an open flight path). Alternatively, in another type of embodiment of the present invention, the beam of charged particles follows substantially the same path within the analyser more than once (i.e. the flight path is a closed or looped flight path), allowing the resolving power to be increased, but at the expense of mass range.

A characteristic feature of some preferred embodiments is that the main flight path orbits around the inner field-defining electrode system approximately once or more than once whilst performing a single oscillation in the direction of the analyser axis. This has the advantageous effect of separating the charged particle beam around the inner field-defining electrode system, reducing the space charge effects of one part of the beam from another, as described earlier. Another advantage is that the strong effective radial potential enforces strong radial focusing of the beam and hence provides a small radial size of the beam. This in turn increases resolving power of the apparatus due to a smaller relative size of the beam and a smaller change of perturbing potentials across the beam. Preferably the ratio of the frequency of the orbital motion to that of the oscillation frequency in the direction of the longitudinal axis z of the analyser is between 0.71 and 5. More preferably the ratio of the frequency of the orbital motion to that of the oscillation frequency in the direction of the longitudinal axis of the analyser is between (in order of increasing preference) 0.8 and 4.5, 1.2 and 3.5, 1.8 and 2.5. Some preferred ranges therefore include 0.8 to 1.2, 1.8 to 2.2, 2.5 to 3.5 and 3.5 to 4.5.

As the charged particles travel along the main flight path of the analyser, they are separated according to their mass to charge ratio (m/z). The degree of separation depends upon the flight path length in the direction of the analyser axis z, amongst other things. Having been separated, the charged particles may have their flight times measured by detecting the particles within the analyser, or one or more ranges of m/z may be selected for detection or ejection from the analyser, optionally to a detector or to another device for further processing of the particles. The term a range of m/z includes herein a range so narrow as to include only one resolved species of m/z. Unlike in the Orbitrap™ mass analyser, which is an ion trap with image detection of ions over the same detection time but very different number of orbits, in some embodiments of the present invention the charged particles undergo the same number of orbits around the analyser axis z before being ejected or detected enabling the particles to be ejected or detected sequentially on the basis of their flight time. However, preferably, the range of m/z comprises a plurality of m/z wherein there is a maximum m/z value, $m/z_{max}$ and a minimum m/z value, $m/z_{min}$, such that $m/z_{max}/m/z_{min}$ is preferably at least 3. In other preferred embodiments, the ratio $m/z_{max}/m/z_{min}$ may be at least 5, at least 10 or at least 20.

In analysers having potential distributions described by equation (3) and other types of analysers, such as the quadro-logarithmic potential distribution, divergence in r is constrained, and arcuate divergence is not constrained at all. Strong radial focusing is achieved automatically in the quadro-logarithmic potential when ions are moving on trajectories close to a circular helix, but the unconstrained arcuate divergence of the beam would, if unchecked, lead to a problem of complete overlapping of trajectories for ions of the same m/z but different initial parameters. Injected charged particles would, as in the Orbitrap™ analyser, form rings around the inner field-defining electrode system, the rings comprising ions of the same m/z, the rings oscillating in the longitudinal analyser axial direction. In the Orbitrap™ analyser, image current detection of ions within the trap is unaffected. However, for use of such a field for time of flight separation of charged particles, the beam must either encounter a detector within the analysing field, or be ejected from the device for detection or further processing. In the latter case, some form of ejection mechanism must be introduced into the beam path to eject the beam from the field to a detector. Any ejection mechanism or any detector within the analysing field would have to act upon all the ions in the ring if it were to eject or detect all the charged particles of the same m/z present within the analyser. This task is impractical as the various rings of charged particles having differing m/z oscillate at different frequencies in the longitudinal direction of the analyser, and rings of different m/z may overlap at any given time. Even if the beam is ejected or detected before it forms a set of full rings of different m/z particles, as already described, during the flight path the initial packet of charged particles becomes a train of packets, lower m/z particles preceding higher m/z particles. Packets of charged particles at the front of the train that have diverged arcuately, spreading out around the inner field-defining electrode system, could overlap packets further back in the train. Any ejection mechanism attempting to eject the train intact from the field acting on such overlapping packets would disrupt all those packets, and the whole train of packets would not be successfully ejected sequentially from the field for detection. Alternatively, any detector placed within the analysing field would detect charged particles at the front of the train and charged particles further back in the train at the same time, where those ions overlap in space due to the arcuate divergence. Similarly, if charged particles are to be separated by their flight time and a subset selected by ejecting them from the analyser to a receiver, the selection process would undesirably select ions having undergone widely differing flight times, as overlapping charged particles from different sections of the train would be ejected.

The present invention addresses this problem by introducing arcuate focusing, i.e. focusing of the charged particle packets in the arcuate direction so as to constrain their divergence in that direction. The term arcuate is used herein to mean the angular direction around the longitudinal analyser axis z. FIG. 1 shows the respective directions of the analyser axis z, the radial direction r and the arcuate direction ø, which thus can be seen as cylindrical coordinates. Arcuate focusing confines the beam so that the train of packets remains sufficiently localised in its spread around the analyser axis z (i.e. in the arcuate direction) that it may be ejected without disrupting the flight path taken by packets further back in the train, and subsequent passes of the packets through the analyser do not overlap with the previous ones. With such arcuate focusing the preferred quadro-logarithmic potential of the present invention can be utilised successfully with large numbers of multiple reflections to give a high mass resolution TOF analyser, optionally having unlimited mass range. Arcuate focusing may also be employed in orbital analysers having other forms of potential distributions.

The term arcuate focusing lens (or simply arcuate lens) is herein used to describe any device which provides a field that acts upon the charged particles in the arcuate direction, the field acting to reduce beam divergence in the arcuate direction. The term focusing in this context is not meant to imply that any form of beam crossover is necessarily formed, nor that a beam waist is necessarily formed. The lens may act upon the charged particles in other directions as well as the arcuate direction. Preferably the lens acts upon the charged particles in substantially only the arcuate direction. Preferably the field provided by the arcuate lens is an electric field. It can be seen therefore, that the arcuate lens may be any device that creates a perturbation to the analyser field that would otherwise exist in the absence of the lens. The lens may include additional electrodes added to the analyser, or it may comprise changes to the shapes of the inner and outer field-defining electrode systems. In one embodiment the lens comprises locally-modified inner field-defining electrode systems of one or both of the mirrors, e.g. an inner field-defining electrode system with a locally-modified surface profile. In a preferred embodiment the lens comprises a pair of opposed electrodes, one either side of the main flight path at different radial distance from the analyser axis z. The pair of opposed electrodes may be constructed having various shapes, e.g. substantially circular in shape. In some embodiments, neighbouring electrodes may be merged into a single-piece lens electrode assembly which is opposed by another single-piece lens electrode assembly located at a different distance from the analyser axis on the other side of the beam. That is, a single piece lens electrode assembly may be utilised which is shaped to provided a plurality of lenses. A plurality of lenses are provided by a single-piece lens electrode assembly which is opposed by another single-piece lens electrode assembly at a different distance from the analyser axis, the single-piece lens electrode assemblies being shaped to provide a plurality of arcuate focusing lenses. The single-piece lens electrode assemblies preferably have edges comprising a plurality of smooth arc shapes. The single-piece lens electrode assemblies preferably extend at least partially, more preferably substantially, around the z axis in the arcuate direction.

Alternatively to having a pair of opposed electrodes on either side of the beam in a radial direction, the arcuate focusing lenses may instead comprises a pair of opposed electrodes on either side of the beam in an arcuate direction. In one such type of embodiment, preferably the one or more arcuate focusing lenses each comprises a pair of opposed electrodes on either side of the beam in an arcuate direction, each opposed electrode comprises a plurality of radially stacked electrodes electrically insulated from each other.

The one or more arcuate lenses are located in the analyser volume. The one or more arcuate lenses may be located anywhere within the analyser volume upon or near the main flight path such that in operation the one or more lenses act upon the charged particles as they pass. In preferred embodiments the one or more arcuate lenses are located at approximately the mid-point between the two mirrors (i.e. mid-point along the analyser axis z). The mid-point between the two mirrors along the z axis of the analyser, i.e. the point of minimum absolute field strength in the direction of the z axis, is herein termed the equator or equatorial position of the analyser. The equator is then also the location of the z=0 plane. In another embodiment the one or more arcuate lenses are placed adjacent one or both of the maximum turning points of the mirrors (i.e. the points of maximum travel along z). In more preferred embodiments, the one or more arcuate lenses are located offset from the mid-point between the two mirrors (i.e. mid-point along the analyser axis z) but still near the mid-point as described in more detail below.

The one or more arcuate lenses act upon the charged particles as they travel along the main flight path between the radii of the inner and outer field-defining electrode systems.

The one or more arcuate lenses may be supported upon the inner and/or outer field-defining electrode systems, upon additional supports, or upon a combination of the two.

The arcuate focusing is preferably performed on the beam at intervals along the flight path. The intervals may be regular (i.e. periodic) or irregular.

The arcuate focusing is more preferably periodic arcuate focusing. In other words, the arcuate focusing is more preferably performed on the beam at regular arcuate positions along the flight path.

The arcuate focusing is preferably achieved by a series of lenses (i.e. a plurality of lenses), which preferably are placed between the radii of the inner and outer field-defining electrode systems, i.e. which generate the, e.g. quadro-logarithmic, potentials, i.e. centred on or close to the z=0 plane. The plurality of lenses may extend completely around the analyser axis z or may extend partially around the analyser axis. In embodiments in which the mirrors are substantially concentric with the analyser axis, the plurality of lenses is preferably also substantially concentric with the analyser axis. More preferably, the lenses are each centred on or near the z=0 plane. This is because at this plane the axial force on the particles is zero, the z component of the electric field being zero, and the presence of any lenses least disturbs the parabolic potential in the z direction elsewhere in the analyser, introducing fewest aberrations to the time focusing.

In another embodiment the plurality of lenses may be located close to one or both of the turning points within the analyser. In this case whilst the z component of the electric field is at its highest value on the flight path, the charged particles are travelling with the least kinetic energy on the flight path and lower focusing potentials are required to be applied to the arcuate lenses to achieve the desired constrainment of arcuate divergence.

Preferably, the arcuate focusing lenses are periodically placed around the analyser axis, i.e. regularly spaced around the analyser axis, in the arcuate direction, i.e. as an array of arcuate focusing lenses. The array of arcuate focusing lenses thus preferably extends around the z axis in the arcuate direction. Preferably, the arcuate focusing lenses in the array are located at substantially the same z coordinate. As described above, near the equator (or near z=0 plane) the beam position preferably advances by an angle or distance in the arcuate direction after a given number of reflections (e.g. one or two reflections) from the mirrors (one full oscillation along z comprises two reflections). The arcuate focusing lenses are preferably periodically placed around the analyser axis of the analyser and spaced apart in the arcuate direction by a distance substantially equal to the distance in the arcuate direction that the beam advances after the given number of reflections from the parabolic mirrors. In one preferred embodiment, the plurality of arcuate focusing lenses are spaced apart in the arcuate direction by an angle $\theta$, where $\theta \ll 2\pi$ radians, and the beam orbits the analyser axis in the arcuate direction by an angle $4\pi+/-\theta$ for each full oscillation. In another preferred embodiment, the plurality of arcuate focusing lenses are spaced apart in the arcuate direction by an angle $\theta$, where $\theta \ll 2\pi$ radians, and the beam orbits the analyser axis in the arcuate direction by an angle $2\pi+/-\theta$ for each half oscillation (i.e. per reflection in a mirror).

Furthermore, the arcuate focusing lenses are preferably periodically placed around the analyser axis of the analyser at or near the positions where the beam crosses the equator as it flies through the analyser. In some preferred types of embodiment the plurality of arcuate focusing lenses form an array of arcuate focusing lenses located at substantially the same z coordinate, which more preferably is at or near z=0 but most preferably is offset from (but near) z=0. The offset z coordinate is preferably where the main flight path crosses over itself during an oscillation, which offset z coordinate is near the z=0 plane. The latter arrangement has the advantage that each arcuate focusing lens can be used to focus the beam twice, i.e. after reflection from one mirror and then after the next reflection from the other mirror as described in more detail below. Utilising each lens twice can therefore be achieved using identical mirrors by offsetting the location of the arcuate focusing lenses from the z=0 plane to the z coordinate where the main flight path crosses over itself during an oscillation. The lens are thus preferably spaced apart in the arcuate direction by the distance that the beam advances in the arcuate direction at the z coordinate at which the lenses are placed after each oscillation along z.

Unlike other multi-reflection or multi-deflection TOFs, there is substantially no field-free drift space (most preferably no field-free drift space) at all as the arcuate lenses are integrated within the analyser field produced by the opposing mirrors, and at no point does the electric analyser field approach zero. Even where there is no axial field, there is a field in the radial direction present. In addition, the charged particles turn per each reflection by an angle which is typically much higher (up to tens of times) than the periodicity of the arcuate lenses. In the analyser of the invention, a substantial axial field (i.e. the field in the z direction) is present throughout the majority of the axial length (preferably two thirds or more) of the analyser. More preferably, a substantial axial field is present throughout 80% or more, even more preferably 90% or more, of the axial length of the analyser. The term substantial axial field herein means more than 1%, preferably more than 5% and more preferably more than 10% of the strength of the axial field at the maximum turning point in the analyser.

In preferred embodiments utilising the quadro logarithmic potential described by equation (1), at the z=0 plane the potential in the radial direction (r) can be approximated by the potential between a pair of concentric cylinders. For this reason, in one type of preferred embodiment, one or more belt electrode assemblies are used, e.g. to support the arcuate focusing lenses or to help to shield the main flight path from voltages applied to other electronic components (e.g. lens, electrodes, accelerators, deflectors, detectors etc.) which may be located within the analyser between the inner and outer field-defining electrode systems or for other purposes. A belt electrode assembly herein is preferably a belt-shaped electrode assembly located in the analyser volume although it need not extend completely around the inner field-defining electrode systems of the one or both mirrors, i.e. it need not extend completely around the z axis. Thus, a belt electrode assembly extends at least partially around the inner field-defining electrode systems of the one or both mirrors, i.e. at least partially around the z axis, more preferably substantially around the z axis. The belt electrode assembly preferably extends in an arcuate direction around the z axis. The one or more belt electrode assemblies may be concentric with the analyser axis. The one or more belt electrode assemblies may be concentric with the inner and outer field-defining electrode systems of one or both mirrors. In a preferred embodiment the one or more belt electrode assemblies are concentric with both the analyser axis and the inner and outer field-defining electrode systems of both mirrors. In some embodiments, the one or more belt electrode assemblies comprise annular belts located between the inner and outer field-defining electrode systems of one or both mirrors, at or near the z=0 plane. In other embodiments, a belt electrode assembly may take the form of a ring located near the maximum turning point of the charged particle beam within one of the mirrors. In some embodiments, it may not be necessary for the belt electrode assemblies to extend completely around the inner field-defining electrode systems of the one or both mirrors, e.g. where there are a small number of arcuate focusing lenses. In use, the belt electrode assemblies function as electrodes to approximate the analyser field (e.g. quadro-logarithmic field), preferably in the vicinity of the z=0 plane, and have a suitable potential applied to them. FIG. 1*e* illustrates the form of the electrical field along z within one mirror in an embodiment of the present invention in which a pair of cylindrical belt electrode assemblies have been incorporated near or at the plane z=0. Comparison with FIG. 1*b* described earlier shows how the perfectly linear field of FIG. 1*b* has been truncated near to the plane z=0 by the presence of the cylindrical belt electrode assemblies. Use of belt electrode assemblies having profiles to follow the equipotential field lines within the analyzer (e.g. quadro-logarithmic shapes in analysers of having quadro-logarithmic potential distributions) would remove this field distortion near the z=0 plane. However the presence of any energized lens or deflection electrodes situated upon the belt electrode assemblies would also distort the electrical field along z to some extent in the region of the belt electrode assemblies.

The one or more belt electrode assemblies may be supported and spaced apart from the inner and/or outer field-defining electrode systems, e.g. by means of electrically insulating supports (i.e. such that the belt electrode assemblies are electrically insulated from the inner and/or outer field-defining electrode systems). The electrically insulating supports may comprise additional conductive elements appropriately electrically biased in order to approximate the potential in the region around them. The outer field-defining electrode system of one or both mirrors may be waisted-in at and/or near the z=0 plane to support the outer belt electrode assembly.

The belt electrode assemblies are electrically insulated from the arcuate focusing lenses which they may support. Preferably, the belt electrode assemblies extend beyond the edges of the arcuate focusing lenses in the z direction in order to shield the remainder of the analyser from the potentials applied to the lenses.

The one or more belt electrode assemblies may be of any suitable shape, e.g. the belts may be in the form of cylinders, preferably concentric cylinders. Preferably, the belt electrode assemblies are in the form of concentric cylinder electrodes. More preferably, the one or more belt electrode assemblies may be in the form of sections having a shape which substantially follows or approximates the equipotentials of the analyser field at the place the belt electrode assemblies are located. As a more preferred example, the belt electrode assemblies may be in the form of quadro-logarithmic sections, i.e. their shape may follow or approximate the equipotentials of the quadro-logarithmic field (i.e. the undistorted quadro-logarithmic field) at the place the belt electrode assemblies are located. The belt electrode assemblies may be of any length in the longitudinal (z) direction, but preferably where the belt electrode assemblies only approximate the quadro-logarithmic potential in the region in which they are placed, such as when they are, for example, cylindrical in shape, they are less than ⅓ the length of the distance between the turning points of the main flight path in the two opposing mirrors. More preferably where the belt electrode assemblies are cylindrical in shape, they are less than ⅙ the length of the distance between the turning points of the main flight path in the two opposing mirrors in the longitudinal (z) direction.

In some embodiments, there may be used only one belt electrode assembly, e.g. where one sub-set (i.e. on one side of the main flight path) of arcuate lenses can be supported by one belt electrode assembly and the other sub-set of lenses are also supported by the inner or outer field-defining electrode system. In other embodiments, there may be used two or more belt electrode assemblies, e.g. where the arcuate lenses require support by two belt electrode assemblies. In the case of using two or more belt electrode assemblies the belt electrode assemblies may comprise at least an inner belt electrode assembly and an outer belt electrode assembly, the inner belt electrode assembly lying closest to the inner field-defining electrode system and the outer belt electrode assembly having greater diameter than the inner belt electrode assembly and lying outside of the inner belt electrode assembly. At least one belt electrode assembly (the outer belt electrode assembly) may be located outside (i.e. at larger distance from the analyser axis) of the flight path of the beam and/or at least one belt electrode assembly (the inner belt electrode assembly) may be located inside (i.e. at a smaller distance from the analyser axis) of the flight path of the beam. Preferably, there are at least two belt electrode assemblies preferably placed within the analyser between the outer and inner field-defining electrode systems, with a belt electrode assembly either side of the flight path. In some embodiments the inner and outer field-defining electrode systems do not have a circular cross section in the plane z=constant. In these cases preferably the one or more belt electrode assemblies also do not have a circular cross section in the plane z=constant, but have a cross sectional shape to match those of the inner and outer field-defining electrode systems.

The belt electrode assemblies may, for example, be made of conductive material or may comprise a printed circuit board having conductive lines thereon. Other designs may be envisaged. Any insulating materials, such as printed circuit board materials, used in the construction of the analyser may be coated with an anti-static coating to resist build-up of charge.

In some preferred embodiments, the one or more arcuate focusing lenses may be supported by the surface of one, or more preferably both, of the inner and outer field defining electrode systems, i.e. without need for belt electrode assemblies. In such cases, the arcuate focusing lenses will of course be electrically insulated from the field defining electrode systems. In such cases, the surface of the arcuate focusing lenses facing the beam may be flush with the surface of the field defining electrode system which they are supported by.

The arcuate focusing lenses, which are of appropriate size and preferably supported by the belt electrode assemblies, are preferably positioned so that the beam passes through a lens (i.e. at least one lens) each time it passes the z=0 plane which herein includes the case where the lenses are located on a plane offset but near the z=0 plane. However, in other embodiments the beam passes through a lens at intervals when it passes through the z=0 plane and not every time. The intervals may be regular or irregular. The arcuate focusing lenses may be astigmatic lenses with focusing predominantly or only in the arcuate direction, or stigmatic lenses. Stigmatic focusing is not required in some preferred embodiments because the nature of the potential, e.g. the quadro-logarithmic potential, confines the beam in the r direction, strong confinement in the radial direction being obtained when the beam orbits are circular. However, a stigmatic lens may be used and may be desirable for embodiments where the beam orbits are not substantially circular. The lenses are preferably astigmatic lenses with focusing in the arcuate direction and may be of any form that produces such astigmatic focusing. Preferred forms of lenses are described herein below.

Use of arcuate focusing lenses allows the analyser of the present invention to be used more efficiently to provide multiple reflections, especially a large number of multiple reflections, of the charged particles as they fly through the analyser. By selecting the principal parameters of the field, the angular (arcuate) and axial oscillating frequency can be chosen to cause the beam of charged particles to pass through the z=0 plane at predetermined positions, the lenses placed to produce a focusing action upon the beam at these locations. The multi-reflecting analyser of the present invention allows a long flight path with unlimited mass range. If higher mass resolution is required, however, in other embodiments multiple passes of the same flight path may be performed but with a restricted mass range.

It is preferred that every time the beam crosses the z=0 plane it passes through an arcuate focusing lens to achieve an optimum reduction of beam spreading in the arcuate direction, where the arcuate focusing lens is preferably located either at or near to where the beam crosses the z=0 (i.e. the arcuate focusing lens may be offset slightly from the z=0 plane as in some preferred embodiments described herein). This therefore does not mean that that the beam necessarily passes through an arcuate lens actually on the z=0 plane each time the beam passes the z=0 plane but the lens may instead be offset from the z=0 but is passed through for each pass through z=0. In this context, every time the beam crosses the z=0 plane may exclude the first time it crosses the z=0 plane (i.e. close to an injection point) and may exclude the last time it crosses the z=0 plane (i.e. close to an ejection or detection point). However, it is possible that the beam does not pass through an arcuate focusing lens every time it crosses the z=0 plane and instead passes through an arcuate focusing lens a fewer number times it crosses the z=0 plane (e.g. every second time it crosses the z=0 plane). Accordingly, any number of arcuate focusing lenses is envisaged.

Any suitable type of lens capable of focusing in the arcuate direction may be utilised for the arcuate focusing lens(es). Various types of arcuate focusing lens are further described below.

One preferred embodiment of arcuate focusing lens comprises a pair of opposing lens electrodes (preferably circular or smooth arc shaped lens electrodes, i.e. having smooth arc shaped edges). The opposing lens electrodes may be of substantially the same size or different size e.g. of sizes scaled to the distance from the analyser axis at which each lens electrode is located. The opposing lens electrodes have potentials applied to them that differ from the potentials that would be in the vicinity of the lens electrodes otherwise (i.e. if the lens electrodes were not there). In preferred embodiments opposing lens electrodes have different potentials applied and the beam of charged particles passes between the pair of opposing lens electrodes which when biased focus the beam in an arcuate direction across the beam, where the lens electrodes are opposing each other in a radial direction across the beam. Where the lenses are supported in belt electrode assemblies as described above, preferably the opposing lens electrodes follow the contour of the belt electrode assembly in which they are supported.

The arcuate focusing may be applied to various types of opposing mirror analysers that employ orbital particle motion about an analyser axis, not limited to opposed linear electric fields oriented in the direction of the analyser axis. Preferably the arcuate focusing is performed in an analyser having opposed linear electric fields oriented in the direction of the analyser axis. In a preferred embodiment the arcuate focusing is employed in an analyser utilising a quadro-logarithmic potential.

In some embodiments, the present invention enables the flight path within the analyser to be doubled without the flight path following substantially the same path more than once, thereby without placing any restriction upon the mass range. This is achieved by making the flight path in the two mirrors of the analyser differ such that the beam passes through each arcuate focusing lens twice, but follows different paths whilst doing so. The beam undergoes a first angle of orbital motion about the z axis whilst it travels through a first of the mirrors and the beam undergoes a second angle of orbital motion whilst it travels through a second of the mirrors, the first angle of orbital motion being different from the second angle of orbital motion. The first angle of orbital motion may be an integer multiple of $\pi$ radians ($a1=\pi*n$, n=1, 2, 3 . . . ) plus or minus an offset, $\delta$, where $\delta$ is typically greater than 0 and less than $\pi$ radians, whilst the second angle of orbital motion is an integer multiple of $\pi$ radians. Where the beam passes through an arcuate lens after every reflection, the offset $\delta$ is set to an integer multiple of the spacing of the lenses in the arcuate direction, for example for 36 full oscillations of the beam before it reaches its starting point then the arcuate lens spacing may be 10 degrees. Alternatively, where the beam does not pass through an arcuate lens after every reflection, the offset $\delta$ is set to a fraction of the spacing of the lenses in the arcuate direction. In embodiments which do not contain arcuate lenses the offset $\delta$ typically may be any value greater than 0 and less than $\pi$. To prevent overlapping of the beam $\delta$ should be greater than the beam width in the arcuate direction.

For example, after reflecting in a first mirror, the charged particles reach the equator (z=0) of the analyser having orbited around the analyser axis by $2.05\pi$ radians, thus shifting by $0.05\pi$ radians relative to their position before reflection. After reflecting in a second mirror, the charged particles reach the equator of the analyser having orbited around the analyser axis by $2\pi$ radians which brings them to their previous position before reflection but at a different direction of arcuate velocity. Thus in being returned to their previous position, the charged particles may be brought back into the same arcuate focusing lens, thereby utilising the lens twice. A subsequent reflection in the first mirror causes them to orbit around the analyser axis again by $2.05\pi$ radians e.g. to bring them into the next arcuate focusing lens. This enables each mirror to be utilised twice as many times to reflect the beam. Furthermore, it enables each arcuate focusing lens to be utilised twice as many times to focus the beam. It provides the advantages that the same high tolerance components are used multiple times giving longer flight paths for the same number of components, the same cost, the same simplicity of construction and approximately the same size of analyser.

Whilst in some embodiments the two mirrors of the analyser differ either in their physical characteristics (size and/or shape for example) or in their electrical characteristics or both, preferably they abut near, and preferably at, the z=0 plane, where, as already described, the axial electric field is lowest and fewest aberrations are introduced to disturb the time focusing. Preferably, the two mirrors of the analyser differ in their physical characteristics (e.g. size and/or shape). In one embodiment the shapes of the corresponding inner and/or outer field-defining electrode systems of the two mirrors differ so that they are not symmetrical in the z=0 plane. In such an embodiment the electrode systems may be continuous across the z=0 plane, or discontinuous. The term abut in this context does not necessarily mean that the mirrors physically touch but may instead lie closely adjacent to each other.

Alternatively or in addition, in other embodiments the one or more belt electrode assemblies which preferably support the arcuate focusing lenses may be located at a position not centred on the z=0 plane, i.e. not on the equator but rather offset therefrom. In these embodiments the flight path within one of the mirrors differs from the flight path within the other mirror, causing the beam to pass through each arcuate focusing lens twice. In embodiments in which identical mirrors are opposed, the distance between the turning point in one mirror and the arcuate focusing lenses differs from the distance between the turning point in the other mirror and the arcuate focusing lenses, as the lenses are displaced from the z=0 plane towards the turning point of one of the mirrors. Embodiments in which the arcuate lenses are displaced as just described are termed offset lens embodiments.

In a further embodiment, one of the mirrors may be of shorter longitudinal (z) length than the other mirror making the distance from the turning point in the one mirror to the plane z=0 where the arcuate lenses are located shorter than the corresponding distance in the other mirror, also causing the beam to pass through each arcuate focusing lens twice.

In a still further embodiment, different potentials may be applied to the corresponding inner and/or outer field-defining electrode systems of each mirror, the mirrors themselves being structurally symmetrical. Alternatively, the structures of the opposing mirrors may also not be symmetrical. For example, a first of the mirrors may comprise a single inner and a single outer electrode, forming the inner and outer field-defining electrode systems of the one mirror respectively, whilst the second mirror may comprise a set of disc electrodes forming the inner field-defining electrode system and a set of ring electrodes forming the outer field-defining electrode system of the second mirror. In one mode of operation giving a first main flight path length, a suitable set of one or more voltages is applied to the electrodes of the two mirrors so that the beam undergoes the same angle of orbital motion in each of the two mirrors, the beam passing through a different arcuate lens after each reflection, and in a second mode of operation which employs the present invention giving a second flight path length approximately twice the distance of the first flight path length, a second different set of potentials is applied to the electrodes of one of the mirrors so that the angle of orbital motion in one mirror differs from the angle of orbital motion in the other mirror, causing the beam to pass through the same arcuate lens twice. Hence both the structures of the mirrors and the potentials applied may be asymmetrical.

The analyser employing opposing mirrors that differ either in their physical characteristics (size and/or shape for example) or in their electrical characteristics or both so as to produce asymmetric mirror fields, is herein described as having asymmetric mirrors. It will be understood from the description above, that it is the asymmetry of the opposing electric fields within the analyser that is common to these embodiments.

An analyser with a combination of asymmetric mirrors and offset lens features may also be used to work the invention.

The asymmetric mirrors and/or offset lens embodiments [of the present invention] may be applied to various types of opposing mirror analysers that employ orbital particle motion about an analyser axis, not limited to opposed linear electric fields oriented in the direction of the analyser axis. Preferably the asymmetric mirrors and/or offset lens embodiments are utilised in an analyser having opposed linear electric fields oriented in the direction of the analyser axis. In a preferred embodiment the asymmetric mirrors and/or offset lens embodiments [of the present invention] are employed in an analyser utilising a quadro-logarithmic potential.

In the present invention injection of ions to the analyser is achieved by preferably locating an injector near to the plane of the lowest axial electric field, (i.e. the z=0 plane) within the device where, as already described, the axial electric field is lowest and fewest aberrations are introduced to disturb the time focusing. However, other injection locations are envisaged and will be described. The term injector herein means one or more components for injecting the charged particles onto the main flight path through the analyser (for example one or more of a pulsed ion source, an orthogonal accelerator, an ion trap and the like, together with any associated beam deflectors, electrical sectors and the like,) optionally via an external and/or an internal injection trajectory as herein described. In some embodiments, a pulsed source of charged particles can be used to select a mass range within the initial packet of ions by using a degree of TOF separation as the particles travel along the external and/or internal injection trajectories to the main flight path.

The term internal injection trajectory used herein refers to a trajectory on injection that is within the analyser volume, and before the main flight path through the analyser. The injection trajectory thus begins where the beam enters the analyser volume. In some embodiments there may be substantially no internal injection trajectory for the particles, e.g. if the particles are injected directly onto the main flight path from outside the analyser volume. As previously described, the main flight path preferably comprises a reflected flight path between the two opposing mirrors. The main flight path of the beam between the two opposing mirrors lies radially between the inner and outer field-defining electrode systems, i.e. in the analyser volume. Additional electrodes may also form one or more of the inner and outer field-defining electrode systems where their function is to produce the main analyser field or inhibit distortion of the main analyser field. For example, an array of electrode tracks, resistive coating or other electrode means for inhibiting distortion of the main analyser field may be used as part of the structure of the outer field-defining electrode system, e.g. where that electrode system waists-in near the equator, e.g. in order that it may support an outer belt electrode assembly, as will be further described. In such a case the array of electrode tracks, resistive coating or other electrode means form part of the outer or inner field-defining electrode system of the mirror to which they relate.

The two opposing mirrors in use define a main flight path for the charged particles to take. A preferred motion of the beam along its flight path within the analyser is a helical motion around the inner field-defining electrode system. The beam flies along the main flight path through the analyser back and forth in the direction of the longitudinal axis in a helical path which moves around the longitudinal axis (i.e. in the arcuate direction) in the z=0 plane. The main flight path is a stable trajectory that is followed by the charged particles when predominantly under the influence of the main analyser field. In this context, a stable trajectory means a trajectory that the particles would follow indefinitely if uninterrupted (e.g. by deflection), assuming no loss of the beam through energy dissipation by collisions or defocusing. Preferably a stable trajectory is a trajectory followed by the ion beam in such a way that small deviations in initial parameters of ions result in beam spreading that remains small relative to the analyser size over the entire length of the trajectory. In contrast, an unstable trajectory means a trajectory that the particles would not follow indefinitely if uninterrupted assuming no loss of the beam through energy dissipation by collisions or defocusing. The main flight path accordingly, does not comprise a flight path of progressively decreasing or increasing radius. However the main flight path may comprise a path which oscillates in radius, e.g. an elliptical trajectory when viewed along the analyser axis. The main analyser field is generated when the inner and outer field defining electrode systems of each mirror are given a first set of one or more voltages. The term first set of one or more voltages herein does not mean that the set of voltages is the first to be applied in time (it may or may not be the first in time) but rather it simply denotes that set of voltages which is given to the inner and outer field-defining electrode systems to make the charged particles follow the main flight path. The main flight path is the path on which the particles spend most of their time during their flight through the analyser.

As described herein, in some preferred embodiments, at the transition between internal injection trajectory and the main flight path, the ions need to be deflected in the radial direction r in order to change their velocity component in the z direction. This deflection will typically tilt the temporal focal plane of the particles in the beam. This aberration can not be easily corrected at the exit of the beam from the analyser and/or at a detector. Instead, the tilt is preferably corrected immediately. Thus, in some preferred embodiments, the ion source and/or injector is tilted with respect to a plane of constant z (i.e. a plane normal to the z axis), such as the z=0 plane, so that after the deflection upon commencing the main fight path from the internal injection trajectory, the temporal focal plane becomes normal to the z axis, i.e. parallel to the z=0 plane. During injection this tilting effect is not typically too large because the radius of the beam is relatively small and in some embodiments correction may not be required. Similarly, during ejection from the main flight path to the internal ejection trajectory, the temporal focal plane is typically tilted with respect to a plane of constant z by the deflectors on the main flight path. In this case, the detector for example is then preferably tilted to the correct angle in order to match the tilt of tilted temporal focal plane, i.e. so that the detector plane and the temporal focal plane are substantially co-located.

In preferred embodiments, the path taken by the beam from the ion source to the analyser volume does not comprise a straight line of sight to avoid undesirable gas loading of the analyser volume from the typically higher pressure ion source. Instead, the path taken by the beam from the ion source to the analyser volume includes at least one deflection (e.g. to provide a kink or dog-leg etc.) to reduce the gas load into the analyser volume. The external injection trajectory thus preferably comprises at least one deflection of the beam. In one method of injection applicable to the present invention, the charged particles are injected from outside the analyser volume onto an internal injection trajectory, the internal injection trajectory being inside the analyser volume, and from thence onto a point on the main flight path. In some embodiments, at least a portion of the internal injection trajectory is traversed by the beam in the absence of the main analyser field. The absence of the main analyser field may be accomplished by: (i) shielding the internal injection trajectory from the main analyser field, (ii) giving a different set of one or more voltages from the first set of one or more voltages which generates the main analyser field (which different set of one or more voltages may comprise voltages at zero potential) to the field-defining electrode systems to generate an analyser electrical field within the analyser (which may be a field of zero strength) different to the main analyser field whilst the ions are upon the internal injection trajectory, or (iii) a combination of both (i) and (ii). The term main analyser field as used herein refers to the field produced within the analyser by the sets of one or more voltages applied to the field-defining electrode systems within which the charged particle beam moves or would move along the main flight path. In this type of injection method, preferably all the internal injection trajectory is provided in the absence of the main analyser field.

Other fields present within the analyser, such as the fields produced by one or more arcuate focusing lenses, for example, may remain on during the injection process, or may also be turned off.

In some embodiments where there is an absence of the main analyser field along the internal injection trajectory it will allow the charged particles to move in a substantially straight line along that portion of the internal injection trajectory that is provided in the absence of the main analyser field. In other embodiments of such types of injection, any remaining fields present in the analyser may cause the internal injection trajectory to deviate from a straight path but preferably the internal injection trajectory is substantially straight. Remaining fields may include fields produced by one or more arcuate lenses, additional beam deflectors or other ion optical devices, and any field due to potentials applied to the mirror inner and outer field-defining electrode systems that are not set to generate the main analyser field. In one preferred embodiment, the internal injection trajectory is entirely shielded from the main analyser field by the presence of an outer belt electrode assembly, the potentials applied to the mirror inner and outer field-defining electrode systems preferably being such as to produce the analyser field elsewhere within the analyser, and the internal injection trajectory is substantially straight.

Upon reaching or close to a point P where the internal injection trajectory reaches the main flight path, the charged particles experience the main analyser field. For example, in some embodiments where the main analyser has been switched off for the internal ijection trajectory the main analyser field may be switched on when the charged particles reach point P.

The charged particles may be deflected and/or accelerated by a charged particle device at or near point P. In some embodiments, the charged particles arrive at point P travelling in a direction such that they commence upon the main flight path without the need for deflection or acceleration. In other embodiments charged particle deflectors are used to alter the beam direction such that the main flight path is commenced. The term charged particle deflectors as used herein refer to any device that deflects the beam and includes for example pairs of plate electrodes, electrical sectors, rod and wire electrodes, mesh electrodes and magnetic deflectors. Preferably electric deflectors are used. Most preferably a pair of electrical deflection plates, one either side of the beam or an electrical sector are used, due to their favourable beam optical properties and compact size. The beam is preferably deflected by a deflector as it is injected onto the main flight path, more preferably by an electrical sector or mirror, wherein the exit aperture of the deflector (preferably sector or mirror) lies on the main flight path.

The beam may or may not be but preferably is deflected, which deflection may be in one or more of the z direction, radial r direction and arcuate direction. The deflection of the charged particles may be such as to change their velocity in the direction of the z axis, either to increase or decrease the velocity in that direction. The velocity in the direction of the z axis means the component of the particles' velocity in the direction of the z axis. An increase in the velocity in the direction of the z axis means the increase in the velocity in the direction of the z axis toward the first mirror which the charged particles enter on the main flight path. A decrease in the velocity in the direction of the z axis means the decrease in the velocity in the direction of the z axis toward the first mirror which the charged particles enter on the main flight path. In some preferred embodiments, the beam is preferably deflected in at least the z direction at point P. In some embodiments, In some embodiments, the charged particles arrive at point P with the correct radial velocity for commencing upon the main flight path without further radial deflection. However, in some preferred embodiments the charged particles may be deflected in the radial direction r such that the main flight path is commenced. The beam is preferably deflected in at least the radial direction r where the main flight path is commenced, e.g. where the internal injection trajectory starts at a different radial distance (radius) from the z axis than the main flight path. In some more preferred embodiments the beam is preferably deflected in at least the radial r and z directions at point P, i.e. optionally also deflected in the arcuate direction at point P. The deflection of the charged particles is preferably such as to change their velocity in the arcuate direction. The velocity in the arcuate direction means the component of the particles' velocity in the arcuate direction. The term charged particle accelerator as used herein refers to any device that changes either the velocity of the charged particles, or their total kinetic energy either increasing it or decreasing it. A charged particle accelerator could be used to change velocity of particles in any direction. The deflector or acceleration electrodes are energised at the time the beam of charged particles arrives, and may then be de-energised once the beam has been injected onto the main flight path, or have a different voltage applied.

The point P may be anywhere within the analyser upon the main flight path. In a preferred embodiment, point P lies at or near the z=0 plane. In another preferred embodiment point P lies at or near the maximum axial extent of the flight path along the longitudinal z axis.

The charged particles may enter the analyser onto the internal injection trajectory through an aperture in one or both of the outer field-defining electrode systems of the mirrors, or through an aperture in one or both of the inner field-defining electrode systems of the mirrors. The injector is preferably located outside the analyser volume. The injector may accordingly be located outside the outer field-defining electrode systems of the mirrors (i.e. outside the analyser volume), or within the inner field-defining electrode systems of the mirrors (i.e. outside the analyser volume). In some embodiments, the charged particles reach the point P by travelling on the internal injection trajectory which passes through an aperture in either the inner or outer belt electrode assembly. Locating the injector inside the inner field-defining electrode systems of the mirrors makes a more compact instrument, but has disadvantages in accessing the injector for service. Preferably the injector is located outside the outer field-defining electrode systems of the mirrors. More preferably the injector or a portion of the injector, which may include beam deflectors, electrical sectors and the like, is located outside the outer field-defining electrode systems of the mirrors but within the distance from the analyser axis of the maximum radial extent (i.e. of the widest part) of the outer field-defining electrode systems of the mirrors, preferably by being located outside and adjacent a waisted-in portion of at least one, preferably both, of the outer field-defining electrode systems of the mirrors, as will be further described.

When injecting charged particles, the packet of charged particles should preferably be as short as possible upon commencing its flight path through the analyser, and this preferably requires a source to be located as close as possible to the analyser, ideally within the analyser. The sum of the flight paths before entry to and after exit from the analyser—the flight path outside the analyser—should ideally be as short as possible or, more importantly, the time of flight of the charged particles whilst travelling these paths should be as short as possible so that the difference in the time of flight of particles of different mass to charge ratio is as small as possible. Utilising a waisted-in portion (i.e. a portion of reduced diameter) of the outer field-defining electrode systems of one or both the mirrors enables the time of flight between the injector and the point P upon the main flight path to be reduced. This is because the waisted in portion allows the outer field-defining electrode system to come closer to the main flight path thereby reducing flight time between injector and point P and allows the injector to be located correspondingly closer to the main flight path whilst remaining outside the analyser volume. In addition, the inward extent of the waisted-in portion may be used to support the outer belt electrode assembly. More preferably still, the outer belt electrode assembly in that embodiment may be used to support the at least one arcuate focusing lens. Therefore, in preferred embodiments of all injection types according to the invention, the outer field-defining electrode system of at least one, more preferably both, of the mirrors comprises a waisted-in portion. In some embodiments, the waisted-in portion does not need to extend all the way around the z axis but may instead extend only partially around the z axis. In some preferred embodiments, the waisted-in portion extends substantially completely around the z axis. Preferably, the waisted-in portion is located at or near the z=0 plane.

In some preferred embodiments of injection, the internal injection trajectory lies at a different distance (i.e. radial distance) from the z axis than the main flight path. The internal injection trajectory which lies at a different radial distance than the main flight path may lead radially inwards or radially outwards toward the main flight path but preferably leads radially inwards toward the main flight path (e.g. from the outer field-defining electrode toward the main flight path). The internal injection trajectory may have at least a portion which is substantially straight, e.g. where the straight portion is traversed in the absence of the influence of the main analyser field. In some embodiments, at least a portion of the injection trajectory may deviate from a straight path, i.e. is curved, e.g. where the curved portion is traversed under the influence of the main analyser field. The point where for example a straight shielded portion of the internal injection trajectory meets the curved portion of the internal injection trajectory may be anywhere within the analyser. In a preferred embodiment, this point lies at or near the z=0 plane. In another preferred embodiment this point lies at or near the maximum axial extent of the flight path along the longitudinal z axis.

The curved internal injection trajectory is traversed under the influence of an analyser field which may be the main analyser field or may be a different analyser field but which is not at the correct distance from the analyser axis for stable progression within the analyser.

In some preferred embodiments, the internal injection trajectory which is at a different radial distance from the z axis than the main flight path follows a spiral path around the z axis with either progressively decreasing distance from the analyser axis if the beam is injected from a distance from the analyser axis larger than that of the main flight path, or progressively increasing distance if the beam is injected from a distance from the analyser axis smaller than that of the main flight path. A spiral path may be produced by changing the voltages on the inner and/or outer field-defining electrode systems. In the case where the voltages on the inner and/or outer field-defining electrode systems are held constant the internal injection trajectory follows a non-circular path. The spiral or non-circular path of the internal injection trajectory leads the charged particles to the main flight path at a point P. The spiral or non-circular path on injection may go through a turning point in one of the mirrors.

Upon commencing the spiral or non-circular path of the internal injection trajectory at a point S, the charged particles experience an analyser field, which may or may not be the main analyser field. For example, in some embodiments the analyser field may be switched on when the charged particles reach point S. The charged particles may or may not be deflected and/or accelerated by a charged particle device at or near point S. In a preferred embodiment, the charged particles arrive at point S travelling in a direction such that they commence upon the spiral or non-circular path without the need for deflection or acceleration. In other embodiments charged particle deflectors are used to alter the beam direction such that the spiral or non-circular path is commenced. The deflection of the charged particles at the commencement of the spiral or non-circular path may be such as to change their velocity in the direction of the z axis, either to increase or decrease the velocity in that direction. Preferably the charged particles travel to the point S with the main analyser field switched on as this avoids the need for rapid electrical switching of high stability power supplies. Preferably the charged particles arrive at point S with the correct radial velocity for commencing upon the spiral or non-circular path without further radial deflection. However, in some embodiments the charged particles may be deflected in the radial direction r such that the spiral or non-circular path is commenced. The deflection of the charged particles at point S is preferably such as to change their velocity in the arcuate direction. The deflector or acceleration electrodes are energised at the time the beam of charged particles arrives at point S, and may then be de-energised once the beam has been injected onto the spiral or non-circular path.

The point S may be anywhere within the analyser. In a preferred embodiment, point S lies at or near the z=0 plane. In another preferred embodiment point S lies at or near the maximum axial extent of the flight path along the longitudinal axis.

In embodiments employing a spiral or non-circular path for all or a portion of the internal injection trajectory, at least upon reaching the point P upon the main flight path, the charged particles experience the main analyser field. The charged particles may or may not be deflected and/or accelerated by a charged particle device at or near point P as described above.

In some types of preferred embodiments, when at or near the point P, the kinetic energy of the particles is changed. This may be used for example where the internal injection trajectory is traversed under the influence of the main analyser field. In embodiments where the kinetic energy is so changed, the charged particles may traverse the internal injection trajectory in the presence of an injection analyser field, which may the same as or different from the main analyser field.

The charged particles may or may not be deflected by a charged particle deflector at or near point P. In a preferred embodiment, the charged particles arrive at point P travelling in a direction such that when they experience a change in their kinetic energy at that point, they commence upon the main flight path without the need for deflection. A change in the particles' kinetic energy is preferably employed when the injection analyser field is the same as the main analyser field. However, a change in the particles' kinetic energy may also be employed when the injection analyser field is different from the main analyser field. In other embodiments charged particle deflectors are used to alter the beam direction such that the main flight path is commenced.

Preferably, the charged particles are injected from outside the analyser volume into the analyser volume and travel along an internal injection trajectory to a point P on the main flight path in the presence of the main analyser field (i.e. the internal injection trajectory is traversed under the influence of the main analyser field) and/or while the main analyser field is on. In this method the internal injection trajectory is preferably made very short relative to the size of the analyser. In one embodiment, this method of injection may utilise the waisted-in portion of the outer field-defining electrode system of one or both the mirrors to reduce the flight path within the analyser before reaching point P (i.e. the internal injection trajectory) to a short length. Preferably, the charged particles are directed into the analyser volume through an aperture in the waisted-in portion. In some embodiments, the injector may be situated outside the analyser volume and charged particles for analysis may be directed through an aperture in the waisted-in portion of the outer field-defining electrode system of one or both of the mirrors, preferably to enter the analyser adjacent an outer belt electrode assembly. In that case, the beam progresses along the internal injection trajectory through an aperture in the outer belt electrode assembly and travels a short distance to point P on the main flight path. The distance between the waisted-in portion of the outer field-defining electrode system of one or both the mirrors and the outer belt electrode assembly may be very short relative to the size of the analyser, e.g. just long enough to sustain the electrical potential difference between the one or more outer field-defining electrode systems and the outer belt electrode assembly when held under vacuum. Thus, preferably, the inward extent of the waisted-in portion of the outer field-defining electrode system of one or both the mirrors lies in close proximity to the outer belt electrode assembly. Also the distance between the outer belt electrode assembly and the main flight path may be very short relative to the size of the analyser, e.g. less than a few percent of the z length of the analyser. At or near point P, the beam is deflected to commence upon the main flight path. In a preferred embodiment a deflector to effect said deflection is located on one or both of the outer belt electrode assembly and an inner belt electrode assembly or between them. The beam is deflected so as to decrease the inwardly radial velocity of the beam. Preferred deflectors are described elsewhere herein.

The charged particle beam may enter the analyser volume through an aperture in one or both of the outer field-defining electrode systems of the mirrors, or through an aperture in one or both of the inner field-defining electrode systems of the mirrors. The injector is preferably substantially located outside the analyser volume. The injector may accordingly be located outside the outer field-defining electrode systems of the mirrors, or inside the inner field-defining electrode systems of the mirrors. In some embodiments, the charged particles reach the point P by passing through an aperture in either the inner or outer belt electrode assembly. Preferably the injector is located outside the outer field-defining electrode systems of the mirrors. More preferably, at least a portion of the injector, is located outside the outer field-defining electrode system but within the maximum radial extent from the analyser axis of the outer field-defining electrode systems of the mirrors preferably by being located outside and adjacent a waisted-in portion of the outer field-defining electrode system of one or both mirrors, as will be further described.

In another embodiment, the injector is located on or is adjacent to the z axis of the analyser, inside the inner field-defining electrode system of one or both the mirrors. In that embodiment, the charged particles are injected through an aperture in the inner field-defining electrode systems of one or both the mirrors, preferably to enter the analyser adjacent an inner belt electrode assembly. The beam progresses along the injection trajectory through an aperture in the inner belt electrode assembly and travels a short distance to point P on the main flight path. The distance between the inner field-defining electrode system of one or both the mirrors and the inner belt electrode assembly may be very short relative to the size of the analyser, e.g. just long enough to sustain the electrical potential difference between the one or more inner field-defining electrode systems and the inner belt electrode assembly when held under vacuum. Also the distance between the inner belt electrode assembly and the main flight path may be very short relative to the size of the analyser, e.g. less than a few percent of the z length of the analyser. At or near point P, the beam is deflected to commence upon the main flight path. In a preferred embodiment a deflector to effect said deflection is located on one or both of an outer belt electrode assembly and the inner belt electrode assembly. The beam is deflected so as to reduce the amplitude of radial velocity of the beam.

Injecting the beam along an internal injection trajectory under the influence of the main analyser field has the advantage that no switching of the electrical potentials that create the main analyser field is necessary upon injection. Such switching would require fast control of what must subsequently be very stable power supplies, since for high mass resolution the main analyser field must be stable to a high degree for the duration of time the charged particles spend upon the main flight path prior to detection. Fast switching followed by highly stable output is technically difficult to achieve with electrical power supplies. The charged particles are able to follow a short injection trajectory (relative to the size of the analyser) in the presence of the main analyser field and reach a point P upon the main flight path and the charged particles do not suffer substantial deviation under the action of the main analyser field because the internal injection trajectory is short. The relatively short injection trajectory is made possible, for example by a waisted-in portion of the outer field-defining electrode system of one or both mirrors and/or by the presence of belt electrode assemblies which maintain the main analyser field in the region of point P and allow the outer and/or inner field-defining electrode systems of one or both mirrors to be very close to the main flight path in the vicinity of point P, reducing the length of the internal injection trajectory.

Various types of injector can be used with the present invention, including but not limited to pulsed laser desorption, pulsed multipole RF traps using either axial or orthogonal ejection, pulsed Paul traps, electrostatic traps, and orthogonal acceleration. Preferably, the injector comprises a pulsed charged particle source, typically a pulsed ion source, e.g. a pulsed ion source as aforementioned. Preferably the injector provides a packet of ions of width less than 5-20 ns. Most preferably the injector is a curved trap such as a C-trap, for example as described in WO 2008/081334. There is preferably a time of flight focus at the detector surface or other desired surface. To assist achievement of this, preferably the injector has a time focus at the exit of the injector. More preferably the injector has a time focus at the start of the main flight path of the analyser. If a time focus is not there, then the electrodes of the analyser are modified to ensure that the final time of flight focus is at the detector surface or other desired surface. This could be achieved, for example, by using additional time-focusing optics such as mirrors or electric sectors. Preferably, voltage on one or more belt electrode assemblies is used to finely adjust the position of the time focus. Preferably, voltage on belts is used to finely adjust the position of the time focus.

The present invention provides for ejecting and/or detecting particles from the beam from a TOF analyser, some preferred embodiments having a quadro-logarithmic potential distribution in the analyser, which may be symmetrical or near-symmetrical in the z=0 plane, enabling this type of analyser to be used as a multi-reflecting device, giving increased flight path length over prior art designs. In an ideal situation, the charged particle detector is preferably placed on the main flight path within the analyser. However many present-day detectors are bulky and at least some of the detector may need to be placed outside (i.e. at larger or smaller distance from the analyser axis than) the main flight path and even outside the field-defining electrode systems (i.e. outside the analyser volume) for reasons described below, and the ejection of charged particles to the detector is achieved by preferably locating an ejector, e.g. ejection electrodes, near to the plane of the lowest axial electric field (i.e. in the z direction), within the device where, as already described, the axial electric field is lowest and fewest aberrations are introduced to disturb the time focusing, i.e. near the z=0 plane. Herein, the term near the z=0 plane includes at the z=0 plane. Preferably, at least some of the ejector, e.g. ejection electrodes, is located between the inner and outer field-defining electrode systems, more preferably all the ejector is located between the inner and outer field-defining electrode systems. Preferably, at least some of the ejector, in certain embodiments all of the ejector, is located at or adjacent the main flight path, more preferably near the z=0 plane. The term ejector as used herein means any one or more components for ejecting the charged particles from the main flight path and optionally out of the analyser volume, for example one or more of ejection electrodes, deflectors, and the like.

Preferably, at least part, more preferably the entire detector is located within the maximum radial distance of the outer field-defining electrode systems from the analyser axis, at a larger distance from the analyser axis than the main flight path and near the z=0 plane. More preferably, at least part, more preferably the entire detector is located within the maximum radial distance of the outer field-defining electrode system from the analyser axis but outside the radial distance of a belt electrode assembly from the analyser axis which lies at a larger radial distance from the analyser axis than the main flight path, further preferably, near the z=0 plane. The belt electrode assembly may assist in shielding the main flight path from potentials applied to the detector. In embodiments where at least part of the detector, more preferably the entire detector is located within the maximum radial distance of the outer field-defining electrode system from the analyser axis, the at least part, more preferably the entire detector may be located outside the analyser volume, preferably outside and adjacent a waisted-in portion of the outer field defining electrode system of one or both of the mirrors as herein described. The detector is preferably preceded by post-acceleration electrodes increase the energy of the charged particles and hence efficiency of secondary electron emission.

A characteristic of the analyser of some embodiments of the present invention such as those having potential distributions described by equation (3), and in particular one having a quadro-logarithmic potential, is that a packet of charged particles introduced to the analyser and time-of-flight focused onto a plane z=a comes to a time focus after a number n of oscillations along the z axis, at $z=a\cdot(-1)^n$. If ions are injected into the analyser of the present invention at or near the z=0 plane, the time focus will also be at or near z=0, and ejection should therefore take place near to this plane in order to direct the ions onto the detector with the best time focus. Thus, any ejector, e.g. ejection electrode(s), in such embodiments should preferably be located near to the z=0 plane.

In embodiments having the parabolic potential distribution (i.e. linear field) in the z direction in the analyser volume, the plane $z=a\cdot(-1)^n$ not only forms the ideal detector location, but also forms the ideal detection plane since it is harmonic motion in the z axial direction only that is energy independent. However charged particle detectors with high sensitivity, preferably with single ion counting detection capability, utilise electric fields. Furthermore, some preferred detectors convert ions into electrons as an initial stage of the detection process using a conversion dynode. As is well known in the art, ion beams for detection are typically accelerated to high energies immediately before this conversion stage to increase the efficiency of the conversion process, which is particularly important for high mass ion detection. The post acceleration to these high energies is also preferably accomplished using electric fields. The presence of such electric fields used in the post acceleration and detection process would, if the detector system were placed within the analyser volume unshielded, seriously perturb the, e.g. quadro-logarithmic, potential distribution within the analyser. In one preferred embodiment it is preferred to locate the detector outside the analyser volume and eject ions out of the analyser volume for detection. In such embodiments, the detector may be located outside the outer field-defining electrode system or inside the inner field-defining electrode system of the mirrors, more preferably outside the outer field-defining electrode system. In one embodiment, the solution of the present invention is to locate the post acceleration electrodes for the detector and the detector outside and adjacent to the field-defining electrode systems (i.e. outside the outer field-defining electrode system and therefore outside the analyser volume), rather than within them, and eject ions out of the analyser volume for detection. In another embodiment, shielding is used to reduce field penetration from the post acceleration electrodes and/or from the detector from distorting the field within the mirrors unduly, with at least part of the detection system being located off the main flight path of ions within the analyser. The detector and/or post acceleration electrodes is/are preferably located off the main flight path to reduce their field penetration and influence on the main flight path, more preferably, they are located outside the analyser volume.

A further advantage of this approach comes from the consideration that the post acceleration electrodes and detection system are of finite size. The train of packets in the beam passing through the analyser of the present invention must pass within the analyser and reach the detector without being impeded during its main flight path. Ejection electrodes for example can be more readily designed to be incorporated within the analyser in such a way as to act only upon the train at the final pass through the analyser, and not to perturb parts of the train still at earlier passes as it does so. This is more difficult to achieve if the post acceleration electrodes and detector were to be incorporated into the analyser on the main flight path.

However, since the ideal detection plane is within the analyser, locating the detector outside the analyser volume, although it has the advantage of avoiding field perturbation within the analyser volume has the potential problem that it will tend to worsen the time focusing properties of the system if the detector is located too far away. A similar potential problem exists when injecting charged particles, since the packet of ions should be as short as possible upon commencing its flight path through the analyser, and this requires a pulsed source to be located as close as possible to the analyser. The combination of the flight paths before entry to and after exit from the analyser volume—the flight path outside the analyser volume—should ideally be as short as possible or, more importantly, the time of flight of the charged particles whilst travelling these paths should be as short as possible so that the difference in the time of flight of particles of different mass to charge ratio is as small as possible. The act of ejecting the particles from the analyser volume may also alter the time focal plane angle and possibly its flatness, the effects of which must be considered when designing and positioning the detector.

To mitigate potential problems with the time of flight outside the analyser, one or more of the charged particle injector, optional post acceleration electrodes and detector (preferably all of these) may be positioned just outside the radial distance from the analyser axis of the main flight path within the analyser volume, with one or more (preferably all) of these components within the maximum radial distance from the analyser axis of the outer field-defining electrode system of the analyser. This reduces the flight paths between the injector and main flight path, and between main flight path and detector. This is achieved preferably by waisting-in a portion of the outer field-defining electrode system of one or preferably both the mirrors in the vicinity of the point where the beam is injected into and ejected out of the analyser volume, as will be further described, and locating the injector, optional post acceleration electrodes and/or detector adjacent the waisted in portion just outside the outer field-defining electrode system (i.e. outside the analyser volume). The beam is then injected and/or ejected through an aperture in the waisted-in portion of the outer field-defining electrode system. The presence of a waisted-in portion of the outer field-defining electrode system of one or both the mirrors reduces the distance from a location just outside the analyser volume to the main flight path, enabling the injector, post acceleration electrodes and/or detector components to be positioned very close to the main flight path, preferably within the maximum radial distance of outer field-defining electrode system from the analyser axis. Belt electrode assemblies may also be incorporated to support the arcuate focusing lenses as described herein (which is preferable). Accordingly, preferably, one or more of the charged particle injector, the post acceleration electrodes and detector (preferably all) are positioned within the maximum radial distance of the outer field-defining electrode system from the analyser axis and outside the distance from the analyser axis of a belt electrode assembly which lies at a larger distance from the analyser axis than the flight path. Further preferably, one or more of the charged particle injector, the post acceleration electrodes and detector (preferably all) are positioned at $|z| << |zs|$ plane where zs is the turning point of ions along z. More preferably, one or more of the charged particle injector, the post acceleration electrodes and detector (preferably all) are positioned at or near the $z=0$ plane.

Fixed structures and/or time-dependent fields could be used for ejection. For example, the charged particles may be directed (ejected) from the main flight path by allowing the beam to enter a fixed structure which might have a deflection system inside. This structure generally extends along the internal and/or external ejection trajectory and preferably contains field-sustaining electrodes on the outside and equipotential surface(s) on the inside. In another embodiment the beam is accelerated off the main flight path using post acceleration electrodes (i.e. the ejector (e.g. deflector) comprises post acceleration electrodes), e.g. causing the beam to follow a path substantially tangential to the path it was on immediately prior to acceleration. In further embodiments a combination of non-accelerated ejection (e.g. deflection) and acceleration may be used. In all these cases the beam may then strike a conversion dynode preferably placed close to, and more preferably placed upon, the $z=0$ plane. Advantageously in these arrangements, the flight path length from the main flight path to the conversion dynode is very short and in the more preferred embodiments utilising beam acceleration, the flight time along this path is particularly short, improving the time focus. Alternatively, in other embodiments, the deflection and/or acceleration cause the beam to pass through an aperture in an outer belt electrode assembly (i.e. a belt electrode assembly located at a larger distance from the analyser axis than the flight path), and through a further aperture in the outer field-defining electrode system of one or both the mirrors, outside which are located the detection system which may comprise a conversion dynode and electron multiplier. This has the advantage of less space being occupied within the region of the main flight path, but the disadvantage of a longer flight path between the main flight path and the detector system. This flight path between the main flight path and the detector system can be substantially reduced by using a waisted-in portion of the outer field-defining electrode system of one or both the mirrors as described elsewhere herein.

If the ejector (e.g. deflector) or post acceleration electrodes are not energised, the beam begins to follow the main flight path once again to provide a closed path TOF with increased mass resolution. To prevent overlap of the train of packets on the closed path, the ejector (e.g. deflector) or post acceleration electrodes may be energised for a time period to eject a portion of the mass range out of the analyser. Optionally the portion ejected may be detected at a first mass resolution, or further processed, whilst a remainder of the mass range continues on the main flight path and is ejected to a detector later, at a second, higher, mass resolution, or further processed. Alternatively the first ejected portion may be discarded. It will be appreciated that the beam may be divided into any number of such portions as required, i.e. into two or more portions.

In a further ejection arrangement, the charged particles are initially ejected (e.g. deflected) from the main flight path (e.g. by a deflector or by acceleration electrodes), which in this context will be referred to as the first main flight path, so that the beam moves to a second main flight path at a larger or smaller radial distance from the analyser axis z. This second main flight path is preferably also a stable path within the analyser. At some point on this second main flight path the beam preferably encounters a detector, or optionally a further ejector (e.g. deflector) followed by a detector, which may include post acceleration electrodes.

In the case where the second main flight path is stable, the beam may traverse the analyser once again on the second main flight path, thereby substantially increasing the total flight path and enabling in some embodiments at least doubling the flight path length through the analyser thereby increasing resolution of the TOF separation without loss of the mass range associated with a closed path TOF. One or more additional belt electrode assemblies may be provided, e.g. to support additional arcuate lenses to focus the beam on the second main flight path. The additional belt electrode assemblies may support or be supported by belt electrode assemblies existing for the first main flight path, e.g. via a mechanical structure. Optionally, such additional belt electrode assemblies may be provided with field-defining elements protecting them from distorting the field at other points in the analyser. Such elements could be: resistive coatings, printed-circuit boards with resistive dividers and other means known in the art. Optionally, in addition to the second main flight path, the same principle may be applied to provide third or higher main flight paths if desired, e.g. by ejecting to the third main flight path from the second main flight path and so on. Optionally, after traversing the second main flight path, the beam may be ejected back to the first main flight path, e.g. to begin a closed path TOF.

The charged particles may be ejected from a point E on the main flight path onto an internal ejection trajectory, the internal ejection trajectory being inside the analyser volume.

In some embodiments at least a portion of the internal ejection trajectory is traversed by the beam in the absence of the influence of the main analyser field. The absence of the main analyser field may be accomplished by (i) shielding a volume surrounding the internal ejection trajectory from the main analyser field and locally changing the field inside the shielded volume, or (ii) applying a different set of one or more potentials to one or more of the inner and outer field-defining electrode systems (including applying zero potentials to some or all electrodes) than is applied to generate the main analyser filed, whilst the ions are upon the internal ejection trajectory, or a combination of both (i) and (ii). In such embodiments, preferably all the internal ejection trajectory is provided in the absence of the main analyser field.

Other fields present within the analyser, such as the fields produced by one or more arcuate focusing lenses, for example, may remain on during the ejection process, or may also be turned off.

In some embodiments, where there is an absence of the main analyser field along the internal ejection trajectory, it will allow the charged particles to move in a substantially straight line along that portion of the internal ejection trajectory that is provided in the absence of the main analyser field and in such embodiments preferably the internal ejection trajectory is substantially straight. In some embodiments any remaining fields present in the analyser may cause the ejection trajectory to deviate from a straight path. Remaining fields may include fields produced by one or more arcuate lenses, additional beam deflectors or other ion optical devices, and any field due to potentials applied to the mirror inner and outer field-defining electrode systems that are not set to generate the main analyser field. In one preferred embodiment of this type, the internal ejection trajectory is entirely shielded from the main analyser field by the presence of an outer belt electrode assembly, the set of potentials applied to the mirror inner and outer field-defining electrode systems preferably being such as to produce the main analyser field elsewhere within the analyser, and the internal ejection trajectory is substantially straight. In another embodiment of this type the internal ejection trajectory is entirely shielded from the main analyser field by the presence of an inner belt electrode assembly, the set of potentials applied to the mirror inner and outer field-defining electrode systems preferably being such as to produce the main analyser field elsewhere within the analyser, and the ejection trajectory is substantially straight. In still another embodiment of this type, the ejection trajectory is entirely shielded from the main analyser field by the presence of an inner and an outer belt electrode assembly, the set of potentials applied to the mirror inner and outer field-defining electrode systems preferably being such as to produce the analyser field elsewhere within the analyser, and the internal ejection trajectory is substantially straight.

The charged particles may or may not be deflected and/or accelerated, e.g. by a charged particle device such as a deflector or accelerator, at or near point E. In a preferred embodiment type, the charged particles are deflected and optionally accelerated at or near point E. In some embodiments, the charged particles arrive at point E travelling in a direction such that they commence upon the internal ejection trajectory without the need for deflection or acceleration, e.g. once they are in the absence of the main analyser electrical field. In other preferred embodiments charged particle deflectors are used to alter the beam direction such that the internal ejection trajectory is commenced. Most preferably a pair of electrical deflection plates, one either side of the beam, or an electrical sector are used, due to their favourable beam optical properties and compact size. The beam is preferably deflected by a deflector as it is ejected from the main flight path, more preferably by an electrical sector, wherein the entrance aperture of the deflector (preferably sector) lies on the main flight path.

The beam may or may not be but preferably is deflected on leaving the main flight path, which deflection may be in one or more of the z direction, radial r direction and arcuate direction. The deflection at or near point E of the charged particles to be ejected may be such as to change their velocity in the direction of the z axis, either to increase or decrease the velocity in that direction. An increase in the velocity in the direction of the z axis means to increase the velocity in the direction of the z axis toward the next mirror which the charged particles would enter on the main flight path if not ejected. A decrease in the velocity in the direction of the z axis means to decrease the velocity in the direction of the z axis toward the next mirror which the charged particles would enter on the main flight path if not ejected. In some preferred embodiments, the beam is preferably deflected in at least the z direction at point E. In some embodiments, the charged particles arrive at point E with the correct radial velocity for commencing upon the internal ejection trajectory without further radial deflection. However, in some preferred embodiments the charged particles may be deflected in the radial direction r at or near point E such that the ejection trajectory is commenced. The beam is preferably deflected in at least the radial direction r at point E, e.g. where the internal ejection trajectory is at a different radial distance (radius) from the z axis than the main flight path. In some more preferred embodiments the beam is preferably deflected in at least the radial r and z directions, or in at least the radial r and arcuate directions at point E. The deflection of the charged particles at or near point E is preferably such as to change their velocity in the arcuate direction. The deflector or acceleration electrodes are energised at the time the beam of charged particles arrives, and may then be de-energised once the beam has been directed onto the internal ejection trajectory. The point E may be anywhere within the analyser upon the main flight path. In a preferred embodiment, point E lies at or near the z=0 plane. In another preferred embodiment point E lies at or near the maximum axial extent of the flight path along the longitudinal axis.

The internal ejection trajectory may exit the analyser volume through an aperture in one or both of the outer field-defining electrode systems of the mirrors, or through an aperture in one or both of the inner field-defining electrode systems of the mirrors. The charged particles that follow the ejection trajectory may enter a receiver. As used herein, a receiver is any charged particle device that forms all or part of a detector or device for further processing of the charged particles. Accordingly the receiver may comprise, for example, a post accelerator, a conversion dynode, a detector such as an electron multiplier, a collision cell, an ion trap, a mass filter, an ion guide, a multipole device or a charged particle store. The receiver may be located at a distance from the analyser axis z that is outside the outer field-defining electrode systems of the mirrors, or inside the inner field-defining electrode systems of the mirrors. Locating the receiver inside the inner field-defining electrode systems of the mirrors makes a more compact instrument, but has disadvantages in accessing the receiver for service. Preferably, e.g. where the receiver is a device for further processing of the charged particles, the receiver is located outside the outer field-defining electrode systems of the mirrors. More preferably, e.g. where the receiver is a device that forms all or part of a detector for the charged particles, the receiver is located outside the outer field-defining electrode systems of the mirror but preferably within the maximum distance from the analyser axis of the outer field-defining electrode systems of the mirrors (e.g. outside and adjacent a waisted-in portion thereof).

In some preferred embodiments, the charged particles are ejected from the main flight path onto an internal ejection trajectory which lies at a different radial distance from the z axis than the main flight path. The internal ejection trajectory which lies at a different radial distance than the main flight path may lead radially outwards or radially inwards from the main flight path but preferably leads radially outwards from the main flight path (e.g. toward the outer field-defining electrode from the main flight path).

The internal ejection trajectory may have at least a portion which is substantially straight, e.g. where the straight portion is traversed by the beam in the absence of the main analyser field. In some embodiments, at least a portion of the internal ejection trajectory, especially an internal ejection trajectory which is at a different radial distance from the z axis than the main flight path may deviate from a straight path, i.e. may be curved, e.g. where the curved portion is traversed by the beam under the influence of the main analyser field. The curved path portion of the internal ejection trajectory is preferably traversed by the beam under the influence of an analyser field which may be the main analyser field or may be a different analyser field but which is not at the correct distance from the analyser axis for stable progression within the analyser.

In some preferred embodiments, the internal ejection trajectory which is at a different radial distance from the z axis than the main flight path follows a spiral path around the z axis with either progressively increasing radial distance from the analyser axis if ejected to an ejection trajectory which is at a distance from the analyser axis larger than that of the main flight path, or progressively decreasing distance from the analyser axis if ejected to an ejection trajectory which is at a radial distance from the analyser axis smaller than that of the main flight path. A spiral path may be produced by changing the voltages on the inner and/or outer field-defining electrode systems. In the case where the voltages on the inner and/or outer field-defining electrode systems are held constant the internal ejection trajectory follows a non-circular path. The spiral or non-circular path of the internal ejection trajectory leads the charged particles from the main flight path at a point E. The spiral or non-circular path on ejection may go through a turning point in one of the mirrors.

The charged particles of the beam may leave the spiral or non-circular path at a point W. The spiral or non-circular path of the internal ejection trajectory may, for example, lead to a non spiral or non-circular portion of the internal ejection trajectory at the point W, the charged particles may or may not be deflected and/or accelerated by a charged particle device at or near the point W. In some embodiments, the charged particles arrive at point W travelling in a direction such that there is no need for deflection or acceleration. In other preferred embodiments charged particle deflectors are used to alter the beam direction at point W. Most preferably a pair of electrical deflection plates, one either side of the beam or a sector are used, due to their favourable beam optical properties and compact size. The deflection of the charged particles at or near point W may such as to change their velocity in the direction of the z axis, either to increase or decrease the velocity in that direction. In some embodiments, the charged particles arrive at point W with the correct radial velocity for commencing the internal remainder of their ejection trajectory without further radial deflection. However, in some embodiments the charged particles may be deflected in the radial direction r at or near point W such that the remainder of their internal ejection trajectory is commenced. The charged particles are preferably deflected in the arcuate direction at or near W such that the remainder of their internal ejection trajectory is commenced. The deflector or acceleration electrodes are energised at the time the beam of charged particles arrives at point W, and may then be de-energised once the beam has been ejected onto the remainder of their internal ejection trajectory.

The point W may be anywhere within the analyser volume upon the trajectory. In a preferred embodiment, point W lies at or near the z=0 plane. In another preferred embodiment point W lies at or near the maximum axial extent of the flight path along the longitudinal axis.

In some types of preferred embodiments, the kinetic energy of the particles is changed at the point where the beam is ejected from the main flight path, i.e. when at or near the point E. This may be used for example where the internal ejection trajectory is traversed under the influence of the main analyser field. In embodiments where the kinetic energy is so changed, the charged particles may traverse the internal ejection trajectory in the presence of an ejection analyser field, which may the same as or different from the main analyser field.

The charged particles may or may not be deflected by a charged particle deflector at or near point E. In a preferred embodiment, the charged particles arrive at point E travelling in a direction such that either when they experience a change in their kinetic energy, they commence upon the internal ejection trajectory without the need for deflection. In other embodiments charged particle deflectors are used to alter the beam direction such that the internal ejection trajectory is commenced.

Preferably, the charged particles are ejected from a point E on the main flight path and travel along an internal ejection trajectory in the presence of the main analyser field (i.e. the internal ejection trajectory is traversed under the influence of the main analyser field) and/or while the main analyser field remains on. In this method the internal ejection trajectory is preferably made very short relative to the size of the analyser. In one embodiment, this method of ejection may utilise the waisted-in portion of the outer field-defining electrode system of one or both the mirrors to reduce the flight path within the analyser after leaving point E (i.e. the internal injection trajectory) to a short length. Preferably, the charged particles are directed out from the analyser volume through an aperture in the waisted-in portion. In some embodiments, the receiver of the charged particles (e.g. detector) may be situated outside the analyser volume and charged particles for analysis may be directed through an aperture in the waisted-in portion of the outer field-defining electrode system of one or both of the mirrors, preferably to leave the analyser adjacent an outer belt electrode assembly. In that case, the beam progresses along the internal ejection trajectory through an aperture in the outer belt electrode assembly and travels a short distance from point E on the main flight path. The distance between the waisted-in portion of the outer field-defining electrode system of one or both the mirrors and the outer belt electrode assembly may be very short relative to the size of the analyser, e.g. just long enough to sustain the electrical potential difference between the one or more outer field-defining electrode systems and the outer belt electrode assembly when held under vacuum. Thus, preferably, the inward extent of the waisted-in portion of the outer field-defining electrode system of one or both the mirrors lies in close proximity to the outer belt electrode assembly. Also the distance between the outer belt electrode assembly and the main flight path may be very short relative to the size of the analyser, e.g. less than a few percent of the z length of the analyser. At or near point E, the beam is preferably deflected to commence upon the internal ejection trajectory. In a preferred embodiment a deflector to effect said deflection is located on one or both of the outer belt electrode assembly and an inner belt electrode assembly or between them. The beam is deflected so as to increase the outwardly radial velocity of the beam. Preferred deflectors are described elsewhere herein.

The charged particle beam may leave the analyser volume through an aperture in one or both of the outer field-defining electrode systems of the mirrors, or through an aperture in one or both of the inner field-defining electrode systems of the mirrors. The receiver of the charged particles (e.g. detector) is preferably substantially located outside the analyser volume. The receiver may accordingly be located outside the outer field-defining electrode systems of the mirrors, or inside the inner field-defining electrode systems of the mirrors. In some embodiments, the charged particles leave the point E by passing through an aperture in either the inner or outer belt electrode assembly. Preferably the receiver is located outside the outer field-defining electrode system of the mirrors. More preferably, at least a portion of the receiver, is located outside the outer field-defining electrode system but within the maximum radial extent from the analyser axis of the outer field-defining electrode systems of the mirrors preferably by being located outside and adjacent a waisted-in portion of the outer field-defining electrode system of one or both mirrors, as will be further described.

In another embodiment, the receiver is located on or is adjacent to the z axis of the analyser, inside the inner field-defining electrode system of one or both the mirrors. In that embodiment, the charged particles are ejected through an aperture in the inner field-defining electrode systems of one or both the mirrors, preferably to leave the analyser adjacent an inner belt electrode assembly. The beam progresses along the ejection trajectory through an aperture in the inner belt electrode assembly and travels a short distance from point E on the main flight path. The distance between the inner field-defining electrode system of one or both the mirrors and the inner belt electrode assembly may be very short relative to the size of the analyser, e.g. just long enough to sustain the electrical potential difference between the one or more inner field-defining electrode systems and the inner belt electrode assembly when held under vacuum. Also the distance between the inner belt electrode assembly and the main flight path may be very short relative to the size of the analyser, e.g. less than a few percent of the z length of the analyser. At or near point E, the beam is preferably deflected to commence upon the internal ejection trajectory. In a preferred embodiment a deflector to effect said deflection is located on one or both of an outer belt electrode assembly and the inner belt electrode assembly. The beam is deflected so as to increase the inwardly radial velocity of the beam.

Ejecting the beam along an internal ejection trajectory in the presence of the main analyser field has the advantage that no switching of the electrical potentials that create the main analyser field is necessary upon ejection. The charged particles are able to follow a short ejection trajectory (relative to the size of the analyser) in the presence of the main analyser field from point E upon the main flight path and the charged particles do not suffer substantial deviation under the action of the main analyser field because the internal ejection trajectory is short. The relatively short ejection trajectory is made possible, for example by a waisted-in portion of the outer field-defining electrode system of one or both mirrors and/or by the presence of belt electrode assemblies which maintain the main analyser field in the region of point E and allow the outer and/or inner field-defining electrode systems of one or both mirrors to be very close to the main flight path in the vicinity of point E, reducing the length of the internal ejection trajectory.

Various types of detector can be used, including but not limited to electron multipliers and micro-channel plates. Preferably the detector can detect single ions. Preferably the detector has a dynamic range including the detection of single ions up to 1000 ions/mass peak/injection or more. Preferably the detector includes a conversion dynode to convert ions into electrons for further amplification. Most preferably the detector comprises a microchannel plate assembly or secondary electron multiplier, with floating or optically-decoupled collector. A multi-channel detection system could also be used. As used herein, the terms detector, detection system or detector system refer to all components required to produce a measurable signal from an incoming charged particle beam and may for example comprise conversion dynode and electron multiplying means. The signal produced from the detector by the incoming charged particle beam is preferably used to measure the flight times of the particles through the analyser. Additional detectors could be used for diagnostic purposes at certain points of the main flight path. For example, image current detection could be used to non-destructively monitor dynamics of intense ion packets. A charge amplifier could be used to diagnose ion losses, either by direct measurement or by measuring secondary electrons produced by ions.

As already described, in the present invention the charged particles undergo the same number of orbits around the analyser axis z before being ejected or detected. As the charged particles travel along the main flight path of the analyser they are separated according to their time of flight and, after undergoing the same number of orbits of the analyser axis z, they are ejected for detection. In some embodiments they are detected within the analyser volume. Alternatively in a preferred embodiment they are detected outside the analyser volume, more preferably within the maximum radial distance of the outer field-defining electrode system of one or both mirrors from the axis of the analyser (e.g. outside and adjacent a waisted-in portion of the outer field-defining electrode system of one or both the mirrors).

The focal plane of detection which is a temporal focal plane may be parallel to the z=0 plane, or tilted with respect to the z=0 plane. The focal plane may be curved or flat. In a preferred embodiment, the temporal focal plane is substantially flat. Preferably post acceleration is used to increase the kinetic energy of the charged particle beam prior to detection. Use of such post acceleration may alter the temporal focal plane angle, introducing or correcting a tilt with respect to the z=0 plane.

As noted above, in some embodiments charged particles are detected within the analyser volume. According to a further aspect of the present invention there is provided a method of monitoring a beam of charged particles comprising the steps of:

providing an analyser; causing a beam of charged particles to fly through the analyser and undergo within the analyser at least one full oscillation in the direction of an analyser axis (z) of the analyser whilst orbiting about the axis (z) along a main flight path; constraining the arcuate divergence of the beam as it flies through the analyser; and causing at least a part of the beam of charged particles to be deflected off the main flight path so that it impinges upon a detector within the analyser volume.

According to another aspect of the invention, there is provided a charged particle analyser comprising:

two opposing mirrors, each mirror comprising inner and outer field-defining electrode systems elongated along an axis z, the outer system surrounding the inner, defining therebetween an analyser volume, whereby when the electrode systems are electrically biased the mirrors create an electrical field comprising opposing electrical fields along z; at least one arcuate focusing lens for constraining the arcuate divergence of a beam of charged particles within the analyser volume whilst the beam orbits around the axis z along a main flight path; and a deflector arranged in use to deflect at least a part of the beam of charged particles off the main flight path so that it impinges upon a detector located within the analyser volume.

According to a still further aspect of the invention, there is provided a charged particle analyser comprising:

two opposing mirrors, each mirror comprising inner and outer field-defining electrode systems elongated along an axis, each system comprising one or more electrodes, the outer system surrounding the inner and defining therebetween an analyser volume; at least one arcuate focusing lens; a deflector located within the analyser volume and a detector located within the analyser volume.

In some embodiments the deflector may also comprise at least part of the detector, e.g. the deflector may comprise the electrode surface upon which ions impinge during the process of detection.

In embodiments in which either the temporal focal plane associated with the pulsed ion source and/or the temporal focal plane associated with the receiver lie outside the analyser volume, it may be necessary to compensate for the distance(s) between the temporal focal plane(s) and the analyser volume so that temporal focusing is correctly achieved on the temporal focal plane associated with the receiver. One method of compensation comprises shifting the distance between the opposing mirrors of the analyser which has the effect of displacing the temporal focal plane progressively within the analyser at each oscillation. The displacement of the mirrors may be set so that the net shift of the temporal focal plane causes charged particles to focus upon the temporal focal plane associated with the receiver. Alternatively or additionally, a further method comprises accelerating the charged particles during a part of their flight path through the analyser. Advantageously this may be achieved in the region near the z=0 plane as the charged particles pass between the belt electrode assemblies. The belt electrode assemblies may be biased appropriately so that the charged particles change their velocity in the z direction, either speeding up or slowing down, which also causes a shift in the location of the temporal focal plane within the analyser at each pass through the belt region.

Higher mass resolution may be achieved by the analysers of the present invention described herein by restricting the phase space of the injected ion packet. This may conveniently be achieved by introducing an aperture into the mass analyser that only allows a central portion of the beam to be transmitted, or it may be achieved by utilising defocusing lenses to expand outer portions of the beam so that they strike an existing beam restrictor, which may be any part of the analyser structure. One or more arcuate lenses may be used as defocusing lenses. In the former case, transmission loss would occur at all times the aperture is present. In the latter case the mass resolution and the associated transmission would be tuneable and switchable from one spectrum to another.

By limiting the transmitted beam in this way within the analyser, the portions of the beam that are trimmed away are the portions that degrade the mass resolution, whether due to excess energy spread, high angular divergence or non-optimal initial source location.

The analyser of the present invention may be coupled to an ion generating means for generating ions, optionally via one or more ion optical components for transmitting the ions from the ion generating means to the analyser of the present invention. Typical ion optical components for transmitting the ions include a lens, an ion guide, a mass filter, an ion trap, a mass analyser of any known type and other similar components. The ion generating means may include any known means such as EI, CI, ESI, MALDI, etc. The ion optical components may include ion guides etc. The analyser of the present invention and a mass spectrometer comprising it may be used as a stand alone instrument for mass analysing charged particles, or in combination with one or more other mass analysers, e.g. in a tandem-MS or $MS^n$ spectrometer. The analyser of the present invention may be coupled with other components of mass spectrometers such as collision cells, mass filters, ion mobility or differential ion mobility spectrometers, mass analysers of any kind etc. For example, ions from an ion generating means may be mass filtered (e.g. by a quadrupole mass filter), guided by an ion guide (e.g. a multipole guide such as flatapole), stored in an ion trap (e.g. a curved linear trap or C-Trap), which storage may be optionally after processing in a collision or reaction cell, and finally injected from the ion trap into the analyser of the present invention. It will be appreciated that many different configurations of components may be combined with the analyser of the invention. The present invention may be coupled, alone or with other mass analysers, with one or more another analytical or separating instruments, e.g. such as a liquid or gas chromatograph (LC or GC) or ion mobility spectrometer.

According to a further aspect of the present invention there is provided a time of flight mass analyzer comprising two opposing mirrors each mirror comprising inner and outer field-defining electrode systems elongated along an axis z, each inner field-defining electrode system comprising a plurality of spindle-like electrodes, the outer system surrounding the inner and defining therebetween an analyser volume.

Further to this aspect of the invention there is provided the time of flight mass analyzer as just described whereby when the electrode systems are electrically biased the mirrors create opposing electrical fields substantially linear along at least a portion of the length of the analyser volume along z.

According to a further aspect of the present invention there is provided a method of separating charged particles using an analyser, the method comprising the steps of:

causing a beam of charged particles to fly through the analyser and undergo within the analyser at least one full oscillation in the direction of an analyser axis (z) of the analyser whilst orbiting about or oscillating between one or more electrodes along a main flight path; constraining the arcuate divergence of the beam as it flies through the analyser; and separating the charged particles according to their flight time.

According to another aspect of the present invention there is provided a method of separating charged particles comprising the steps of:

providing an analyser comprising two opposing mirrors each mirror comprising inner and outer field-defining electrode systems elongated along an axis z, the outer system surrounding the inner, whereby when the electrode systems are electrically biased the mirrors create an electrical field comprising opposing electrical fields along z; and at least one arcuate focusing lens for constraining the arcuate divergence of a beam of charged particles within the analyser;

causing a beam of charged particles to fly through the analyser, reflecting from one opposing mirror to the other at least once whilst orbiting about or oscillating between one or more electrodes of the inner field-defining electrode systems and passing through the at least one arcuate focusing lens; and separating the charged particles according to their flight time.

According to still another aspect of the invention, there is provided a charged particle analyser comprising two opposing mirrors each mirror comprising inner and outer field-defining electrode systems elongated along an axis z, the outer system surrounding the inner, whereby when the electrode systems are electrically biased the mirrors create an electrical field comprising opposing electrical fields along z; and at least one arcuate focusing lens for constraining the arcuate divergence of a beam of charged particles within the analyser whilst the beam orbits about or oscillates between one or more electrodes of the inner field-defining electrode systems.

According to a further aspect of the present invention there is provided a method of separating charged particles comprising the steps of:

providing an analyser comprising two opposing mirrors each mirror comprising inner and outer field-defining electrode systems elongated along an axis z, each system comprising one or more electrodes, the outer system surrounding the inner and defining therebetween an analyser volume, whereby when the electrode systems are electrically biased the mirrors create an electrical field within the analyser volume comprising opposing electrical fields along z, the absolute strength along z of the electrical field being a minimum at a plane z=0;

causing a beam of charged particles to fly through the analyser, orbiting around or oscillating between one or more electrodes of the inner field-defining electrode systems within the analyser volume, reflecting from one mirror to the other at least once thereby defining a maximum turning point within a mirror; the strength along z of the electrical field at the maximum turning point being |X| and the absolute strength along z of the electrical field being less than |X|/2 for not more than ⅔ of the distance along z between the plane z=0 and the maximum turning point in each mirror;

separating the charged particles according to their flight times; and ejecting at least some of the charged particles having a plurality of m/z from the analyser or detecting the at least some of charged particles having a plurality of m/z, the ejecting or detecting being performed after the particles have undergone the same number of orbits around or oscillations between one or more electrodes of the inner field-defining electrode systems.

According to another aspect of the invention, there is provided a charged particle analyser comprising:

two opposing mirrors, each mirror comprising inner and outer field-defining electrode systems elongated along an axis z, each system comprising one or more electrodes, the outer system surrounding the inner and defining therebetween an analyser volume, whereby in use a beam of charged particles is caused to fly through the analyser, orbiting around or oscillating between one or more electrodes of the inner field-defining electrode systems within the analyser volume whilst reflecting from one mirror to the other at least once thereby defining a maximum turning point within a mirror and whereby when the electrode systems are electrically biased the mirrors create an electrical field within the analyser volume comprising opposing electrical fields along z, the absolute strength along z of the electrical field being a minimum at a plane z=0 and the strength along z of the electrical field at the maximum turning point being X and the absolute strength along z of the electrical field being less than |X|/2 for not more than ⅔ of the distance along z between the plane z=0 and the maximum turning point in each mirror; and an ejector or at least part of a detector located within the analyser volume for respectively ejecting out of the analyser volume or detecting within the analyser volume at least some charged particles from the beam, the at least some particles having a plurality of m/z, the ejecting or detecting being performed after the at least some particles have undergone the same number of orbits around or oscillations between one or more electrodes of the inner field-defining electrode systems.

The present invention provides in another independent aspect a method of separating charged particles comprising the steps of:

providing an analyser comprising two opposing mirrors each mirror comprising inner and outer field-defining electrode systems elongated along an axis z, each system comprising one or more electrodes, the outer system surrounding the inner and defining therebetween an analyser volume, whereby when the electrode systems are electrically biased the mirrors create in the analyser volume an electrical field comprising opposing electrical fields substantially linear along at least a portion of the length of the analyser volume along z;

causing a beam of charged particles to fly through the analyser, reflecting from one mirror to the other at least once whilst orbiting around or oscillating between one or more electrodes of the inner field-defining electrode systems within the analyser volume;

separating the charged particles according to their flight times; and ejecting at least some of the charged particles having a plurality of m/z from the analyser or detecting the at least some of charged particles having a plurality of m/z, the ejecting or detecting being performed after the particles have undergone the same number of orbits around or oscillations between one or more electrodes of the inner field-defining electrode systems.

The present invention provides in another independent aspect a charged particle analyser comprising:

two opposing mirrors, each mirror comprising inner and outer field-defining electrode systems elongated along an axis z, each system comprising one or more electrodes, the outer system surrounding the inner and defining therebetween an analyser volume, whereby when the electrode systems are electrically biased the mirrors create in the analyser volume an electrical field comprising opposing electrical fields substantially linear along at least a portion of the length of the analyser volume along z and whereby in use a beam of charged particles is caused to fly through the analyser, reflecting from one mirror to the other at least once whilst orbiting around or oscillating between one or more electrodes of the inner field-defining electrode systems within the analyser volume; and an ejector or at least part of a detector located within the analyser volume for respectively ejecting out of the analyser volume or detecting within the analyser volume at least some charged particles from the beam, the at least some particles having a plurality of m/z, the ejecting or detecting being performed after the at least some particles have undergone the same number of orbits around or oscillations between one or more electrodes of the inner field-defining electrode systems.

The present invention provides in another independent aspect a method of separating charged particles using an analyser comprising one or more inner field-defining electrode systems, each system comprising one or more electrodes, the method comprising:

causing a beam of charged particles to fly through the analyser and undergo within the analyser at least one full oscillation in the direction of a longitudinal (z) axis of the analyser whilst orbiting around or oscillating between one or more electrodes of the inner field-defining electrode systems;

wherein the charged particles fly with substantially constant velocity along z less than half of the overall time of the oscillation;

separating the charged particles according to their flight times; and ejecting at least some of the charged particles having a plurality of m/z from the analyser or detecting the at least some of charged particles having a plurality of m/z, the ejecting or detecting being performed after the particles have undergone the same number of orbits around or oscillations between one or more electrodes of the inner field-defining electrode systems.

The present invention provides in another independent aspect a charged particle analyser comprising:

two opposing mirrors, each mirror comprising inner and outer field-defining electrode systems elongated along an axis z, each system comprising one or more electrodes, the outer system surrounding the inner and defining therebetween an analyser volume, whereby when the electrode systems are electrically biased the mirrors create an electrical field within the analyser volume comprising opposing electrical fields along the z axis and whereby, in use, a beam of charged particles is caused to fly through the analyser, orbiting around or oscillating between one or more electrodes of the inner field-defining electrode systems within the analyser volume whilst undergoing at least one full oscillation between the mirrors in the direction of the z axis of the analyser wherein the charged particles fly with constant velocity along z less than half of the overall time of the oscillation; and an ejector or at least part of a detector located within the analyser volume for respectively ejecting out of the analyser volume or detecting within the analyser volume at least some charged particles from the beam, the at least some particles having a plurality of m/z, the ejecting or detecting being performed after the at least some particles have undergone the same number of orbits around or oscillations between one or more electrodes of the inner field-defining electrode systems.

The present invention provides in another independent aspect a method of time of flight analysis of charged particles comprising the steps of:

providing an analyser comprising two opposing mirrors each mirror comprising inner and outer field-defining electrode systems elongated along an axis z, each system comprising one or more electrodes, the outer system surrounding the inner and defining therebetween an analyser volume, whereby when the electrode systems are electrically biased the mirrors create opposing electrical fields substantially linear along at least a portion of the length of the analyser volume along z;

causing a beam of charged particles to fly through the analyser, reflecting from one mirror to the other at least once whilst orbiting around or oscillating between one or more electrodes of the inner field-defining electrode systems between the inner and outer electrode systems;

and measuring the flight time of the charged particles after the particles have undergone the same number of orbits around or oscillations between one or more electrodes of the inner field-defining electrode systems.

The present invention also provides in another independent aspect a method of isolating selected charged particles from a beam of charged particles, the method comprising the steps of:

providing an analyser comprising two opposing mirrors each mirror comprising inner and outer field-defining electrode systems elongated along an axis z, each system comprising one or more electrodes, the outer system surrounding the inner and defining therebetween an analyser volume, whereby when the electrode systems are electrically biased the mirrors create an electrical field within the analyser volume comprising opposing electrical fields along z, the strength along z of the electrical field being a minimum at a plane z=0;

causing a beam of charged particles to fly through the analyser, orbiting around or oscillating between one or more electrodes of the inner field-defining electrode systems within the analyser volume, reflecting from one mirror to the other at least once thereby defining a maximum turning point within a mirror; the strength along z of the electrical field at the maximum turning point being X and the absolute strength along z of the electrical field being less than $|X|/2$ for not more than ⅔ of the distance along z between the plane z=0 and the maximum turning point in each mirror; wherein the beam of charged particles includes selected charged particles of one or more m/z and further charged particles; and isolating the selected charged particles in the analyser volume by ejecting the further charged particles from the analyser after the further particles have undergone the same number of orbits around or oscillations between one or more electrodes of the inner field-defining electrode systems.

Additional embodiments of the invention utilise two opposing mirrors with the analyser field generated within the analyser volume by the application of potentials to electrode structures comprising two opposing outer field-defining electrode systems and two opposing inner field-defining electrode systems, wherein the inner field-defining electrode systems comprise a plurality of spindle-like electrode structures extending within the outer field-defining electrode systems. Each of the plurality of spindle-like structures extends substantially parallel to the z axis. In common with previously described embodiments, the field in the z direction is substantially linear and ion motion along the main flight path in the z direction is substantially simple harmonic. Ion motion orthogonal to the z direction may take a variety of forms, including: orbiting around one or more of the inner field-defining electrode spindle structures; and, oscillating between one or more pairs of the inner field-defining electrode spindle structures. The term orbiting around includes orbiting successively around each of a plurality of the inner field-defining electrode spindle structures one or more times and it also includes orbiting around a plurality of the inner field-defining electrode spindle structures in each orbit, i.e. each orbit encompasses more than one of the inner field-defining electrode spindle structures. The term oscillating between includes, (whilst executing substantially harmonic motion in a direction substantially parallel to the z axis), substantially linear motion in a plane perpendicular to the z axis and it also includes motion where such substantially linear motion rotates about the z axis producing a star-shaped beam envelope, which will be further described. The term oscillating between also includes motion where the ions remain approximately the same distance from each of two inner field-defining electrode spindle structures.

The above embodiments are particular solutions to the general equation $$U(x, y, z) = \frac{k}{2} \cdot z^2 + V(x, y) \tag{5a}$$

where k has the same sign as ion charge (e.g. k is positive for positive ions) and $$\Delta V(x, y) = -\frac{k}{2}. \tag{5b}$$

Specifically, solutions include $$U(x, y, z) = \sum_{i=1}^{N} A_i \cdot \ln(f_i(x, y)) + \frac{k}{2} \cdot (z^2 - (1-a) \cdot x^2 - a \cdot y^2) + W(x, y) \tag{6a}$$

where $$W(x, y) = \left(B \cdot r^m + \frac{D}{r^m}\right) \cdot \cos\left(m \cdot \cos^{-1}\left(\frac{x}{r}\right) + a\right) + E \cdot \exp(F \cdot x) \cdot \cos(F \cdot y + \beta) + G\exp(H \cdot y)\cos(H \cdot x + \gamma) + C \tag{6b}$$

and where $A_i$, B, C, D, E, F, G, H are real constants and each $f_i(x, y)$ satisfies $$F(x, y) = \frac{\left(\frac{d}{dx}(f(x, y))\right)^2 + \left(\frac{d}{dy}(f(x, y))\right)^2}{\frac{d^2}{dx^2}(f(x, y)) + \frac{d^2}{dy^2}(f(x, y))}. \tag{6c}$$

A particular solution being $$f(x, y) = (x^2+y^2)^2 - 2b^2(x^2-y^2) + b^4 \tag{6d}$$

where b is a constant (C. Köster, Int. J. Mass Spectrom. Volume 287, Issues 1-3, pages 114-118 (2009)).

Equations (6a-c) with the particular solution (6d) is satisfied by two opposing mirrors each mirror comprising inner and outer field-defining electrode systems elongated along an axis z, each system comprising one or more electrodes, the outer system surrounding the inner. The inner field-defining electrode systems each comprise one or more electrodes. The one or more electrodes include spindle-like structures extending substantially parallel to the z axis. Each spindle-like structure may itself comprise one or more electrodes. One of the spindle-like structures may be on the z axis. Additionally or alternatively, two or more of the spindle-like structures may be off the z axis, typically disposed symmetrically about the z axis.

Arcuate focusing may be accomplished in ways described above. Alternatively, for some embodiments in which there is a plurality of inner spindle-like structures, additional structures to induce arcuate focusing may not be required. Embodiments that provide this effect include the case where there are, in equations (6a-c), N terms of $f_i(x,y)$ and where b is $b_i$ with different values between 0 and 1, providing 2N spindle-like structures as inner field-defining electrode systems, within a single outer field-defining electrode system. Charged particles that are directed to oscillate between two electrodes of the inner field-defining electrode systems, i.e. between two of the spindle-like structures, passing through or close to the z axis, and arriving between a further two spindle-like structures, may so arrive with a small angular offset. The angular offset progressively adds on further oscillations causing the plane of oscillation (of motion perpendicular to the z axis) to shift around the z axis, producing a star-shaped beam envelope. This form of motion also at the same time prevents the beam from expanding in the arcuate direction.

The two opposing mirrors may be asymmetric in ways as described above. Injection, ejection and detection of charged particles may include methods described above.

Some embodiments of the present invention benefit from the further advantage that charged particles are transported through the TOF analyser coherently, enabling TOF imaging to be performed, or allowing a beam of charged particles comprising multiple beams from different starting locations to be sent through the analyser, overlapping in time, but following different paths to arrive at different locations at a detector plane, thereby increasing the throughput of the analyser. The detector plane may be flat or curved. A detection system may be employed to either image the charged particles or provide detection facilities at locations where the different multiple beams of charged particles will arrive. In both cases the detection system distinguishes between charged particles that started from different locations. This characteristic provides immediate application for MALDI sources but is not so limited.

Focusing occurs in both planes perpendicular to the main flight path in contrast to that of most prior art TOF analysers in which focusing occurs in one plane only. In the analysers of the present invention, focusing in both planes is produced by the inherent radial focusing properties of the field together with arcuate focusing by means already described. A further advantage when operating in this way is the absence of grids in the analysers of the present invention.

According to a further aspect of the present invention there is provided a method of separating charged particles using an analyser, the method comprising the steps of:

causing a beam of charged particles to fly through the analyser and undergo within the analyser at least one full oscillation in the direction of an analyser axis (z) of the analyser whilst orbiting about or oscillating between one or more electrodes along a main flight path; constraining the arcuate divergence of the beam as it flies through the analyser; and separating the charged particles according to their flight time;

wherein the beam of charged particles comprises charged particles that have originated at different starting locations, and wherein a position-sensitive detection system receives at least some of the charged particles, distinguishing between those that started from different locations.

According to still another aspect of the invention, there is provided a charged particle analyser comprising two opposing mirrors each mirror comprising inner and outer field-defining electrode systems elongated along an axis z, the outer system surrounding the inner, whereby when the electrode systems are electrically biased the mirrors create an electrical field comprising opposing electrical fields along z; at least one arcuate focusing lens for constraining the arcuate divergence of a beam of charged particles within the analyser whilst the beam orbits about or oscillates between one or more electrodes of the inner field-defining electrode systems; and a position-sensitive detection system.

In a further independent aspect of the present invention there is provided a method of inhibiting the distortion of an electrostatic field within a first volume of space of a mass analyser due to the presence of a nearby charged object, the charged object distorting the electrostatic field within a second volume of space within the mass analyser, comprising the steps of:

a) substantially surrounding the second volume of space by one or more surfaces located within the mass analyser, at least one of the said surfaces being disposed between the second volume of space and the first volume of space;

b) providing a plurality of electrical tracks upon the one or more surfaces, the tracks substantially following electrical equipotential lines which would be created by the electrostatic field in the absence of the one or more surfaces, the tracks and the charged object;

c) applying to the tracks electrical potentials substantially equal to the electrical potentials of the electrical equipotential lines.

In the absence of the surfaces and tracks with applied potentials as described, the distortion of the electrostatic field within the second volume of space would extend into the first volume of space, undesirably distorting the electrostatic field within the analyser within the first volume of space.

In some embodiments the charged object is located within the mass analyser. In some embodiments the second volume of space abuts a boundary of the mass analyser. Preferably the electrostatic field is due to a quadro-logarithmic potential distribution within the analyser. Preferably the mass analyser is a TOF mass analyser or an electrostatic trap. More preferably the mass analyser comprises opposing electrostatic mirrors. The one or more surfaces may be substantially flat; alternatively the one or more surfaces may be curved or folded or a combination thereof. Preferably the one or more surfaces extends over 2 or more orthogonal planes. Preferably the one or more surfaces comprises four or more surfaces. Preferably the one or more surfaces faces into the first volume of space. The one or more surfaces may contain one or more apertures to allow charged particles or gas to be transmitted therethrough. The one or more surfaces may be insulating or semiconducting. The electrical tracks may be formed of metalized deposits applied to local areas of the surface. Preferably the surface between at least some of the electrical tracks is covered by a resistive coating. Preferably the charged object comprises an ion optical device. More preferably the charged object comprises a detector or a source of charged particles.

DETAILED DESCRIPTION

In order to more fully understand the invention, various embodiments of the invention will now be described by way of examples only and with reference to the Figures. The embodiments described are not limiting on the scope of the invention.

DESCRIPTION OF FIGURES

One preferred embodiment of the present invention utilises the quadro-logarithmic potential distribution described by equation (1) as the main analyser field.

Figure 1A:
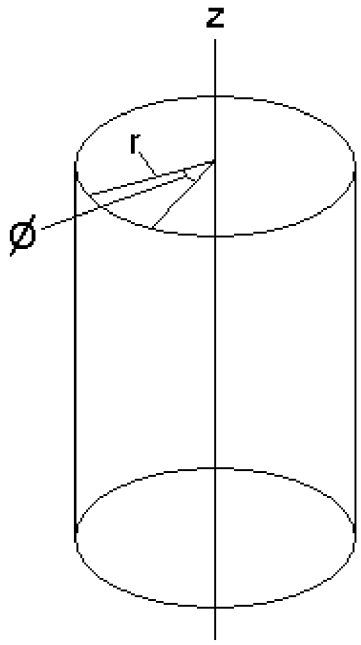
FIG. 1 shows the coordinate system used to describe features of the present invention and the z dependence of the of the electric field strength.
Figure 1B:
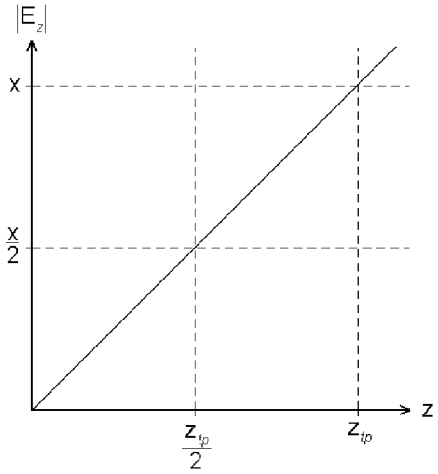
Figure 1C:
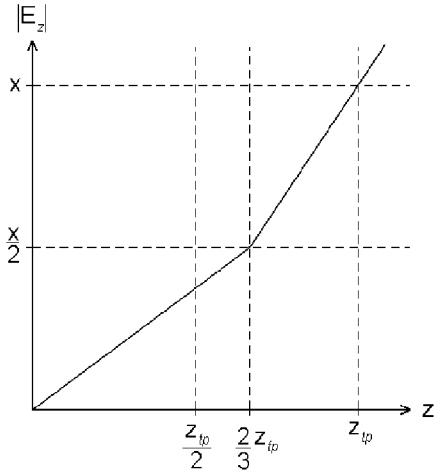
Figure 1D:
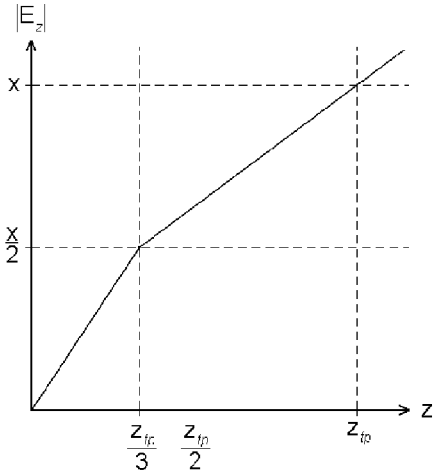
Figure 1E:
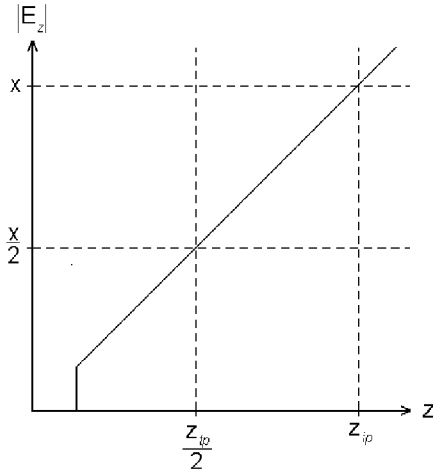
Figure 2A:
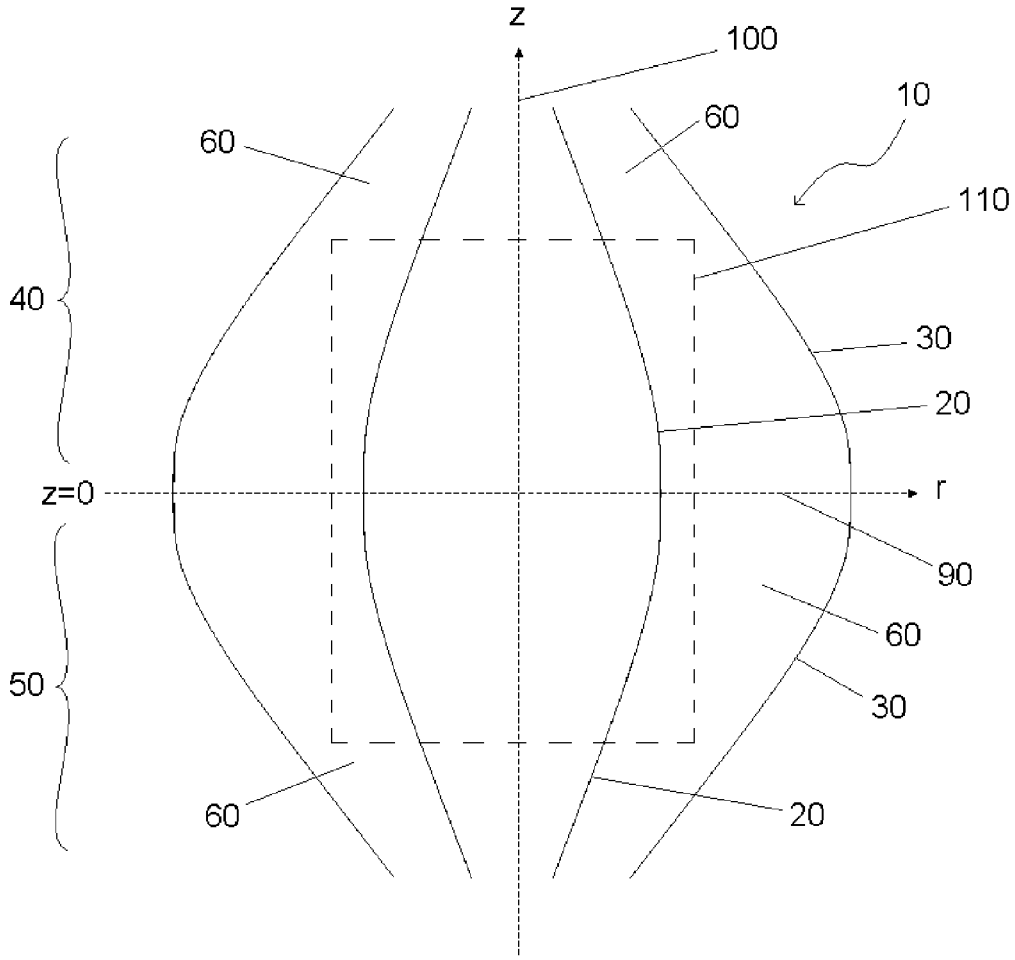
FIG. 2*a* is a schematic cross sectional side view of the electrode structures for such a preferred embodiment. Analyser 10 comprises inner and outer field-defining electrode systems, 20, 30 respectively, of two opposing mirrors 40, 50. The inner and outer field-defining electrode systems in this embodiment are constructed of gold-coated glass. However, various materials may be used to construct these electrode systems: e.g. Inver; glass (zerodur, borosilicate etc) coated with metal; molybdenum; stainless steel and the like. The inner field-defining electrode system 20 is of spindle-like shape and the outer field-defining electrode system 30 is of barrel-like shape which annularly surrounds the inner field-defining electrode system 20. The inner field-defining electrode systems 20 and outer field-defining electrode systems 30 of both mirrors are in this example single-piece electrodes, the pair of inner electrodes 20 for the two mirrors abutting and electrically connected at the z=0 plane, and the pair of outer electrodes for the two mirrors also abutting and electrically connected at the z=0 plane, 90. In this example the inner field-defining electrode systems 20 of both mirrors are formed from a single electrode also referred to herein by the reference 20 and the outer field-defining electrode systems 30 of both mirrors are formed from a single electrode also referred to herein by the reference 30. The inner and outer field-defining electrode systems 20, 30 of both mirrors are shaped so that when a set of potentials is applied to the electrode systems, a quadro-logarithmic potential distribution is formed within the analyser volume located between the inner and outer field-defining electrode systems, i.e. within region 60. The quadro-logarithmic potential distribution formed results in each mirror 40, 50 having a substantially linear electric field along z, the fields of the mirrors opposing each other along z. The shapes of electrode systems 20 and 30 are calculated using equation (1), with the knowledge that the electrode surfaces themselves form equipotentials of the quadro-logarithmic form. Values for the constants k, C and $R_m$ are chosen and the equation solved for one of the variables r or z as a function of the other variable z or r. A value for one of the variables r or z is chosen at a given value of the other variable z or r for each of the inner and outer electrodes and the solved equation is used to generate the dimensions of the inner and outer electrodes 20 and 30 at other values of r and z, defining the inner and outer field-defining electrode system shapes.

For illustration, in one example of an analyser as shown schematically in FIG. 2*a*, the analyser has the following parameters. The z length (i.e. length in the z direction) of the electrodes 20, 30 is 380 mm, i.e. +/−190 mm about the z=0 plane. The maximum radius of the inner surface of the outer electrode 30 lies at z=0 and is 150.0 mm. The maximum radius of the outer surface of the inner electrode 20 also lies at z=0 and is 95.0 mm. The outer electrode 30 has a potential of 0 V and the inner electrode 20 has a potential of −2587 V in order to generate the main analyser electrical field in the analyser volume under the influence of which the charged particles will fly through the analyser volume as herein described. The voltages given herein are for the case of analysing positive ions. It will be appreciated that the opposite voltages will be needed in the case of analysing negative ions. The values of the constants of equation (1) are: $k=1.42*10^5 V/m^2$, $R_m=307.4$ mm, C=0.0.

The inner and outer field-defining electrode systems 20, 30 of both mirrors are concentric in the example shown in FIG. 2*a*, and also concentric with the analyser axis z 100. The two mirrors 40, 50 constitute two halves of the analyser 10. A radial axis is shown at the z=0 plane 90. The analyser is symmetrical about the z=0 plane. For a TOF analyser of this size able to achieve high mass resolving power such as 50,000, the alignment of the mirror axes with each other should be to within a few hundred microns in displacement and between 0.1-0.2 degrees in angle. In this example, the accuracy of shape of the electrodes is within 10 microns. Ions would travel on a stable flight path through the analyser even at much higher misalignment but the mass resolving power would reduce.

Figure 2B:
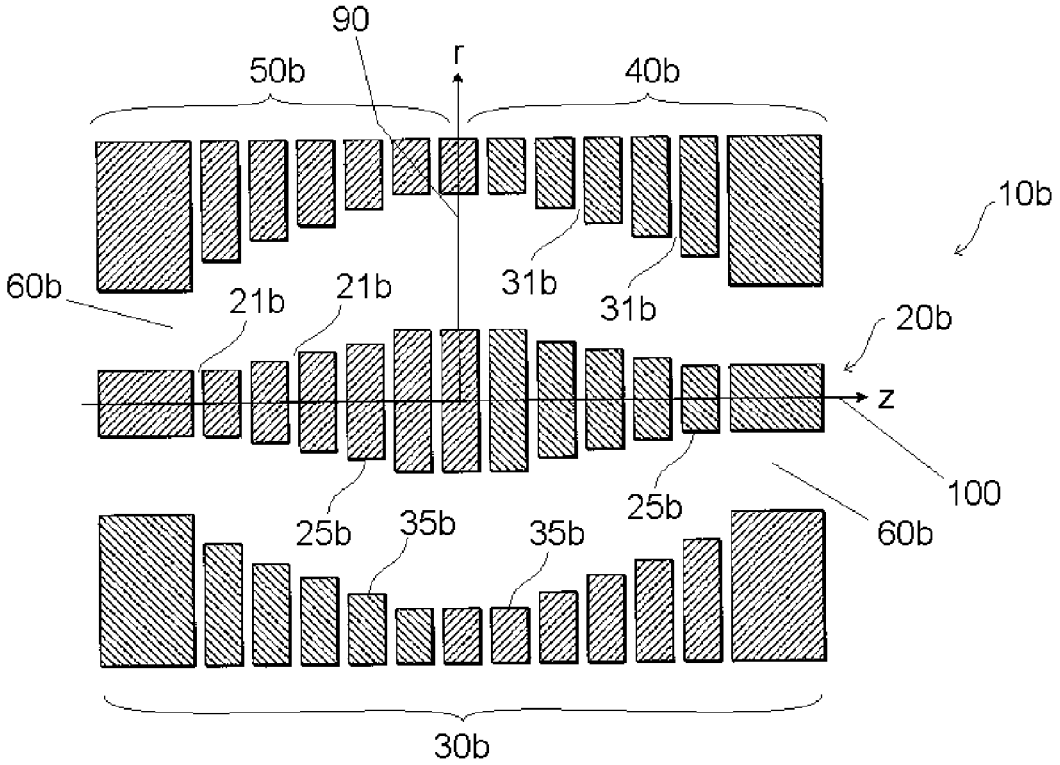
FIG. 2 shows schematic views of the electrode structures for various embodiments of the invention.

FIG. 2*b* shows another embodiment of the present invention which also utilises the quadro-logarithmic potential distribution described by equation (1) as the main analyser field. FIG. 2*b* is a schematic cross-sectional side view of the electrode structures for such an embodiment, where like features have the same identifiers as in FIG. 2*a*. Analyser 10*b* comprises inner and outer field-defining electrode systems, 20*b*, 30*b* respectively, of two opposing mirrors 40*b*, 50*b*.

Herein, where features have the same or a similar function, they may be identified by the same numerical identifier, but where they may differ in their form the identifier contains an additional letter; for example the analyser 10*b* of FIG. 2*b* has a similar function to the analyser 10 of FIG. 2*a*, but has a different form.

The inner and outer field-defining electrode systems of FIG. 2*b* are constructed of sets of metal electrodes. The inner field-defining electrode system comprises an axially extending row of discs 25*b*, and the outer field-defining electrode system comprises a set of rings 35*b* assembled in an axially extending row co-axial with the discs 20*b* and coaxial with the analyser axis 100, the outer ring electrodes 35*b* surrounding the inner discs 25*b*. The outer diameters of the discs 25*b* are not of equal size, but instead approximately follow the profile of the outer diameter of the spindle-shaped single piece inner field-defining electrode system 20 shown in FIG. 2*a*. Likewise the internal diameters of the ring electrodes 35*b* approximately follow the profile of the internal diameter of the barrel-shaped single piece outer field-defining electrode system 30 of FIG. 2*a*. The inner and outer field-defining electrode systems 20*b*, 30*b* of both mirrors are shaped so that when potentials are applied to the electrode systems, a quadro-logarithmic potential distribution is formed within the analyser between the inner and outer field-defining electrode systems, within region 60*b*. The quadro-logarithmic potential distribution formed results in each mirror 40*b*, 50*b* having a substantially linear electric field along z, the fields of the mirrors opposing each other along z. The shapes of the discs and rings of electrode systems 20*b* and 30*b* respectively allow a set of electrical potentials comprising only a single potential applied to all discs 25*b* and another single potential applied to all rings 35*b* to generate the quadro-logarithmic potential distribution within volume 60*b*. Due to the discrete nature of the discs 25*b* and rings 35*b* that form the electrode systems, the quadro-logarithmic potential distribution within volume 60*b* will not be perfect. The more discs that comprise the inner field-defining electrode system 20*b* and rings that comprise the outer field-defining electrode system 30*b*, the better the quadro-logarithmic potential distribution within volume 60*b*. Generally, the smaller the imperfections of the potential distribution within volume 60*b*, the higher the maximum mass resolution achievable by the analyser. Small gaps 31*b* and 21*b* are left between each ring electrode 35*b* and between each disc electrode 25*b* respectively. These gaps are preferably at least two to three times smaller than the distance to the nearest point upon the main flight path. The construction of analyzer 10*b* in FIG. 2*b* has the advantage that the inner and outer field-defining electrode systems may be formed using simple machining methods.

Figure 2C:
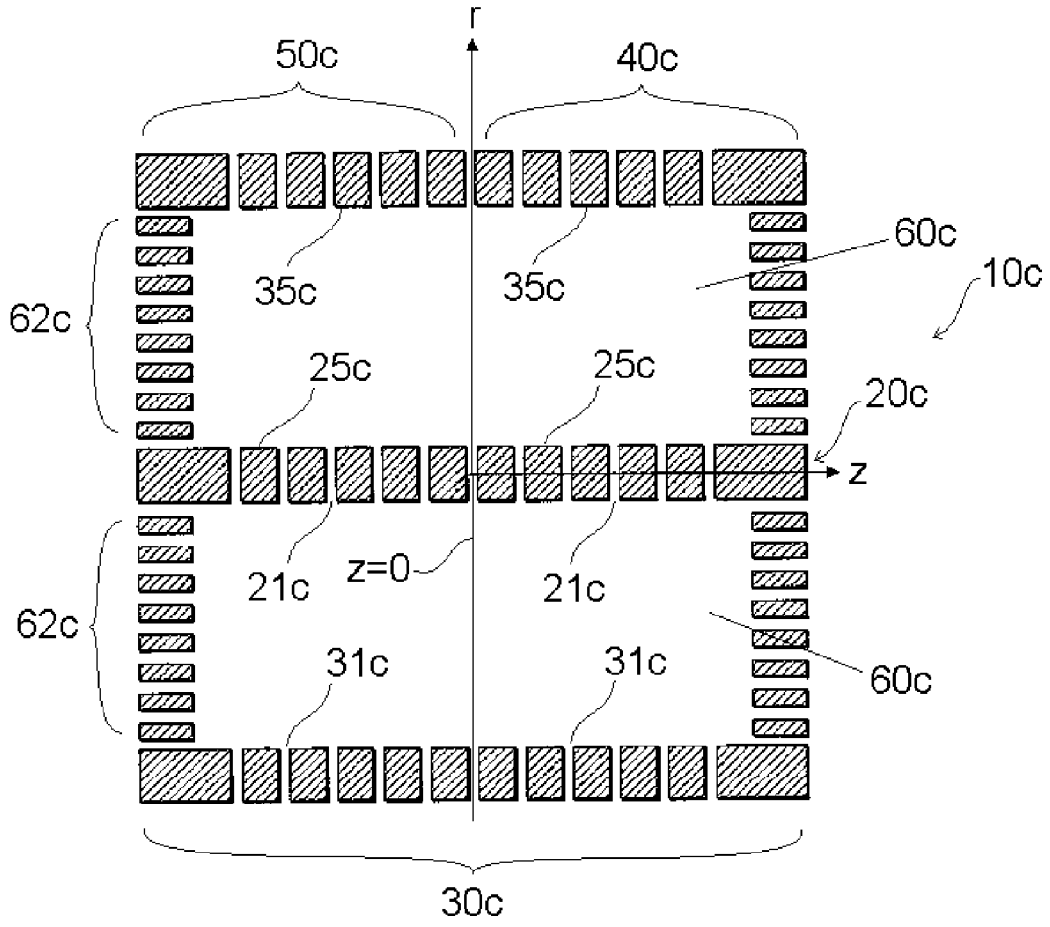
Figure 2D:
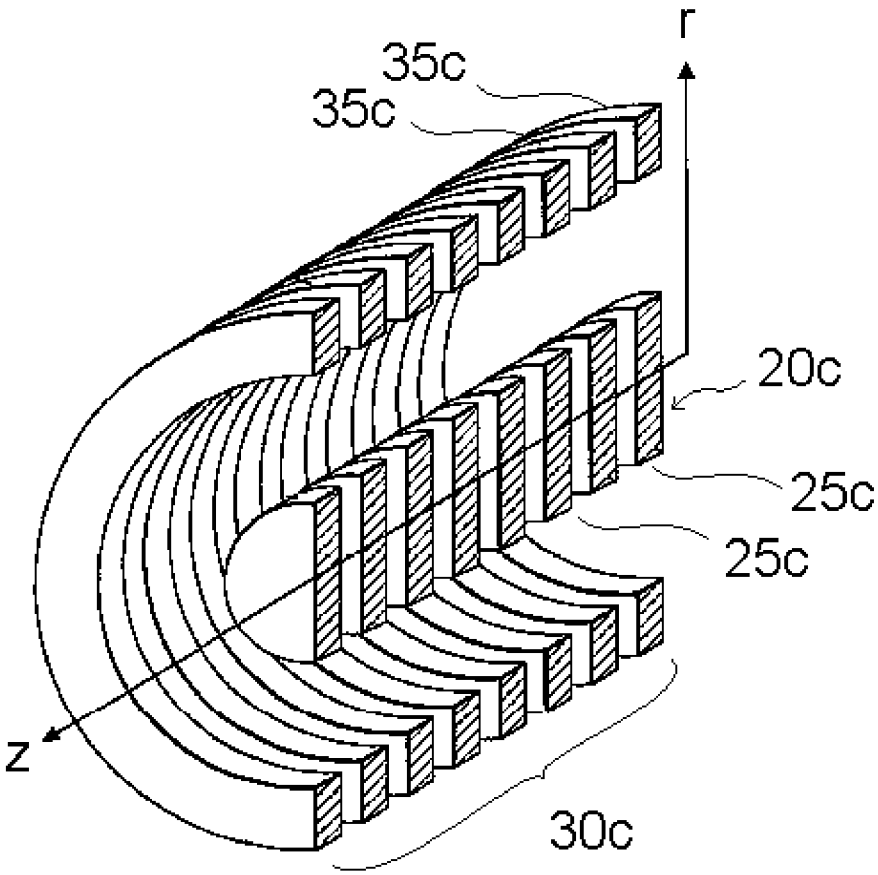

FIG. 2*c* shows a further embodiment of the present invention as a schematic cross sectional side view. FIG. 2*d* shows a central portion about the z=0 plane of the embodiment of FIG. 2*c* as a schematic isometric view, with a cut-away. Like features are given the same labels as in FIG. 2*a*. Disc electrodes 25*c* and ring electrodes 35*c* comprise the inner and outer field-defining electrode systems 20*c* and 30*c* respectively, and form opposing mirrors 40*c* and 50*c*. Mirror 40*c* and mirror 50*c* are symmetrical about the plane z=0 and form the analyser 10*c*. The outer diameters of disc electrodes 25*c* all are of the same size. The internal diameters of ring electrodes 35*c* are all of the same size. This embodiment again utilises the quadro-logarithmic potential distribution described by equation (1) within volume 60*c*, as, for each mirror, in this embodiment the set of electrical potentials applied to the field-defining electrodes comprises different electrical potentials: different potentials are applied to each disc, and different potentials are applied to each ring, the set of potentials chosen to generate the quadro-logarithmic potential distribution. The notional equipotentials of the ideal quadro-logarithmic potential distribution meet the inner and outer electrode systems 20*c* and 30*c* respectively at a series of points along the length of the electrodes 20*c* and 30*c*. To generate the required quadro-logarithmic potential distribution, the individual disc electrodes 25*c* that comprise the inner field-defining electrode system 20*c* and the individual ring electrodes 35*c* that comprise the outer field-defining electrode system 30*c* are operated to have a potential that matches the various equipotentials where they intersect. Gaps 21*c* and 31*c* separate the discs 25*c* and rings 35*c* respectively and are preferably at least two to three times smaller than the distance to the nearest point upon the main flight path. The ends of the trapping volume 60*c* are closed by end electrodes 62*c* (shown only in FIG. 2*c*), rather than being open as in FIG. 2*a* and FIG. 2*b*. The electrodes 62*c* define the field in regions furthest from the z=0 plane and comprise a series of radially-extending concentric ring electrodes that reside between respective ends of the inner field-defining electrode system 20*c* and the outer electrode field-defining electrode system 30*c*. The notional equipotentials of the ideal quadro-logarithmic potential distribution meet the electrodes 62*c* at a series of points spaced radially from the z axis. To further define the field in the regions furthest from the z=0 plane, the individual electrodes 62*c* are operated to have potentials that match the various equipotentials where they intersect. The presence of the electrodes 62*c* allows the analyzer 10*c* to be shorter in z length than would be possible in their absence, for the same degree of accuracy of the quadro-logarithmic potential distribution within volume 60*c*.

Figure 2E:
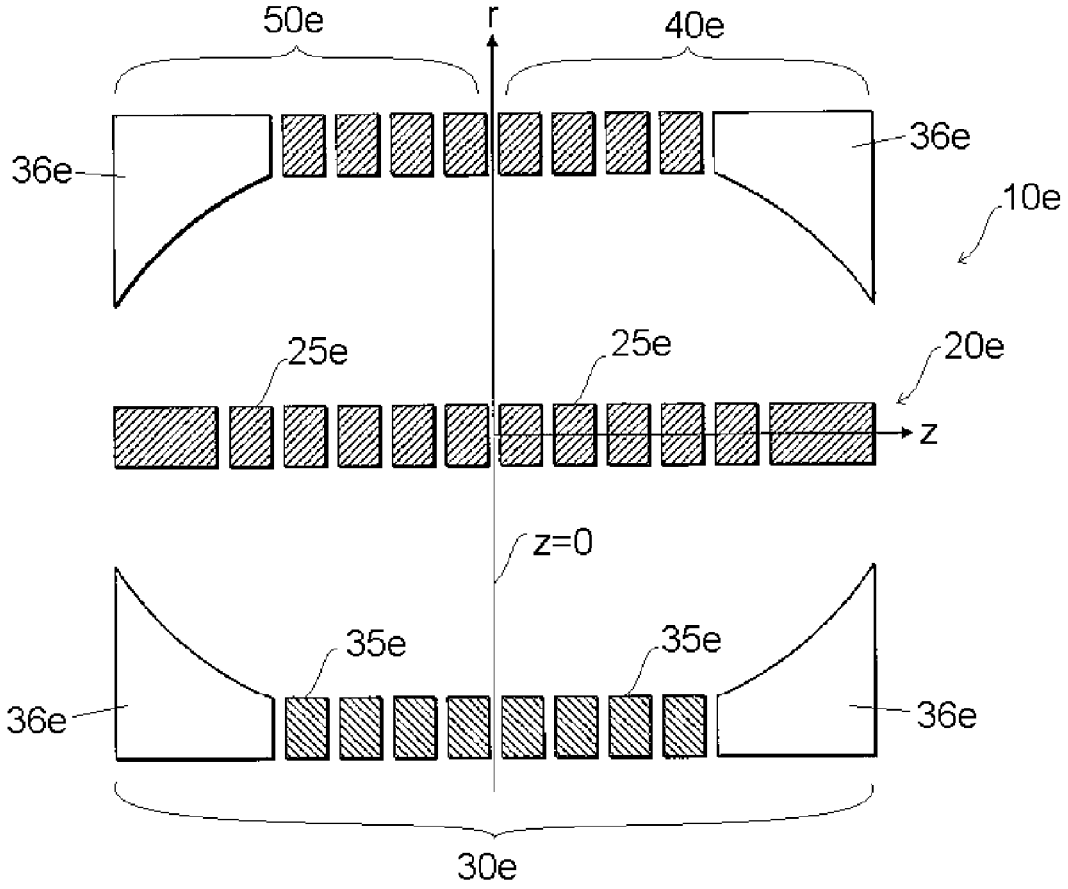
Figure 2F:
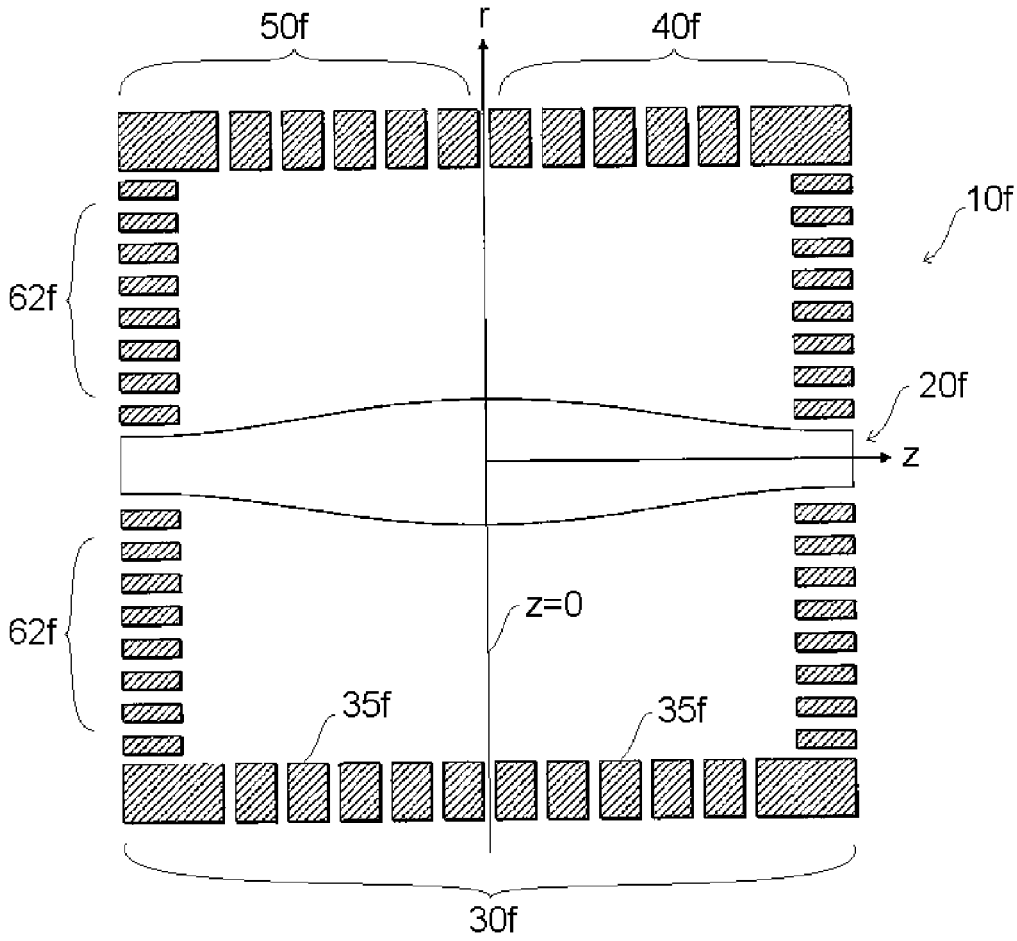

Two further embodiments are shown as schematic cross sectional side views in FIGS. 2*e* and 2*f*. Both embodiments also utilize the quadro-logarithmic potential distribution described by equation (1) and both have one or more of the inner and outer field-defining electrode systems comprising sets of discrete electrodes. Like features are labeled in a similar manner to FIGS. 2*a*, 2*b* and 2*c*. FIG. 2*e* utilizes a set of disc electrodes 25*e*, all of the same outer diameter, to comprise the inner field-defining electrode systems 20*e* of two opposing mirrors 40*e* and 50*e*. It utilizes a set of ring electrodes 35*e*, all of the same internal diameter, to comprise the outer field-defining electrode system 30*e* of the two opposing mirrors 40*e* and 50*e*, and the outer field-defining electrode system 30*e* further comprises shaped ring electrodes 36*e*. Ring electrodes 36*e* are shaped to aid in defining the field in the regions furthest from the z=0 plane, allowing analyzer 10*e* to achieve a desired field accuracy in those regions without the use of a set of ring electrodes such as those labeled 62*c* in FIG. 2*c*. The embodiment of FIG. 2*f* utilizes a single shaped inner field-defining electrode system 20*f* to form the inner field-defining electrode systems of opposing mirrors 40*f* and 50*f*. The outer field-defining electrode systems 30*f* of mirrors 40*f* and 50*f* comprise a set of ring electrodes 35*f* all of the same internal diameter. Electrodes 62*f* similar to electrodes 62*c* in FIG. 2*c* serve a similar function to better define the field in the regions furthest from the z=0 plane. FIGS. 2*e* and 2*f* illustrate that a variety of structures may be used in combination to comprise the inner and outer field-defining electrode systems of analysers of the present invention; other combinations may be envisaged by those skilled in the art.

Utilising electrode systems such as shown in FIG. 2, the two opposing mirrors may each be formed from differently shaped electrode systems and the electrode systems not be symmetrical in the plane z=0, yet still generate opposing fields that are symmetrical in the plane z=0. Alternatively, to obtain a further advantage, the two opposing mirrors may not generate opposing fields that are symmetrical in the plane z=0, as will be further described below, whether the electrode systems are symmetrical or not. Where the electrode systems are not symmetrical in the plane z=0, the plane z=0 may not be equidistant from the turning points of the ions in the two opposing mirrors.

Figure 3A:
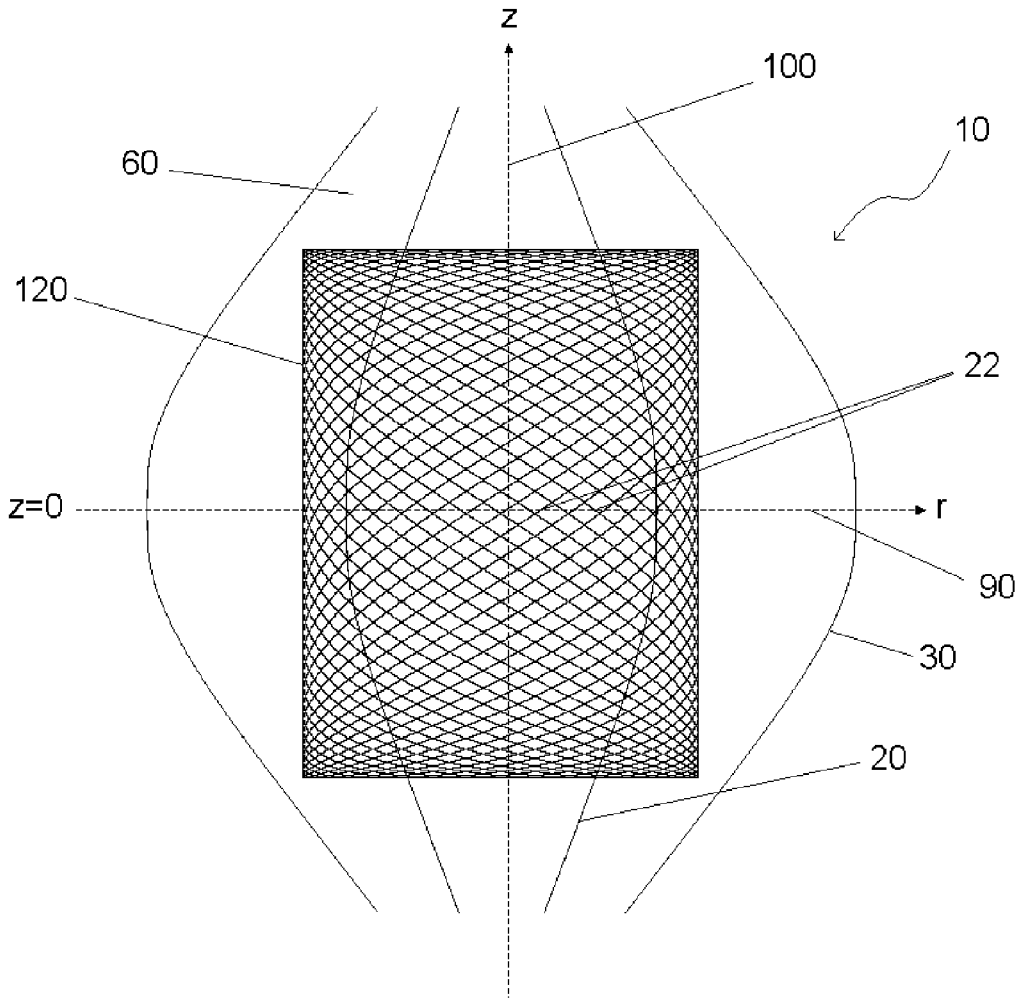
FIG. 3 shows schematically examples of main flight paths of the beam in embodiments of the invention and its envelopes.
Figure 3B:
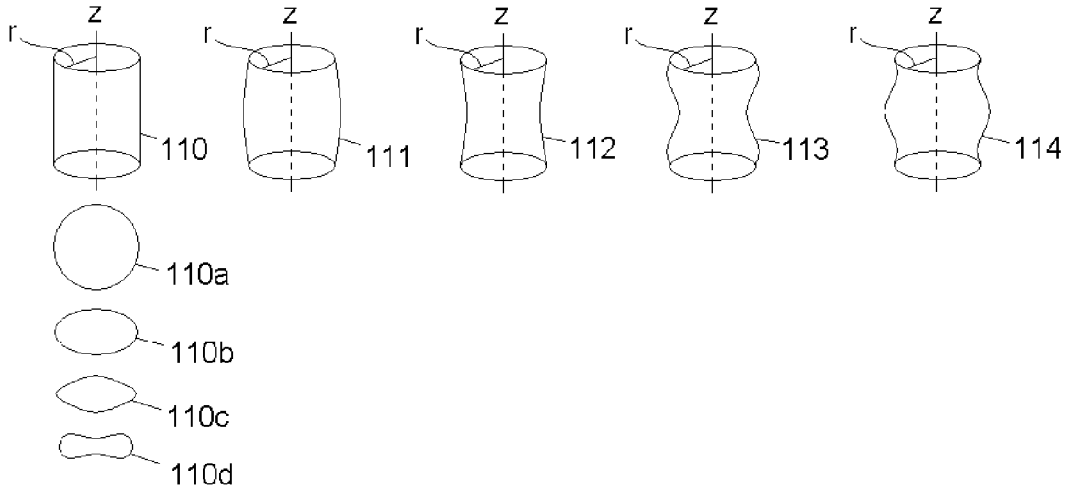

The main flight path within the analyzer shown in FIG. 2*a* is within a cylindrical envelope 110 of radius approximately 100 mm and maximum distance from the z=0 plane of 138 mm. The main flight path comprises a reflected helical trajectory 120 between the two mirrors (i.e. around the inner electrode 20 between the inner electrode 20 and outer electrode 30) as shown in the schematic diagram of FIG. 3, where like components have been given the same labels as in FIG. 2*a*. In the present invention, the radial distance of the main flight path of the beam from the z axis does not change from one axial oscillation to another axial oscillation. In the embodiment shown the main flight path undergoes 18 full oscillations along the z axis before reaching its starting point once again. Each oscillation along the z axis is simple harmonic motion. The helical trajectory 120 of FIG. 3 shows the main flight path as though the inner field-defining electrode systems of the mirrors were not present, i.e. the main flight path is unobscured by the inner field-defining electrode systems and there are 36 separate points at which the main flight path crosses the z=0 plane, (though those at the extremes in r are difficult to resolve in the figure). The principal parameters of the field have been chosen so that the orbiting (i.e. arcuate) frequency and the axial (z direction) oscillating frequency are such as to cause the beam of ions to pass through the z=0 plane at predetermined positions, such as those marked 22. The main flight path is inclined at 55.96 degrees to the z axis at the z=0 plane, and progresses around the z axis on the plane z=0 (i.e. each time it passes the z=0 plane) at 5 degree intervals, thereby reaching its starting point after 72 half oscillations or reflections. In use, a beam of ions following the main flight path has an arcuate velocity corresponding to 3000 eV kinetic energy and an axial velocity corresponding to 1217.5 eV kinetic energy when at the plane z=0. The total beam energy is 4217.5 eV. In this particular embodiment, after 36 full oscillations along z(equal to 72 passes across the z=0 plane), the beam travels approximately 9.94 m in the analyser axial direction, which is the direction of time of flight separation of the ions, before reaching its starting point once again. This is due to the particles travelling the z length of the cylindrical envelope 110 twice (i.e. back and forth) for each full oscillation along z (i.e. a distance per oscillation of 138 mm×2=276 mm but an effective distance of 138 mm×2π=867 mm). For 36 full oscillations, the total effective length travelled is therefore 867 mm×36=31.2 m. The beam orbits around the z axis just over once (i.e. 5 degrees over) per reflection from one of the mirrors, i.e. just over twice (i.e. 10 degrees over) per full oscillation along the z axis.

As in the embodiment of FIG. 2*a*, the flight path within the analysers of the embodiments shown in FIGS. 2*b*, 2*c*, 2*e* and 2*f* also follow a cylindrical envelope such as 110 in FIG. 2*a*. However other analysers utilising the present invention are also possible which produce different flight path envelope shapes. Some non-limiting examples of shapes of the main flight path envelope are shown schematically in FIG. 3*b*, at 110, 111, 112, 113, 114. Each of these envelope shapes may also have, for example, any of the cross sectional shapes shown at 110*a*, 110*b*, 110*c*, and 110*d*.

Figure 4A:
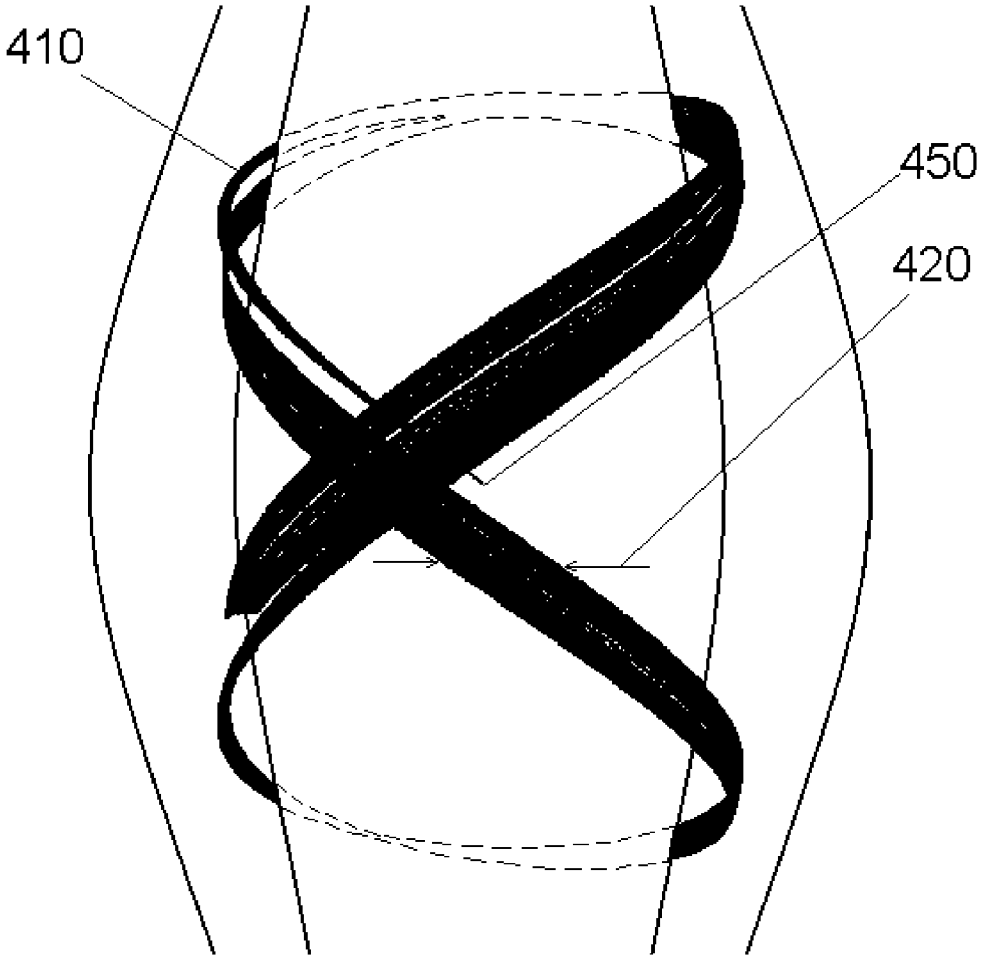
FIG. 4 shows schematic representations of a beam of ions undergoing oscillations in an analyser according to the invention with (FIG. 4*b,c*) and without (FIG. 4*a*) arcuate focusing lenses, and an example of an arcuate focusing lens.
Figure 4B:
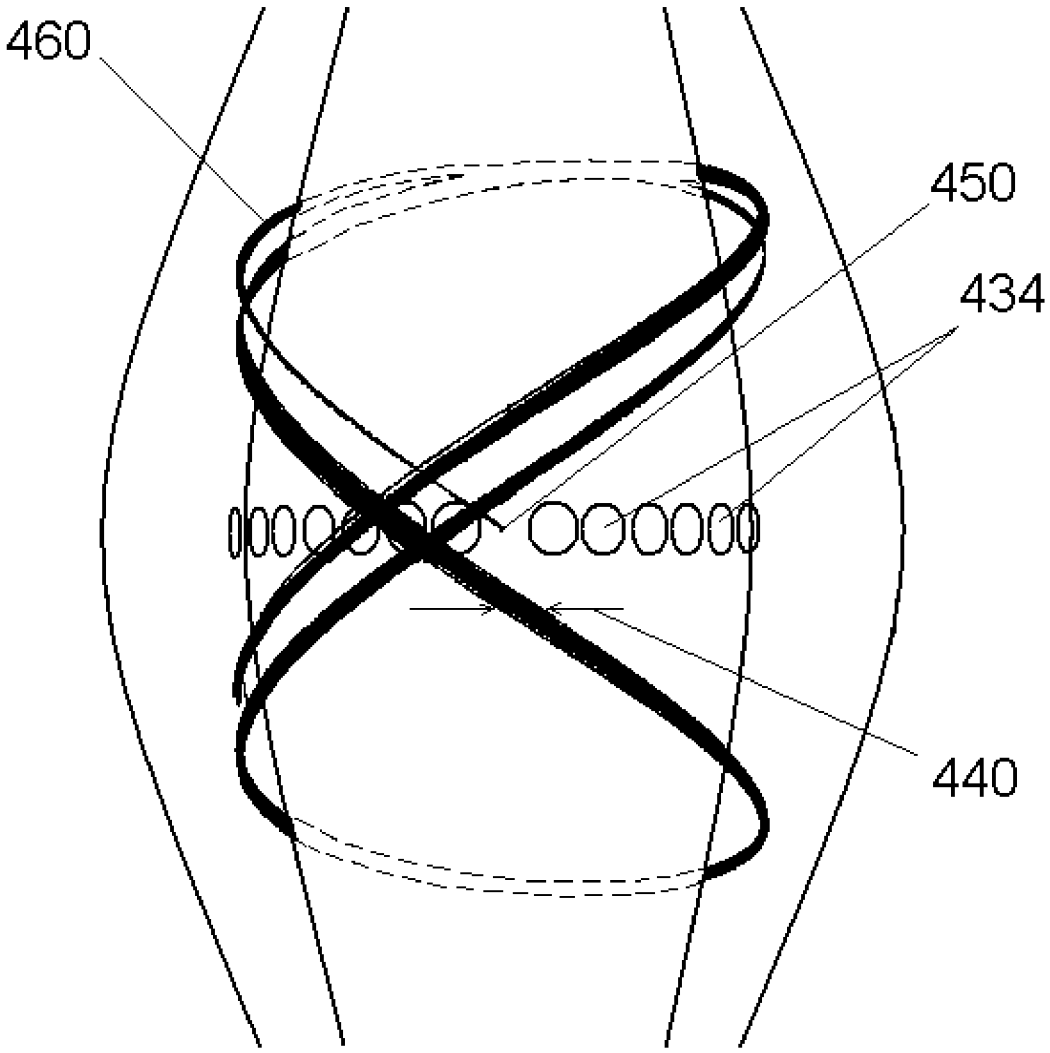

As previously described, whilst travelling upon the main flight path, the beam is confined radially but is unconfined in its arcuate divergence within the analyser. FIG. 4*a* shows a schematic representation of a beam of ions 410 undergoing less than two axial oscillations in a quadro-logarithmic potential analyser similar to that in FIGS. 2 and 3, illustrating the beam spread in the arcuate direction, 420, after just less than one axial oscillation. FIG. 4*b* shows a similar beam 460 in a similar analyser but in which a plurality of arcuate focusing lens assemblies has been incorporated. The arcuate lens assemblies comprise two opposing circular lens electrodes in the form of plates, 432, 434 shown in FIG. 4*c*. FIG. 4*b* only shows the inner plates 434 for clarity. FIG. 4*b* also shows the resultant reduced arcuate beam spread, 440. The beam starts from position 450 in both cases, with the same beam divergence. It will be understood from FIG. 4*a* that without arcuate focusing only a very limited path length within the analyser is possible without overlapping of the beam path, causing the attendant problems of ejection and detection as already described. FIG. 4*b* illustrates that beam divergence in the arcuate direction can be controlled allowing a far greater number of reflections. If there is sufficient arcuate focusing, the beam path without overlapping is in principle of unlimited length.

Figure 4C:
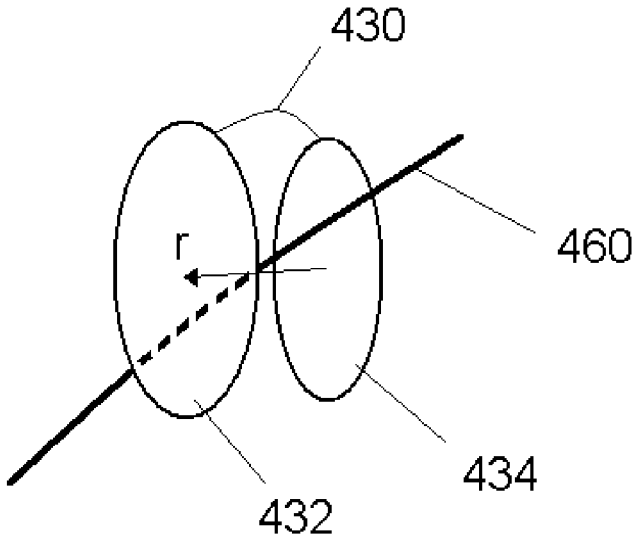

In the example shown schematically in FIG. 4*b*, the arcuate lenses 430 each comprise a pair of opposing circular lens electrodes, positioned around the z=0 plane at 10 degree spacing in the arcuate angle, to intercept the beam as it crosses the z=0 plane. One electrode 434 of each lens 430 is at a smaller radius from the z axis than the beam, and the opposing electrode 432 of the same lens 430 is at larger radius from the z axis than the beam, the beam passing between the two opposing electrodes 432, 434 as shown in FIG. 4*c*. In FIG. 4*b*, for clarity, only the circular electrodes 434 of each pair at smaller radius are shown. The opposing lens electrodes 434 and 432 are located in cylindrical annular belt electrode assemblies (not shown) at r=97 mm and 103 mm respectively and electrically insulated therefrom (where r=radius from the z axis). The belt electrode assembly at smaller radius is referred to herein as the inner belt electrode assembly and the belt electrode assembly at large radius is referred to herein as the outer belt electrode assembly. The belt electrode assemblies therefore lie closely radially on either side of the main flight path which is at r=100 mm. Further details of various embodiments of belt electrode assemblies are described below. The belt electrode assemblies are centred on the z=0 plane and are of z length 44 mm. The inner belt electrode assembly is electrically biased with a potential $U_1$=−2426.0 V and the outer belt electrode assembly is biased with a potential $U_2$=−2065.8 V, which are close to the potentials of the quadro-logarithmic potential in the analyser at the respective belt radii. Ideally the belt electrode assemblies would not be strict cylinders but would follow the contours (equipotential lines) of the quadro-logarithmic potential in the region in which they are placed, but in this example, cylindrical electrodes are used which are a reasonable approximation to the quadro-logarithmic potentials in that region. In order to avoid a step of the field at the point where the inner belt joins the inner electrode, the inner belt is made slightly smaller than the nominal diameter of the inner electrode at z=0. The inner belt electrode assembly has 36 equally spaced apertures each of diameter 14.9 mm in which the inner arcuate lens electrodes 434 are mounted, and the outer belt electrode assembly has 36 equally spaced apertures each of diameter 16.0 mm in which the outer arcuate lens electrodes 432 are mounted. In alternative embodiments, arcuate lens electrodes may be absent at the locations around the analyser axis z at which deflectors are placed to effect injection and ejection. In some preferred embodiments, the arcuate lenses themselves can act as deflectors when energised with deflecting potentials. In this example, the inner lens electrodes 434 are of diameter 13.0 mm and the outer lens electrodes 432 are of diameter 13.8 mm. The lens electrodes are mounted within the belt electrode assemblies upon insulators which thereby insulate the lens electrodes from the belt electrode assemblies. In other embodiments, the lens electrodes can be part of the belt electrode assembly.

The electrical potentials applied to the belt electrode assemblies may be varied independently of the potentials upon the inner and outer field-defining electrode systems or the lens electrodes, so that the beam satisfies the following conditions: (i) the radial distance of the beam from the z axis does not change from one axial oscillation to another axial oscillation; (ii) the half period of axial oscillations corresponds to the 10 degree arcuate angle of rotation at the z=0 plane, so that the beam is centred upon each arcuate focusing lens 430 as it passes through the z=0 plane.

The spatial spread of the beam in the arcuate direction $\phi$ should not exceed the diameter of the lens electrodes 434, 432 of the arcuate lenses 430 so that large high-order aberrations are not induced. This imposes a lower limit upon the potential applied to the lens electrodes. Large potentials applied to the lens electrodes should also be avoided so that distortions of the main analyser field are not produced. In this example, the ion beam is stable with up to +/−5 mm beam spread in the arcuate direction. With larger spread, the second order aberrations of the arcuate lenses become significant and after multiple reflections in the mirrors, some ions may extend outside the circular lens electrodes 432, 434. The arcuate lenses 430 also affect the ion beam trajectory in the radial direction to some extent, introducing some beam broadening in the radial direction, larger beam broadening occurring to those ions that start their trajectories with larger initial displacements radially. For example ions that start their trajectories at r=100.5 mm are retained radially to within approximately +/−1 mm, but particles that start their trajectories at r=101.0 mm are retained radially to within approximately +/−3.5 mm. A broadening of the beam radially may result in the loss of ions after multiple reflections in the analyser mirrors, and the arcuate lens designs must take account of this if the initial spatial extent of the ion beam in the radial direction is sufficiently large. Initial ion energy spread also affects the focusing of the arcuate lenses. In this example relative energy spreads $\Delta E/E$ up to +/−1%, radial spreads up to +/−0.3 mm and arcuate spreads up to +/−5 mm may be accommodated with only ~20% loss in transmission after 27 full oscillations in the z direction, and with over 80,000 resolving power (for an initial packet of ions having negligible temporal spread).

A further example (Example B) of the invention utilises a similar analyser to that described above (Example A), but alternative values for some constants, dimensions and potentials are used. Table 1 shows the constants, dimensions and potentials which differ between the two examples, all other values being the same for both examples and being as detailed above.

TABLE 1

| Parameter | Example A | Example B |
|---|---|---|
| Maximum radius of the outer surface of the inner electrode | 95.0 mm | 97.5 mm |
| Outer electrode potential | 0 V | 0 V |
| Inner electrode potential | 2587 V | 2060.74 V |
| k | $1.42 * 10^5$ V/m$^2$ | $1.54 * 10^5$ V/m$^2$ |
| $R_m$ | 307.4 mm | 296.3 mm |
| Maximum distance of the main flight path from the z = 0 plane | 138 mm | 125.6 mm |
| Main flight path inclination to the z axis | 55.96 degrees | 57.5 degrees |
| Main flight path length in the axial (z) direction | 9.94 m | 9.05 m |
| Total effective length of flight | 31.2 m | 28.4 m |

TABLE 1-continued

| Parameter | Example A | Example B |
|---|---|---|
| path | | |
| Potential of the inner belt electrode assembly | −2426.0 V | −2060.4 V |
| Potential of the outer belt electrode assembly | −2065.8 V | −1693.4 V |
| Belt electrode assembly z length | 40 mm | 44 mm |
| Offset distance of arcuate lenses from the z = 0 plane | 5 mm | 2.75 mm |

Figure 5A:
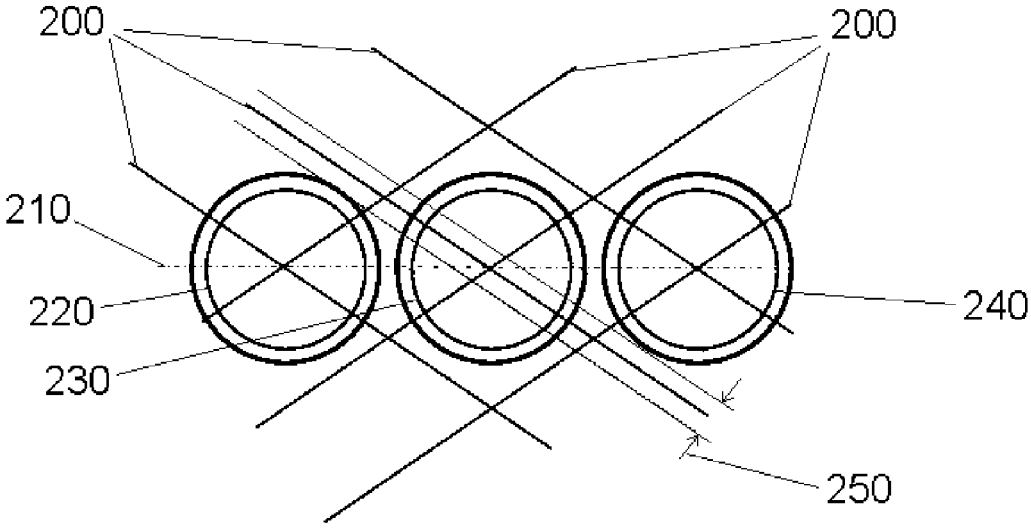
FIG. 5 shows schematically various embodiments of arcuate focusing lenses of the invention and a schematic embodiment of a means of supporting arcuate lenses or other components.

Different arcuate lens shapes may be utilised. With the circular arcuate lens electrodes 432, 434 of the previous example, immediately before and after passing through one of the arcuate lenses, the ions pass close to two neighbouring arcuate lens electrodes and experience asymmetric electric fields from those neighbouring lenses. This is illustrated schematically in FIG. 5*a*. The principal ion beam paths 200 pass across the z=0 plane 210 during the course of 3 full oscillations in the z direction. Arcuate lenses 220, 230 and 240 are centred on z=0 plane. A beam of width +/−3 mm is shown at 250 and can be seen to pass close to lenses 220 and 240 though it is centred upon lens 230.

Figure 5B:
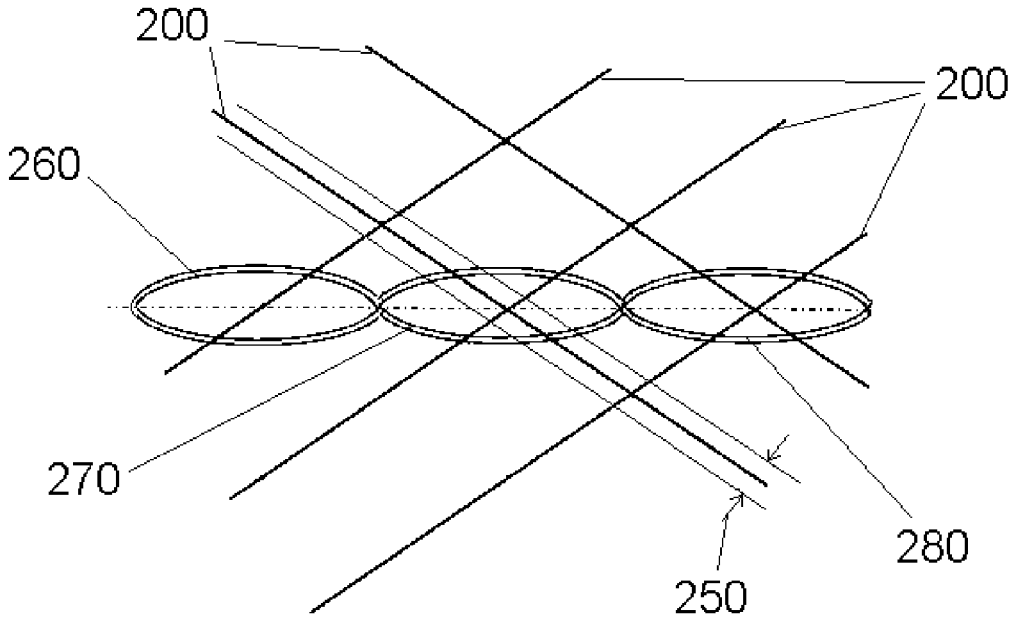
Figure 5C:
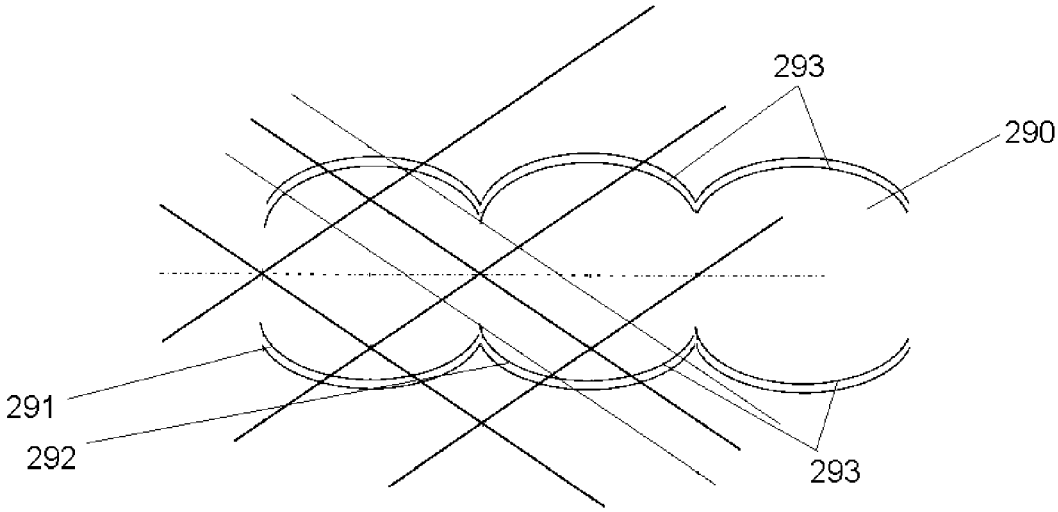
Figure 5D:
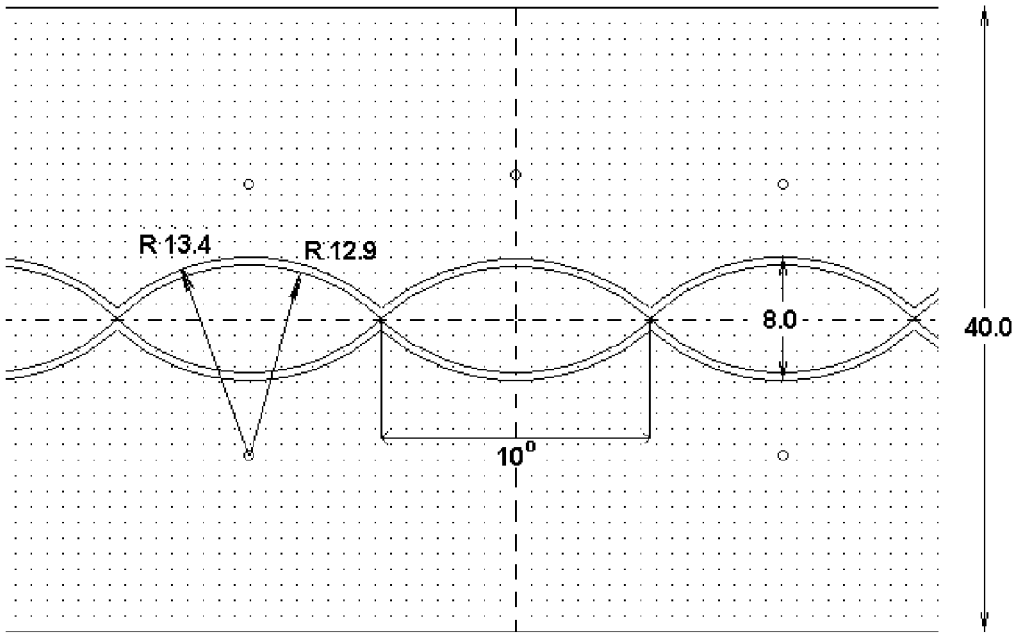
Figure 5E:
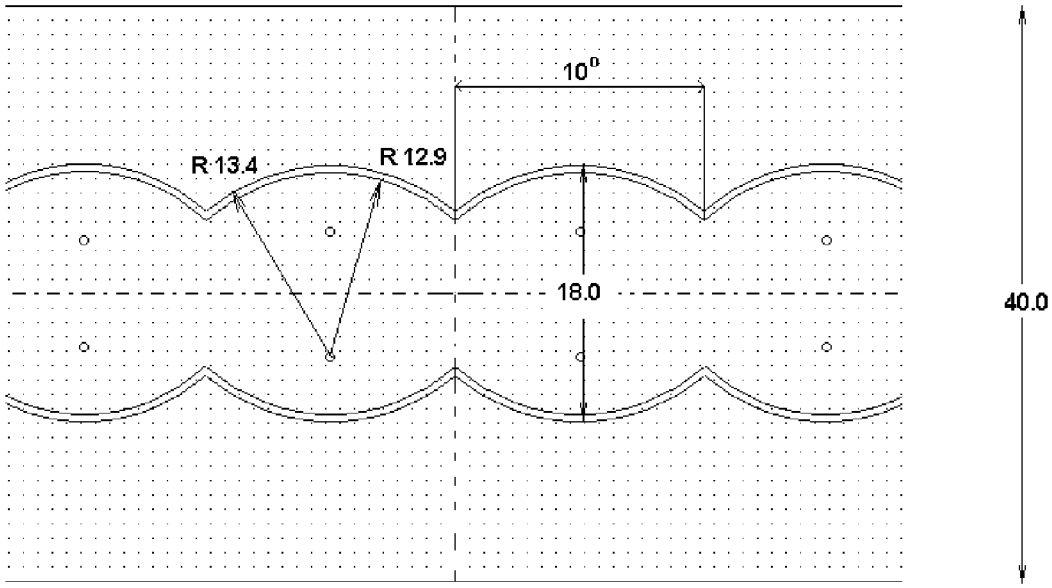
Figure 5F:
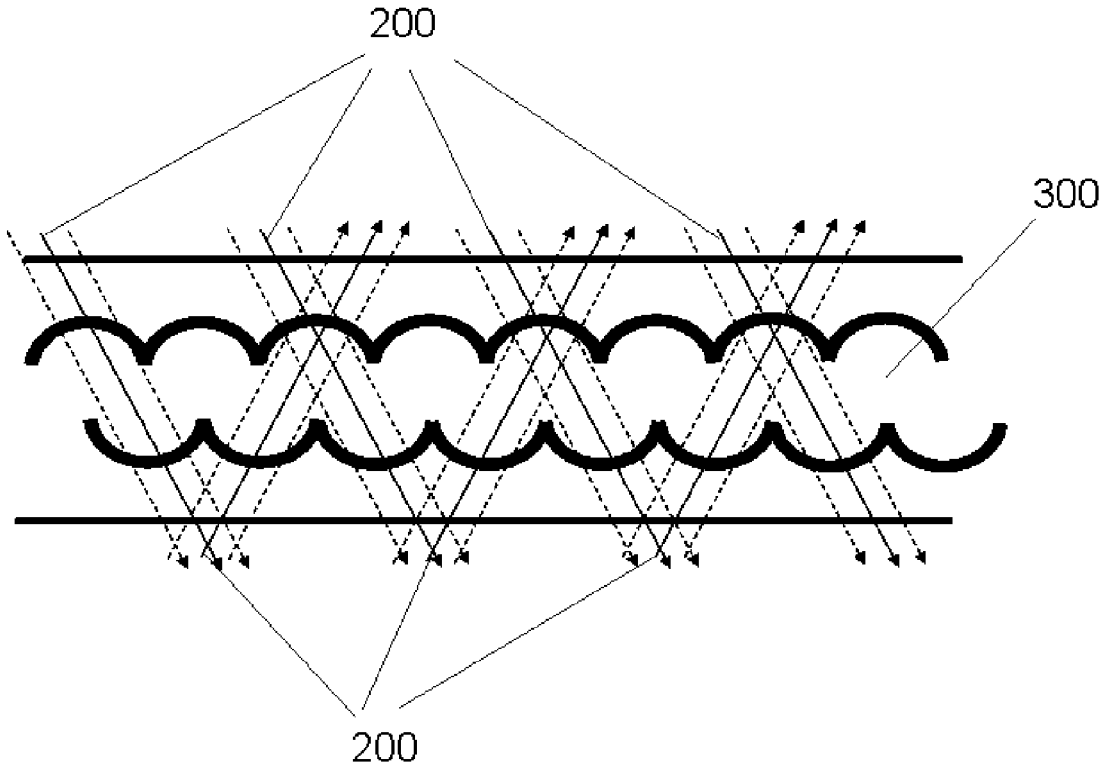
Figure 5G:
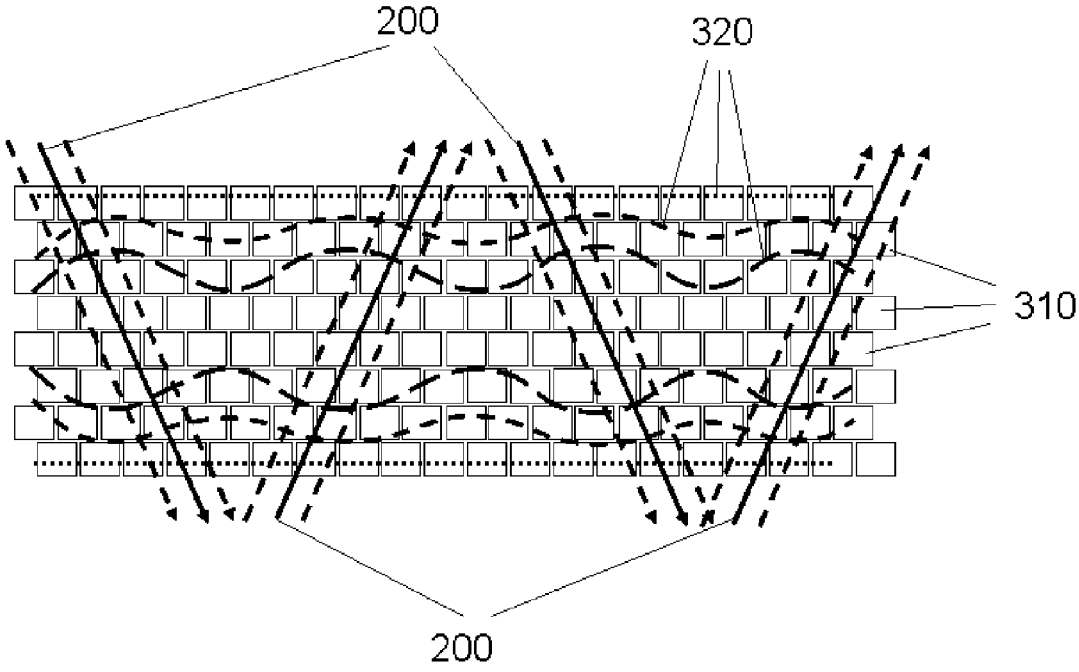

Two more preferred arcuate lens designs are shown in FIGS. 5*b* and 5*c*. FIG. 5*b* illustrates arcuate lens electrodes 260, 270, 280 that are narrower in the z direction than in the arcuate direction. The +/−3 mm beam shown at 250 now no longer passes close to neighbouring arcuate lenses 260 and 280, before and after its passage through arcuate lens 270. FIG. 5*c* illustrates arcuate lens electrodes that are merged, the lens electrodes in one belt electrode assembly themselves becoming a shaped lens electrode assembly 290. Each shaped lens electrode assembly 290 thereby comprises a plurality of opposing curved portions 293 along each edge in the z direction which provide the arcuate focusing of the beam. The beam passes through two arcuate lens electrodes 291 and 292 on each pass. The electrical potential that need be applied to obtain a given arcuate focusing is reduced and this lower potential applied to all arcuate lens electrodes causes neighbouring arcuate lens electrodes to affect the beam less. This design also has the advantage that the first order aberrations are lower than is the case for the example in FIG. 5*b*. Typical dimensions in mm of the lenses of FIGS. 5*b* and 5*c* are shown in FIGS. 5*d* and 5*e*, suitable for incorporation into the analyser of FIGS. 1 and 2. FIG. 5*f* illustrates a further embodiment of the arcuate focusing lens in which the concept of the focusing lens as a shaped lens electrode assembly 300 is utilised with an offset (i.e. the opposing curved portions along each edge in the z direction of the lens assembly are offset from each other in the arcuate direction), to position the curved portions of the lens electrodes in alignment with the main flight path. A still further embodiment is illustrated schematically in FIG. 5*g* in which an array of pixel electrodes 310 is utilised. Different potentials are applied to the pixel electrodes so that equipotentials 320 result and the electrodes function as arcuate focusing lenses. This example has the advantage that given sufficient numbers and density of pixels, arbitrary lens electrode shapes may be generated and different lens properties may be obtained.

Figure 6A:
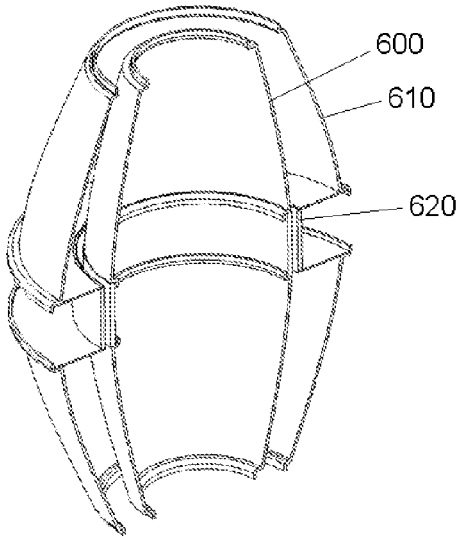
FIG. 6 shows schematic views of the electrode structures for various further embodiments of the invention.
Figure 6B:
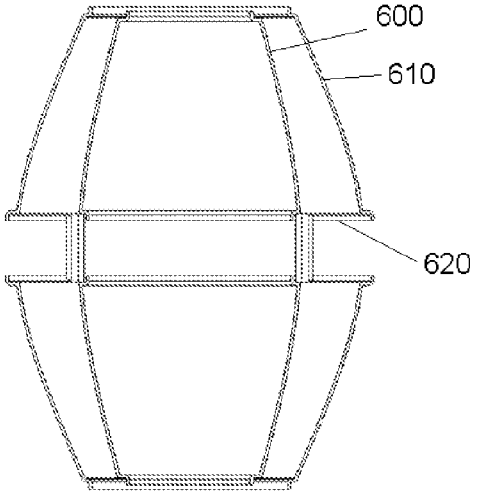
Figure 6C:
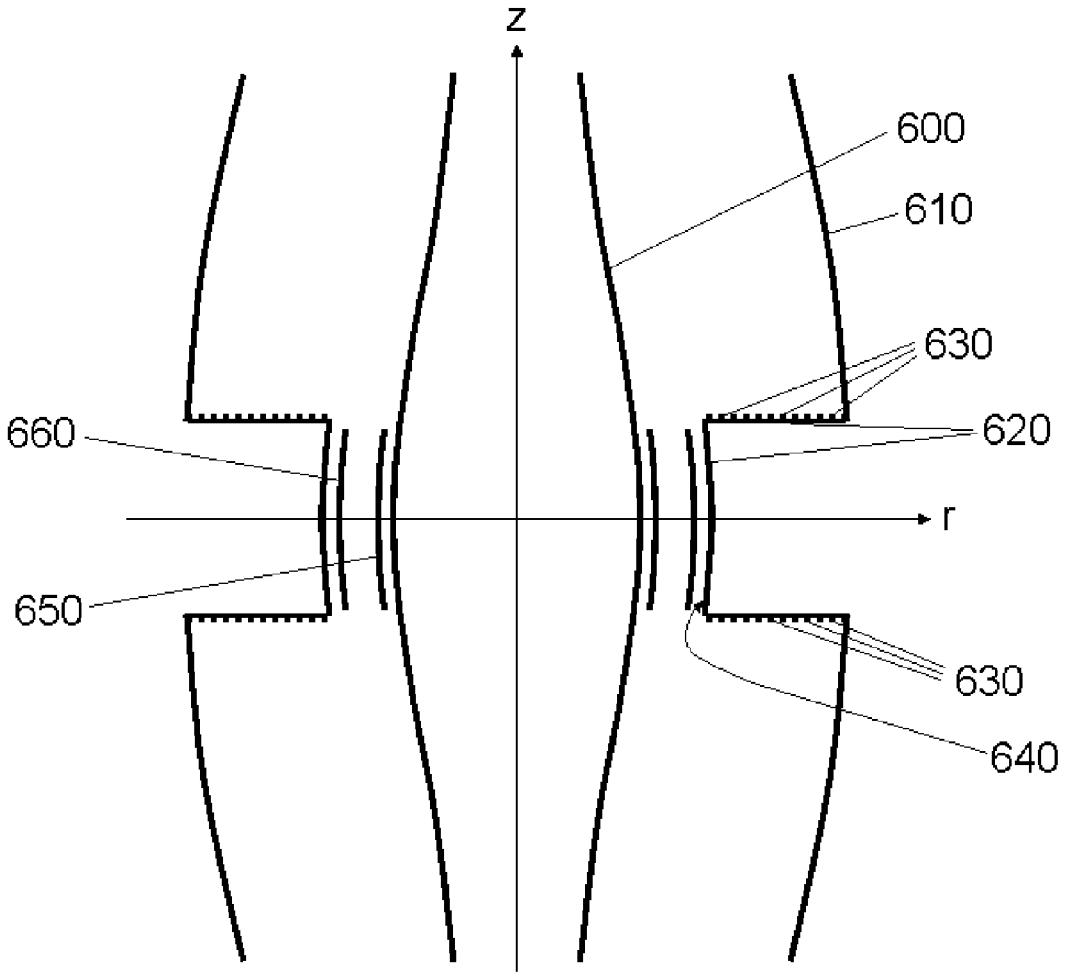

The examples given above for arcuate focusing lenses utilise belt electrode assemblies to support the lens electrodes, as already described. The inner belt electrode assembly is supported from the single inner field-defining electrode system 20 of both mirrors. The outer belt electrode assembly is supported from the single outer field-defining electrode system 30 of both mirrors. The inner belt electrode assembly has a radius only slightly larger than that of the inner field-defining electrode system at the z=0 plane and can conveniently be mounted to the inner field-defining electrode system via short insulators or an insulating sheet, for example. However the outer belt electrode assembly 20 has a radius considerably smaller than the radius of the outer field-defining electrode system at the z=0 plane. To facilitate mounting of the belt electrode, the outer field-defining electrode system structure 20 is preferably altered. A schematic illustration of a preferred outer field-defining electrode structure for mounting belt electrode assemblies is given in FIG. 6. FIGS. 6*a* and 6*b* show cross sectional side and cut-away perspective views respectively of the inner and outer field-defining electrode systems 600, 610 of two mirrors respectively. The outer field-defining electrode system 610 has a waisted portion 620 of reduced diameter, at a region near the z=0 plane. FIG. 6*c* shows a schematic side view cross section of the analyser where it can be seen that where the outer field-defining electrode system 610 waists in at 620, an array of electrode tracks 630 are positioned at different radial positions facing into the analyser. These electrode tracks are suitably electrically biased so that they inhibit the waisted portion of the outer field-defining electrode system from distorting the quadro-logarithmic potential distribution elsewhere within the analyser. The array of electrode tracks may be exchanged for a suitable resistive coating as an alternative, for example, or other electrode means may be envisaged. As termed herein, due to their function, the array of electrode tracks, resistive coating or other electrode means for inhibiting distortion of the main field form part of the outer field-defining electrode system of the mirror to which they relate. The inner surface 640 of the waisted portion 620 of the outer field-defining electrode system is used to support the outer belt electrode, 660 which in turn supports arcuate lens electrodes as previously described. Inner and outer belt electrode assemblies 650 and 660 respectively may then conveniently be mounted within the analyser from the inner and outer field-defining electrode systems 600, 610 respectively. The belt electrode assemblies 650 and 660 may be mounted from the inner and outer field-defining electrode systems 600, 610 via short insulators or an insulating sheet. In the example of FIG. 6*c*, both inner and outer belt electrode assemblies 650, 660 are curved to follow the contours of the quadro-logarithmic potential equipotentials where they are positioned, though simpler cylindrical sections could be used.

Figure 5H:
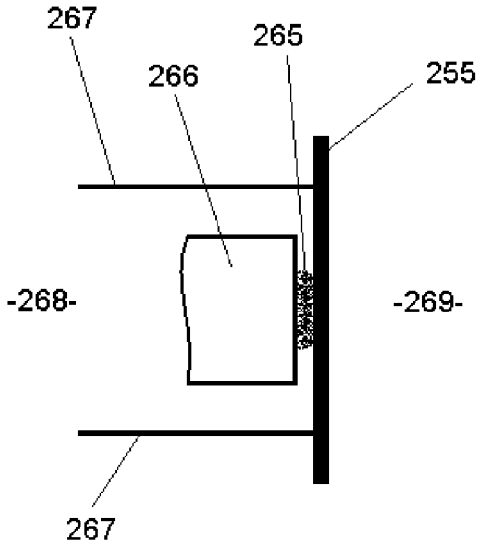

As previously described, both inner and outer belt electrode assemblies may be formed of printed circuit board, and preferably this may be flexible printed circuit sheet material wherein the belts are created together with arcuate focusing lens electrodes and deflector electrodes. Such a flexible printed circuit sheet material is typically very thin. This is advantageous as, once first heated within vacuum, the material substantially completely outgases and thereafter remains stable with low outgasing characteristics. Such a flexible sheet may be supported at various points and held in place by adhesive material. To reduce the outgasing load from the glue into the high vacuum analyser region, a baffle system may be employed as shown in FIG. 5*h*. In the figure, belt 255 is supported upon support member 266 by adhesive 265. Baffle system 267 separates vacuum region 268 (which may for example be at $10^{-6}$ mbar) from vacuum region 269 (which may for example be at $10^{-9}$ mbar). Outgasing form the adhesive 265 is directed away from vacuum region 269 by baffle system 267 towards vacuum region 268, ensuring the gas load from the adhesive does not increase the pressure of vacuum region 269. This type of arrangement may be used for similar purpose for other components of ion optical systems within vacuum.

Figure 6D:
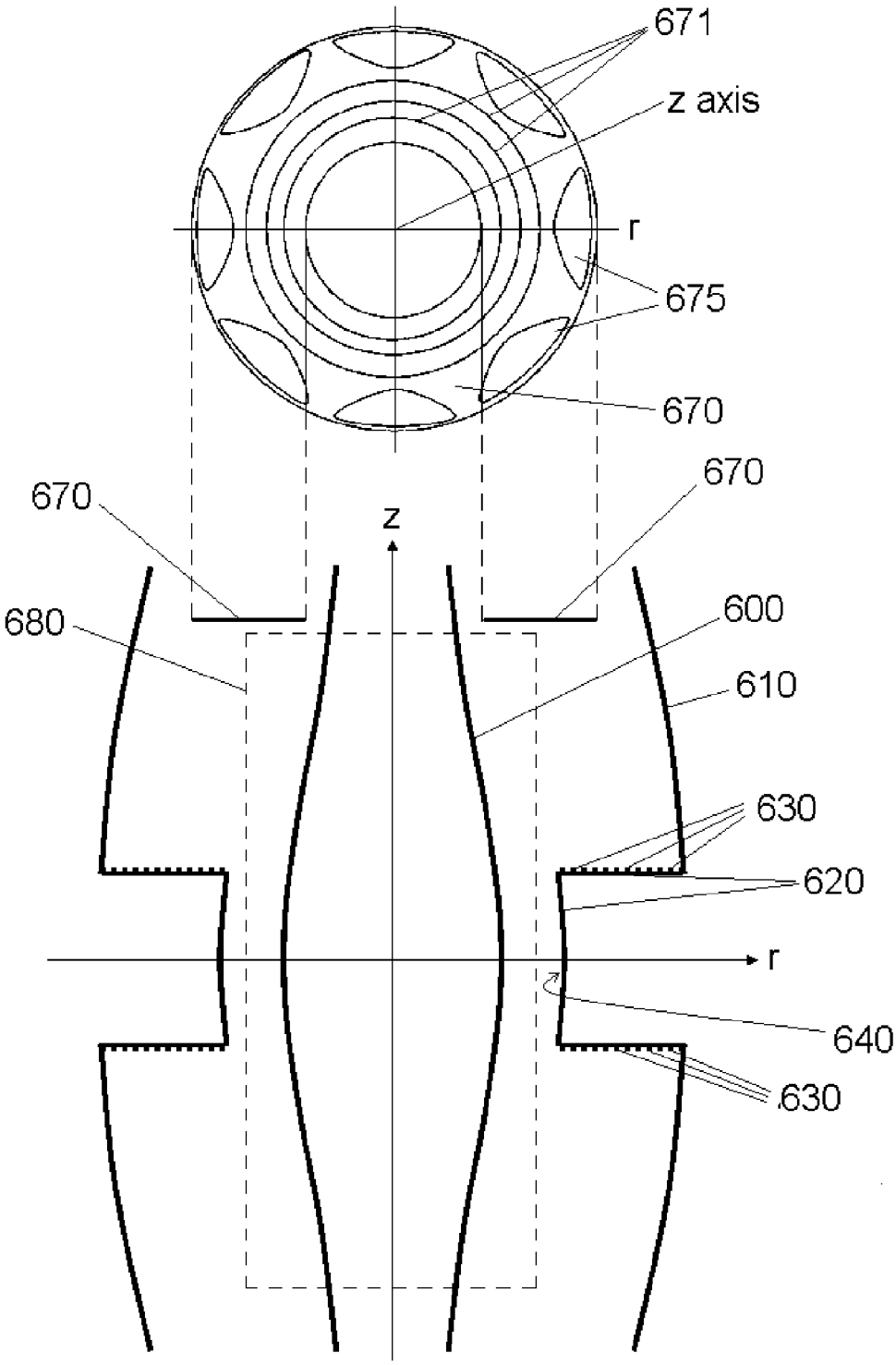

Electrode assemblies to support arcuate focusing lenses may be positioned anywhere near the main flight path within the analyser. An alternative embodiment to that in FIG. 6*c* is shown schematically in FIG. 6*d*. In this embodiment a single belt electrode assembly 670 that supports arcuate lenses is located adjacent the main flight path at one of the turning points. FIG. 6*d* shows both a side view cross section of the analyser and a view along the z axis of the belt electrode assembly 670 with arcuate lens electrodes 675 equally spaced about the analyser axis z. Only eight arcuate lens electrodes 675 are shown in this example; in other embodiments there may be more or less; preferably there would be one gap between adjacent arcuate lens electrodes for each full oscillation of the main flight path along the analyser axis z, so that arcuate focusing of the beam occurs each time the beam reaches the turning point adjacent the belt electrode assembly. The beam envelope in this embodiment is a cylinder 680. The belt electrode assembly 670 supporting the arcuate lenses 675 comprises a disc shaped plate with a central aperture through which passes the end of the inner field-defining electrode system 600. Electrode tracks 671 are mounted upon the belt electrode assembly 670, set in insulation. These electrode tracks 671 are each given an appropriate electrical bias to reduce distortion of the main analyser field in the vicinity of the belt electrode assembly 670 so that they perform in a similar manner to the use of end electrodes 62*c* shown and described in relation to FIG. 2*c*.

Figure 6E:
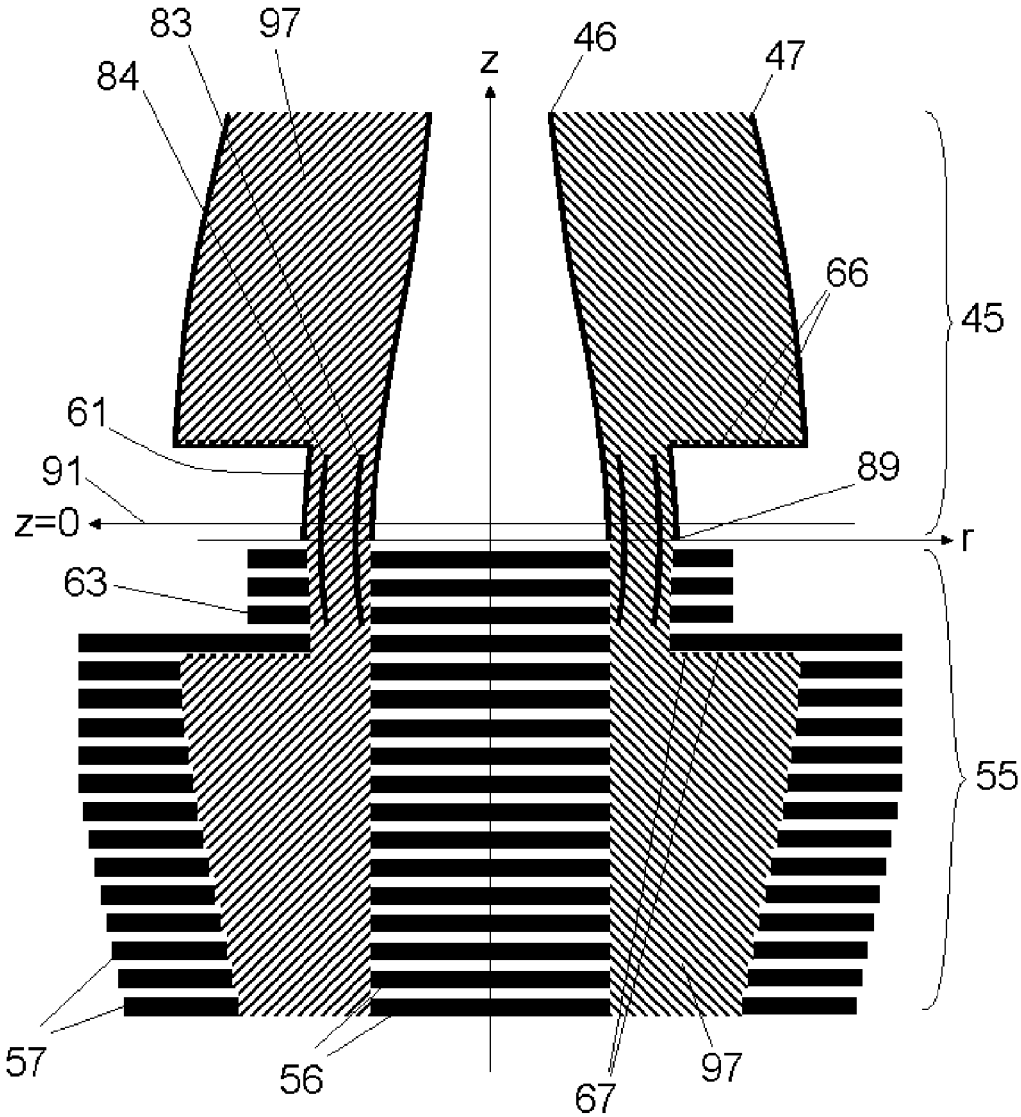

FIG. 6*e* is a schematic cross sectional side view of another embodiment of the invention in which the two opposing mirrors are not symmetrical in their structure. Mirror 45 comprises a single-piece cylindrically symmetric inner field-defining electrode system 46 and a single-piece cylindrically symmetric outer field-defining electrode system 47 (both being symmetrical about the z axis) which when electrically biased produce a quadro-logarithmic potential distribution in the space between the inner and outer field-defining electrode systems. Mirror 55 comprises a multi-piece inner field-defining electrode system comprising a set of conductive discs 56 of constant outer diameter, and a multi-piece outer field-defining electrode system comprising a set of conductive rings 57 of varying inner diameter. As already described in relation to FIG. 2, a quadro-logarithmic potential distribution may be formed in the space between the inner and outer field-defining electrode systems of mirror 55 by applying a suitable set of electrical potentials to the electrodes 56, 57. In this example, a single electrical potential may be applied to all the rings 57 of the outer field-defining electrode system whilst a set of different electrical potentials is applied to the discs 56 of the inner field-defining electrode system, each disc having a different electrical potential applied to it. The mirrors 45, 55 are abutted at 89 near the z=0 plane 91 and define an analyser volume 97 (shown shaded in FIG. 6*e*). The term analyser volume used herein refers to the volume between the inner and outer field-defining electrode systems of the two mirrors and does not extend to any volume within the inner field-defining electrode system, nor to any volume outside the inner surface of the outer field-defining electrode system. The analyser electrical field is formed within the analyser volume 97. The plane z=0, 91, is at the plane of lowest axial electrical field, i.e. where the analyser electrical field in the longitudinal (z) direction within the analyser volume is at a minimum. In this example, the z=0 plane does not lie at the mid point of the structure comprising mirrors 45, 55, nor where mirrors 45, 55 abut. Inner and outer belt electrode assemblies 83, 84 are located near, but not centred on the z=0 plane 91. In this embodiment, the outer field-defining electrode systems of both mirrors comprise a waisted portion 61, 63 in the region where the mirrors abut. Electrode tracks 66, 67 comprising a series of radially-extending concentric rings are attached to the waisted portions of the inner surfaces of the outer field-defining electrode systems via insulation (not shown), which when suitable electrical potentials are applied inhibit distortion of the quadro-logarithmic potential distribution within the analyzer volume 97. Electrode tracks 66, 67 are considered herein to form part of the outer field-defining electrode systems of the two mirrors.

Figure 7A:
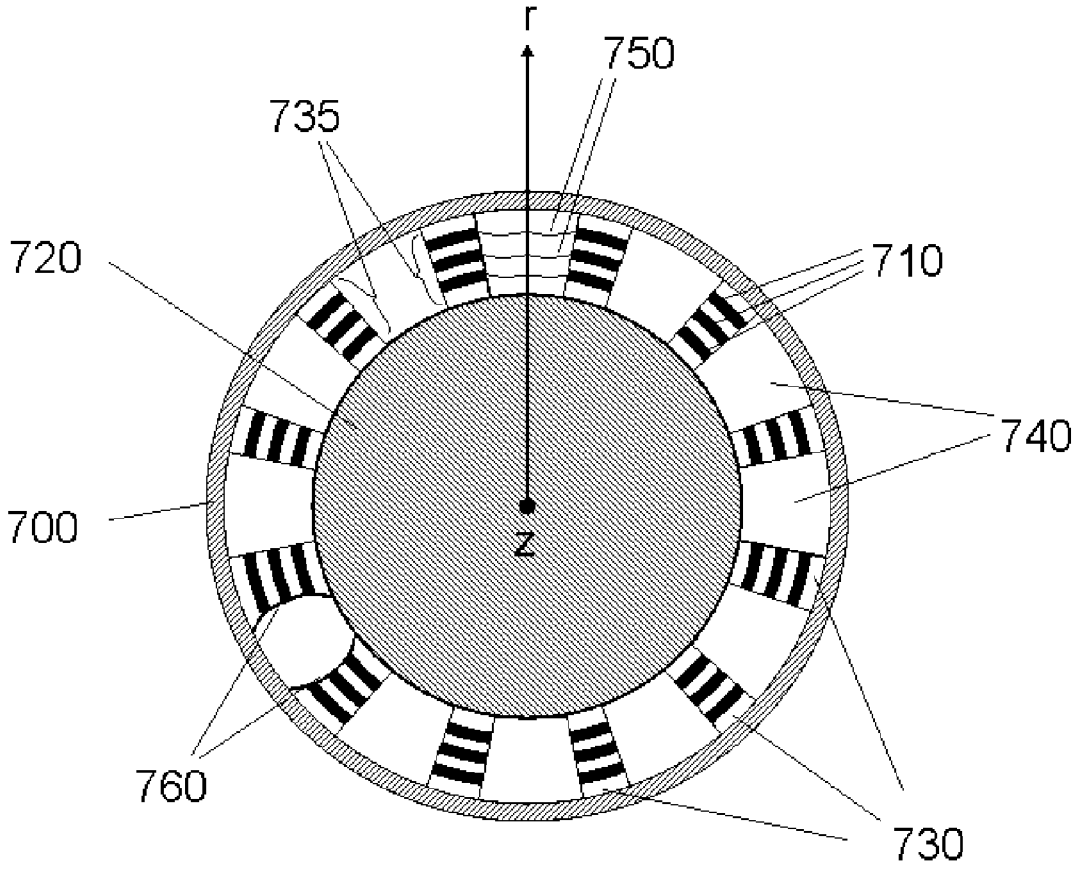
FIG. 7 shows schematic views of the electrode structures for various embodiments of the invention with various arrangements of arcuate focusing lenses.
Figure 7B:
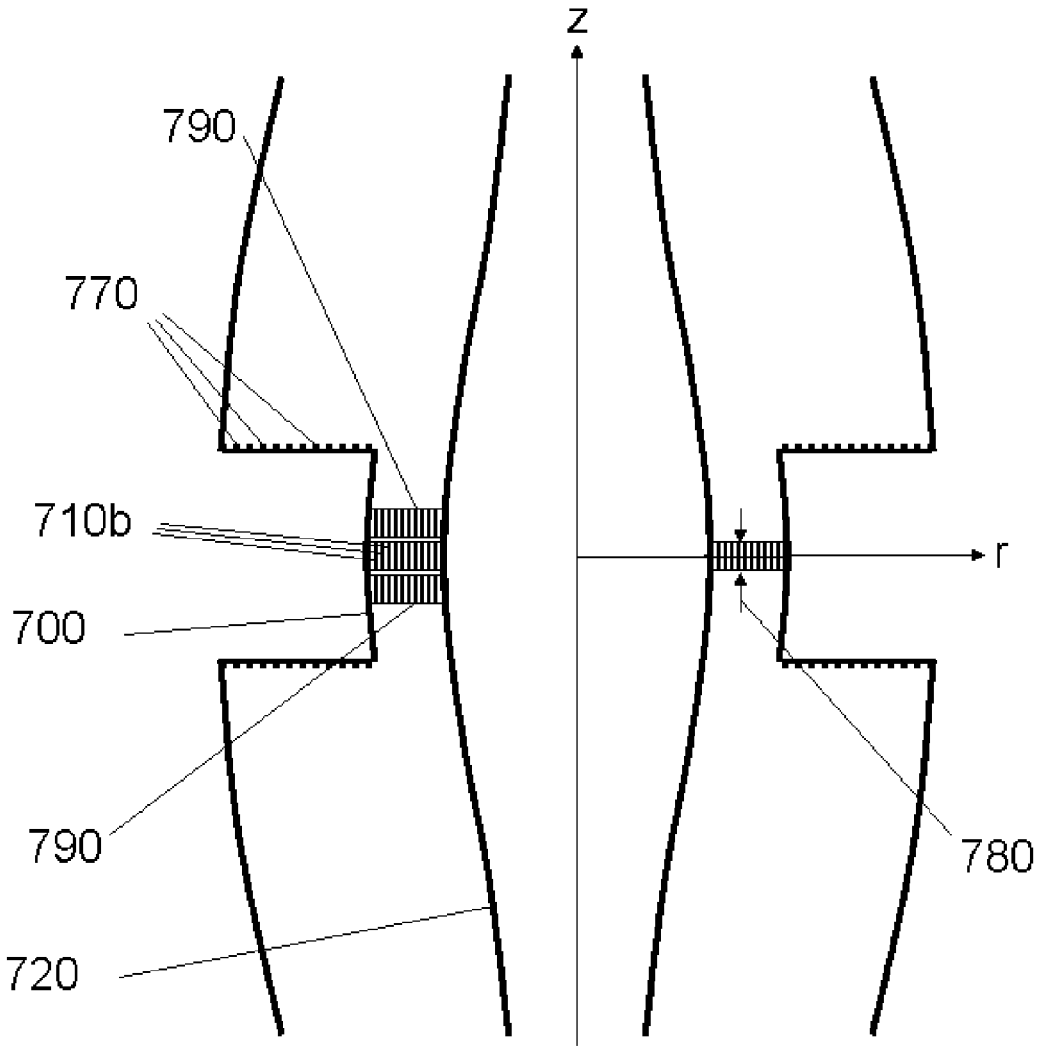

The arcuate focusing lens examples shown in FIGS. 4 and 5 have opposing lens electrodes either side of the beam, at larger and smaller radial distances from the analyser axis. An alternate arcuate focusing lens design may be employed in which opposing lens electrodes are placed either side of the beam in the arcuate direction. An example of this type of lens arrangement is given in the schematic illustration of FIG. 7. FIG. 7*a* shows a cross section in the z=0 plane of a quadro-logarithmic potential analyser, viewed along the analyser axis z. The outer field-defining electrode system 700 is shown waisted-in at the z=0 plane. In this example no inner belt electrode assembly is used. Arcuate focusing lens electrodes 710 are layered between the inner field-defining electrode system 720 and the waisted portion of the outer field-defining electrode system 700, in focusing stacks 735, spaced apart around the inner field-defining electrode system 720. The stacks may conveniently be formed from printed circuit board (PCB). The electrodes may be 1.8 mm thick, with 0.2 mm dielectric 730 between each electrode and between the end electrodes of the stacks and the inner and outer field-defining electrode systems 720, 700, for example. In operation, gaps 740 between the stacks 730 accommodate the ion beam. Only three electrodes per stack are shown for clarity; more or less than three electrodes may be used. Moreover, only 12 stacks are shown for illustration. In practice, more or less stacks than this may be used. Electrical potentials are applied to the electrodes in each stack, creating equipotentials 750 within the gaps 740. The potentials applied to the electrodes within each stack vary according to the radius at which the electrode is positioned within the analyser. The potential distribution within the gaps locally distorts the equipotentials that are formed by the analyser and this produces arcuate focusing. In addition to arcuate focusing, variations in the arcuate length of the electrodes can also produce radial focusing, should that be desired. Such shaped electrodes are shown in FIG. 7*a* at 760. FIG. 7*b* shows an alternate view of a similar lens arrangement to that in FIG. 7*a*, but with more electrodes 710*b* per stack. An array of electrode tracks 770 are positioned facing into the analyser, similar to those shown in FIG. 6 at 630. These electrode tracks are suitably electrically biased so that they inhibit the waisted portion of the outer field-defining electrode system 700 from distorting the quadro-logarithmic potential distribution elsewhere within the analyser. The z height of the stacks, 780, is preferably between 1 and 4 mm. To shield adjacent parts of the analyser at z locations away from the z=0 plane from the potentials applied to the electrodes within each focusing stack 730, the electrodes 710*b* and focusing stack 730 may be sandwiched between two additional shielding stacks, 790. Stacks 790 also have electrodes but these are biased to match the equi-potentials of the main analyser field, limiting the effects of the focusing stack electrodes 710*b* to the region of the z=0 plane.

Arcuate focusing lenses may be created by suitable shaping of the inner field-defining electrode systems or other electrodes within the analyser.

Figure 8:
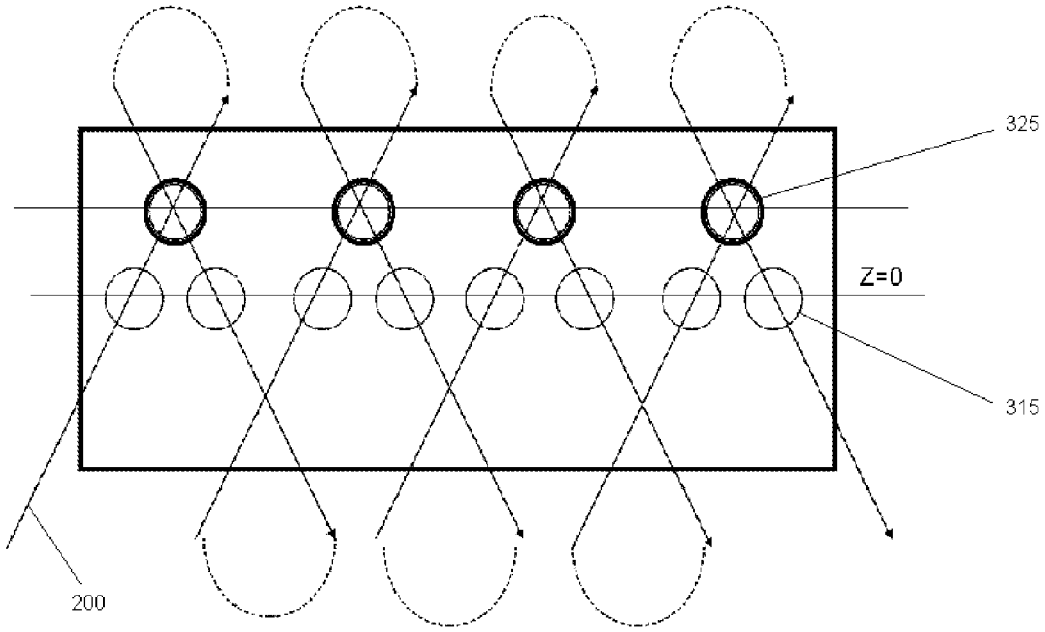
FIG. 8 shows schematically an offset arcuate lens embodiment of the invention.

A preferred positioning of the arcuate focusing lenses is shown schematically with reference to FIG. 8. Preferably, the opposing mirrors of the analyser are symmetrical about the z=0 plane. In such embodiments, the principal ion beam path shown schematically by path 200 will oscillate between the mirrors whilst orbiting around the z axis and will cross the z=0 plane at a different arcuate position after each reflection from a mirror. That is, for each half of an oscillation along z (i.e. for each reflection from a mirror) the beam orbits around the analyser axis z by an amount $2\pi$ radians plus a small angle, where the small angle is $<<2\pi$ radians. It will be understood that in other embodiments the beam may orbit around the analyser axis z by an amount $2\pi$ radians minus a small angle, where the small angle is $<<2\pi$ radians. In one embodiment therefore, the arcuate focusing lenses may be placed at each point on the z=0 plane where the ion beam crosses as shown by the positions of arcuate lenses 315 in FIG. 8. For illustration only eight such lens 315 are shown. Thus, if the plurality of arcuate focusing lenses are periodically spaced apart in the arcuate direction by an angle $\theta$radians, where $\theta<<2\pi$, and the beam orbits the analyser axis in the arcuate direction by an angle $2\pi+/-\theta$ radians for each half oscillation, the beam will pass through an arcuate focusing lens at z=0 after each half oscillation (each reflection). However, in a more preferred embedment, the arcuate lenses are instead placed offset a short distance from the z=0 plane at the points where the beam path overlaps itself travelling in opposite directions (during any one oscillation) as shown by the positions of arcuate lenses 325 in FIG. 8. The offset from the z=0 plane may be e.g. 5 mm in the analyser of Example A and 2.75 mm in the analyser of Example B. For illustration only four such lens 325 are shown in the Figure. This has the advantage that each lens is used twice and if the same number of lenses 325 are used as would be used for the lenses 315 the trajectories of the main flight path may be packed more closely together thereby doubling the total flight path length. For example, whereas there may be space around the main flight path of the ion beam for 36 arcuate focusing lenses, in the case of placing the lenses at the z=0 plane, that would mean having 36 passes across the z=0 plane (i.e. 36 reflections from the mirrors or 18 full oscillations in the z direction) before the beam returns to its starting position. However, in the case of placing the lenses offset from the z=0 plane as described above, it would mean having up to 72 passes across the z=0 plane (i.e. 72 reflections from the mirrors or 36 full oscillations in the z direction) before the beam returns to its starting position. Thus, for the case of offset lenses 325, if the plurality of arcuate focusing lenses 325 are periodically spaced apart in the arcuate direction by an angle $\theta$radians, where $\theta<<2\pi$, and the beam orbits the analyser axis in the arcuate direction by an angle $4\pi+/-\theta$ radians for each full oscillation, the beam will pass through each arcuate focusing lens twice per full oscillation.

Various embodiments of injection of the beam into the analyser volume and onto the main flight path will now be described.

A first group of methods for injection to the analyser is illustrated in the schematic cross sectional diagrams of FIGS. 9 and 10. In a first group of embodiments, in which like components have the same labels, FIG. 9*a* is a cross sectional view of the analyser at the plane z=0, though it also contains some features off the z=0 plane. The inner and outer field-defining electrode systems 900, 910 respectively, and part of the main flight path of the principal beam 920 are shown. The principal beam herein referred to means the beam path taken by ions having the nominal beam energy and no beam divergence. Injection trajectory 930*a* (denoted by a dashed line), which is an internal injection trajectory, is located within the outer field-defining electrode system 910 (i.e. within the analyser volume). Ions enter the analyser volume from an external injection trajectory 940*a* (denoted by a dotted line) through an aperture 950*a* in the outer field-defining electrode system 910 of one, or in some embodiments, both the mirrors. The ions travel along the injection trajectory 930*a* onto the main flight path 920 at point P. Whilst the ions travel along the injection trajectory 930*a*, they do so in the absence of the main analyser field and in this example the injection trajectory is straight and extends substantially from the outer field-defining electrode system to the main flight path. The injection trajectory 930*a* intercepts the main flight path 920 tangentially at the point P. FIG. 9*b* illustrates an injection arrangement to which FIG. 9*a* applies but in an orthogonal cross sectional side view looking in the direction of arrow A and shows that in this example the ions enter the analyser from external trajectory 940*b*, (940*a* in FIG. 9*a*) through aperture 950*b* (950*a* in FIG. 9*a*) in the outer field-defining electrode system 910 of just one of the analyser mirrors. In this example the point P is displaced from the z=0 plane by a distance 960*b*, since it is not a requirement that the injection trajectory 930*b* join the main flight path 920 on the z=0 plane, though it may do so. The displacement may be towards or away from the first mirror encountered by the ions once commencing the main flight path. In this example, the ions arrive at point P with the correct energy and direction of motion to commence the main flight path under the action of the main analyser electrical field.

In certain examples herein, e.g. relating to FIGS. 9 and 10 and some other examples, for simplicity of illustration the injection is exemplified by having the main analyser field turned off whilst the beam traverses the injection trajectory. However, it will be appreciated that the same methods of injection may alternatively be performed not by having the main analyser field turned off but by shielding the injection trajectory from the main analyser field, i.e. the injection trajectory up to point P could be shielded from the main analyser field, in which cases the main analyser field is preferably not turned off during injection which is advantageous from the perspective of not requiring fast switching of voltages. The potential upon the outer field-defining electrode systems of the two mirrors is the same, and that potential, which may be zero, is also applied to all the electrodes within the analyser, making the volume within the analyser field-free. Upon the beam arriving at the main flight path 920 at point P, the potentials upon the analyser electrodes are applied to produce the main analyser field. The charged particle beam is directed onto the injection trajectory 930 (930*a*-930*g*) with the kinetic energy required to travel along the main flight path 920 of the analyser when the potentials on the analyser are applied to produce the main analyser field (although optionally a different kinetic energy could be used with a change of kinetic energy imparted upon reaching point P). In these examples, when the beam travels along the main flight path 920, the potential upon the inner field-defining electrode systems of both the mirrors is −2587V whilst that on the outer field-defining electrode systems of both mirrors is 0V. Whilst the beam traverses the injection trajectory 930, the potential upon the inner field-defining electrode systems 900 of both the mirrors is set to 0V. Upon reaching point P therefore, when the potential is applied upon the inner field-defining electrode systems 900 of both mirrors, the beam experiences an accelerating field towards the analyser axis which causes the beam to orbit within the analyser. For clarity, FIGS. 9 and 10 omit the arcuate focusing lenses and their support belt electrode assemblies as previously described. The potentials upon these components are also set to 0V whilst the beam traverses the injection trajectory 930, and are then restored when the beam arrives at point P. The beam reaches the point P by passing through an aperture in the outer belt electrode (not shown).

As already described, the injection of the invention may be worked by producing a different field from the main analyser field whilst the beam traverses the injection trajectory, that field not necessarily being zero.

Figure 9A:
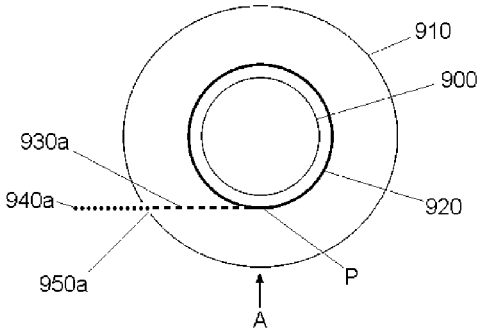
FIGS. 9 and 10 show schematically various embodiments of injection of the beam into the analyser of the invention.
Figure 9B:
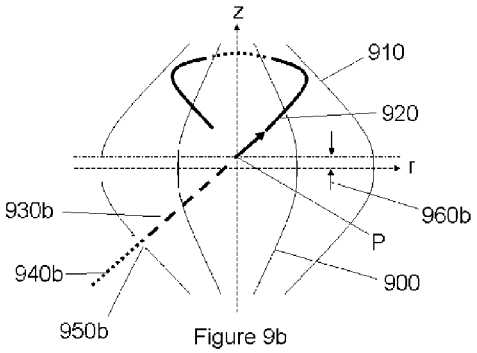
Figure 9C:
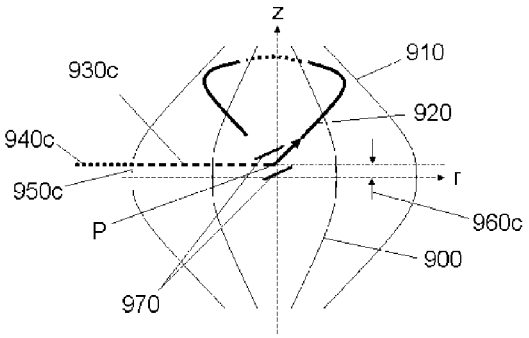

FIG. 9*c* illustrates another example of injection. The view in FIG. 9*a* also applies to this example. The external trajectory 940*c* in this case again enters the analyser through an aperture 950*c* in the outer field-defining electrode systems of one mirror 910, at which point the injection trajectory 930*c* commences, and again point P does not lie on the plane z=0, being offset by distance 960*c*. However in this example the ions reach point P travelling in a direction parallel to the z=0 plane which does not allow them to commence upon the main flight path without realignment, and a deflector 970 is provided near the point P to change the velocity of the beam so that it can commence the main flight path 920, deflecting the beam in the z direction. Deflector 970 is shown schematically as a pair of deflector plates. The deflection increases the velocity of the beam in the z direction and decreases the velocity of the beam in the arcuate direction.

Figure 9D:
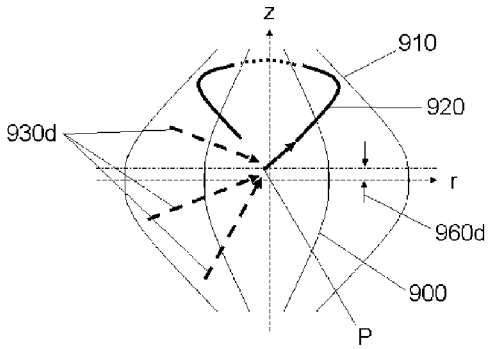

FIG. 9*d* illustrates the general case where the injection trajectory 930*d* is directed to point P from any angle (i.e. not only parallel to the z=0 plane as shown in FIG. 9*c*). Again FIG. 9*a* applies to these cases as the injection trajectory is directed to intercept the main flight path tangentially at the point P. Deflection in the z direction is required for all cases where the injection trajectory 930*d* is not aligned with the main flight path as it is in the example of FIG. 9*b*. Deflection may be to increase the z velocity or decrease it depending upon the angle at which the injection trajectory intercepts the main flight path. Accordingly the velocity in the arcuate direction may be decreased or increased.

FIG. 10 illustrates a second group of examples of injection. Components similar to those in FIG. 9 are given the same identifiers. In these examples the injection trajectory 930 does not intercept the main flight path 920 tangentially, but intercepts normal to the tangent, as is shown in FIG. 10*a*, which is a schematic cross sectional view of the analyser in the plane z=0, though it also contains some features off the z=0 plane. The inner and outer field-defining electrode systems 900, 910 respectively, and the main flight path of the principal beam 920 are shown. Injection trajectory 930*e* (denoted by a dashed line) is located within the analyser volume inside the outer field-defining electrode system 910 of one, or in some embodiments, both the mirrors. Ions enter the analyser from external trajectory 940*e* (denoted by a dotted line) through an aperture 950*e* in the outer field-defining electrode system 910. The ions travel along the injection trajectory 930*e* onto the main flight path 920 at point P. Whilst the ions travel along the injection trajectory 930*e*, they do so in the absence of the main analyser field and in this example the injection trajectory 930*e* is straight and extends substantially from the outer field-defining electrode system 910 to the main flight path. The injection trajectory 930*e* intercepts the main flight path 920 orthogonal to the tangent of the main flight path at point P. FIGS. 10*b* and 10*c* show two cross sectional side views, orthogonal to one another, of an example of an injection arrangement for which FIG. 10*a* applies, both views also being orthogonal to that in FIG. 10*a*. FIG. 10*b* is the cross sectional side view looking in the direction of arrow A and FIG. 10*c* is the cross sectional side view looking in the direction of arrow B. The ion beam follows an external trajectory 940*f*, passes through aperture 950*f* in the outer field-defining electrode system 910 and commences injection trajectory 930*f*. It is deflected by one or more deflectors (e.g. electric sectors) to commence motion on the main flight path (not shown) so that upon reaching point P the beam commences the main flight path 920. In this case the deflectors act to increase the velocity of the beam in the arcuate direction and decrease the velocity of the beam in the inward radial direction. FIG. 10*d* illustrates the general case in which the injection trajectory 930*g* is directed to point P from any angle. Where that angle does not equal the angle taken by the main flight path at point P, deflection is required.

Types of injection may also be arranged with a combination of the cases illustrated in FIGS. 9 and 10, in which the injection trajectory is directed to point P at any angle, whilst in the absence of the main analyser field, where the injection trajectory intercepts the main flight path neither tangentially nor in a direction orthogonal to the tangent of the main flight path.

Injection may also be conveniently arranged where point P is at or near one of the turning points in the analyser. In this case a belt electrode such as is shown in FIG. 6*d* at 670 may be used to support a deflector.

Figure 10A:
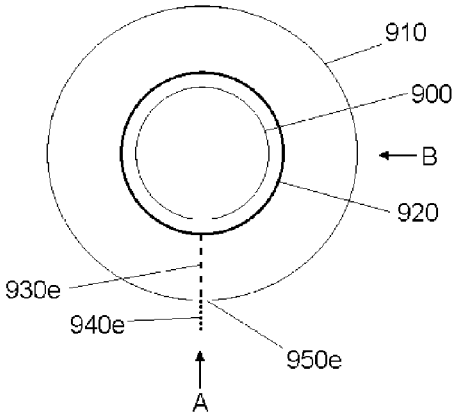
Figure 10B:
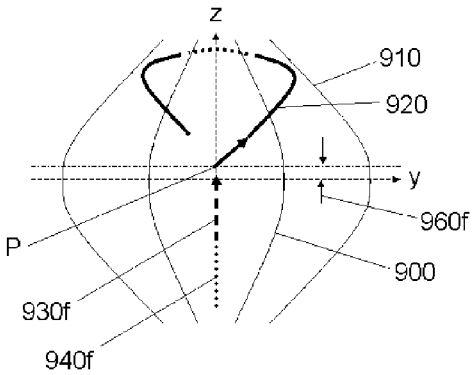
Figure 10C:
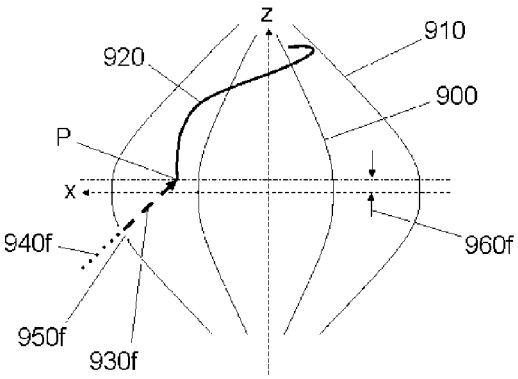
Figure 10D:
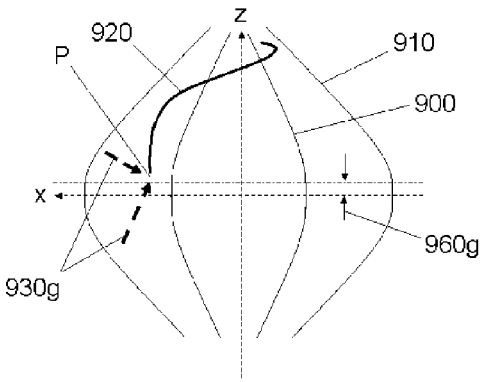
Figure 10E:
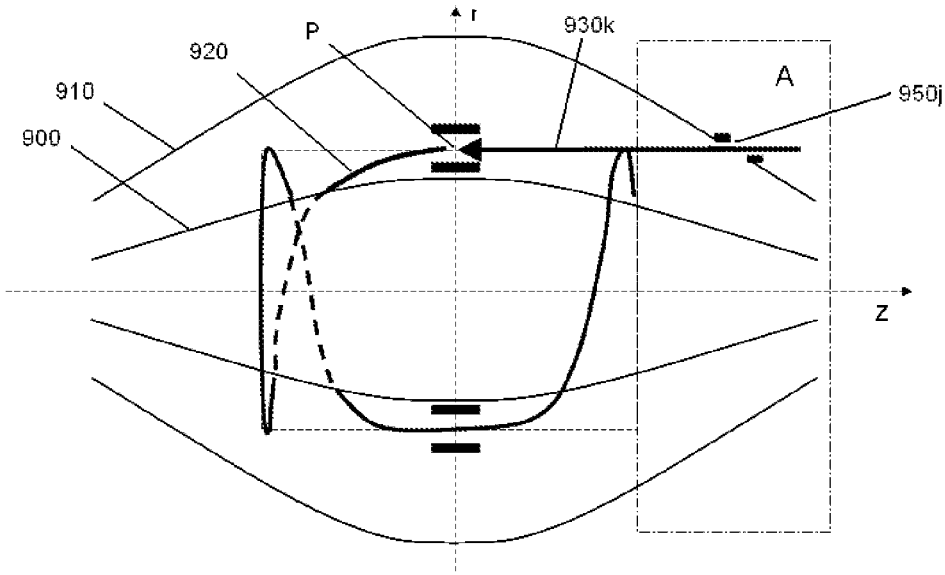
Figure 10F:
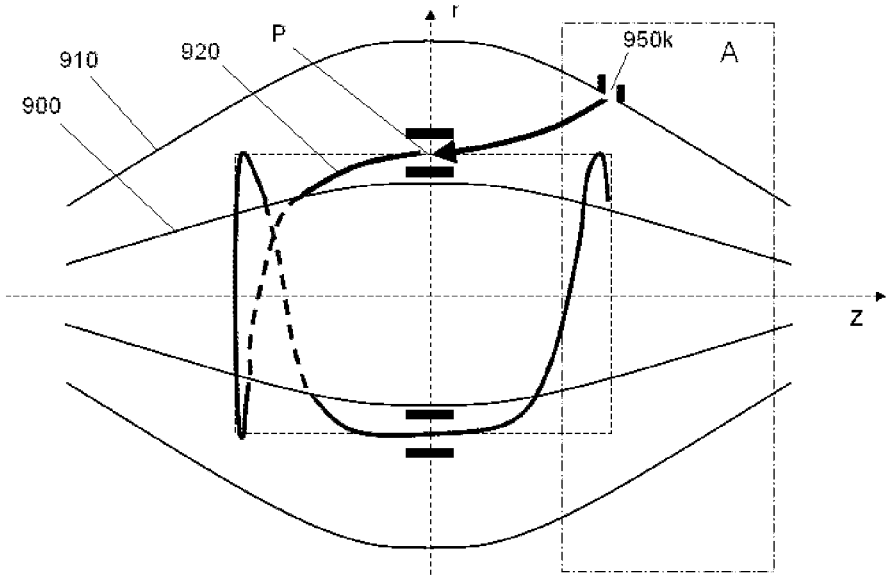

Further injection embodiments are shown in FIGS. 10*e* and 10*f* which show schematic cross sectional side views of an analyser according to the invention where like components are identified by like references used in previous Figures. In FIG. 10*e*, the beam enters the analyser volume through an aperture 950*j* in the outer field-defining electrode system 910 of one of the mirrors at a z position greater than the maximum turning point of the beam in the mirror but at the same radius from the analyser axis as the main flight path. The internal injection trajectory 930*k* is traversed until the beam reaches the main flight path 920 at point P at the z=0 plane where the beam receives a deflection in the arcuate direction from a deflector not shown. The region denoted A, which is enclosed by the dash-dot line, is held at a potential whilst the ion beam enters the analyser volume which is different to the potential it is held at once the beam is travelling on the main flight path. This may be conveniently achieved by the presence of appropriate field-spoiling or modifying electrodes (not shown) located a greater z than the maximum turning point. Whilst the beam enters the analyser volume the field-spoiling or modifying electrodes are biased electrically so that the potential within region A is distorted. When the beam has begun its travel on the main flight path, the potential distribution in the region A is restored to that which is necessary for the beam to continue travel on the stable main flight path 920. FIG. 10*f* shows an analogous arrangement having a similar region A but the beam enters the analyser volume at a different radius than the main flight path through an aperture 950*k* in the outer field-defining electrode system 910 of one of the mirrors. In that case, the beam is additionally given a deflection in the radial direction where it meets the main flight path at point P.

Figure 11A:
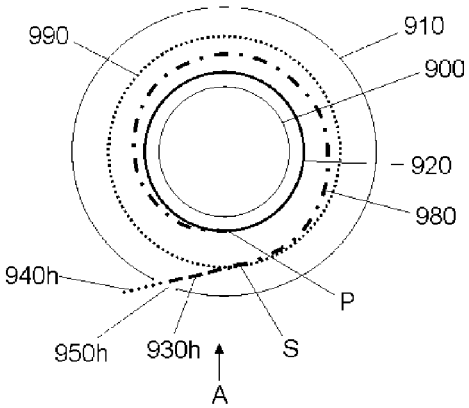
FIGS. 11 to 17 (but not FIGS. 16*c* and 16*d*) show schematically various embodiments of injection of the beam into the analyser of the invention.
Figure 11B:
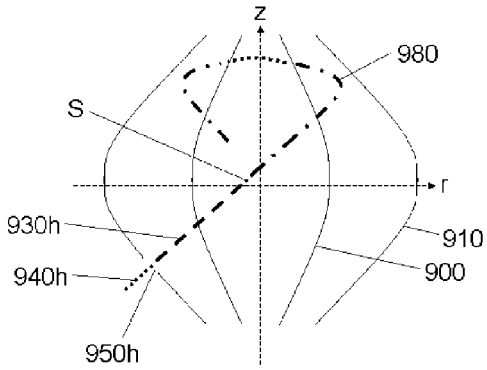
Figure 11C:
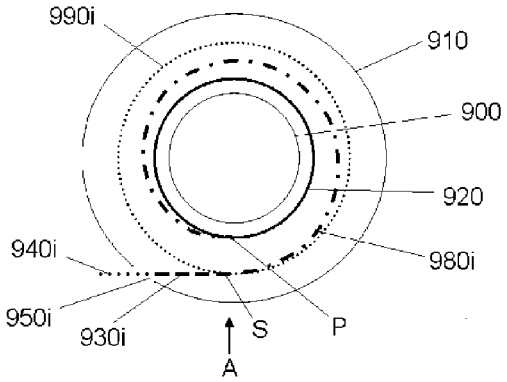
Figure 11D:
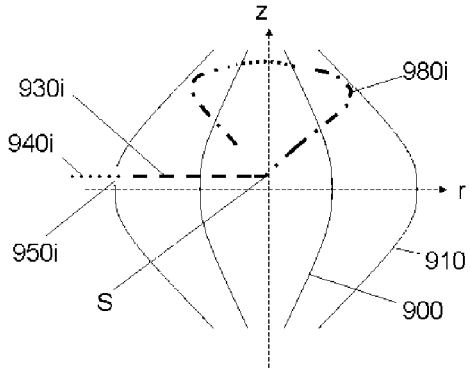
Figure 11E:
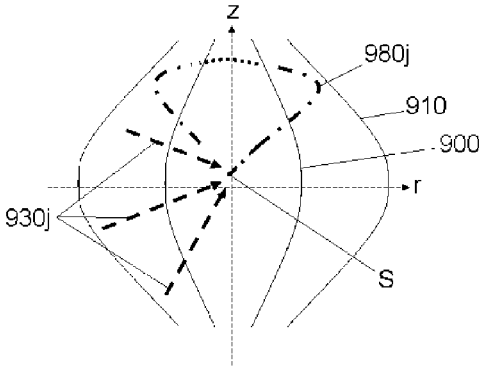
Figure 12A:
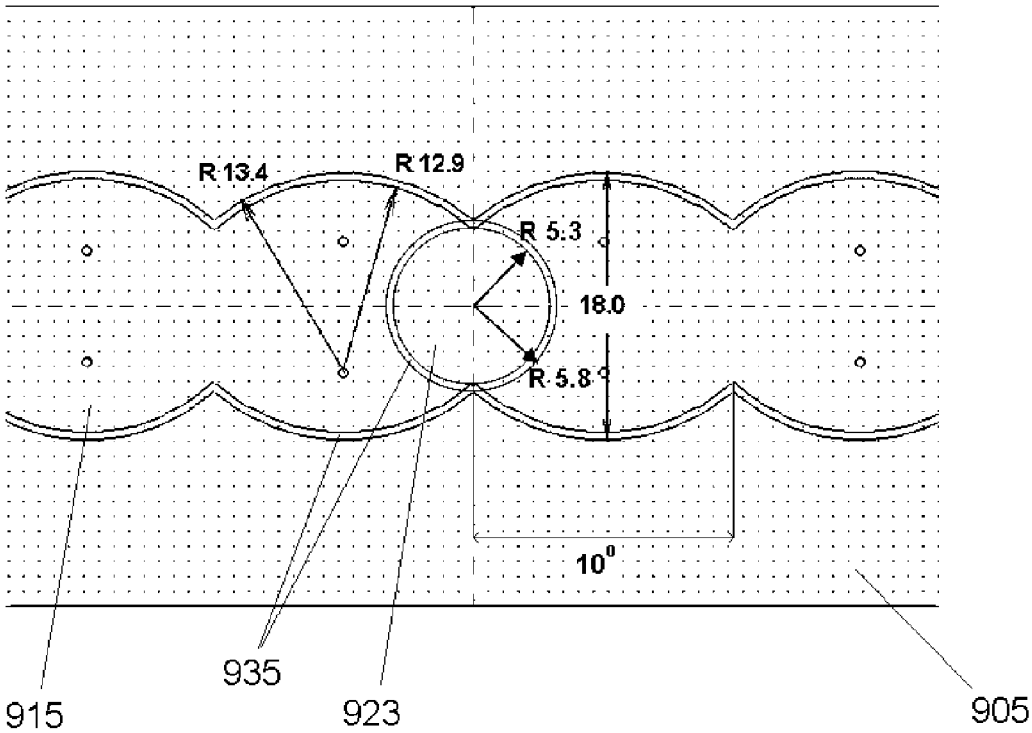
Figure 12B:
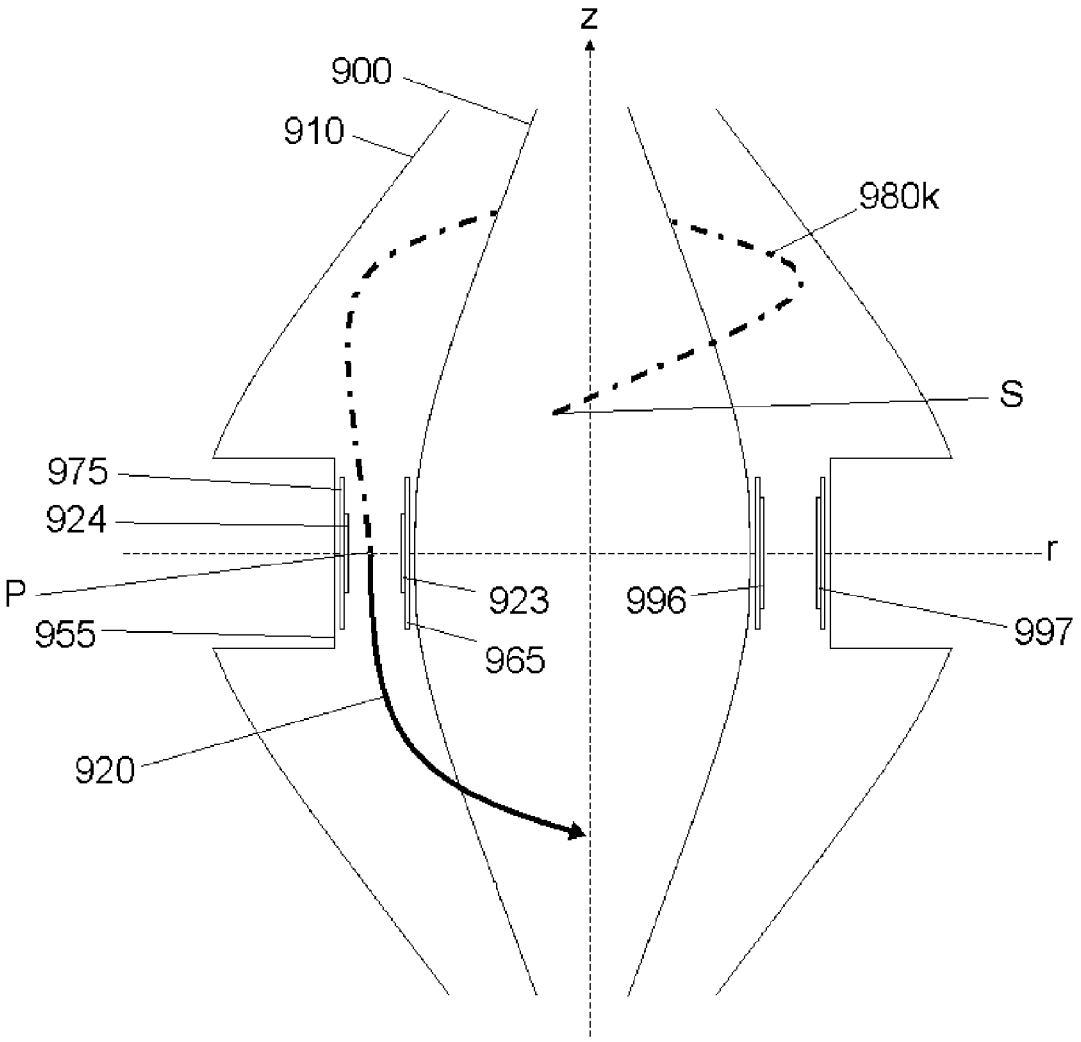

Injection to the analyser utilising other injection embodiments is illustrated in the schematic diagrams of FIGS. 11 and 12. Components similar to those in FIG. 9 are given the same labels. In a first group of embodiments, FIG. 11*a* is a cross sectional view of the analyser at the plane z=0 though it also contains some features off the z=0 plane. The inner and outer field-defining electrode systems 900, 910 respectively, and the main flight path of the principal beam 920 are shown. Injection trajectory 930*h* (denoted by a dashed line) is located in the analyser volume within the outer field-defining electrode system 910. Ions enter the analyser from an external trajectory 940*h* through an aperture 950*h* in the outer field-defining electrode system 910 of one or both of the analyser mirrors. The ions travel along the injection trajectory 930*h* onto an injection trajectory 980 at a different distance 990 from the z axis than the main flight path, at a point S. Whilst the ions travel along the injection trajectory 930*h*, they do so in the absence of the main analyser field, e.g. with the potentials on the inner and outer field defining electrode systems 900, 910 switched off, and in this example the injection trajectory 930*h* is therefore straight and extends substantially from the outer field-defining electrode system 910 to the injection trajectory 980 at point S. Upon reaching point S, the main analyser field is switched on and the beam travels along the injection trajectory 980 in the presence of the main analyser field, which is also the field applied as the beam reaches point P at the start of the main flight path and as the beam travels along the main flight path. In this example, the kinetic energy of the ions is chosen such that the injection trajectory 980 of the ions (denoted by a dash-dot line) does not remain upon a path at distance 990, but instead proceeds to spiral with progressively decreasing radius towards the analyser axis z and intercept the main flight path at point P. References herein to the injection trajectory being at a different distance than the main flight path do not mean that the injection trajectory remains upon a path at that distance, only that the beam at least proceeds to a point at that distance. The ions on the injection trajectory 980 spiral inward and eventually reach point P but do not have the correct velocity to commence upon the main flight path. FIG. 11*b* shows this example in an orthogonal cross sectional side view looking in the direction of arrow A in FIG. 11*a*. The main flight path is not shown in FIG. 11*b* for clarity, and only a portion of the injection trajectory 980 is illustrated. The point S at which the injection trajectory 930*h* joins the injection trajectory 980 may be anywhere within the analyser between the inner and outer field-defining electrode systems 900, 910 and in this example is not exactly on the z=0 plane but near to it. Upon reaching or approaching the main flight path at or near point P, the ions are deflected by a deflection device (not shown in FIG. 11) to impart additional velocity to the ions in the radial direction away from the analyser axis z, whereupon they are able to commence upon the main flight path 920. An example of one electrode which comprises half of the deflector assembly is shown in FIG. 12*a*. A belt electrode assembly 905 of z height 40.0 mm supports one half of the arcuate focusing lens assembly 915 and one half of the deflector assembly 923, each set within the belt and electrically insulated from it by insulation 935. In this embodiment, the belt electrode assembly 905 and lens assembly 915 are located at the same radius from the analyser axis. All dimensions shown are in mm. FIG. 12*b* shows a schematic cross sectional side view through a portion of the analyser with identifiers for like components as in FIG. 11. The outer field-defining electrode systems of both mirrors have a waisted-in portion 955. The inner and outer belt electrode assemblies 965 and 975 respectively support inner and outer deflection electrodes 923, 924 respectively. The injection trajectory 930 (not shown) is traversed by the beam in the manner shown in FIG. 11 to point S at a larger distance from the analyser axis z than the main flight path 920, whereupon the beam commences the injection trajectory 980*k*, spiralling inward to pass through the gap between the deflection electrodes 923, 924 to point P upon the main flight path 920. For injection, deflection electrodes 923, 924 are only present at one location on the analyser equator. At other points upon the equator arcuate focusing lens electrodes 996 and 997 are present (only one pair of which is shown). As will be further described, an additional pair of deflection electrodes may be positioned upon the equator to effect ejection of the beam from the analyser. The belt, lens and deflection electrodes depicted in FIG. 12*b* are not to scale and the trajectories are schematic representations only. Both the deflection electrodes 923, 924 of the deflector assembly and the arcuate lens electrodes 996, 997 are shown schematically to be proud of the belt electrode assemblies 965, 975 in which they are mounted, for clarity, but in practice, these electrodes may be set into the belt electrode assemblies and the surfaces of the belt electrode assemblies and the deflector and lens electrodes may be flush.

When the deflection electrodes 923, 924 are not energized, the electrodes are set to the same potentials as the arcuate lens electrodes adjacent to them. When the deflection electrodes 923, 924 are energized, additional voltages are applied to them. In the example utilising electrodes as shown in FIG. 12*a*, the inner deflection electrode 923 has an additional +200 V applied and the outer deflection electrode 924 (not shown in FIG. 12*a*) has an additional −100 V applied when energized. For the arcuate lens electrode design 915 of FIG. 12*a*, the arcuate lens electrodes have the same potential as the belt electrode assembly which supports them, plus an additional +30 V. The pair of deflection electrodes 923, 924 may also be used for arcuate focusing when not used for deflection, in which case a common potential is placed on both the electrodes of the pair. Similar belt electrode assemblies, arcuate lens electrodes and deflection electrodes may be used in the injection embodiments of FIG. 10.

FIG. 11*c* illustrates a further embodiment of injection, and is a cross sectional view of the analyser at the plane z=0 though it also contains some features off the z=0 plane. The inner and outer field-defining electrode systems 900, 910 respectively, and the main flight path of the principal beam 920 are shown. Internal injection trajectory 930*i* (denoted by a dashed line) is located in the analyser volume within the outer field-defining electrode system 910. Ions enter the analyser volume from an external injection trajectory 940*i* through an aperture 950*i* in the outer field-defining electrode system of one or both of the analyser mirrors. The ions travel along the injection trajectory 930*i* in the absence of the main analyser field onto an injection trajectory 980*i* at a different distance 990*i* from the z axis than the main flight path, at a point S. At point S the charged particles experience the main analyser field. Again in this example, the kinetic energy of the ions is chosen such that the injection trajectory 980*i* of the ions (denoted by a dash-dot line) does not remain upon a path at distance 990, but instead proceeds to spiral with progressively decreasing radius towards the analyser axis and intercept the main flight path at point P. The ions reach point P and do not have the correct velocity to commence upon the main flight path 920. FIG. 11*d* shows the example of FIG. 11*c* in a schematic cross sectional side view looking in the direction of arrow A in FIG. 11*c*. The main flight path is not shown in FIG. 11*d* for clarity, and only a portion of the injection trajectory 980 is illustrated. Again, the point S at which the injection trajectory 930 joins the injection trajectory 980 may be anywhere within the analyser between the inner and outer field-defining electrode systems 900, 910 and in this example is not on the z=0 plane. Unlike the embodiment of FIGS. 11*a* and 11*b*, the beam is deflected by a deflection device (not shown) at or near point S to commence the injection trajectory 980*i*. Upon reaching or approaching the main flight path at or near point P, the ions are deflected by a deflection device (not shown in FIG. 11) to impart additional velocity to the ions in the radial direction away from the analyser axis, whereupon they are able to commence upon the main flight path 920. A deflection device similar to that shown in FIG. 12*a* is used, in like manner.

FIG. 11*e* is a similar schematic cross sectional side view to FIGS. 11*b* and 11*d* which illustrates the general case where the injection trajectory 930*j* reaches point S from any angle with respect to the z=0 plane, but still reaches point S tangentially to the radius from the analyser axis. FIG. 11*c* therefore applies to all the cases illustrated in FIG. 11*e*. Deflection of the beam occurs at or near points S and P in a similar manner as described with reference to FIG. 11*d*.

FIG. 13 illustrates in schematic cross sectional views a second group of injection embodiments similar to those shown in FIGS. 11 and 12. Components similar to those in FIG. 9 are given the same identifiers. In these examples the injection trajectory 930*m*, 930*n* does not intercept the injection trajectory 980 at point S tangentially to the distance from the analyser axis to point S, but intercepts normal to the tangent, as is shown in FIG. 13*a*, which is a schematic cross sectional view of the analyser in the plane z=0 though it also contains some features off the z=0 plane. The inner and outer field-defining electrode systems 900, 910 respectively, and the main flight path of the principal beam 920 are shown. Injection trajectory 930*m* (denoted by a dashed line) is located in the analyser volume within the outer field-defining electrode system 910. Ions enter the analyser volume from an external trajectory 940*m* (denoted by a dotted line) through an aperture 950*m* in the outer field-defining electrode system 910 of one or both of the analyser mirrors. The ions travel along the injection trajectory 930*m* onto the injection trajectory 980*m* at point S. Whilst the ions travel along the injection trajectory 930*m*, they do so in the absence of the main analyser field and in this example the injection trajectory 930*m* is again straight and extends substantially from the outer field-defining electrode system 910 to the injection trajectory 980*m* at point S. The injection trajectory 930*m* intercepts the injection trajectory 980*m* orthogonal to the tangent of the injection trajectory 980*m* at point S. FIGS. 13*b* and 13*c* show two schematic cross sectional side views, orthogonal to one another, of an example of an injection arrangement for which FIG. 13*a* applies, both views also being orthogonal to that in FIG. 13*a*. FIG. 13*b* is the cross sectional side view looking in the direction of arrow A and FIG. 13*c* is the cross sectional side view looking in the direction of arrow B. The ion beam is deflected by a deflection device (not shown) located at point S so that upon reaching point S the beam commences the injection trajectory 980*m*. In this case the deflection device acts to increase the velocity of the beam in the arcuate direction and decrease the velocity of the beam in the inward radial direction. FIG. 13*d* illustrates the general case in which the injection trajectory 930*n* is directed to point S on the injection trajectory 980*n* from any angle. Where that angle does not equal the angle taken by the injection trajectory at point S, deflection at point S is required. A deflection device similar to that shown in FIG. 12*a* is used, in like manner. Deflection devices suitable for use in any of the Types of injection described herein include electrostatic sectors.

Injection may also be arranged with a combination of the cases illustrated in FIGS. 11 and 13, in which the injection trajectory is directed to point S at any angle, whilst in the absence of the main analyser field, where the injection trajectory 930 intercepts the injection trajectory 980 neither tangentially nor in a direction orthogonal to the tangent of the injection trajectory 980 at point S.

Figure 15:
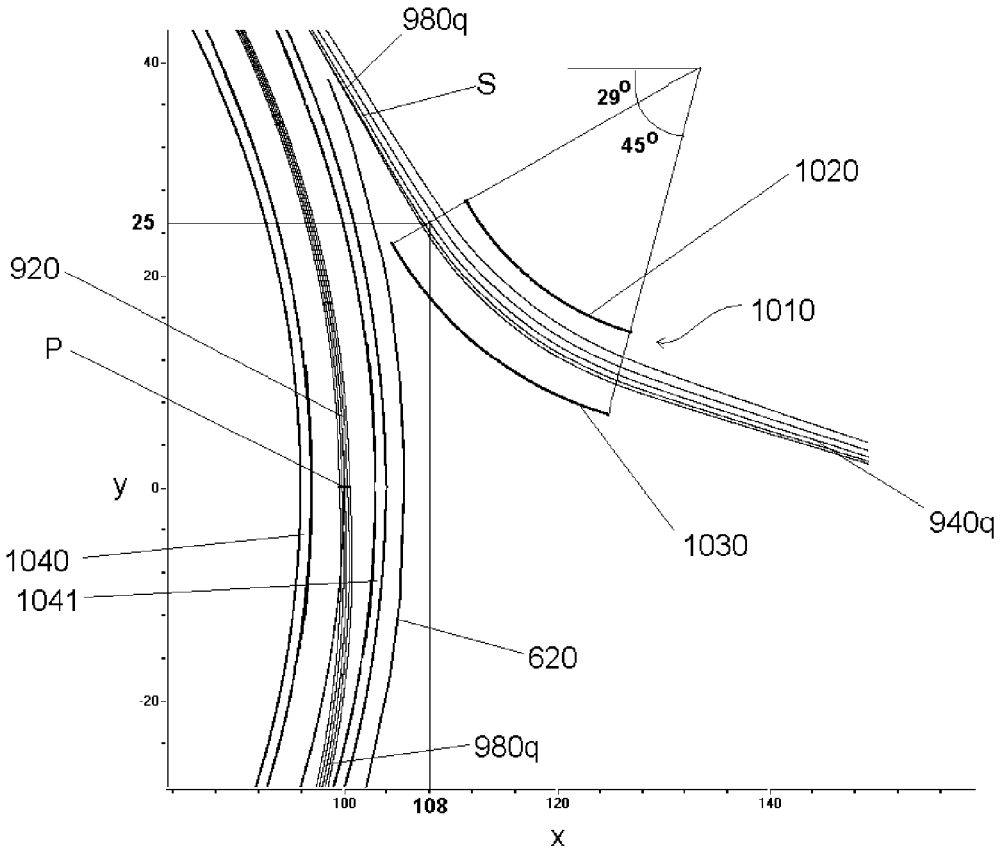

In some embodiments of injection there is no injection trajectory 930, i.e. the substantially straight section of injection trajectory. An example of an electrostatic sector used in a preferred embodiment of this type of injection in which there is no injection trajectory 930 is shown schematically in FIG. 15 where like components to those in FIG. 9 are given the same identifiers. FIG. 15 shows a cross sectional view at the plane z=0 of only part of an analyser. In this example the electrostatic sector 1010 is positioned outside the analyser volume but adjacent a waisted-in portion 620 of the outer field defining electrode systems of both mirrors which is utilised as described in relation to FIG. 6, to position the electrostatic sector 1010 much closer to the main flight path 920 than would otherwise be possible. The sector 1010 deflects the beam through 45 degrees onto the injection trajectory 980*q* at point S, on passing through an aperture in the waisted-in portion 620 of the outer field-defining electrodes, i.e. point S is located at the aperture. The aperture is not shown in FIG. 15 as it is off the z=0 plane. Further description will be given of this in relation to FIG. 16*a*. The sector comprises inner 1020 and outer 1030 sector electrode elements. The inner sector electrode element has a radius of 26.0 mm and the outer sector electrode element has a radius of 34.0 mm. Inner and outer belt electrode assemblies 1040, 1041 respectively are shown. The incoming beam travels outside the analyser volume along an external trajectory 940*q* and enters the sector between the inner and outer sector elements, whereupon it is deflected through 45 degrees and travels to point S on the injection trajectory 980*q*. After a partial orbit of the analyser axis z, the inwardly spiralling injection trajectory 980*q* (re-appearing in FIG. 15 near (x,y) co-ordinate (80,−28)) is at a distance from the analyser axis that is smaller than that of the waisted-in portion 620 of the outer field-defining electrode systems of the mirrors. The beam then reaches point P on the main flight path 920 and proceeds to follow the main flight path. Electrical potentials of +580 V and −580 V are applied to the outer and inner sector elements respectively. The kinetic energy of the particles in this embodiment, i.e. with the main flight path at r=100 mm, is 4350 eV.

Figure 16B:
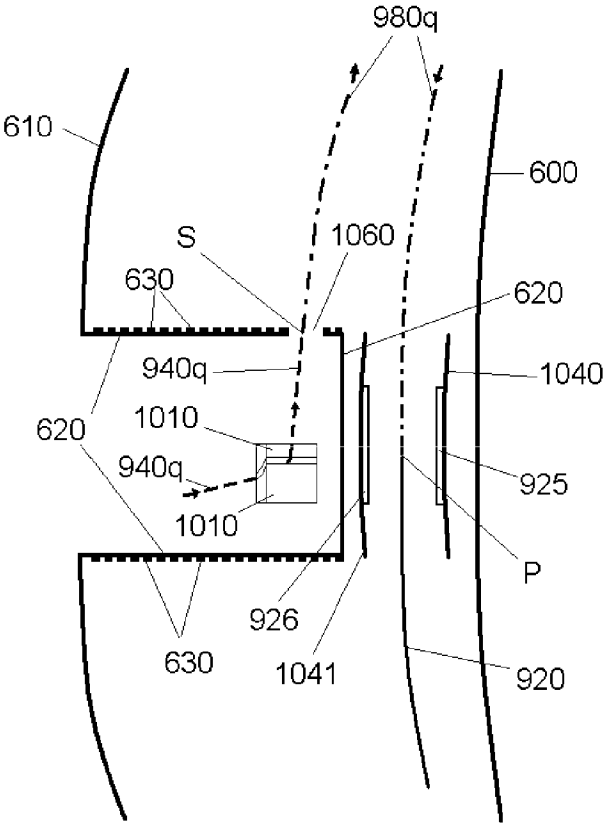
FIGS. 16*c* and 16*d* show schematically embodiments of ejection of the beam from the analyser of the invention.
Figure 16A:
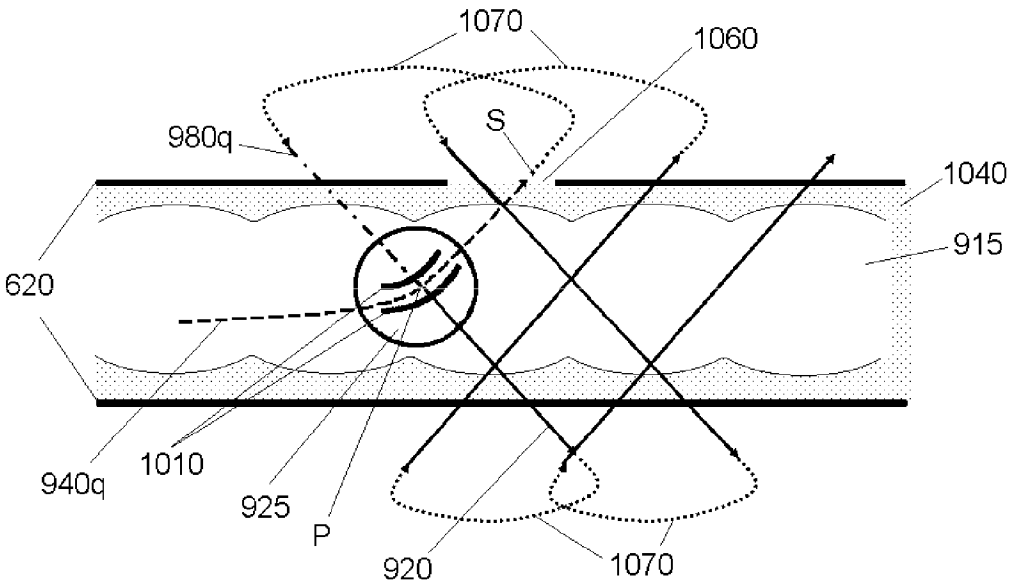

FIG. 16*a* shows a schematic representation of a portion of the analyser of the preferred injection embodiment of FIG. 15, and FIG. 16*b* shows a side view orthogonal to that of FIG. 16*a* in a schematic cross sectional view, also containing some features, such as the beam, that are not in the cross sectional plane. FIGS. 16*a* and 16*b* show a portion of the analyser comprising inner and outer belt electrode assemblies 1040, 1041, inner and outer arcuate lens assemblies 915, 916 an injection deflector electrode 925 and an injection sector 1010. The outer belt electrode assembly 1041, outer lens assembly 916, outer deflector electrode 926 and most of the outer field-defining electrode system 610 are not shown for clarity in FIG. 16*a*. FIG. 16*b* shows the outer and inner field-defining electrode systems 610, 600. The outer field-defining electrode system 610 has a waisted portion 620 as previously described in relation to FIG. 6 and includes an aperture 1060 which is shown in both FIGS. 16*a* and 16*b*. FIG. 16*b* also shows electrode tracks 630 similar to those described in relation to tracks 630 in FIG. 6. The aperture 1060 is located in the waisted portion 620 of the outer field-defining electrode system upon which are situated the array of electrode tracks 630 shown in FIG. 6. The aperture 1060 pierces the waisted portion 620 of the outer field-defining electrode system and some of the array of electrode tracks 630. An ion beam leaves the pulsed ion source (not shown) along an external trajectory 940*q* and enters the sector 1010, whereupon it is acted upon by the sector to commence upon an injection trajectory 980*q* within the analyser volume at point S upon passing through the aperture 1060 in the waisted outer field-defining electrode system. In this example the injection trajectory 980*q* is traversed whilst in the presence of the main analyser field. This preferred embodiment has no straight internal injection trajectory (i.e. no trajectory within the analyser volume before point S). After approximately one orbit of the analyser axis along the injection trajectory 980*q* the beam arrives at point P between the inner and outer belt electrode systems 1040, 1041 and does not need to pass through an aperture in the outer belt electrode assembly 1041, as the injection trajectory 980*q* has spiralled in decreasing distance from the analyser axis and is inside the radius of the outer belt electrode system 1041, as can be seen in FIG. 16*b* and FIG. 15. The beam is then acted upon by the injection deflector electrodes 925, 926 shown in FIG. 16*b* imparting a radial velocity component to prevent further inward spiralling of the beam, and the beam then commences the main flight path 920 at point P. The dotted lines 1070 in FIG. 16*a* are to indicate orbits taken around the analyser axis (either on the injection trajectory 980*q* or the main flight path) and are not to scale. It can be seen that the beam passes through one turning point (i.e. in one mirror) between commencing the injection trajectory at point S and commencing the main flight path at point P. In this example, the main flight path 920 passes through each one of the arcuate lenses 915 twice per oscillation in the direction of the longitudinal axis z of the analyser. The injection deflector comprises two opposing electrodes 925, 926 at different radii similar to that described in relation to FIG. 12. When not used as a deflector, a similar electrical bias may be applied to both opposing electrodes to convert the deflector into another arcuate lens.

Use of an electrostatic sector, such as sector 1010, in this way may provide the additional advantage that the temporal focal surface of ions of differing kinetic energy may be aligned with a plane of constant z in the analyser, such as z=0, or a plane near to z=0. In addition, alignment of the electrostatic sector may be achieved as shown in FIG. 15, in which all dominant electrical forces from the sector occur in radial and arcuate directions, with little or no forces acting in the direction of the analyser axis, z. This has the effect of maintaining the same path length along z for all ions in the sector and therefore does not alter the location or angle of the temporal focal plane within the analyser.

Figures 14A, 14B:
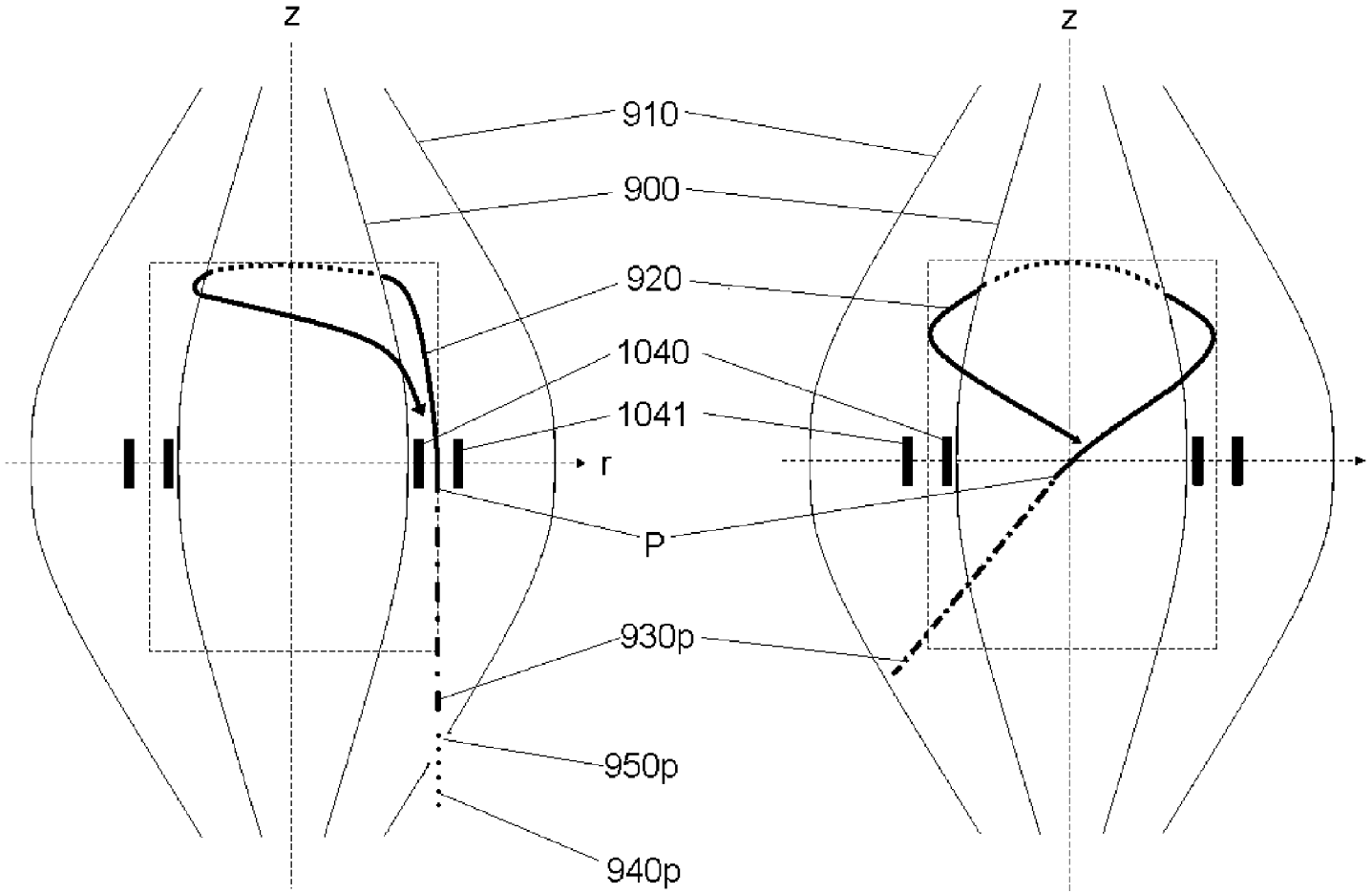

A further type of injection is illustrated in the examples shown schematically in FIG. 14. FIGS. 14*a* and 14*b* show two cross sectional side views, orthogonal to one another, of the same embodiment. Components similar to those in FIG. 9 are given the same identifiers. Ions travel along an external trajectory 940*p* outside the analyser volume and enter the analyser volume through an aperture 950*p*. Inside the analyser volume, they proceed upon an injection trajectory 930*p*, and onto the main flight path 920 at point P, which in this example is not on the plane z=0, though it may be in other embodiments. The main flight path 920 passes between inner and outer annular belt electrode assemblies 1040 and 1041 respectively which are coaxial with and surround the inner field-defining electrode systems 900 at the z=0 plane. Deflection in the arcuate direction may or may not be required for the beam to commence the main flight path 920. If required a deflection device such as those described earlier may be used. In this example, the injection trajectory 930*p* is traversed whilst in the presence of an injection analyser field which differs from the main analyser field. When the beam arrives at or near point P, the field within the analyser is changed from the injection field to the main analyser field by changing the electrical bias upon the inner and outer field-defining electrode systems 900, 910. The beam has an injection kinetic energy such that upon reaching point P, it commences the main flight path 920 in the presence of the main analyser field. The injection trajectory 930*p* is shown as being straight as, in this example, the injection field is of much lower intensity than the main analyser field and the beam travels along the injection trajectory with only a small deviation from a straight line. The intensity of the injection field may optionally be a substantial fraction of the main analyser field intensity, in which case the injection trajectory 930*p* would deviate significantly from a straight line.

Figure 14C:
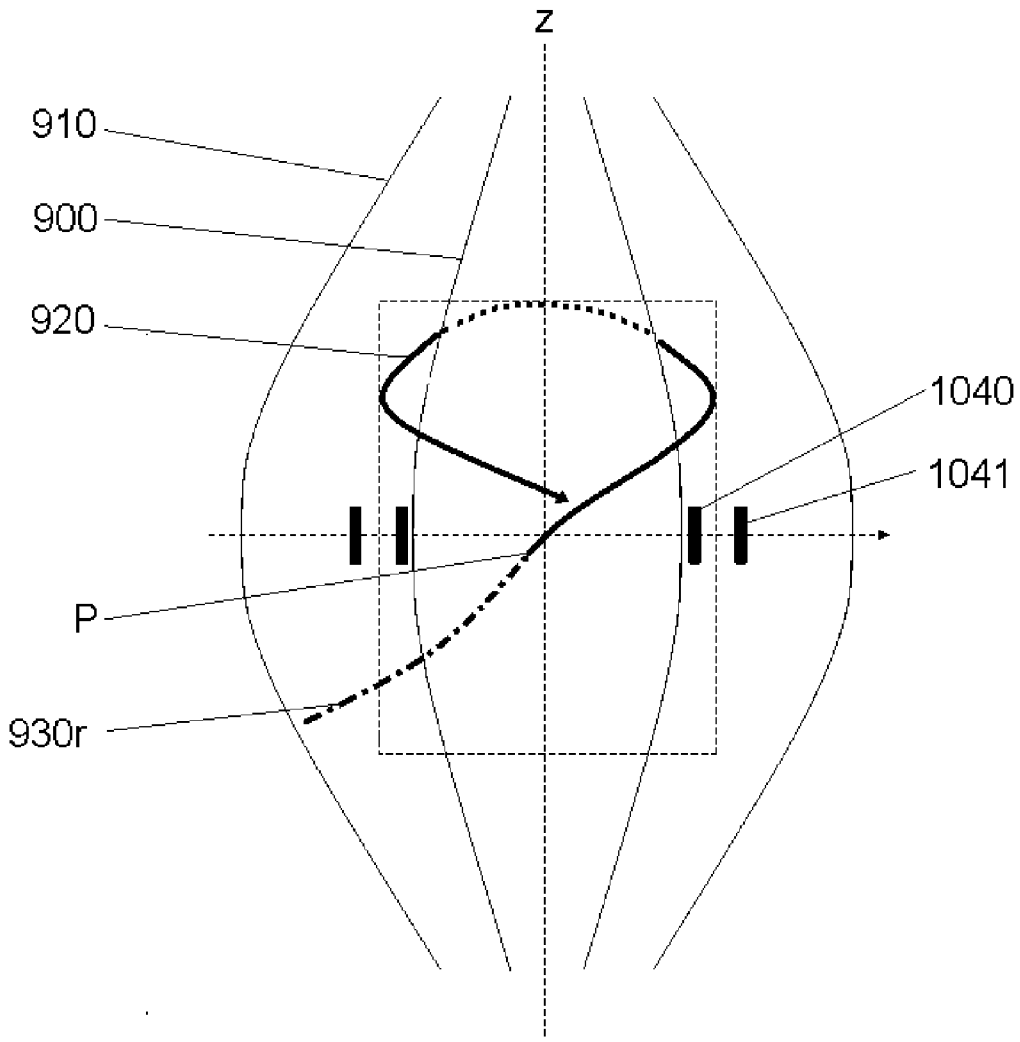

An alternative embodiment is shown schematically in FIG. 14*c*, from the same viewpoint as FIG. 14*b*. In this case the beam travels along the injection trajectory 930*r* in the presence of the main analyser field, but does so having an injection kinetic energy that is greater than would allow it to travel along the main flight path upon reaching point P. Accordingly a deceleration device is used to reduce the kinetic energy of the beam as it approaches point P. The injection trajectory 930*r* is in this example a curved path.

Another further type of injection is illustrated in the examples shown in FIG. 17, which shows two alternative embodiments as schematic cross sectional side views. Like features have the same identifiers as in FIG. 6. In FIG. 17*a*, injector 681 directs ions along an external trajectory 940*s* outside the analyser volume of analyser 601. The ions pass through aperture 950*s* in the waisted-in portion 620 of outer field-defining electrode systems 610 and thereafter enter the analyser volume of analyser 601. The ions proceed within the analyser volume under the influence of the main analyser field along the injection trajectory 930*s*, through aperture 688 in the outer belt electrode assembly 660, and onto the main flight path 920 at point P. The injection trajectory 930*s* is short relative to the size of the analyser 601. A deflector (not shown) is mounted upon the inner and outer belt assembles 650, 660, near point P and acts to deflect the beam so it commences upon the main flight path 920 by imparting an outwardly radial force upon the beam.

Figure 17B:
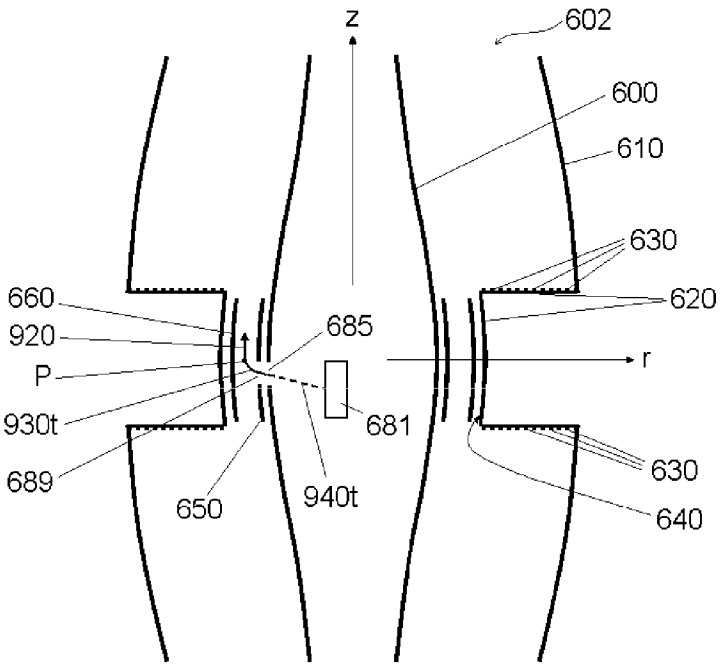

An alternative embodiment is shown in FIG. 17*b*. Injector 681 is positioned outside the analyser volume at a smaller radius than the inner field-defining electrode system 600 and directs ions along an external trajectory 940*t* outside the analyser 602. The ions pass through aperture 685 in the inner field-defining electrode system 600 and enter the analyser volume of analyser 602. The ions proceed in the analyser volume under the influence of the main analyser field along the injection trajectory 930*t*, through aperture 689 in the inner belt electrode assembly 650, and onto the main flight path 920 at point P. The injection trajectory 930*t* is short relative to the size of the analyser 602. A deflector (not shown) is mounted upon the inner and outer belt assembles 650, 660, near point P and acts to deflect the beam so it commences upon the main flight path 690 by imparting an inwardly radial force upon the beam.

Figure 17A:
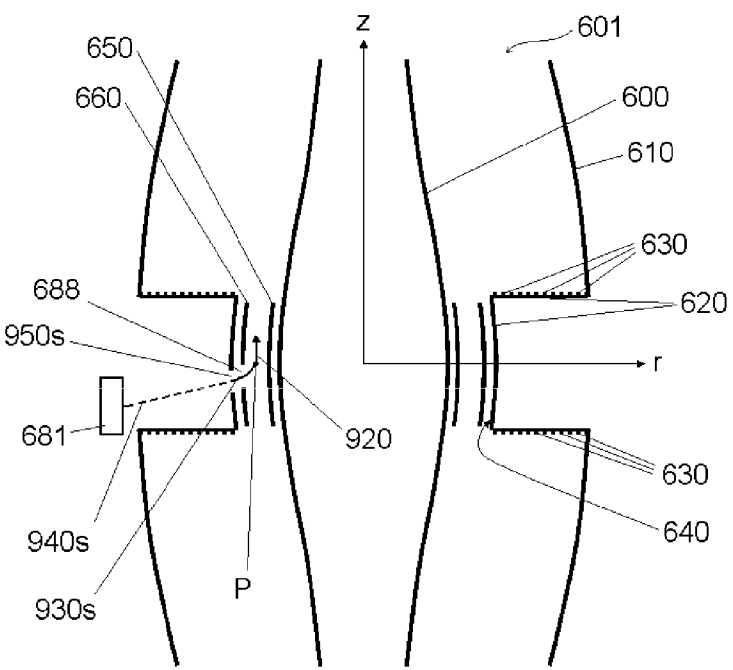

In both embodiments of FIGS. 17*a* and 17*b*, deflectors such as those shown in FIG. 12 and already described are suitable for imparting the outwardly or inwardly radial force at or near point P. These injection deflectors and the apertures 688 and 689 in outer and inner belt electrode assemblies respectively need only be located at one arcuate position within the analyser near the z=0 plane in communication with the injector 681, and hence do not affect the main analyser field elsewhere within the analyser. Alternative forms of deflector may comprise opposing electrodes mounted upon inner and outer belt electrode assemblies but not integrated into the series of arcuate focusing lenses. Instead the electrodes may be located upon regions of the belt assemblies displaced from the arcuate focusing lenses in the z direction.

In all the injection types and cases described, deflection may include changing the kinetic energy of the charged particle beam at or near point P so that the beam commences the main flight path with the correct energy for stable progression through the analyser on the main flight path.

Figure 17C:
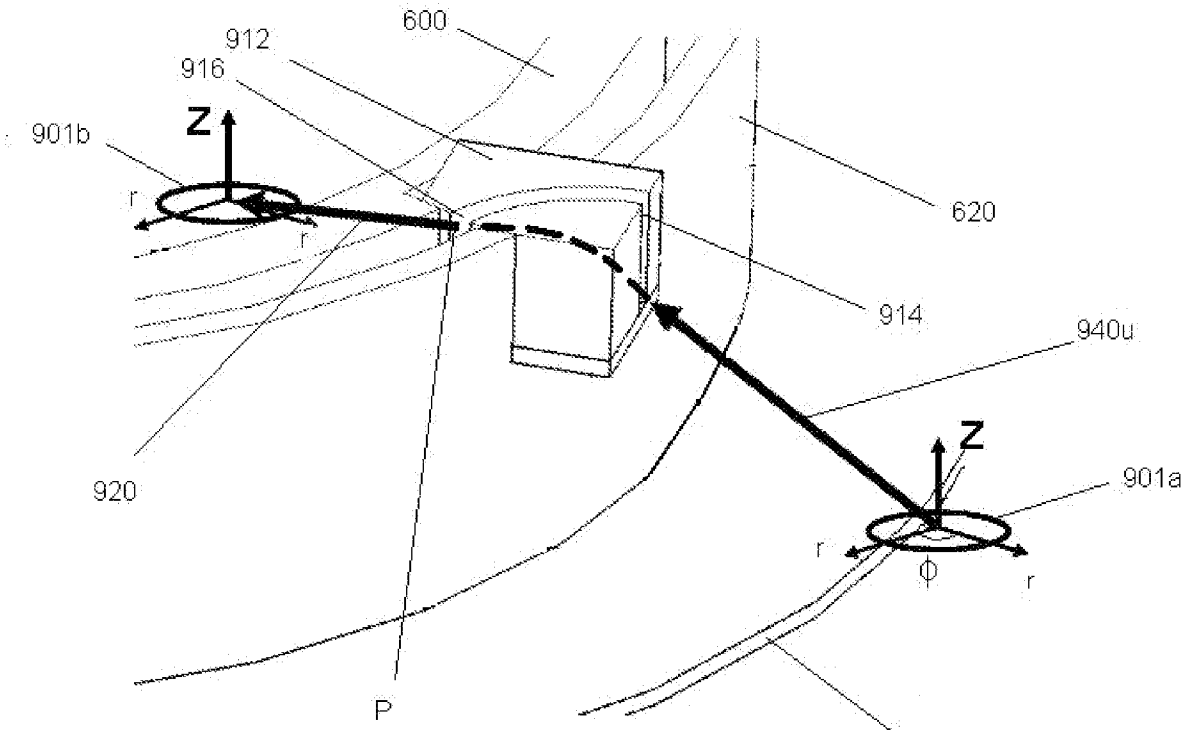

A further preferred embodiment of injection is shown in FIG. 17*c* which shows a schematic view in perspective of a section through the analyser in the region of the equator where an injection of the beam takes place. A part of the outer field-defining electrode system 610 is shown, which is waisted-in at a part 620. The beam follows external injection trajectory 940*u* outside the analyser volume (i.e. outside the waisted-in portion 620) and enters an electrical sector 912 for deflection of the beam. The sector 912 is partly supported by the waisted-in portion 620 and partly supported by the inner field-defining electrode system 600. As described in previous embodiments, an inner belt electrode assembly with associated arcuate focusing lens electrodes is present supported on the outer surface of the inner field-defining electrode system 600 and an outer belt electrode assembly with associated arcuate focusing lens electrodes is present supported on the inner surface of the waisted-in part 620 but these are not shown in the Figure for ease of illustration. The beam enters the sector 912 through an entrance aperture 914 which lies outside the outer belt electrode assembly and waisted-in part 620 and the beam is deflected in the radial r and arcuate $\phi$ directions. The beam exits the sector 912 through its exit aperture 916 which lies inside the outer belt electrode assembly 660 and lies on the same radius (i.e. same radial distance from the z axis) as the main flight path 920, i.e. radially between the inner and outer belt electrode assemblies and arcuate focusing electrodes (not shown). Accordingly, the beam exits the sector 912 directly at point P at the commencement of the main flight path 920 along which it then continues. There is no time focus provided by the sector 912 since there is no force acting in the z direction. The time focus outside the analyser volume is shown by circle 901*a* and inside the analyser volume on the main flight path by circle 901*b*.

Figure 17D:
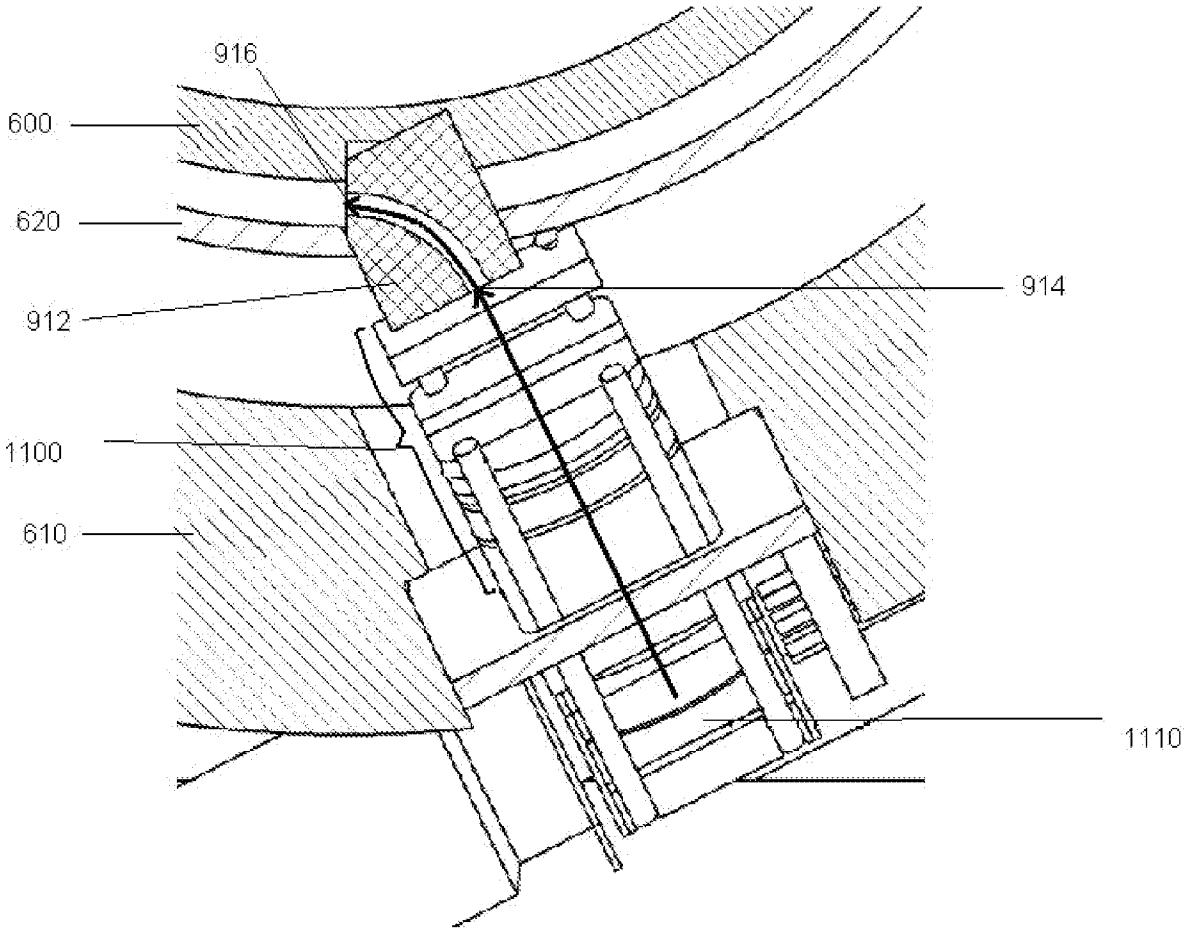

A preferred embodiment utilising an electric sector to deflect the beam directly onto the main flight path is shown in the schematic cross section view through the equator of the analyser in FIG. 17*d*, where like components to those in previous Figures have like references. A pulsed ion trap in the form of a C-trap 1110 is located outside the outer field-defining electrode system 610. The C-trap 1110 generates a beam in the form of a packet of ions for injection into the analyser volume. The injection trajectory of the ion packet from the C-trap is shown by the arrow. The ion packet is guided by ion optics indicated collectively by reference 1100 and into an electric sector 912 through its entrance aperture 914. The ion packet exits directly onto the main flight path at the exit aperture 916 of the sector 912 which lies at the same radius as the main flight path. The sector 912 is partly supported by the waisted in part 620 and partly supported by the inner field-defining electrode system 600. An inner and an outer belt electrode assembly as described in previous embodiments are present in the analyser but is not shown in the section view of the Figure.

Figure 17E:
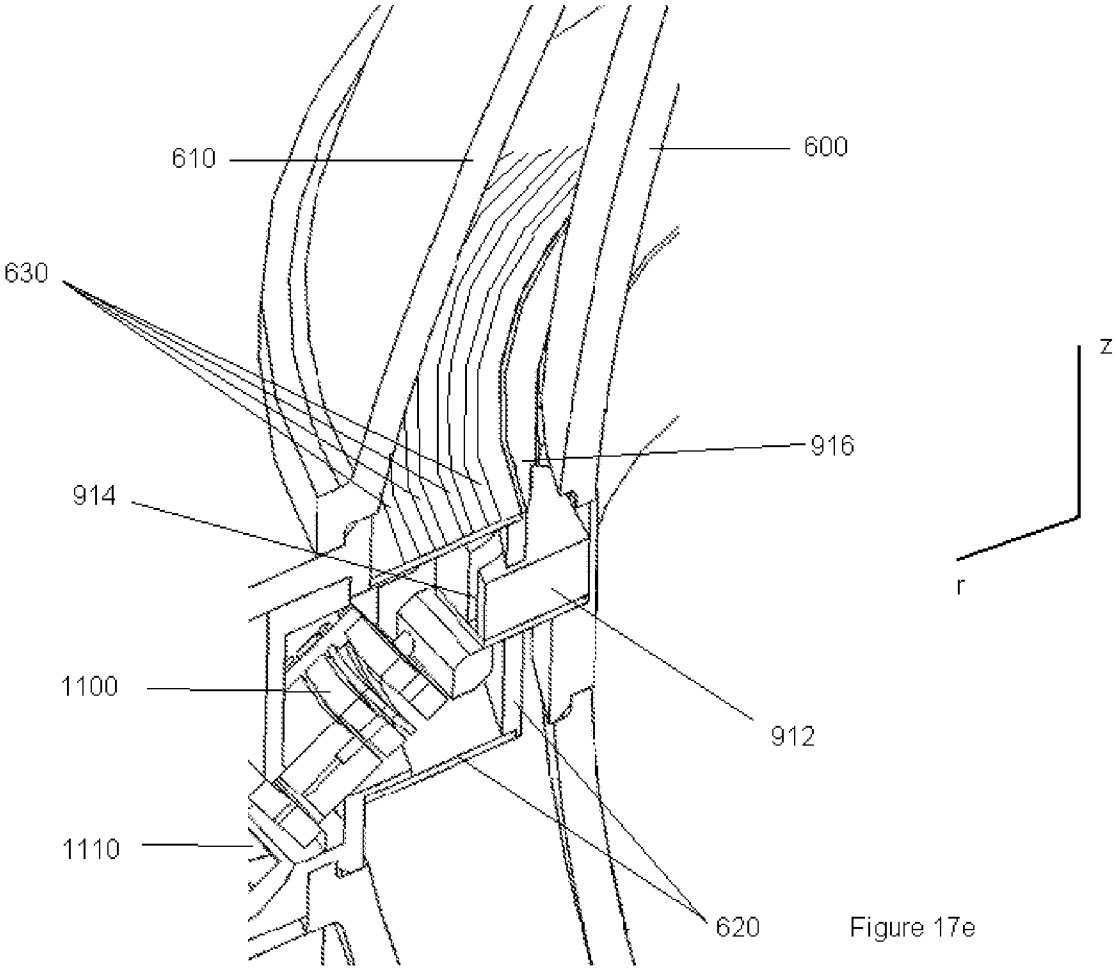

A further similar preferred injection embodiment using an electric sector is shown in FIG. 17*e* which shows part of a cut-away side view in the region of the injection components. In this view the C-trap 1110, ion optics, 1100, electric sector 912 can each be clearly seen. The outer field-defining electrode system 610 and inner field defining electrode system 600 are shown. The outer field-defining electrode system 610 has a waisted-in portion 620 which surrounds part of the ion optics for the injection (the optics thereby lies outside the analyser volume) and partly supports the sector 912. The sector 912 is also partly supported by the inner field-defining electrode 600. The entrance 914 to the sector 912 lies in the area outside the analyser volume surrounded by the waisted-in portion 620 of the outer field-defining electrode 610. In this way, the ions enter the sector 912 without experiencing the main analyser field inside the analyser volume, even though the main analyser field is switched on inside the analyser volume. As in the embodiments shown in FIGS. 17*c* and 17*d*, the ions are injected from the C-trap 1110 and travel through the ion optics 1100 and finally through the sector 912 to emerge from the sector exit 916 directly on the main flight path. The innermost surface of the waisted-in portion 620 of the outer field-defining electrode 610 supports an outer belt electrode (not shown) lying outside the radius of the main flight path. Opposite the outer belt electrode lying inside the radius of the main flight path lies an inner belt electrode (also not shown). The outer and inner belt electrodes (not shown) support the arcuate focusing lenses (not shown) as described with reference to previous Figures. On the side of the analyser volume, the radially inwardly directed side surfaces of the waisted-in portion 620 have electrode tracks 630 similar to those described earlier. The electrode tracks 630 have such voltages applied to them to sustain the, in this case quadro-logarithmic, potential of the main analyser field in the vicinity of the surfaces of the waisted-in portion 620. Similar electrode tracks (not shown) are also provided on the surfaces of the electric sector 912 which face into the analyser volume.

As previously described, the inner and outer field-defining electrode systems may be made of glass. Such glass electrodes have the advantage that they are lower in weight than metals such as invar (glass density may be ~2.5 g/cm$^3$ whilst the density of invar is ~8 g/cm$^3$), and also lower in cost. In the Orbitrap™ electrostatic trap, where the outer halves of the trap are being used for detection, the use of metal-coated glass adds a further advantage of lower capacitance between adjacent electrodes. This property could be also exploited in this analyser when fast switching of voltages on such electrodes is required. In embodiments in which the inner and/or outer field-defining electrode systems are made of glass, resistive electrodes may be incorporated into the glass or formed upon the surface of the glass which, when current is passed through them, heat up for use as bakeout heaters for the analyser.

Analysers of the present invention and especially the analyser volume inside the analyser are maintained under vacuum, preferably high vacuum, more preferably ultra-high vacuum, preferably less than $10^{-8}$ mbar, more preferably less than $10^{-9}$ mbar and still more preferably less than $10^{-10}$ mbar to minimise collisions between the ions and residual gas which would scatter the beam. Materials to be used to achieve such vacuums will be known to those skilled in the art. Bake-out of the analyser to temperatures in excess of 80° C. may be required to achieve the required vacuum. The degree of vacuum required depends upon the path length to be used in the analyser, as is known in the art. Injectors suitable for use with the present invention include curved linear traps that have been termed C traps. Injectors of various known types frequently utilise locally increased gas pressure to collisionally cool ions before injection. To avoid loading the analyser with gas from the injector, an additional deflector may be employed immediately after the injector, to deflect the beam out from the gas emanating from the injector. The analyser aperture through which the beam then passes is located out of the gas stream from the injector, reducing the gas loading on the analyser. Preferably a single deflection or a double deflection is used between the injector and the analyser. The pressure outside the analyser volume may be lower than that inside the analyser volume and may be $10^{-6}$ mbar for example outside the analyser volume.

Various embodiments of ejection of the beam from the main flight path, e.g. to a detector and/or another device for further processing, will now be described.

Ejection from the analyser utilising a first type of ejection embodiments is illustrated in the schematic diagrams of FIGS. 18 and 19. In a first group of embodiments, in which like components have the same labels as used in FIG. 9, FIG. 18*a* is a cross sectional view of the analyser at the plane z=0 though it also contains some features off the z=0 plane. The inner and outer field-defining electrode systems 900, 910 respectively, and the main flight path of the principal beam 920 are shown. Ejection trajectory 931*a* (denoted by a dashed line) is located within the outer field-defining electrode system 910 (i.e. within the analyser volume). Ions leave the analyser volume on an external trajectory 941*a* (denoted by a dotted line) through an aperture 951*a* in the outer field-defining electrode system 910 of one, or in some embodiments, both the mirrors. In use, the ions travel along the main flight path 920, along which they may be separated, to a point E whereupon they commence the ejection trajectory 931*a*. Whilst the ions travel along the ejection trajectory 931*a*, they do so in the absence of the main analyser field and in this example the ejection trajectory is straight and extends substantially from the main flight path to the outer field-defining electrode system. The ejection trajectory 931*a* intercepts the main flight path 920 tangentially at the point E. FIG. 18*b* illustrates an injection arrangement to which FIG. 18*a* applies but in an orthogonal cross sectional side view looking in the direction of arrow A and shows that in this example the ions leave the analyser volume to commence external trajectory 941*b*, (941*a* in FIG. 18*a*) through aperture 951*b* (951*a* in FIG. 18*a*) in the outer field-defining electrode system 910 of just one of the analyser mirrors. In this example the point E is displaced from the z=0 plane by a distance 962*b*, since it is not a requirement that the ejection trajectory 931*b* leave the main flight path 920 on the z=0 plane, though it may do so. The displacement may be towards or away from the last mirror encountered by the ions before commencing the ejection trajectory. In this example, the ions arrive at point E with the correct energy and direction of motion to commence the ejection trajectory once the main analyser electrical field has been removed.

In examples relating to FIGS. 18 and 19 and some other examples, the ejection has been illustrated by having main analyser field is turned off whilst the beam traverses the ejection trajectory. However, it will be appreciated that the same methods of ejection may alternatively be performed not by having the main analyser field turned off but by shielding the ejection trajectory from the main analyser field, i.e. the ejection trajectory from point E could be shielded from the main analyser field, in which cases the main analyser field is preferably not turned off during ejection which is advantageous from the perspective of not requiring fast switching of voltages. The potential upon the outer field-defining electrode systems of the two mirrors is the same, and that potential, which may be zero, is also applied to all the electrodes within the analyser, making the volume within the analyser field-free. Upon the beam arriving at the main flight path 920 at point E, the potentials upon the analyser electrodes are switched to remove the main analyser field. In these examples, when the beam travels along the main flight path 920, the potential upon the inner field-defining electrode systems of both the mirrors is −2587V in the analyser of Example A and 2046.7V in the analyser of Example B, whilst that on the outer field-defining electrode systems of both mirrors is 0V in both examples. Whilst the beam traverses the ejection trajectory 931 (931*a*-931*g*), the potential upon the inner field-defining electrode systems 900 of both the mirrors is set to 0V. Upon reaching point E therefore, the beam experiences the removal of the accelerating field towards the analyser axis which had caused it to orbit within the analyser, and the beam proceeds upon the ejection trajectory. For clarity, FIGS. 18 and 19 omit the arcuate focusing lenses and their support belt electrode assemblies as previously described. The potentials upon these components are also set to 0V whilst the beam traverses the ejection trajectory 931. The beam leaves the point E and passes through an aperture in the outer belt electrode (not shown).

As already described, the ejection of the invention may be worked by producing a different field from the main analyser field whilst the beam traverses the ejection trajectory, that field not necessarily being zero.

Figure 18A:
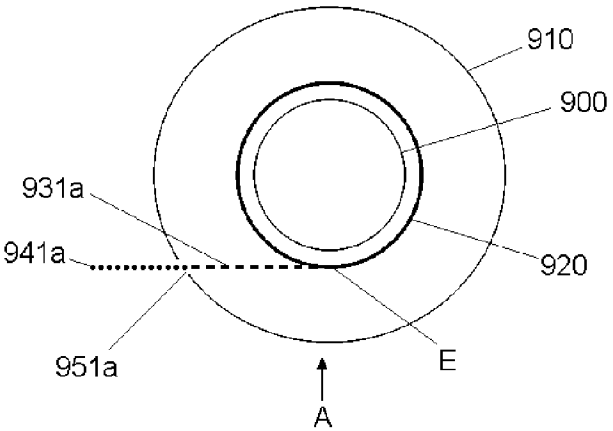
FIGS. 18 to 24 (but not FIG. 24*c*) show schematically various embodiments of ejection of the beam from the analyser of the invention.
Figure 18B:
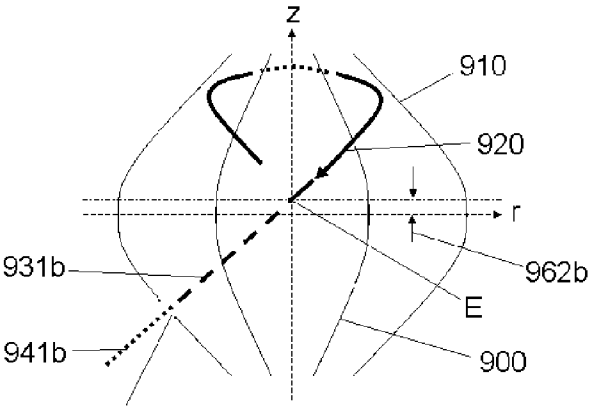
Figure 18C:
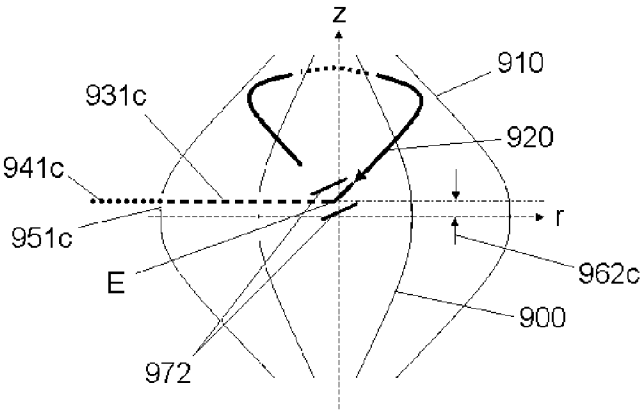

FIG. 18*c* illustrates another example of ejection. The view in FIG. 18*a* also applies to this example. Point E does not lie on the plane z=0, being offset by distance 962*c*. However in this example the ions reach point E on the main flight path 920 and commence the ejection trajectory 931*c* travelling in a direction parallel to the z=0 plane, requiring realignment, and a deflector 972 is provided near the point E to change the velocity of the beam so that it can commence the ejection trajectory 931*c*, deflecting the beam in the z direction. Deflector 972 is shown schematically as a pair of deflector plates. The deflection decreases the velocity of the beam in the z direction and increases the velocity of the beam in the arcuate direction. The external trajectory 941*c* in this case again leaves the analyser through an aperture 951*c* in the outer field-defining electrode systems of one mirror 910, at which point the ejection trajectory 931*c* terminates.

Figure 18D:
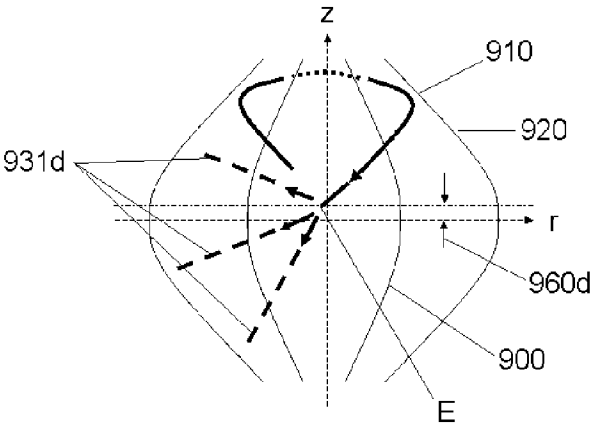
Figure 19A:
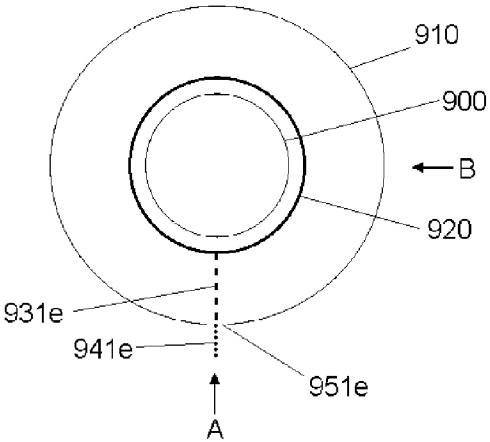
Figure 19B:
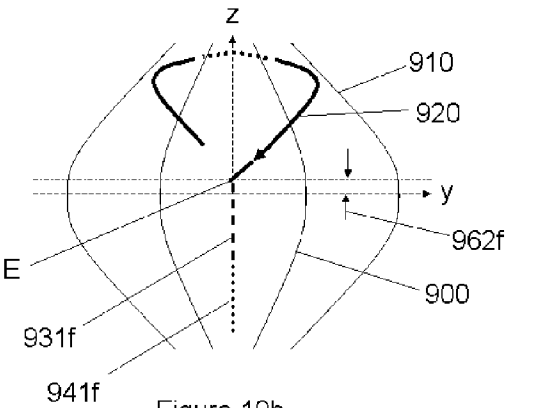
Figure 19C:
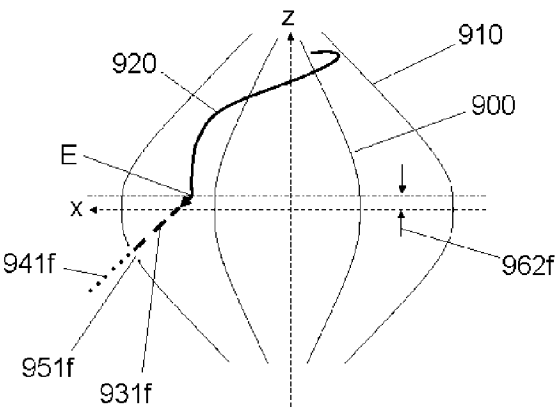
Figure 19D:
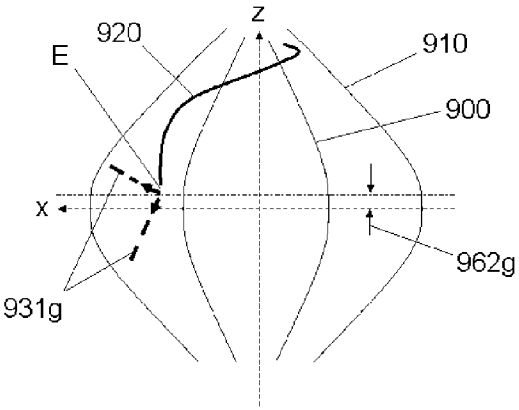

FIG. 18*d* illustrates the general case where the ejection trajectory 931*d* leaves point E at any angle (i.e. not only parallel to the z=0 plane as shown in FIG. 18*c*). Again FIG. 18*a* applies to these cases as the ejection trajectory intercepts the main flight path tangentially at the point E. Deflection in the z direction is required for all cases where the ejection trajectory 931*d* is not aligned with the main flight path as it is in the example of FIG. 18*b*. Deflection may be to increase the z velocity or decrease it depending upon the angle at which the ejection trajectory intercepts the main flight path. Accordingly the velocity in the arcuate direction may be decreased or increased.

FIG. 19 illustrates a second group of examples of ejection. Components similar to those in FIG. 18 are given the same identifiers. In these examples the ejection trajectory 931 does not intercept the main flight path 920 tangentially, but intercepts normal to the tangent, as is shown in FIG. 19*a*, which is a schematic cross sectional view of the analyser in the plane z=0, though it also contains some features off the z=0 plane. The inner and outer field-defining electrode systems 900, 910 respectively, and the main flight path of the principal beam 920 are shown. Ejection trajectory 931*e* (denoted by a dashed line) is located within the analyser volume inside the outer field-defining electrode system 910 of one, or in some embodiments, both the mirrors. Ions leave the main flight path via the ejection trajectory 931*e* and leave the analyser volume by commencing external trajectory 941*e* (denoted by a dotted line) through an aperture 951*e* in the outer field-defining electrode system 910. The ions travel along the ejection trajectory 931*e* from the main flight path 920 at point E. Whilst the ions travel along the ejection trajectory 931*e*, they do so in the absence of the main analyser field and in this example the ejection trajectory 931*e* is straight and extends substantially from the main flight path 920 to the outer field-defining electrode system 910. The ejection trajectory 931*e* intercepts the main flight path 920 orthogonal to the tangent of the main flight path at point E. FIGS. 19*b* and 19*c* show two cross sectional side views, orthogonal to one another, of an example of an ejection arrangement for which FIG. 19*a* applies, both views also being orthogonal to that in FIG. 19*a*. FIG. 19*b* is the cross sectional side view looking in the direction of arrow A and FIG. 19*c* is the cross sectional side view looking in the direction of arrow B. The ion beam follows the main flight path 920 and at point E is deflected by deflectors (not shown) so that upon reaching point E on the main flight path 920 the beam commences the ejection trajectory 931*f*. From ejection trajectory 931*f* the beam passes through aperture 951*f* in the outer field-defining electrode system 910 and commences external trajectory 941*f*. In this case the deflectors act to decrease the velocity of the beam in the arcuate direction and increase the velocity of the beam in the outward radial direction. FIG. 19*d* illustrates the general case in which the ejection trajectory 931*g* is directed away from point E from any angle. Where that angle does not equal the angle taken by the main flight path at point E, deflection is required.

The above described types of ejection may also be arranged with a combination of the cases illustrated in FIGS. 18 and 19, in which the ejection trajectory is directed away from point E at any angle, whilst in the absence of the main analyser field, where the ejection trajectory intercepts the main flight path neither tangentially nor in a direction orthogonal to the tangent of the main flight path. This type of ejection may also be conveniently arranged where point E is at or near one of the turning points in the analyser. In this case a belt electrode such as is shown in FIG. 6*d* at 670 may be used to support a deflector to deflect ions out of the analyser.

Figure 12C:
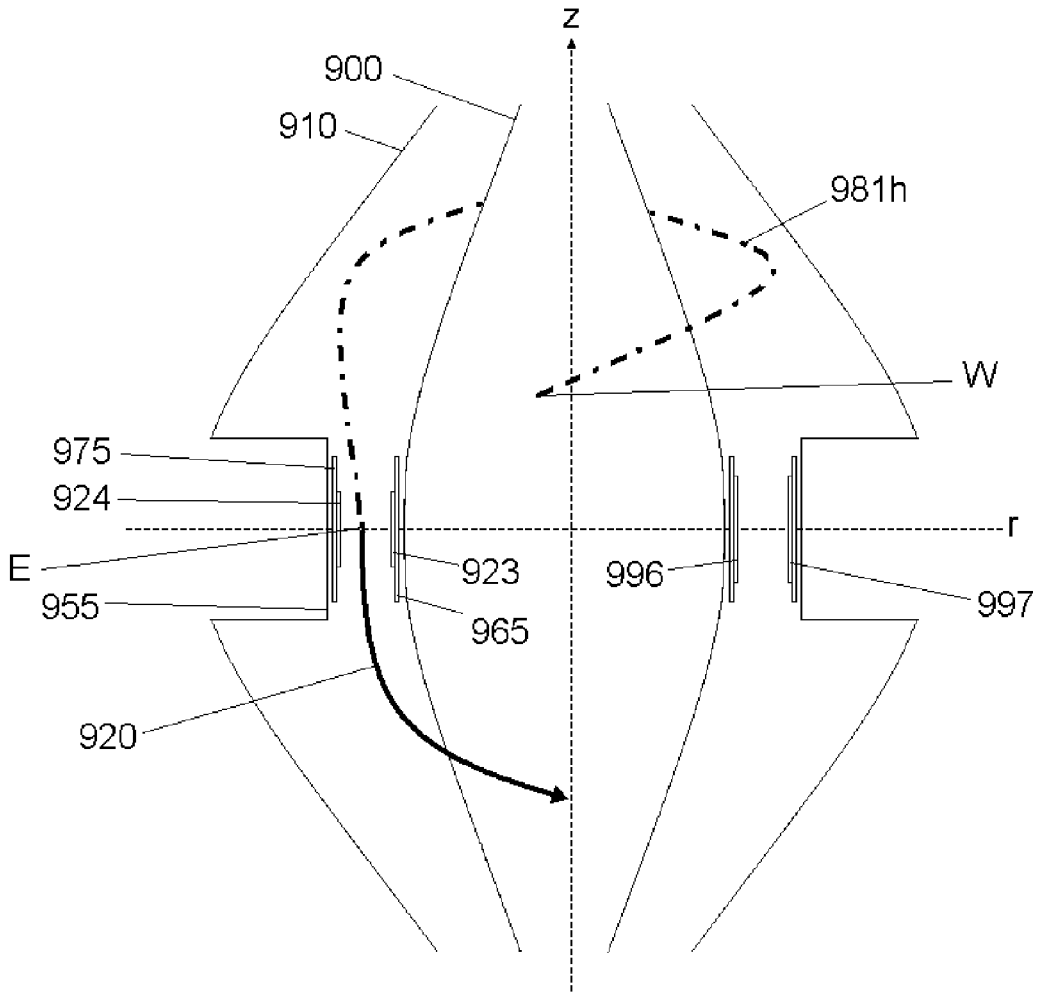
Figure 13A:
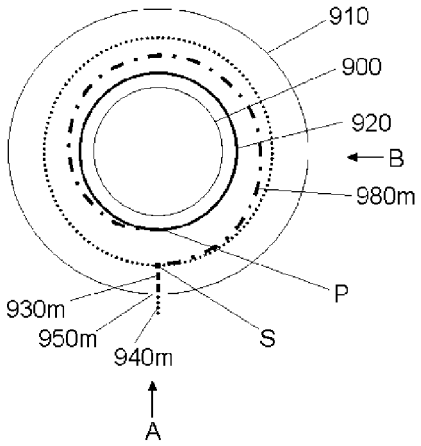
Figure 13B:
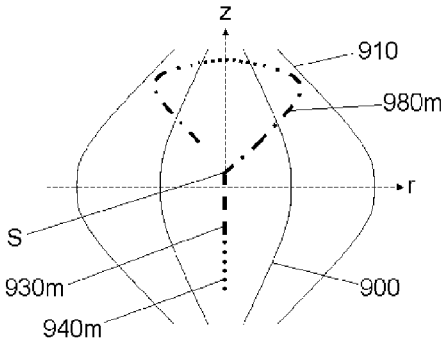
Figure 13C:
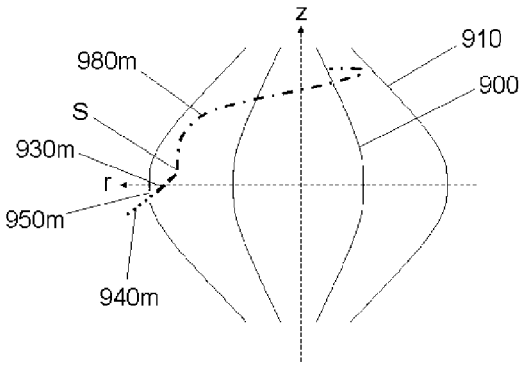
Figure 13D:
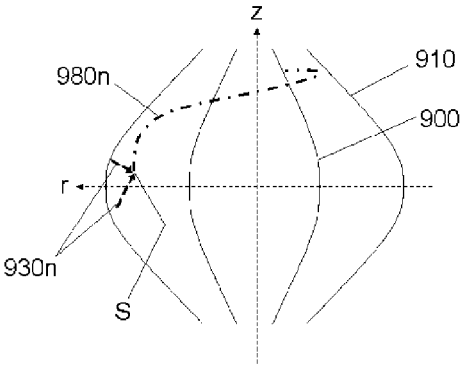

Ejection from the analyser utilising a further type of injection embodiments is illustrated in the schematic diagrams of FIGS. 20 and 12*c*. Components similar to those in FIG. 9 are given the same labels. In a first group of embodiments, FIG. 20*a* is a cross sectional view of the analyser at the plane z=0 though it also contains some features off the z=0 plane. The inner and outer field-defining electrode systems 900, 910 respectively, and the main flight path of the principal beam 920 are shown. Ejection trajectory 931*h* (denoted by a dashed line) is located in the analyser volume within the outer field-defining electrode system 910. Ions leave the analyser from the ejection trajectory 931*h* along an external trajectory 941*h* through an aperture 951*h* in the outer field-defining electrode system 910 of one or both of the analyser mirrors. In use, after travelling on the main flight path, the ions leave the main flight path at point E and commence travel along an ejection trajectory 981*h* toward a different distance 991*h* from the z axis than the main flight path, and at a point W at distance 991*h* commence the ejection trajectory 931*h*. Whilst the ions travel along the ejection trajectory 931*h*, they do so in the absence of the main analyser field, e.g. with the potentials on the inner and outer field defining electrode systems 900, 910 switched off, and in this example the ejection trajectory 931*h* is therefore straight and extends substantially from the ejection trajectory 981*h* at point W to the outer field-defining electrode system 910. Until reaching point W, the main analyser field is switched on and the beam travels along the ejection trajectory 981*h* in the presence of the main analyser field, which is also the field applied as the beam travels the main flight path 920. In this example, upon reaching or approaching the point E upon the main flight path 920, the ions are deflected by a deflection device (not shown in FIG. 20) to impart additional velocity to the ions in the radial direction away from the analyser axis z, whereupon they are able to commence upon the ejection trajectory 981*h*.

An example of one electrode which comprises half of a suitable deflector assembly is shown in FIG. 12*a*. This example is suitable for injection embodiments and has already been described in relation to injection above. The same deflector electrodes may be used for ejection as are used for injection. Similar deflection voltages may be applied to the deflection electrodes 923, 924 to effect ejection as were used to effect injection or alternatively different voltages may be applied if a different ejection trajectory is to be traversed by the beam during ejection, from that traversed during injection. Such a different ejection trajectory may be utilised to enable the injector and detector to be located in different positions. Alternatively a second pair of deflector electrodes similar to injection deflector electrodes 923, 924 may be provided mounted elsewhere upon the belt electrode assembly 965, 975. In one embodiment to be later described, such a second pair of deflection electrodes are positioned adjacent the injection deflection electrodes. In the present example, the same deflector electrodes are used for ejection as are used for injection and the same voltages are applied to the deflector electrodes as were used during injection, so the ejection trajectory 981*h* is the same as that followed during injection (though travelled in reverse direction). A belt electrode assembly 905 of z height 40.0 mm supports one half of the arcuate focusing lens assembly 915 and one half of the deflector assembly 923, each set within the belt and electrically insulated from it by insulation 935. All dimensions shown are in mm.

The kinetic energy of the ions is such that the ejection trajectory 981*h* of the ions (denoted by a dash-dot line) proceeds to spiral with progressively increasing radius away from the analyser axis z until it reaches point W at a distance 991*h* from the analyser axis z. FIG. 20*b* shows this example in an orthogonal cross sectional side view looking in the direction of arrow A in FIG. 20*a*. The main flight path is not shown in FIG. 20*b* for clarity, and only a portion of the ejection trajectory 981*h* is illustrated. The point W at which the ejection trajectory 931*h* joins the ejection trajectory 981*h* may be anywhere within the analyser between the inner and outer field-defining electrode systems 900, 910 and in this example is not exactly on the z=0 plane but near to it.

Figure 20A:
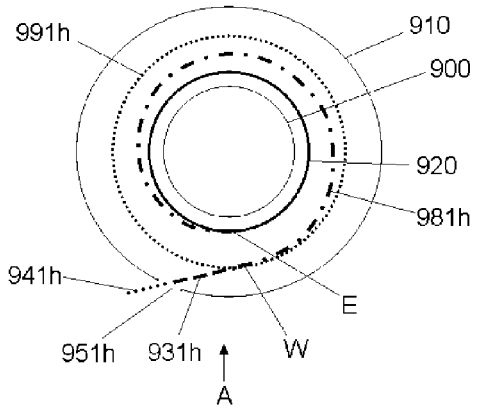
Figure 20B:
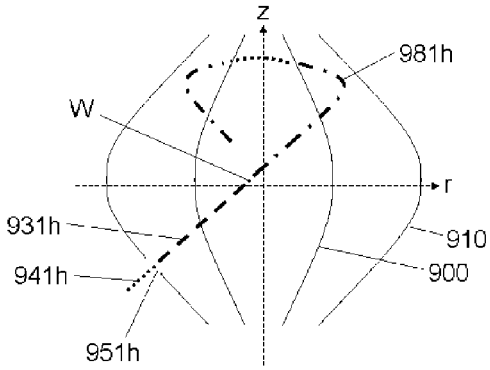

FIG. 12*c* shows a schematic cross sectional side view through a portion of the analyser with identifiers for like components as in FIGS. 20*a* and 20*b* and FIG. 12*b*. The outer field-defining electrode systems of both mirrors have a waisted-in portion 955. The inner and outer belt electrode assemblies 965 and 975 respectively support inner and outer deflection electrodes 923, 924 respectively. The main flight path 920 is traversed by the beam to point E adjacent to deflection electrodes 923, 924 whereupon the deflection electrodes are energised, and the beam commences the ejection trajectory 981*h*, spiralling about the analyser axis z with increasing radius. In this example, for both injection and ejection, deflection electrodes 923, 924 are only present at one location on the analyser equator. At other points upon the equator arcuate focusing lens electrodes 996 and 997 are present (only one pair of which is shown). The belt, lens and deflection electrodes depicted in FIG. 12*c* are not to scale and the trajectories are schematic representations only. Both the deflection electrodes 923, 924 of the deflector assembly and the arcuate lens electrodes 996, 997 are shown schematically to be proud of the belt electrode assemblies 965, 975 in which they are mounted, for clarity, but in practice, these electrodes may be set into the belt electrode assemblies and the surfaces of the belt electrode assemblies and the deflector and lens electrodes may be flush.

When the deflection electrodes 923, 924 are not energized, the electrodes are set to the same potentials as the arcuate lens electrodes adjacent to them. When the deflection electrodes 923, 924 are energized, additional voltages are applied to them. In the example utilising electrodes as shown in FIG. 12*c*, the inner deflection electrode 923 has an additional +200

V applied and the outer deflection electrode 924 (not shown in FIG. 12*a*) has an additional −100 V applied when energized. For the arcuate lens electrode design 915 of FIG. 12*c*, the arcuate lens electrodes have the same potential as the belt electrode assembly which supports them, plus an additional +10 to +30 V. The pair of deflection electrodes 923, 924 may also be used for arcuate focusing when not used for deflection, in which case a common potential is placed on both the electrodes of the pair. Similar belt electrode assemblies, arcuate lens electrodes and deflection electrodes may be used in the ejection embodiments of FIG. 19.

Figure 20C:
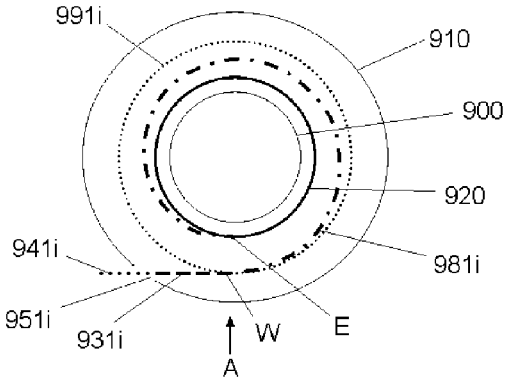
Figure 20D:
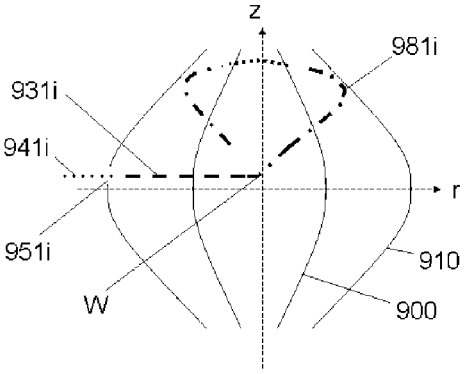

FIG. 20*c* illustrates a further embodiment of ejection, and is a cross sectional view of the analyser at the plane z=0 though it also contains some features off the z=0 plane. The inner and outer field-defining electrode systems 900, 910 respectively, and the main flight path of the principal beam 920 are shown. Ejection trajectory 931*i* (denoted by a dashed line) is located in the analyser volume within the outer field-defining electrode system 910. Ions leave the analyser volume from the ejection trajectory 931*i* and traverse an external trajectory 941*i* through an aperture 951*i* in the outer field-defining electrode system of one or both of the analyser mirrors. The ions commence the ejection trajectory 931*i* in the absence of the main analyser field from a ejection trajectory 981*i* at a different distance 991*i* from the z axis than the main flight path, at a point W. When the beam reaches point W the main analyser field is switched off. In use, the ion beam travels along the main flight path 920 and upon reaching point E, ejection deflector electrodes (not shown) at or near point E are energised, to impart additional velocity to the ions in the radial direction away from the analyser axis, whereupon they are able to commence upon the ejection trajectory 981*i* this trajectory spiralling around the analyser axis with increasing radius in the presence of the analyser field until reaching point W. FIG. 20*d* shows the example of FIG. 20*c* in a schematic cross sectional side view looking in the direction of arrow A in FIG. 20*c*. The main flight path is not shown in FIG. 20*d* for clarity, and only a portion of the ejection trajectory 981*i* is illustrated. Again, the point W at which the ejection trajectory joins the ejection trajectory 981*i* may be anywhere within the analyser between the inner and outer field-defining electrode systems 900, 910 and in this example is not on the z=0 plane. Unlike the embodiment of FIGS. 20*a* and 20*b*, the beam is deflected by a deflection device (not shown) at or near point W to commence the ejection trajectory 931*i*.

Figure 20E:
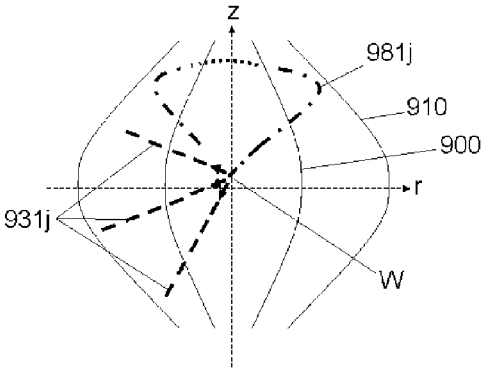
Figure 21A:
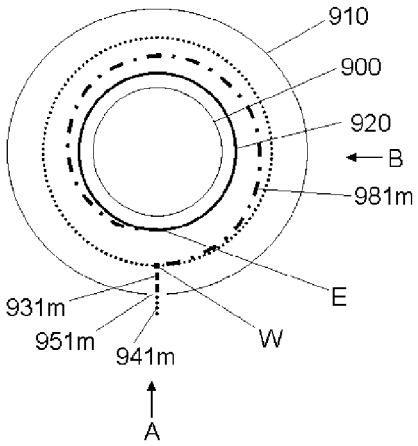
Figure 21B:
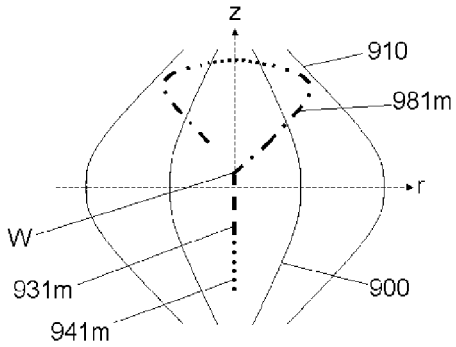
Figure 21C:
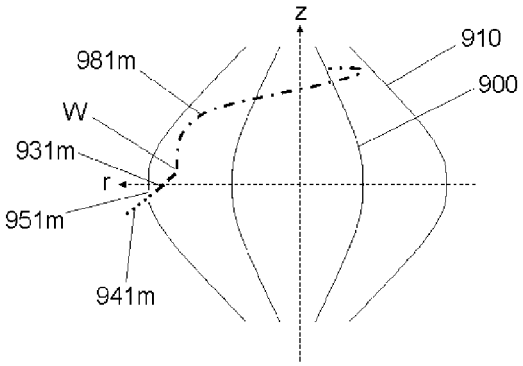
Figure 21D:
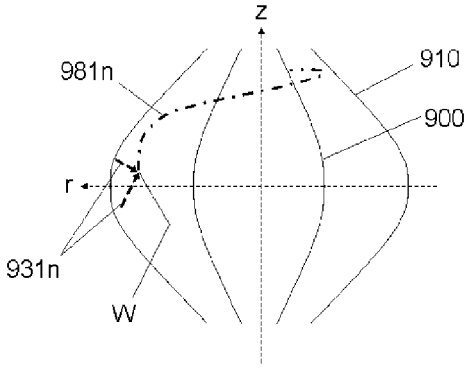

FIG. 20*e* is a similar schematic cross sectional side view to FIGS. 20*b* and 20*d* which illustrates the general case where the ejection trajectory 931*j* reaches point W from any angle with respect to the z=0 plane, but still reaches point W tangentially to the radius from the analyser axis. FIG. 20*c* therefore applies to all the cases illustrated in FIG. 20*e*. Deflection of the beam occurs at or near points W and E in a similar manner as described with reference to FIG. 20*d*.

FIG. 21 illustrates in schematic cross sectional views another group of injection embodiments. Components similar to those in FIG. 9 are given the same identifiers. In these examples the ejection trajectory 931*m*, 931*n* does not intercept the ejection trajectory 981*m*, 981*n* at point W tangentially to the distance from the analyser axis to point W, but intercepts normal to the tangent, as is shown in FIG. 21*a*, which is a schematic cross sectional view of the analyser in the plane z=0 though it also contains some features off the z=0 plane. The inner and outer field-defining electrode systems 900, 910 respectively, and the main flight path of the principal beam 920 are shown. Ejection trajectory 931*m* (denoted by a dashed line) is located in the analyser volume within the outer field-defining electrode system 910. Ions leave the analyser volume from ejection trajectory 931*m* along an external trajectory 941*m* (denoted by a dotted line) through an aperture 951*m* in the outer field-defining electrode system 910 of one or both of the analyser mirrors. In use, the ions leave the main flight path 920, travel along the ejection trajectory 981*m* onto the ejection trajectory 931*m* at point W. Whilst the ions travel along the ejection trajectory 931*m*, they do so in the absence of the main analyser field and in this example the ejection trajectory 931*m* is again straight and extends substantially from the ejection trajectory 981*m* at point W to the outer field-defining electrode system 910. The ejection trajectory 931*m* intercepts the ejection trajectory 981*m* orthogonal to the tangent of the secondary ejection trajectory 981*m* at point W. FIGS. 21*b* and 21*c* show two schematic cross sectional side views, orthogonal to one another, of an example of an injection arrangement for which FIG. 21*a* applies, both views also being orthogonal to that in FIG. 21*a*. FIG. 21*b* is the cross sectional side view looking in the direction of arrow A and FIG. 21*c* is the cross sectional side view looking in the direction of arrow B. At the terminus of the ejection trajectory 981*m*, the ion beam is deflected by a deflection device (not shown) located at point W so that upon reaching point W the beam commences the ejection trajectory 931*m*. In this case the deflection device acts to decrease the velocity of the beam in the arcuate direction and increase the velocity of the beam in the outward radial direction. FIG. 21*d* illustrates the general case in which the ejection trajectory 931*n* is directed away from point W on the ejection trajectory 981*n* from any angle. Where that angle does not equal the angle taken by the ejection trajectory 981*n* at point W, deflection at point W is required. A deflection device similar to that shown in FIG. 12*a* is used, in like manner. Deflection devices suitable for use in any of the Types of injection described herein include electrostatic sectors The ejection may also be arranged with a combination of the cases illustrated in FIGS. 20 and 21, in which the ejection trajectory is directed away from point W at any angle, whilst in the absence of the main analyser field, where the ejection trajectory 931 intercepts the ejection trajectory 981 neither tangentially nor in a direction orthogonal to the tangent of the ejection trajectory 981 at point W.

Figure 16D:
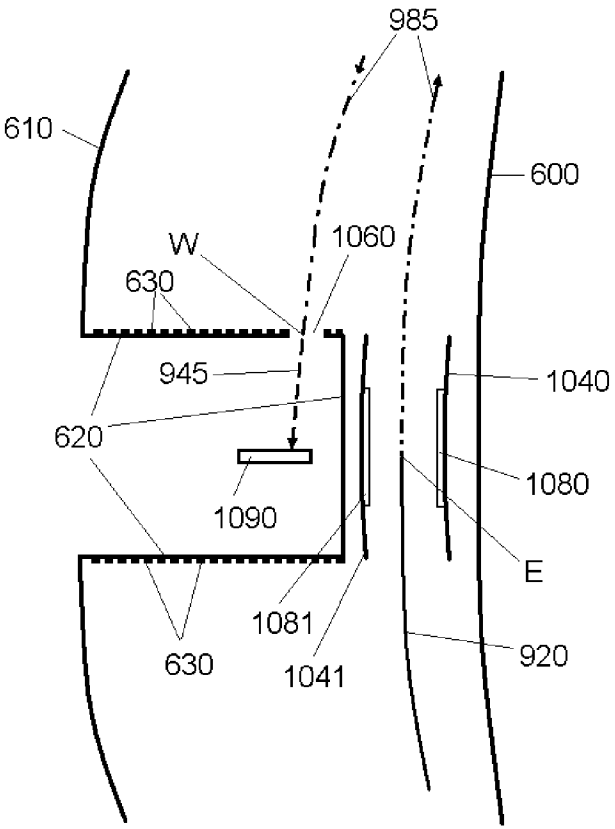
Figure 16C:
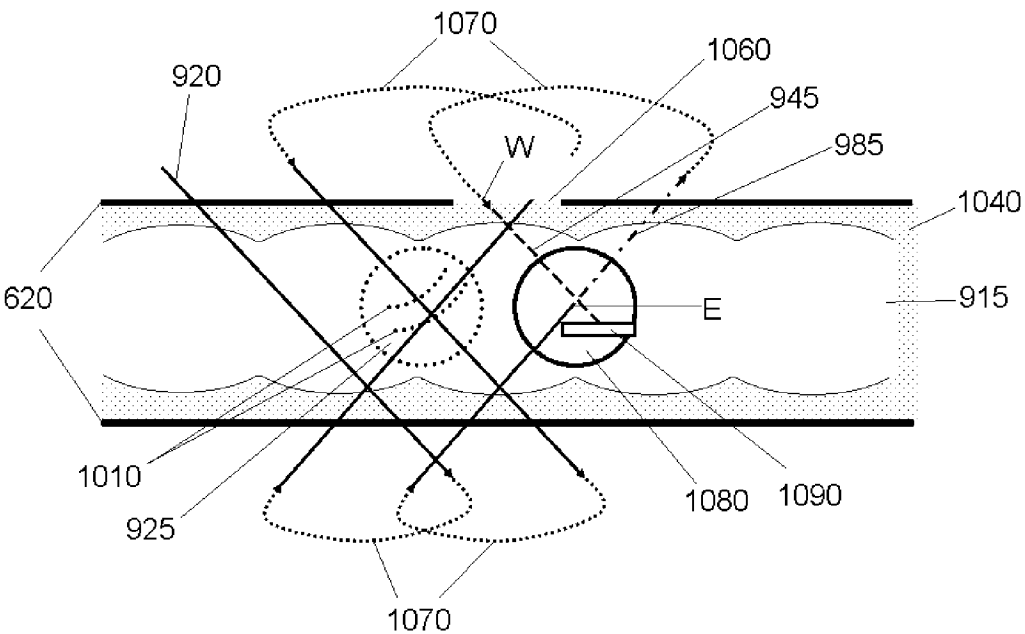

FIG. 16*c* depicts a schematic representation of a preferred ejection embodiment and shows a portion of the analyser comprising an inner belt electrode assembly 1040, arcuate lenses 915, an ejection deflector electrode 1080. The figure also shows the injection deflector element 925 and injection sector 1010, which were described in relation to FIGS. 15, 16*a* and 16*b*, in outline only. In this example, there are two separate deflector electrode pairs, one pair for injection 925, 926 and one pair for ejection 1080, 1081, and they are located adjacent one another around the belt electrode assemblies. The inner belt electrode assembly 1040 is shown, but the outer belt electrode assembly and outer ejection deflector electrode is not shown in FIG. 16*c* for clarity. Injection deflector electrode 925 and injection sector 1010 as were described in relation to FIG. 16*a* are shown dotted. As in FIG. 16*a*, the dotted lines 1070 are to indicate orbits taken around the analyser axis (either on the secondary ejection trajectory or the main flight path) and are not to scale. FIG. 16*d* shows a side view orthogonal to that in FIG. 16*c*, and includes outer belt electrode assembly 1041, outer ejection deflector electrode 1081, electrical tracks similar to those in FIG. 6, 630, and outer and inner field-defining electrode systems 610, 600. FIG. 6*d* omits the injection deflector and injection sector for clarity. The outer field-defining electrode system 610 has a waisted portion 620 which includes an aperture 1060 as described earlier. In this example, ejection occurs using ejection deflector electrodes 1080, 1081 located adjacent to the injection deflector 925 of FIG. 16*a*, described earlier. The same aperture 1060 is used for both injection and ejection, though two separate apertures could be used in other embodiments. Following injection the ion beam proceeds to orbit around the analyser axis on the main flight path. For each orbit, the ion beam position progresses a fraction of 2π radians around the analyser at the z=0 plane. The ejection deflector electrodes 1080, 1081 remain de-energised and may be set to the same potentials as are applied to belt electrode assemblies 1040, 1041 whilst the beam progresses in this way until the beam progression has brought the beam past the injection deflector electrodes 925, 926 at the z=0 plane and is aligned with the ejection deflector electrodes 1080, 1081. When so aligned at a point E, the ejection deflection electrodes are energised and the whole or part of the train of ions is deflected to commence upon an ejection trajectory 985. In this example the ejection trajectory 985 is traversed whilst in the presence of the main analyser field. The ejection trajectory 985 spirals out in increasing distance from the analyser axis from the point E on the main flight path, and after approximately one orbit of the analyser axis and one reflection from one of the opposing mirrors, at point W the beam passes through the aperture 1060 in the waisted portion of the outer field-defining electrode system, leaves the analyser upon an external trajectory 945 and impinges upon a first element of a charged particle detector 1090. The point W marks the transition from the internal ejection trajectory 985 to the external trajectory 945. In this embodiment, the ejection trajectory 985 is the only trajectory that the ion beam takes from the main flight path to the exit from the analyser volume at the aperture 1060. In this example, the first element of a charged particle detector 1090 is in a plane parallel to the plane z=0, located close to the z=0 plane, at a temporal focal point and aligned with a temporal focal plane. Alternatively, in other embodiments, the point W marks the point at which the beam transfers from the ejection trajectory 985 to an external trajectory 945 to pass into an ion store or collision cell, for example, which are not shown.

As described earlier, when not used as deflectors, a similar electrical bias may be applied to both opposing electrodes of both the injection deflector 925, 926 and the ejection deflector electrodes 1080, 1081 to convert the deflectors into additional arcuate focusing lenses. This method may be used with the injection deflector once the beam has been successfully injected, so that upon approaching the detector or ejection stage, an additional arcuate lens action is performed by the injection deflector electrodes. The method may also be used with the ejection deflector during and after injection, until the time for ejection has been reached.

Figure 22:
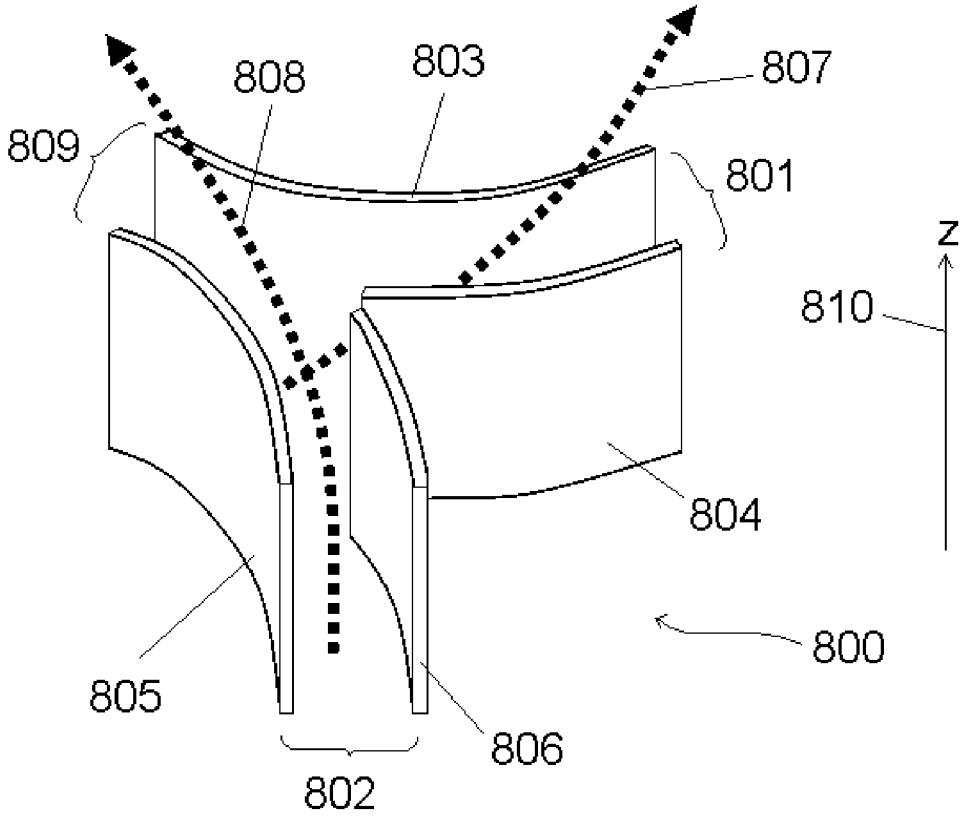

Alternative embodiments utilise either two separate, or a single double electrostatic sector to effect injection and ejection. Both these embodiments have the advantage that the ion injector and/or the ion detector may be positioned further from the analyser axis, outside the maximum distance from the analyser axis z of the outer field-defining electrode system, allowing larger injection and detection systems to be utilised. A double electrostatic sector, 800, is shown in the schematic diagram of FIG. 22. In its simplest form, the double electrostatic sector 800 comprises two sectors 801, 802, sector 801 comprising two electrodes 803, 804, sector 802 comprising two electrodes 805, 806. In operation, sector 801 has voltage V1 applied to electrode 803, and voltage V2 applied to electrode 804, whilst sector 802 has voltage V3 applied to electrode 806 and voltage V2 is applied to electrode 805 in common with electrode 804 of sector 801. Beam trajectories 807, 808 proceed through sectors 801, 802 respectively, and through a portion 809 common to both sectors 801 and 802. In this embodiment, portion 809 lies adjacent the analyser (not shown), beam 808 being injected into the analyser and beam 807 being ejected from the analyser. As noted earlier, if the electrostatic sectors are oriented so they have no dominant forces on the ion beam in the z direction, as depicted in FIG. 22 where the z axis 810 is shown, the temporal focal plane angles and positions within the analyser are unaffected. The double electrostatic sector shown in FIG. 22 may be used for injection to and ejection from either the main flight path, or a secondary injection/ejection trajectory.

Figures 23A, 23B:
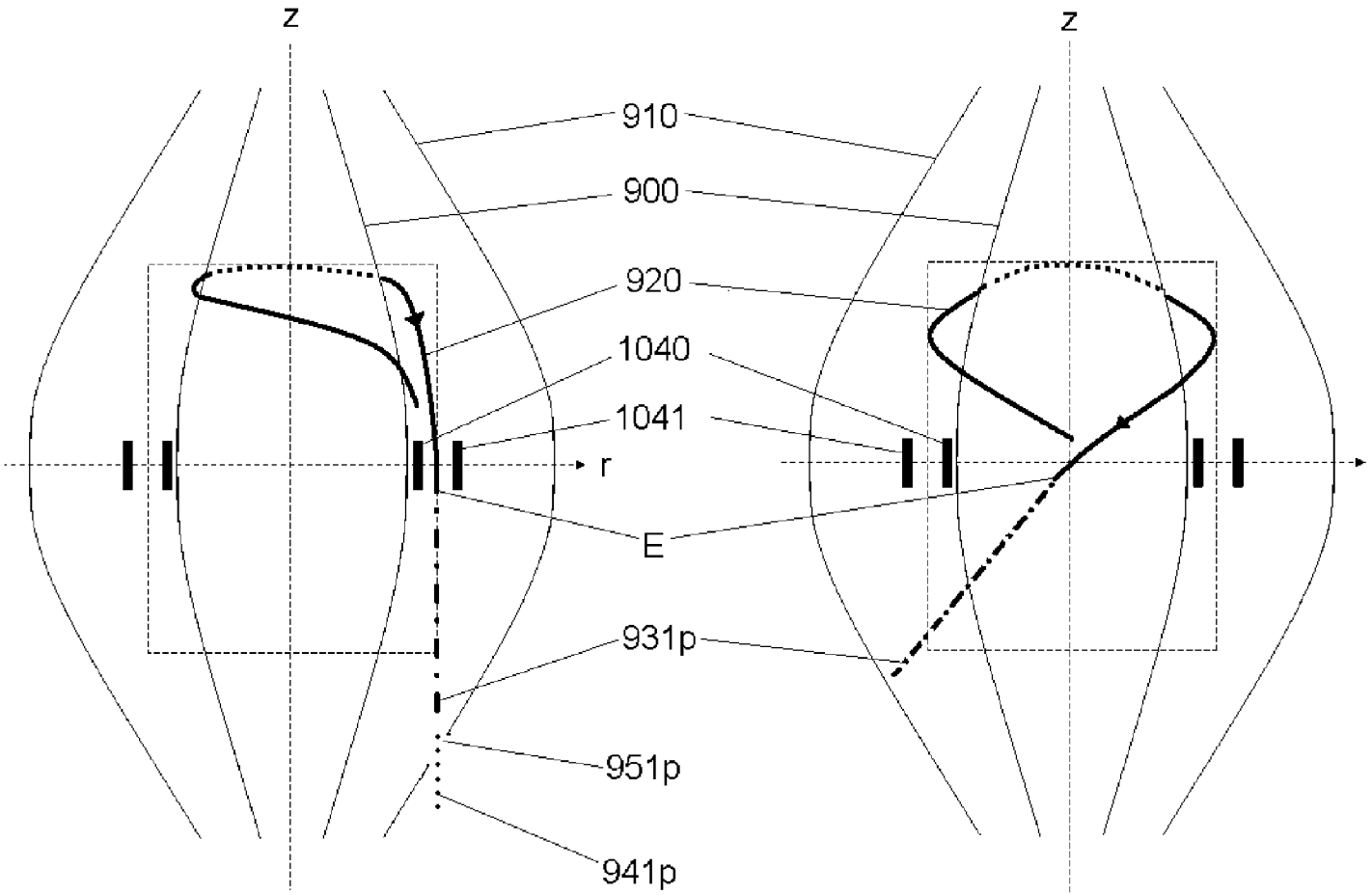

Another type of ejection is illustrated in the examples shown schematically in FIG. 23. FIGS. 23*a* and 23*b* show two cross sectional side views, orthogonal to one another, of the same embodiment. Components similar to those in FIG. 9 are given the same identifiers. Ions travel along the main flight path 920 within the analyser volume, and on reaching point E commence ejection trajectory 931*p*. The ions leave the analyser volume through aperture 951*p* in the outer field-defining electrode system of one of the mirrors 910. In this example the point E is not on the plane z=0, though it may be in other embodiments.

The main flight path 920 passes between inner and outer annular belt electrode assemblies 1040 and 1041 respectively which are coaxial with and surround the inner field-defining electrode systems 900 at the z=0 plane. Deflection in the arcuate direction may or may not be required for the beam to commence the ejection trajectory 931*p*. If required a deflection device such as those described earlier may be used. In this example, the ejection trajectory 931*p* is traversed whilst in the presence of an ejection analyser field which differs from the main analyser field. When the beam arrives at or near point E the field within the analyser is changed from the main analyser field to the ejection field by changing the electrical bias upon the inner and outer field-defining electrode systems 900, 910. The beam has kinetic energy such that upon reaching point E, it commences the ejection trajectory 931*p* in the presence of the injection field. The ejection trajectory 931*p* is shown as being straight as, in this example, the ejection field is of much lower intensity than the main analyser field and the beam travels along the ejection trajectory with only a small deviation from a straight line. The intensity of the ejection field may optionally be a substantial fraction of the main analyser field intensity, in which case the ejection trajectory 931*p* would deviate significantly from a straight line.

Figure 23C:
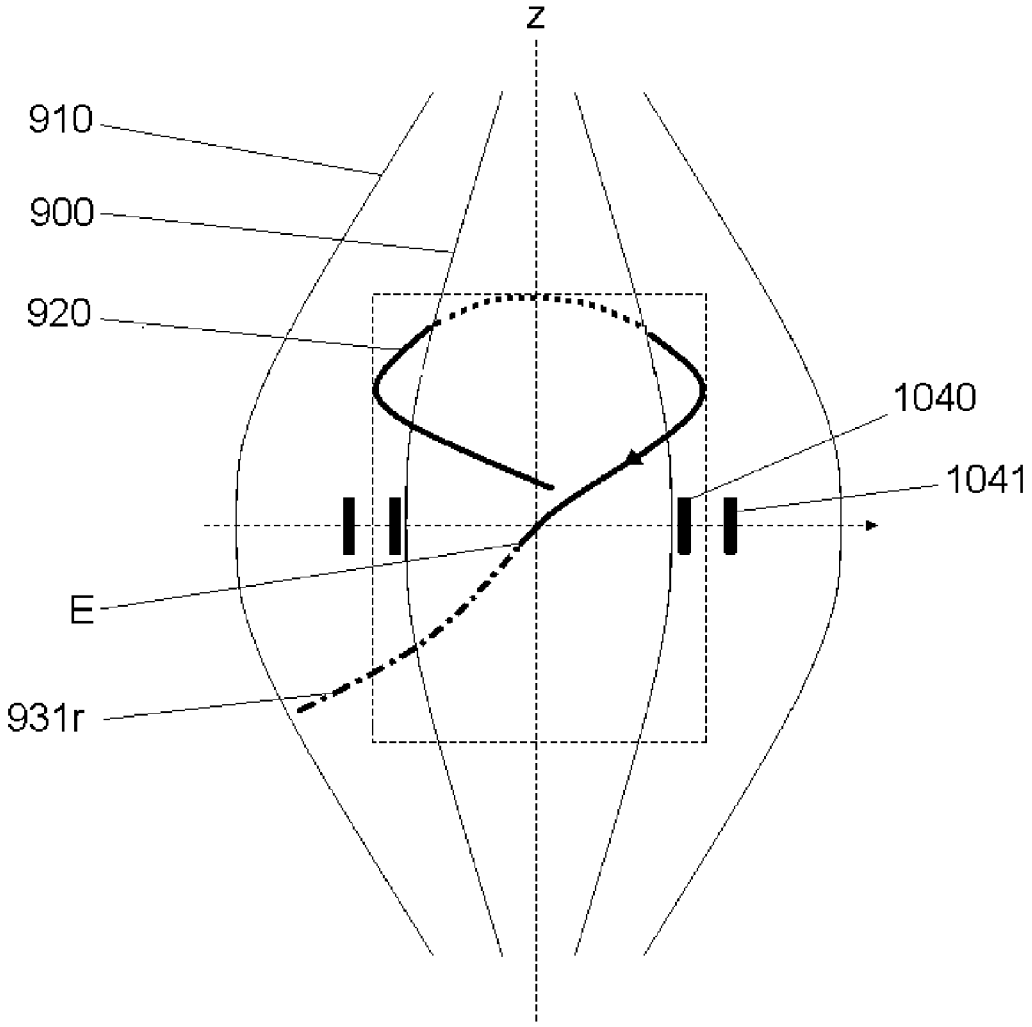

An alternative embodiment is shown schematically in FIG. 23*c*, from the same viewpoint as FIG. 23*b*. In this case the beam travels along the ejection trajectory 931*r* in the presence of the main analyser field, but does so having an ejection kinetic energy that is greater than the kinetic energy it has whilst travelling along the main flight path 920. Accordingly an acceleration device is used to increase the kinetic energy of the beam as it leaves point E. The ejection trajectory 931*r* is in this example a curved path.

Figure 24B:
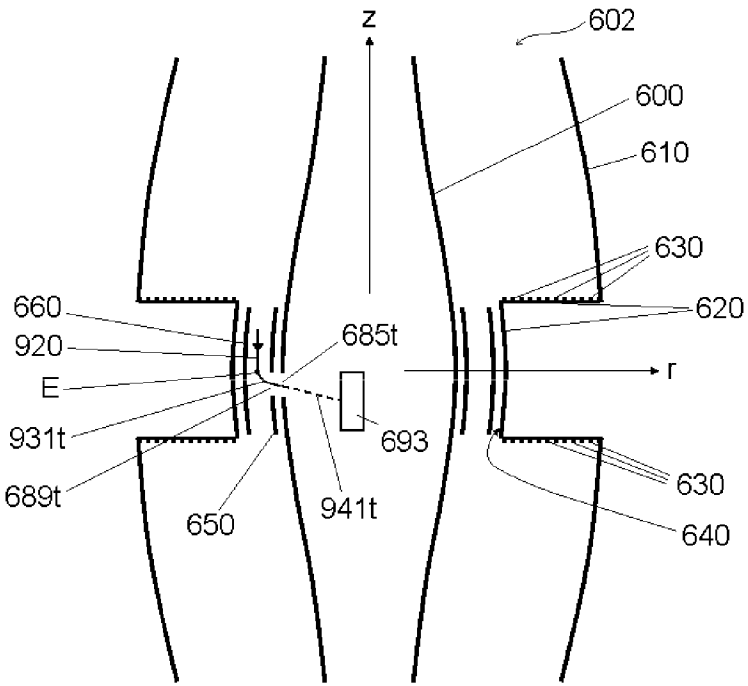
FIG. 24*c* shows schematically an embodiment of the invention comprising transferring portions of the beam between different main flight paths.
Figure 24A:
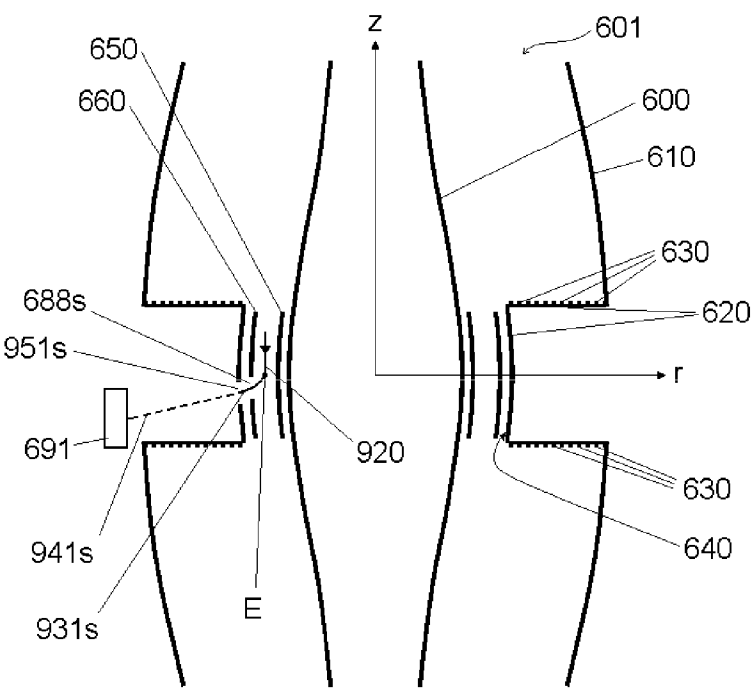

A still further type of preferred ejection is illustrated in the examples shown in FIG. 24, which shows two alternative embodiments as schematic cross sectional side views. Like features have the same identifiers as in FIG. 17. In FIG. 24*a*, ions follow the main flight path 920 and upon reaching point E commence an ejection trajectory 931*s* within the analyser volume, through aperture 688*s* in the outer belt electrode assembly 660, whilst under the influence of the main analyser field, and reach aperture 951*s* in the outer field-defining electrode systems 610, whereupon they commence an external trajectory 941*s* to a detector 691. The ejection trajectory 931*s* is short relative to the size of the analyser 601. A deflector (not shown) is mounted upon the inner and outer belt assembles 650, 660, near point E and acts to deflect the beam so it commences upon the ejection trajectory 931*s* by imparting an outwardly radial force upon the beam.

An alternative embodiment is shown in FIG. 24*b*. Detector 693 is positioned outside the analyser volume at a smaller radius than the inner field-defining electrode system 600. Ions follow the main flight path 920 and upon reaching point E commence an ejection trajectory 931*t* within the analyser volume, through aperture 689*t* in the inner belt electrode assembly 650, whilst under the influence of the main analyser field, and reach aperture 685*t* in the inner field-defining electrode systems 600, whereupon they commence an external trajectory 941*t* to a detector 693. The ejection trajectory 931*s* is short relative to the size of the analyser 601. A deflector (not shown) is mounted upon the inner and outer belt assembles 650, 660, near point E and acts to deflect the beam so it commences upon the ejection trajectory 931*s* by imparting an inwardly radial force upon the beam.

In both embodiments of FIG. 24, deflectors such as those shown in FIG. 12 and already described are suitable for imparting the outwardly or inwardly radial force at or near point E. These ejection deflectors and the apertures 688*s* and 689*t* in outer and inner belt electrode assemblies respectively need only be located at one arcuate position within the analyser near the z=0 plane in communication with the detector 691, 693, and hence do not affect the main analyser field elsewhere within the analyser. Alternative forms of deflector may comprise opposing electrodes mounted upon inner and outer belt electrode assemblies but not integrated into the series of arcuate focusing lenses. Instead the electrodes may be located upon regions of the belt assemblies displaced from the arcuate focusing lenses in the z direction.

In all the ejection types and cases described, deflection may include changing the kinetic energy of the charged particle beam at or near point E so that the beam leaves the main flight path with the correct energy for progression.

It will be appreciated that the method of injection shown in FIG. 17*c* using the sector 912 may also be applied in reverse to eject the beam from the analyser, i.e. the beam would enter a sector (the same or different sector to the one used for injection) directly from the main flight path through an entrance aperture of the sector at the same radius as the main flight path and be radially deflected out of the analyser by the sector. Thus FIG. 17*c* applies to ejection with the direction of the beam reversed.

Figure 24C:
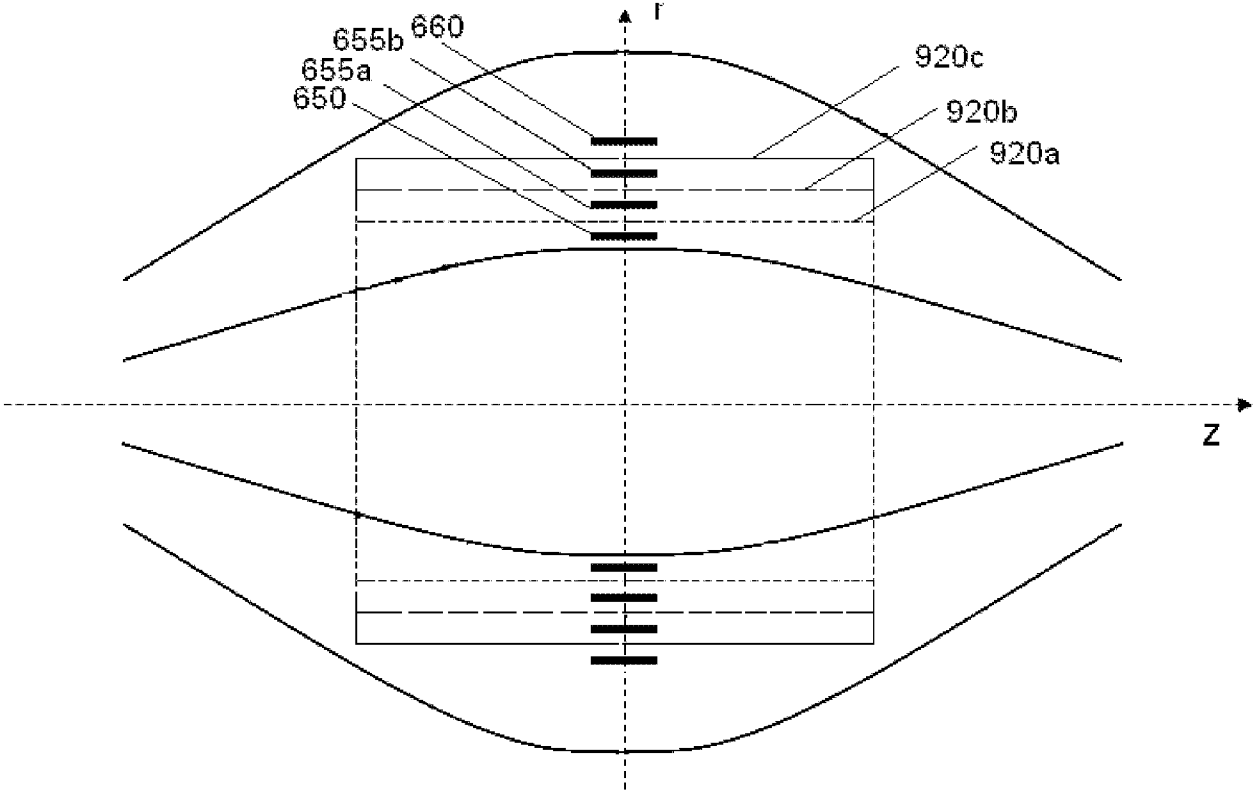

In a further ejection arrangement shown schematically in FIG. 24*c*, the ions are initially ejected (e.g. deflected) from the main flight path (e.g. by a deflector or by acceleration electrodes located at the z=0 plane), which is/are represented by a first cylindrical envelope 920*a* at a first radius, so that the beam moves to a second main flight path represented by a second cylindrical envelope 920*b* at a larger radius than the main flight path 920*a*. The main flight path 920*a* is located between inner belt electrode assembly 650 and a first intermediate belt electrode assembly 655*a* and is focussed by arcuate focusing lenses (not shown) periodically spaced around these belts. The second main flight path 920*b*, like the main flight path 920*a*, is also a stable path within the analyser, and passes between the first intermediate belt electrode assembly 655*a* and a second intermediate belt electrode assembly 655*b*. In some embodiments, after completing the required number of orbits around the z axis on the second main flight path 920*b*, the beam is deflected out of the analyser according to a previously described method for detection or further ion processing. Since the second main flight path is stable, the beam may traverse the analyser once again on the second main flight path, thereby substantially increasing the total flight path and enabling in some embodiments at least doubling the flight path length through the analyser thereby increasing resolution of the TOF separation without loss of the mass range associated with a closed path TOF. In some embodiments, after completing the required number of orbits around the z axis on the second main flight path 920*b*, the beam can be deflected back to the first main flight path 920*a* or deflected to a third main flight path at a still greater radius as represented by cylindrical envelope 920*c* which travels between the second intermediate belt electrode assembly 655*b* and an outer belt electrode assembly 660. It will be appreciated that each time the beam is deflected to a different main flight path the whole or only a portion of the mass range of the beam may be so deflected, with the remaining portion remaining on the previous flight path or being ejected from the analyser and/or detected. Accordingly, it may be possible to eject a first portion of the mass range to the second main flight path 920*b* for TOF analysis at higher resolution whilst a second portion is ejected out of the analyser for detection, further processing or even a second pass through the first main flight path 920*a*. It will be appreciated that parts of the mass range can be "parked" in different radius orbits until they are ready for ejection and/or detection. In order to have ions orbiting in different radius main flight paths simultaneously, it is necessary to change the kinetic energy of the beam as it is ejected to a different radius flight path in order for the different radius flight path to be a stable trajectory for the same main analyser field. If all of the beam is ejected to a different radius main flight path then it may be possible to either change the kinetic energy of the ions whilst keeping the main analyser field constant or to keep the kinetic energy the same but change the main analyser field for the different radius flight path. The second, third etc. main flight paths may have a different cross sectional profile to the first main flight path, which is preferably circular. For example the second, third etc. main flight paths may have elliptical cross sectional profiles or one of the profiles shown as 110*a-d* in FIG. 3*b*.

Alternatively or additionally, different mass ranges may be held in different radius orbits at the same time. Where the mass ranges are small, they may traverse the analyser several times before any mass overlap occurs, enabling multiple traverses before overlap of masses within the range, providing higher mass resolution. Mass separation of all the mass ranges occurs in parallel. Preferably the mass ranges comprising the smallest mass to charge ratio ions are detected first, as they will have traversed the analyser a given number of times in the shortest time.

A further utilisation of the facility of different radius orbits involves intentionally allowing ions of different mass to charge ratio to overlap one another after multiple traverses of the analyser. In this mode of operation, ions of different mass to charge ratio may be injected into an orbit of a given radius, allowed to traverse the analyser multiple times and ejected one at a time, in any chosen order, once the chosen packet for ejection is sufficiently separated from any neighbouring packet. In this case the neighbouring packet may contain ions of a very different mass to charge ratio. In this example, packets of ions may be injected into the orbit at different times, successful operation of the analyser being dependent upon knowledge of the injection time, the mass to charge ratio of the ions injected and the ion energy, enabling prediction of where all the packets of ions will be at any given time within the analyser. Alternatively, multiple packets may be ejected or detected simultaneously where they overlap at the ejection or detection means within the analyser, if desired. Ejection may be to any form of ion receiver, such as a fragmentation device for example.

Figure 25:
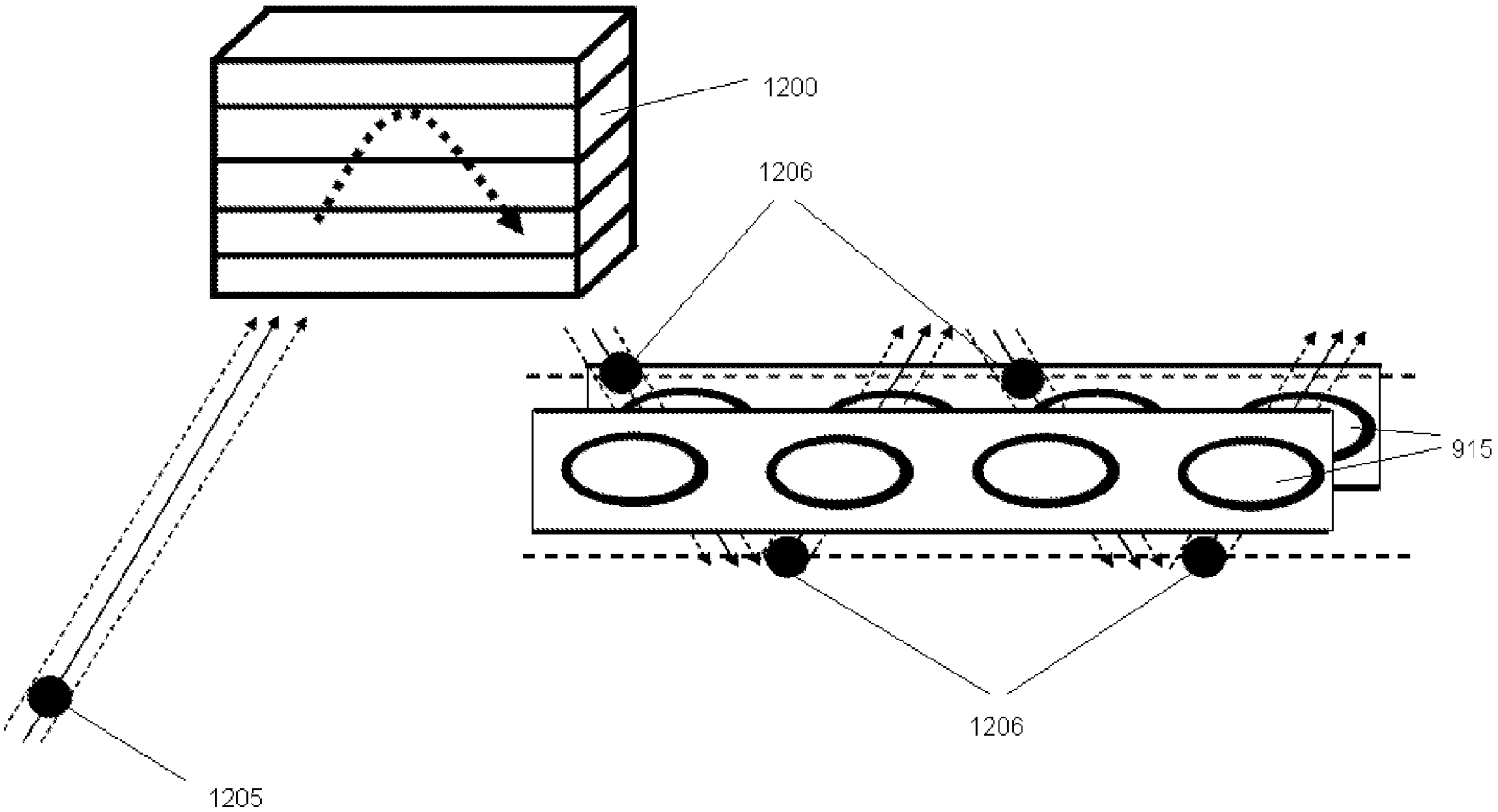
FIG. 25 shows schematically a method of transferring the temporal focus of the ion source using an ion mirror.

Preferably, the position of the temporal focal plane of ions emitted from the ion source, and the detector position, are each located on the z=0 plane. However, due to spatial constraints associated with the ion source this may not be possible to achieve. Thus, one or both of the temporal focal plane of ions emitted from the ion source and the detector are in practice likely to be located slightly offset from the z=0 plane. Small changes in the z position of the temporal focal plane of the source can be corrected by moving the focal plane of the detector in the opposite z direction. However, distances between the ion source and the analyzer, such as may be required to bring the ions from outside the analyser volume into the analyser field, often can not be corrected just by a simple shift of the temporal focal plane on the z axis. The invention may use one of two preferred methods to implement a correction in order to obtain temporal focus at a detector. The first method uses an ion mirror, positioned where the temporal focal plane of the source is transferred to the desired position in the analyser volume, or positioned where the temporal focal plane of the final oscillation/rotation is transferred to the detector. This is possible because an ion mirror may be constructed which has temporal focusing properties. FIG. 25 shows schematically how such an ion mirror 1200 can be used to transfer what would otherwise be the temporal focus point 1205 of an ion source (not shown) closer to the equator of the analyser near or at which the arcuate lenses 915 are located, the transferred temporal focus points being shown at positions 1206. The second method, which is more preferred, uses a deflector such as an electric sector having its axis parallel to the z axis of the instrument. The electric sector diverts the ion beam outside the analyser volume. In such a configuration, the sector itself does not offer any temporal focusing. However, the greatest advantage of the second method is that the detector does not have to be placed within the analysed field which would have been the case otherwise and so may be positioned at the temporal focal plane.

As previously described, in a further method, the two opposing mirrors may be displaced closer together to compensate for the distance(s) between the temporal focal plane (s) and the analyser so that temporal focusing is correctly achieved on the temporal focal plane associated with the receiver. For example, the analyser already described as Example A, having a z length of 380 mm (i.e. +/−190 mm), would be reduced in overall z length by 1.389 mm so that the 36 full oscillations of reduced length compensate for a 100 mm displacement of a temporal focal plane. In a preferred embodiment, the pulsed ion source lies outside the analyser at the axial coordinate 35 mm tangentially to the entrance point at a distance of 160 mm from it, the temporal focal plane of the receiver lies at the axial coordinate −20 mm, and the opposing mirrors are displaced closer together by 0.5 mm from each side (1 mm total) to compensate aberrations accrued over 31 full oscillations. Fine tuning of temporal focal plane is achieved by shifting voltages on both inner and outer belt electrode assemblies by 20-30 V.

FIG. 26 shows schematic views of embodiments of the invention, in which like components have the same identifiers as used in FIG. 9. Analysers of the present invention comprise inner and outer field-defining electrode systems 900, 910. In some embodiments the outer field-defining electrode system comprises a waisted portion 955, and in some embodiments the waisted portion also comprises an aperture 961. FIG. 26*a* shows a schematic cross sectional side view of an analyser in which main flight path 920 impinges upon a detector 959*a* within the analyser volume 971. All detectors in the embodiments of FIG. 26 may comprise multiple components, including one or more of conversion dynodes, electron multiplying dynodes, scintillators, anodes, multiple channel plates and the like. The embodiment of FIG. 26*a* comprises a channel plate because of the compact size of this type of detector which makes it suitable for its position within the limited space of the analyser volume 971. FIG. 26*b* shows a cross sectional view at the z=0 plane 963 of the embodiment of FIG. 26*a*. The detector 959*a* is shown in dotted outline in FIG. 26*b* as it lies off the z=0 plane, by a distance 957*a* shown in FIG. 26*a*. The distance 957*a*, termed herein the detector offset distance, preferably positions the detector on or close to a temporal focal plane of the analyser; in the embodiment of FIG. 26*a* the detector offset distance positions the detector on a temporal focal plane of the analyser. In this embodiment temporal focal planes of the analyser are substantially flat and lie parallel to the z=0 plane 963. FIG. 26*c* shows a schematic cross sectional side view of a further embodiment of the present invention, in which main flight path 920 impinges upon a detector 959*c*, positioned away from the z=0 plane 963 by a detector offset distance 957*c*. In this embodiment the outer field defining electrode system comprises a waisted portion 955, and detector 959*c* is tilted with respect to the z=0 plane 963 because the temporal focal plane upon which it is located is also tilted. The detector is tilted to match the tilt of the temporal focal plane. Such tilted temporal focal planes may result, for example, from the use of deflectors to alter the course of the ion beam on or before the main flight path 920.

Figure 26B:
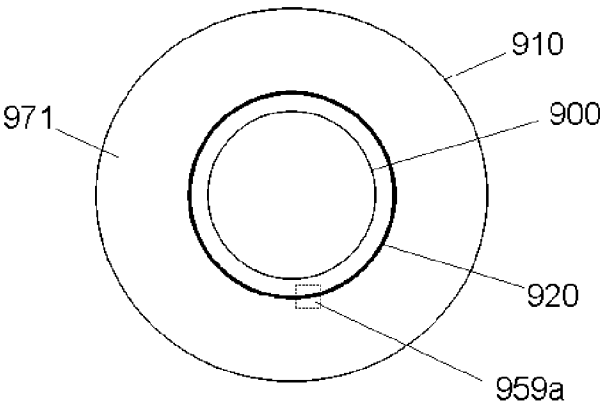
FIG. 26 shows schematically various embodiments of detection of the beam in the invention.
Figure 26A:
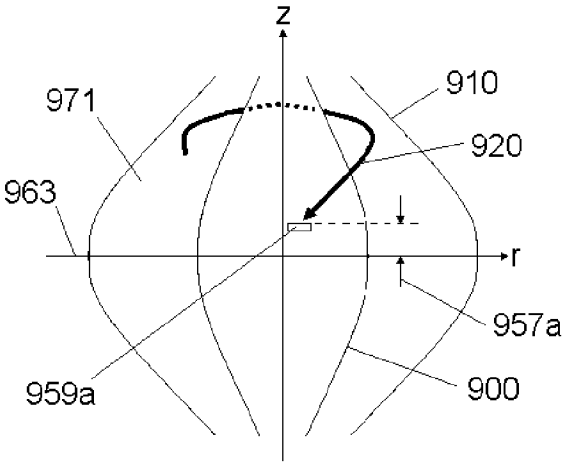
Figure 26C:
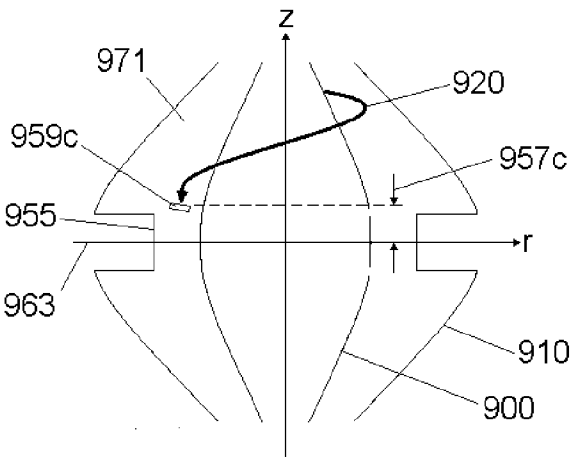
Figure 26E:
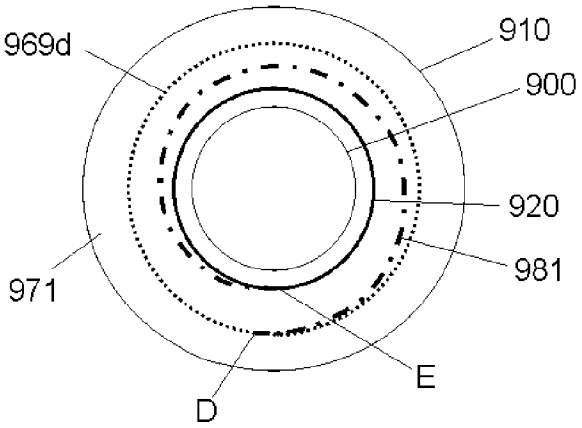
Figure 26G:
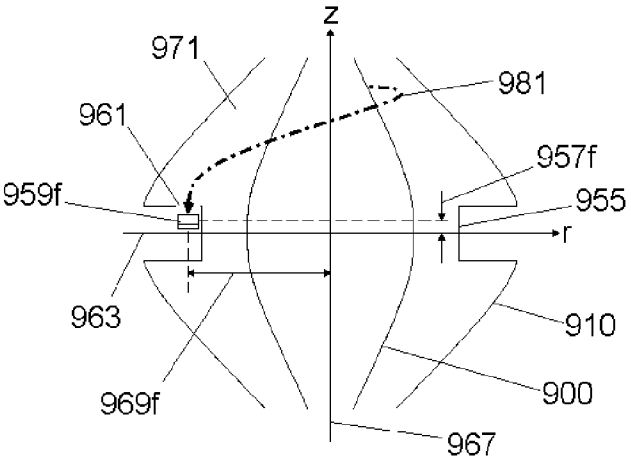
Figure 26D:
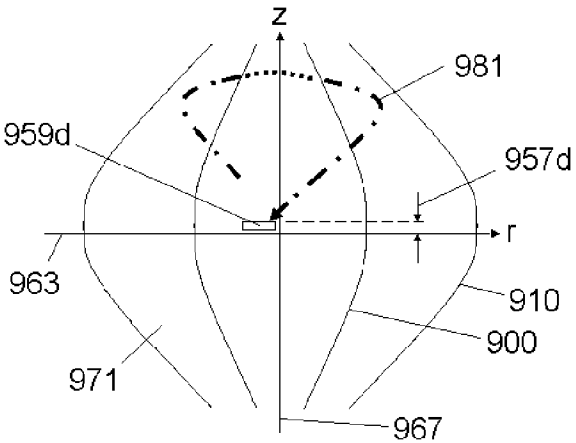

FIGS. 26*d* and 26*e* show a further embodiment of the present invention in which an internal ejection trajectory 981 is utilised during ejection of the beam from the main flight path 920. FIG. 26*d* is a schematic cross sectional side view and FIG. 26*e* is a schematic top view, which shows the analyser at the z=0 plane, and the ejection trajectory 981 in its entirety (even though the ejection trajectory 981 lies off the z=0 plane). The ejection trajectory 981 leaves the main flight path 920 at point E shown in FIG. 26*e* and spirals with increasing distance from the analyser axis 967 to a distance 969*d*. Detector 959*d* (not shown in FIG. 26*e*) lies at point D at distance 969*d* and receives the ion beam within the analyser volume 971. The detector 959*d* is displaced from the z=0 963 plane by detector offset distance 957*d* and lies at a temporal focal plane of the analyser, said plane being in this case parallel to the plane z=0 963.

Figure 26F:
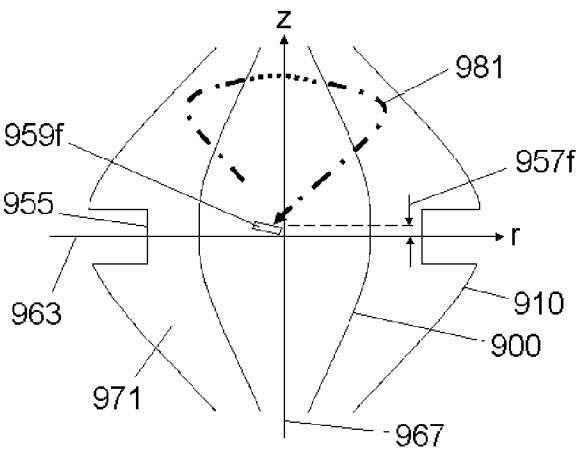

FIGS. 26*f* and 26*g* show two schematic side views of a further embodiment of the invention, each view orthogonal to the other. Ions are ejected from the main flight path (not shown) along ejection trajectory 981, spiralling out from the analyser axis 967 to a distance 969*f*. Outer field-defining electrode system 910 comprises a waisted portion 955 which lies at a distance from the analyser axis 967 that is smaller than distance 969*f*. The waisted portion 955 comprises an aperture 961, positioned to intercept the ejection trajectory 981. The ion beam passes through aperture 961 and impinges upon detector 959*f* which lies outside the analyser volume 971. The use of the waisted portion 955 of the outer field-defining electrode system 910 allows a detector to be located closer to the analyser axis 967, yet remain outside the analyser volume 971 than would otherwise be possible. This allows the use of detectors which utilise high voltages, for example, the analyser field within the analyser volume 971 being shielded from the electric fields produced by the detectors. The use of the waisted portion 955 in combination with an ejection trajectory 981 allows the use of larger detectors, the bulk of those detectors being accommodated in a larger free space outside the analyser volume 971. In this embodiment, detector 959*f* is tilted and does not lie parallel to the z=0 plane 963, the tilt being such as to match the detector plane to that of a temporal focal plane of the analyser, which is also tilted with respect to the z=0 plane due to the use of deflectors to deflect the ion beam from the main flight path (not shown) onto the ejection trajectory 981.

Figure 26I:
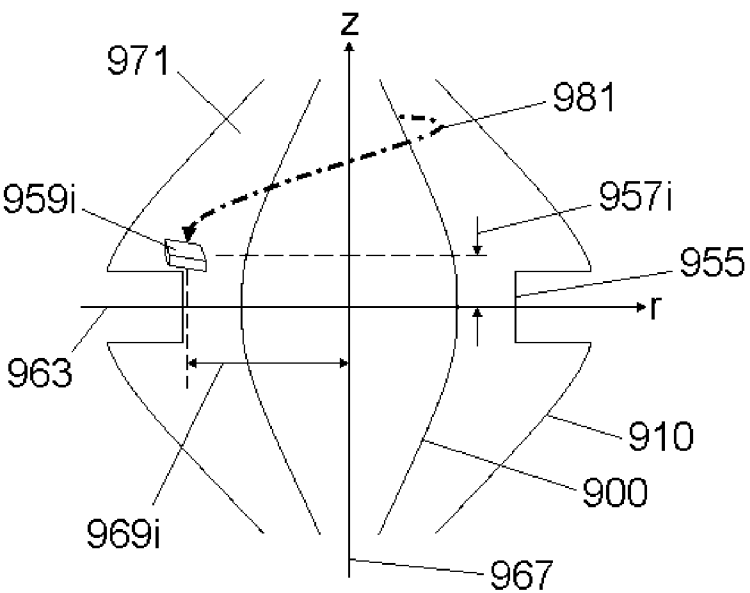
Figure 26H:
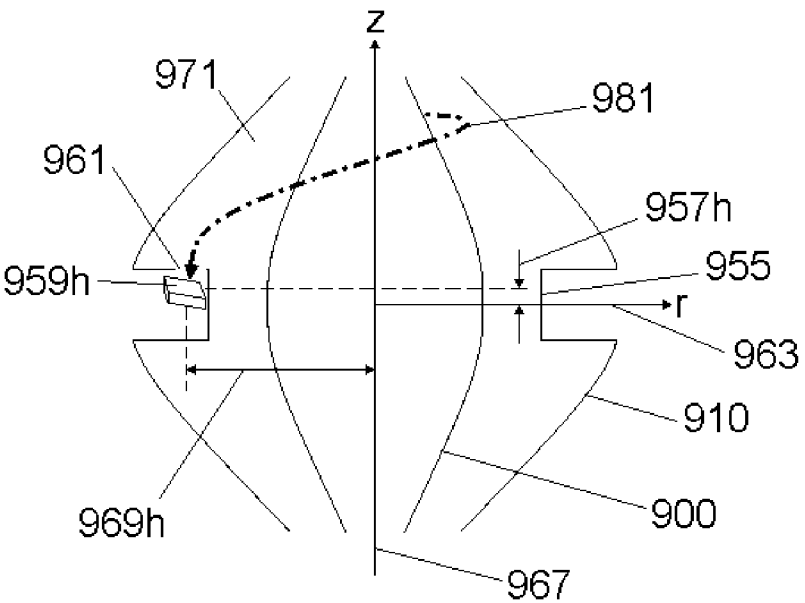

FIG. 26*h* shows a further embodiment of the invention similar to that in FIGS. 26*f* and 26*g*, but illustrating a detector 959*h* which is tilted in two planes with respect to the z=0 plane 955.

FIG. 26*i* shows a further embodiment of the invention utilising the ejection trajectory 981, but in which the detector 959*i*, which is tilted in two planes, lies within the analyser volume 971, close to the waisted portion 955 of the outer field-defining electrode system 910 of the analyser. Positioned in this way, the detector 959*i* may be supported from the waisted portion 955.

Before reaching the detectors in any of the embodiments of FIG. 26, ions may be given increased kinetic energy by post acceleration using electric fields. The acceleration may be in a direction parallel to the analyser axis 967; in the radial direction (towards or away from the analyser axis 967); in the arcuate direction; or in a combination of two or more of those directions. Some forms of post acceleration rotate the temporal focal plane angle. This can be achieved by accelerating the ions by different amounts depending upon where they lie across a plane K upstream of the temporal focal plane, the plane K being parallel to the unrotated focal plane. Those ions that have further to travel between the plane K and the desired, rotated temporal focal plane L are given greater additional kinetic energy than those with lesser distance to travel. In this case, the final kinetic energy of the ions varies depending upon where they lie across the focal plane. Alternatively, and preferably, rotation of the temporal focal plane may also be achieved by accelerating the ions at different locations along the beam path depending upon where they lie across the plane K, with those ions that have further to travel being accelerated before (upstream of) those with lesser distance to travel. In this latter case, all ions arrive at the detector plane (L, the rotated temporal focal plane) with the same increase in kinetic energy, but those with further distance to travel have been accelerated earlier, allowing them to travel that further distance more rapidly than those with less distance to travel.

Figure 27:
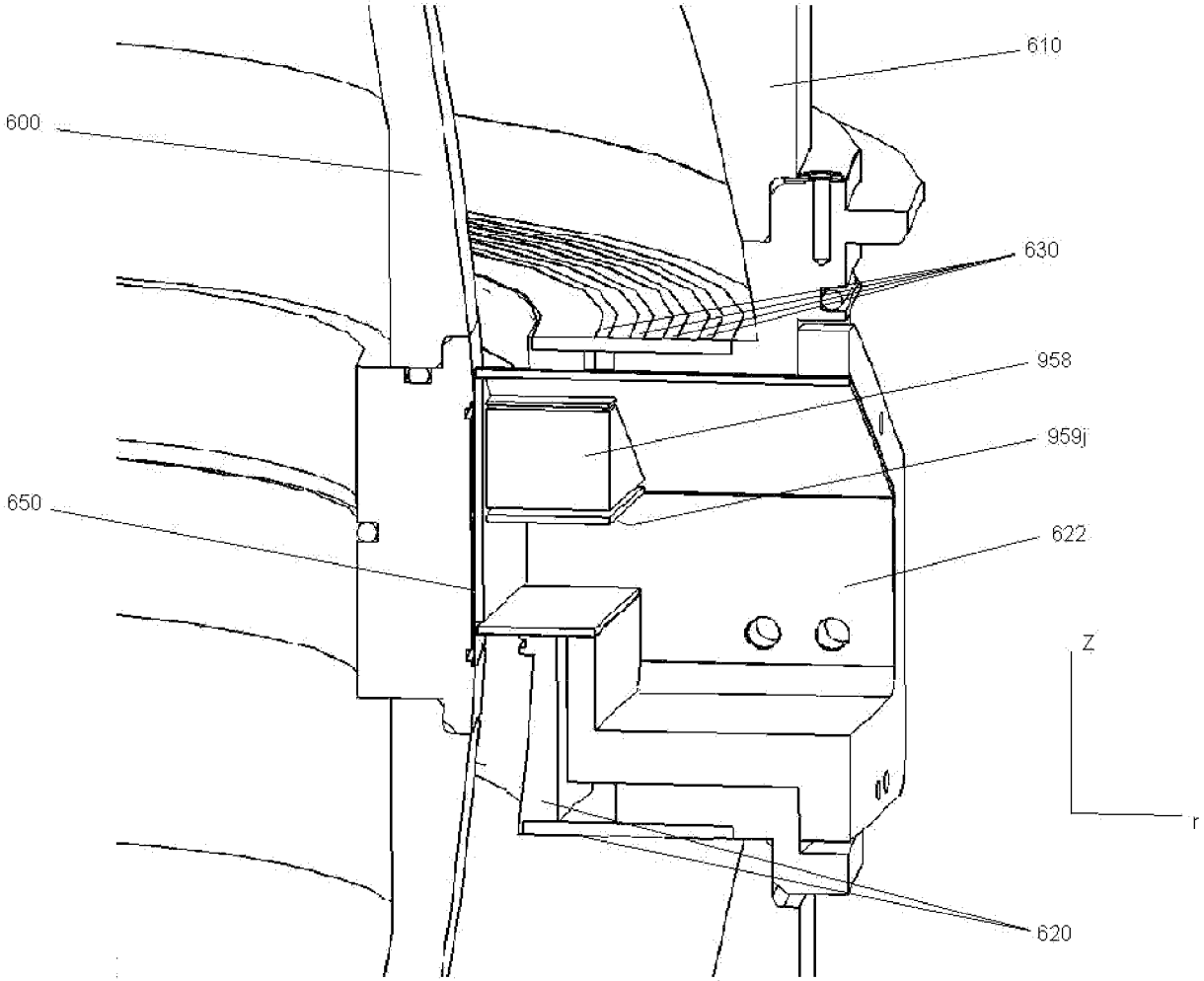
FIG. 27 shows schematically an embodiment for post-acceleration and detection of the beam according the invention.

FIG. 27 shows part of a cut-away side view in the region of the ejection to a detector according to one embodiment of the invention. Many of the same components are shown in FIG. 27 as are shown in the similar view of the injection embodiment in FIG. 17*e*. In FIG. 27, the outer field-defining electrode system 610 and inner field-defining electrode system 600 are shown. The outer field-defining electrode system 610 has a waisted-in portion 620 which allows the detector and associated components to be placed close to the main flight path. FIG. 27 again shows the electrode tracks 630 on the sides of the waisted-in portion 620 which in use have such voltages applied to them to sustain the potential of the main analyser field, as shown in FIG. 17*e*. The position of the inner belt electrode assembly 650 which supports one half of the arcuate focusing lenses (not shown) can be seen in FIG. 27. In this embodiment, the waisted-in portion 620 supports a box 622 for housing a post accelerator 958 and a detector 959*j*. Portions of the box 622 which protrude outside the waisted-in portion 620 may also be provided with electrode tracks on their surface to sustain the analyser field in the vicinity of the box. During ejection and detection, as the main flight path of the ion beam passes between the waisted-in portion 620 of the outer field-defining electrode system 610 and the inner field-defining electrode system 600 at the arcuate coordinate where the ejection deflector is located, the beam is deflected radially outwardly by a electric sector deflector (not visible in FIG. 27) and through an aperture (not shown) in the box 622. Inside the box 622, the ions are first accelerated by the post accelerator 958 and then detected by the detector 959*j*. Conveniently, the box 622 in some embodiments can also be used to house the injection optics that are shown in FIG. 17*e*.

The analyser of the present invention is preferably constructed to minimise and/or compensate for expansion and/or contraction of materials due to temperature changes which may otherwise affect the time of flight. Preferably, any loss of resolving power should be <5% and any TOF shift should be <1 ppm for a temperature change of 1° C. Preferred materials for the inner and outer field-defining electrodes include borosilicate glass and invar. Preferred materials for the belt electrode assemblies include aluminium and stainless steel.

Figure 28A:
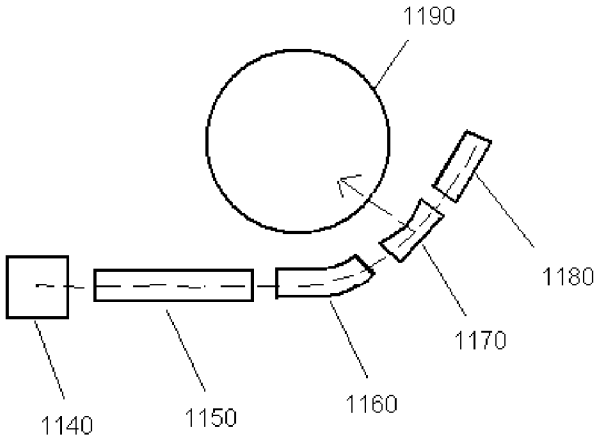
FIG. 28 shows two schematic representations of analysis systems incorporating an analyser according to the present invention.

An example of a configuration of an analysis system incorporating the analyser of the present invention is shown schematically in FIG. 28*a*. An ion source 1140 such as an electrospray source for producing ions is interfaced to a quadrupole mass filter 1150 to conduct an initial mass filtering of the ions generated by the source 1140. An ion guide such as a flatapole 1160 guides the ions to the storage means which is a curved liner trap or C-trap 1170. Optionally, ions may be passed from the C-trap 1170 to a collision cell 1180 for fragmentation of ions of selected m/z before being passed back to the C-trap 1170. Alternatively, filling of flatapole 1160 with gas would allow its use as a collision cell. The ions are then ejected radially from the C-trap 1170 and injected into the analyser of the present invention 1190 for time of flight separation and/or analysis.

More or less complex instrument configurations utilising the analyser of the present invention may be envisaged by those skilled in the art. Possible instrument configurations are now discussed by way of example in relation to FIG. 28*b*.

Figure 28B:
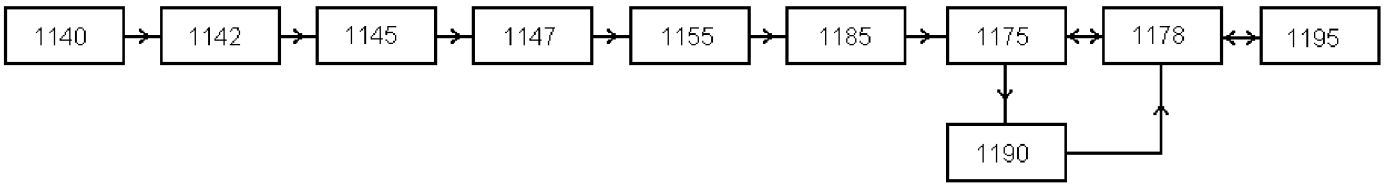

Many different types of ionization sources may be used with the analyser of the present invention, including but not limited to ESI, atmospheric pressure photo-ionization, APCI, MALDI, atmospheric pressure MALDI, DIOS, EI, CI, FI, FD, thermal desoption, ICP, FAB, LSIMS and DESI, at 1140. Optionally, various forms of ion mobility spectrometry may be performed following ionization, including FAIMS, 1145. Ion mobility apparatus may be incorporated up or downstream of a first mass selector 1155, preceding the analyser of the present invention, e.g. at locations 1145 and 1185. Ion guides of known types may be incorporated into the instrument including for example multipoles, multiple ion rings, funnels, cells comprising pixels and combinations of such devices. Various RF potentials may be applied, such as superimposed RF waveforms as for example described in U.S. Pat. No. 7,375,344, different RF parameters for different mass ranges, different RF parameters for different parts of the ion guide/cell, and various RF plus time-invariant potential combinations. The ion guide/cell may comprise different regions, each of which may be operated at the same or different gas pressures. Multiple ion guides may be used to transport ions from an atmospheric pressure ion source into the high vacuum of the instrument, as is well known in the art. These guides may be used in conjunction with various types of ion lenses and deflector systems. Example locations are shown in FIGS. 28*b* at 1142 and 1147. The instrument configuration may include a first mass selector (MS1) 1155, upstream of the analyser of the present invention 1190 for preselecting ions of a mass to charge ratio or a range of mass to charge ratios. MS1 may comprise for example a quadrupole mass filter, a linear ion trap such as a LTQ, a time of flight mass selector, a 3D ion trap, a magnetic sector, and electrostatic trap or any other form of mass filter. An analyser of the present invention may also be used as MS1, operated in mass selective mode. Fragmentation devices may also be incorporated, such as for example devices operating in CID, photo dissociation, ETD or ECD modes of operation, or combinations of such modes, at location 1185. Various types of ion guide/cells may be utilised for the fragmentation device, including the examples given above. A device for raising ions to a high energy—an energy lift-suitable for injection into the analyser of the present invention may also be incorporated at location 1185. This device may be a dedicated device or may be part of a fragmentor, ion mobility device or ion guide. It may incorporate ion cooling facilities by being pressurised with gas. The pulsed ion source 1175 used to supply packets of ions to the analyser of the present invention may be a C trap, an orthogonal accelerator or some other form of ion trap, for example. The pulsed ion source 1175 may be pressurised with a gas for, amongst other things, cooling the ions before ejection, or alternatively an external cooling device may be used. Alternatively still, some other means for cooling ions, such as a directed gas jet (as described in WO2010/034630) either within or outside the pulsed ion source may be utilised. The pulsed ion source preferably includes storage capabilities to accumulate ions prior to ejection (e.g. as in the C-trap). Optionally, further fragmentation devices may be incorporated downstream of the pulsed ion source upon another leg of the instrument from the TOF analyser of the present invention, at location 1178. Ions may then be passed through the pulsed ion source 1175 to the further fragmentor 1178, then following fragmentation, be passed back upstream to the pulsed ion source 1175 for ejection to the TOF analyser 1190. The further fragmentor 1178 may again be a device operating in CID, photo dissociation, ETD or ECD modes of operation, or combinations of such modes and again various types of ion guide/cells may be utilised for the further fragmentation device, including the examples given above. Optionally an additional mass selector may be downstream of the further fragmentor at location 1195, in which case ions may be passed downstream from the further fragmentor 1178 to the additional mass selector 1195, ions may be selected and passed back upstream through the further fragmentor 1178 to the pulsed ion source 1175 for ejection to the TOF analyser 1190. The additional mass analyser 1195 may be any type of mass selector such as those given as examples for MS1 above. Accordingly, additional mass analysers may also be incorporated into the instrument, either upstream or downstream of the analyser of the present invention 1190. Multiple analysers of the present invention may be used, in which case one or more may be operated in mass selective mode, including the TOF analyser 1190. When the TOF analyser 1190 is operated in mass selective mode ions may be passed to a fragmentor, conveniently the further fragmentor 1178 described previously. There the ions may be fragmented and passed to the pulsed ion source 1175 for ejection to the TOF analyser 1190 once more. This process may be performed multiple times to provide $MS^n$ capabilities.

Preferably an analyser of the present invention 1190 may be used in conjunction with an ion source 1140, an ion mobility device 1145, a first mass selector 1155, a first fragmentation device 1185 which incorporates an energy lift, a pulsed ion source 1175, and a second fragmentation device 1178.

The analyser described earlier having opposing mirrors providing a total z length of some 380 mm and some 36 full oscillations is calculated to be capable of providing mass resolving power in excess of 120,000 when utilizing a C-trap pulsed ion source. However the requirement to prevent gas emanating from the C-trap from entering the analyser, and the need to rotate the temporal focal plane both create extra aberrations, reducing the calculated resolving power to 60,000 though maintaining almost full transmission (~90%). Use of beam defining methods as described to only allow transmission of the central portion of the beam reduce the transmission to <10%, but increase the mass resolving power to 120,000. The transmission loss is considerable, but the analyser transmission nevertheless remains comparable to or better than conventional orthogonal-acceleration TOF analysers and at the same time provides exceptionally high mass resolving power. Typically, with reduced transmission, multiple spectra will be added. Where using the defocusing lens method described earlier to limit the phase space of the beam it is possible to obtain a full parent ion spectrum at 120,000 resolving power, followed by even higher resolving power spectra over restricted mass ranges of interest. A pre-filter may be used to select ions within these regions of interest for accumulation within the C-trap or a preceding storage multipole, the accumulated ions being sufficient to compensate for the subsequent loss in transmission when passed through the analyser of the present invention operating in highest mass resolving power mode. This approach is of particular use in applications which do not utilise high speed chromatography, for example.

Figure 29A:
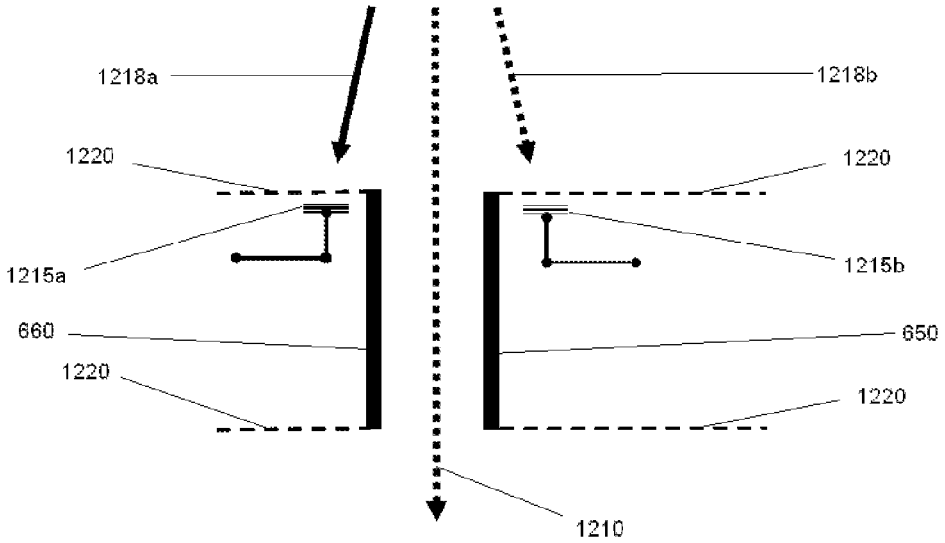
FIG. 29 shows schematic representations of various embodiments for aligning the ion beam using an additional detector.
Figure 29B:
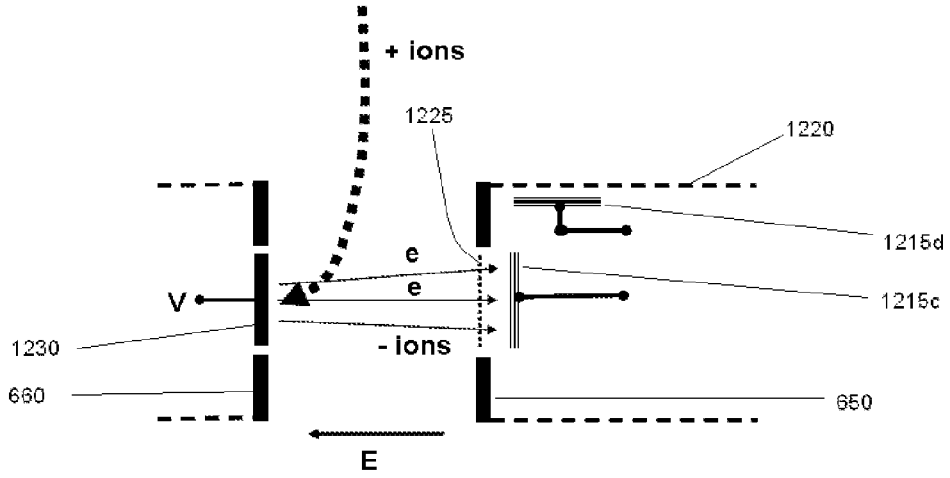
Figure 29C:
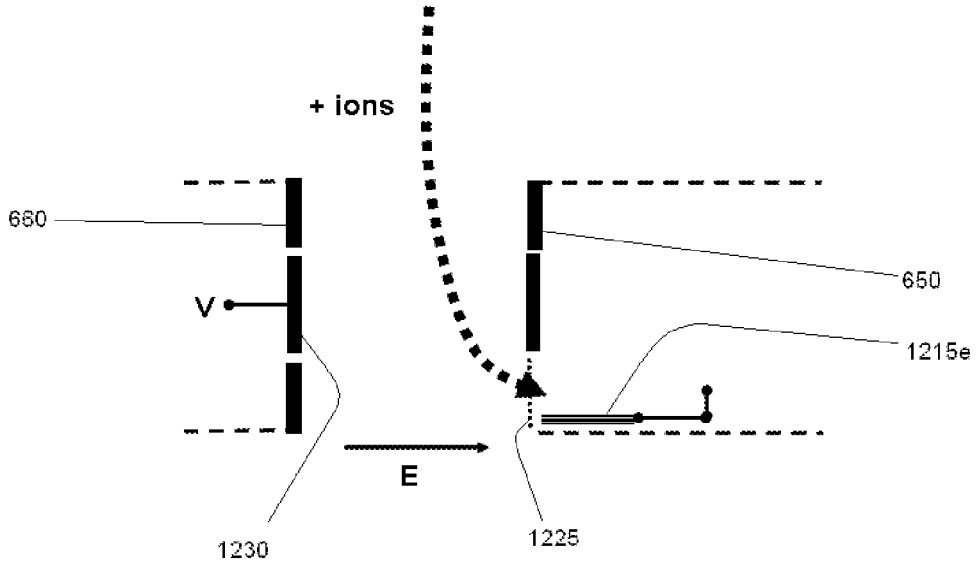
Figure 29D:
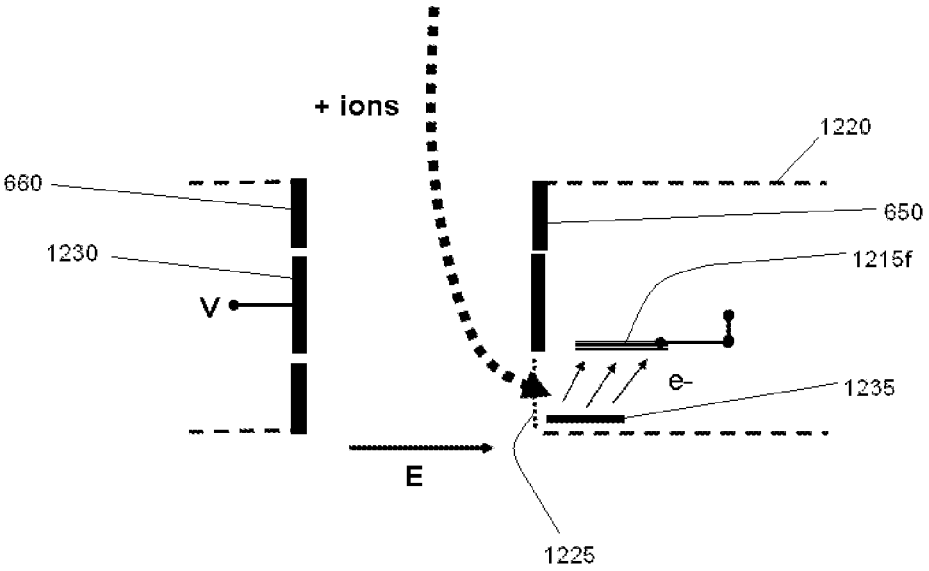

In order to check and/or optimise the position of the ion beam as it travels through the analyser, especially on the main flight path, various methods incorporating alignment or tuning aids can be used. As mentioned before, image current detection on any of electrodes could be used to detect a ion packet when it passes near the electrode. However, sensitivity of such detection for so short detection time would be generally low, so a more sensitive detector would be needed to detect low-intensity ion pulses characteristic for time-of-flight systems. In one embodiment of such an alignment or tuning aid, it is possible to use one or two detectors (or more) located off the main flight path as now described with reference to FIG. 29. FIG. 29*a* shows a schematic side view in the vicinity of the equator of the analyser. The main flight path is shown at 1210 passing between the inner and outer belt electrode assemblies 650 and 660 respectively. Located behind the outer belt electrode 660 at a distance on one side of the main flight path is a first alignment detector 1215*a* and behind the inner belt electrode 650 at an equal distance on the other side of the main flight path is a second alignment detector 1215*b*. The dotted lines 1220 represent field-defining structures (e.g. electrode tracks) which form part of the inner and outer field-defining electrode systems to sustain the analyser field in the vicinity of the belts and detectors. The detectors 1215*a,b* are located behind slits in the field-defining structures 1220. During the previous reflection within the analyser, the ions can be deflected, by, for example, deflector electrodes located upon the belt electrode assemblies, to follow trajectories as shown by arrows 1218*a* and 1218*b* to either a larger or smaller radius than the main flight path 1210 so that they impinge or either detector 1215*a* or 1215*b*, passing through apertures in the field-defining structures 1220. By scanning the beam from a smaller to a larger radius (or vice versa), the centre position of the beam, i.e. the optimum position for the main flight path, can determined from the signal on the two detectors 1215*a,b*. The detectors 1215*a,b* do not have to have time resolving capabilities. An alternative arrangement for checking the correct alignment of the beam is shown schematically in FIG. 29*b* in which ions can be deflected toward one of the belt electrodes, e.g. the outer belt electrode assembly 660 in this case, using an negatively biased (for a beam of positive ions) deflection electrode 1230 in the belt electrode assembly 660. The deflection electrode 1230 can conveniently be one of the arcuate focusing lenses or a separate electrode. The ions impinge on the deflection electrode 1230 and secondary ions and negative electrons are produced which are directed toward the opposite belt electrode, in this case the inner belt electrode assembly 650. The inner belt electrode assembly 650 in this arrangement has a grid 1225 to allow the emitted ions and electrons to pass through to an alignment detector 1215*c*. The detector signal may thus be monitored for different ion beam paths between the belt electrodes to find the optimum beam position. Optionally, a second alignment detector 1215*d* can also be utilized in the manner shown in FIG. 29*a*. An analogous arrangement is shown schematically in FIG. 29*c* in which like parts are labeled as in FIG. 29*b*. In FIG. 29*c*, the deflection electrode 1230 is given a voltage to repel the ion beam toward the opposite belt electrode assembly 650 where it passes through a grid 1225 to impinge on an alignment detector 1215*e*. In a further variation shown schematically in FIG. 29*d*, in which like parts are labeled as in FIG. 29*c*, the ion beam may first strike a conversion dynode 1235 which produces a more measurable charge for the alignment detector 1215*f*. A plurality of alignment detectors may be located annularly around the z axis to aid in tuning the analyser as shown in FIG. 29*e* which shows schematically detectors 1215*g* arranged annularly around the analyser axis z.

Figure 29E:
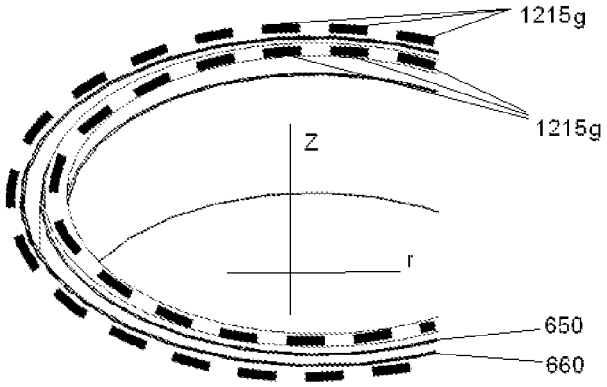
Figure 29F:
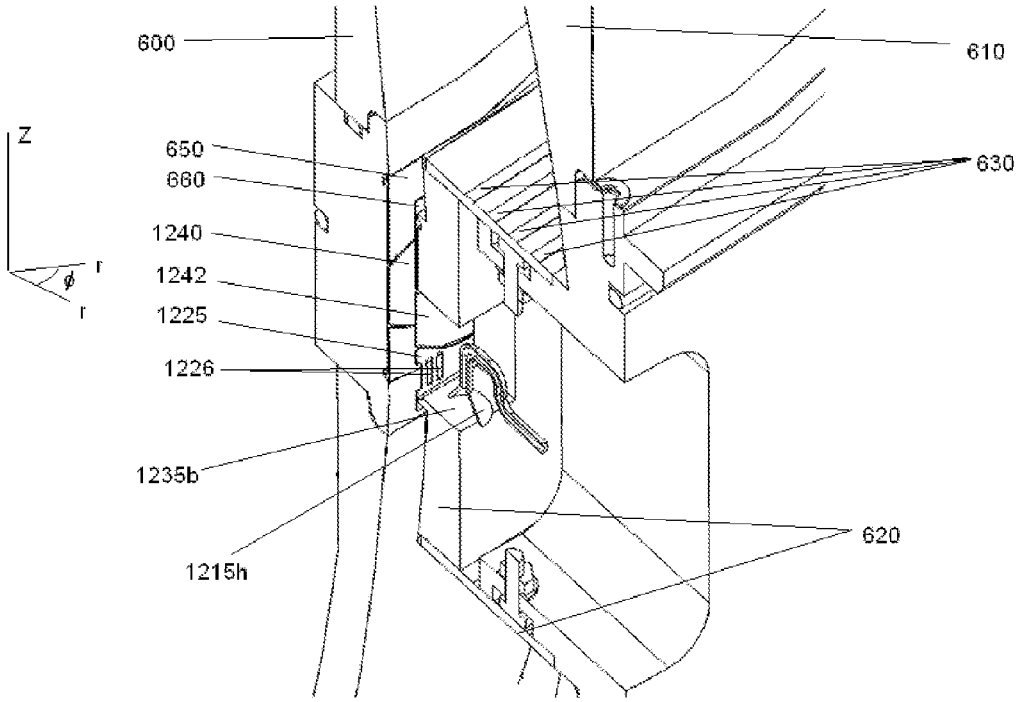

The beam alignment or tuning arrangement shown in schematically in FIG. 29*e* is shown in more detail in FIG. 29*f* which shows a schematic cut-away perspective view in the region of the tuning arrangement. Outer field-defining electrode system 610 having waisted-in portion 620 is shown radially surrounding the inner field-defining electrode system 600. As shown in previous Figures, the surfaces of waisted-in portion 620 facing into the analyser volume carry electrode tracks 630 to sustain the quadro-logarithmic potential of the analyser field in the region of the waisted in portion. The inner field-defining electrode system 600 carries an inner belt electrode assembly 650 which supports inner arcuate focusing lenses in the form of shaped electrode 1240. Opposite the inner belt electrode assembly 650 is an outer belt electrode assembly 660 which supports outer arcuate focusing lenses in the form of shaped electrode 1242. The ion beam travels on the main flight path passing between the inner belt electrode assembly 650 and outer belt electrode assembly 660. Application of an appropriate voltage to the inner shaped electrode 1240 causes the beam to be deflected through slits 1226 in a portion 1225 of outer belt electrode assembly 660. The beam then hits the surface of conversion dynode 1235*b* and the emitted charged particles are then detected by the channeltron detector 1215*h*. By monitoring the detection signal from the channeltron detector 1215*h* for different trajectories of the main flight path, the optimum flight path can be ascertained.

Alternatively or additionally, signals detected from any of the types of detectors described with reference to FIG. 29 may be used in a control system. A controller is connected to the detection system and is used to control ion optical devices which precede the analyser and which influence the entry trajectory of the ion packet entering the analyser, and/or the analyser field. The entry trajectory for the next packet of injected ions may thereby be adjusted, and/or the analyser field may thereby be adjusted by, for example, altering the electrical potentials applied to electrodes, so as to control the ion beam path through the analyser. The controller may also be used so that a desired number of ions is passed to analyser in the next injected packet, on the basis of the quantity of charge that was detected by the detection system. The quantity of charge detected is indicative of the number of ions that were injected into analyser. Where it is desirable to inject a certain quantity of ions into analyser, so as, for example, to optimally fill the analyser so that mass resolution is not adversely affected by space charge, or to ensure a final detector is not overloaded, the quantity of ions can be controlled as just described by the controller, which is a form of automatic gain control (AGC). Alternatively or additionally the gain of a final detector may also be adjusted by the controller on the basis of the quantity of charge that was detected by the detection system, providing the advantage that the detection system connected to the final detector (the final detection system) is thereby prepared for the quantity of ions that will subsequently arrive at the final detector. The useful dynamic range of the final detection system may thereby be arranged to accommodate the arrival rate of ions that are either already in flight within the analyzer or which will be injected into the analyzer in a subsequent injection.

As described previously and with reference to FIGS. 6, 7, 16, 17, 24, 27 and 29, distortion of the electrostatic mass analyser field may be inhibited by the provision of electrical tracks which in use have such voltages applied to them to sustain the potential of the main analyser field. The electrodes are biased to match the equipotentials of the main analyser field. As such, this aspect of the invention relates to inhibiting distortion of a non-zero electrostatic field, since a zero field would not present more than one equipotential. The surface may be substantially flat, or may be folded and may extend over two or more orthogonal planes, as shown in FIGS. 17*c*-*e*, 27 and 29*f*. The surface may be broken into a plurality of spatially separate sub-surfaces. It will be apparent to those skilled in the art that the surface may be curved. The surface may contain an aperture, as previously described in relation to FIG. 16*b*. Where there is an aperture, the electrode tracks may be shaped so as to inhibit distortion of the field due to electric field penetrating through the aperture. The surface may be insulating or semiconducting so as to provide electrical isolation between tracks where necessary. Accordingly the surface may comprise polymer or ceramic pcb material. The tracks may be resistive material as already described, or may be conventional metalized deposits.

Embodiments utilising the further advantage that charged particles are transported through the TOF analyser coherently include the use of MALDI sources. A specifically designed MALDI source coupled to the TOF analyser of the present invention can provide higher mass to charge resolution than embodiments utilising a trap such as the C-trap already described, as the ions may be formed within a smaller volume, e.g. <100 μm diameter compared to the 200 μm×1000 μm dimensions in the C-trap, and because the ions produced have lower energy spreads, reducing time-of-flight aberrations. In addition, due to the absence of the RF fields present in the C-trap, there is no upper mass limit. The MALDI source does not require a gas to provide collisional cooling of ions and therefore no provision is needed to prevent a gas beam emanating from the pulsed ion source from entering the analyser.

Simulations on a beam comprising multiple beams from a +/−100 μm area, diverging with 0.01 degrees, with 1 eV energy spread (giving a theoretical upper mass limit of some 2000 Da) undergoing eight reflections indicate that the image remains coherent and increases in size to some 1 mm.

In addition to the above mentioned specifically designed MALDI sources for use with the TOF Source analyser of the present invention, non-imaging MALDI sources may be used with the described C-trap, e.g. for applications on metabolites and small molecules with high speed and high resolution. The MALDI source may, for example, be coupled to the C-trap in the same manner as it is in the LTQ-Orbitrap™ instrument from Thermo Fisher Scientific. The MALDI source can be situated on either side of the C-trap. The MALDI Source may be situated on one side of the C-trap, whilst another source is situated on the other side of the C-trap, thereby offering a dual source instrument. As examples, depending on the manner of post acceleration on the detector and potential on the C-trap, the following layouts can exist: (1) ESI/LTQ_or_Q/HCD/C-trap/HCD/LTQ_or_Q/MALDI, or (2) ESI/LTQ_or_Q/HCD/c-trap/MALDI, where ESI is electrospray source, LTQ is linear trap quadrupole, Q is quadrupole, and HCD is collision cell. An HCD cell which can apply a potential gradient in both directions may be required for complicated operations on moving ions from one side of the C-trap to the other. Although, in theory, such MALDI arrangements may be used only for small peptides and proteins because the apparatus requires RF devices which generally will not transmit effectively ions higher than 10,000-20,000 m/z. However, this problem can be solved in practice by using two switchable RF frequencies/potentials and operating at two switchable mass ranges. Spectra could also be stitched seamlessly with a small cost in time. A modified C-trap with integrated MALDI source could be used. In such a design the ion optics of any source in the system, e.g. an ESI injection system, may remain the same as for a conventional, e.g. ESI, arrangement and may be coupled to the C-trap as normal. In the integrated C-trap/MALDI arrangement, however, the rear plate of the normal C-trap can be the sample surface on an x-y translational stage. In this case the C-trap operates without RF during MALDI, and requires two stage extraction or delayed extraction. The advantages of this approach is that there is no RF required for MALDI and the device can be used for large molecules (e.g. proteins) and almost all the ion introduction system remains the same.

To compensate for expansion and/or contraction of materials due to temperature changes, preferably the analyser is constructed using the principles described by Davis et.al. in U.S. Pat. No. 6,998,607. These principles include the use of materials that have non-zero thermal expansion coefficients and which are combined in such a way that the flight time of ions passing through the analyser remains constant. More specifically, the time of flight analyser is constructed using a first element having a temperature dependent parameter which causes the time of flight of ions along a first segment of flight path to change with a change in temperature, and the construction also includes a second element, such as a spacer, also having a temperature dependent parameter causing the second element to have a temperature dependent length, and the length of the second element and the temperature dependence of the material used for the second element are chosen such that the overall flight time of ions passing along the whole flight path remains constant for ions of the same mass to charge ratio, irrespective of the temperature of the analyser.

Figure 30:
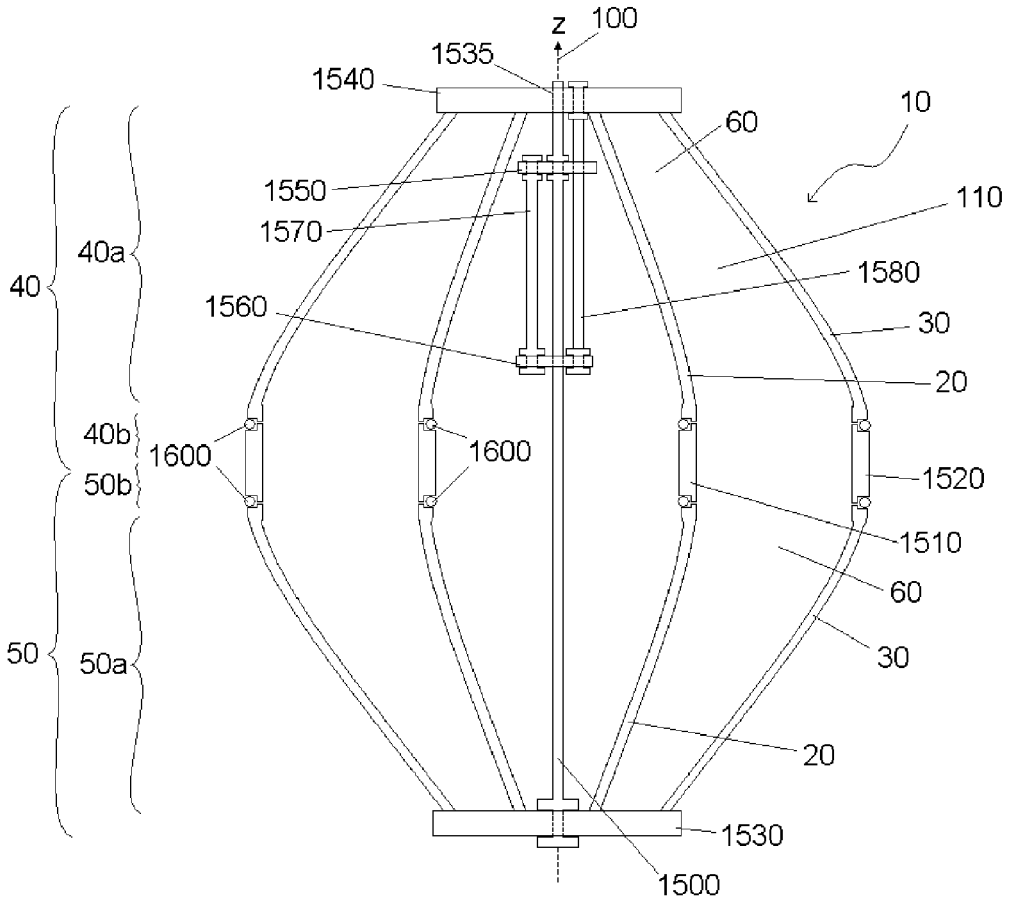
FIG. 30 is a schematic diagram illustrating a preferred system for temperature compensation of the analyser of the present invention.

Referring to FIG. 30, one embodiment that utilises this approach comprises a central pillar 1500 of a first material, located on the z axis 100, extending the full axial length of the analyser 10 which comprises mirrors 40, 50. Mirrors 40, 50 each comprise two sections, 40*a*, 40*b*, 50*a*, 50*b* respectively. Central pillar 1500 runs inside the inner field defining electrode systems 20 of both mirrors 40, 50. Mirrors 40, 50 comprise inner and outer central segments 1510, 1520 respectively in the region where inner and outer belts (not shown) reside. Mirrors 40, 50 are terminated by end plates 1530, 1540. Central pillar 1500 is rigidly attached to end plate 1530, but runs moveably through a hole 1535 within end plate 1540. Upper collar 1550 is rigidly attached to central pillar 1500 and moves with it. Lower collar 1560 surrounds central pillar 1500, and central pillar 1500 can move freely through collar 1560. Auxiliary pillar A 1570 is rigidly attached to both upper and lower collars 1550 and 1560. Auxiliary pillar A 1570 moves with upper collar 1550 and thus causes lower collar 1560 to move. Auxiliary pillar B 1580 passes through both collars 1550 and 1560. Auxiliary pillar B 1580 is free to move through upper collar 1550, but is rigidly attached at its lower end to lower collar 1560 such that auxiliary pillar B 1580 moves with lower collar 1560. At its upper end pillar B 1580 is rigidly attached to the end plate 1540. The components described above comprise a temperature compensation mechanism.

Most materials expand with a rise in temperature and many practical materials with which to fabricate mirrors 40, 50 such as various types of metal or glass also expand with a rise in temperature. Such expansion would, in the absence of any mechanism, cause the mirrors 40, 50 to become larger and to increase the axial length of the analyser in the z direction, increasing the flight path length and the total flight time through the analyser 10. In operation, the temperature compensation mechanism described above and depicted in FIG. 30 causes mirror sections 40*a* and 50*a* to move closer together with a rise in temperature, compressing material 1600 located adjacent inner and outer central segments 1510, 1520. Whilst mirror sections 40*a*, 50*a* become longer in their z length, increasing the flight path length within each mirror section 40*a*, 50*a*, the temperature compensation mechanism causes these expanded mirror sections 40*a*, 50*a* to be moved closer to one another, reducing the flight path length in the region of the inner and outer central segments 1510, 1520. These changes to the flight path lengths are such that overall flight time through the analyser is invariant with changes in the temperature of the analyser. Upon a rise in temperature, the materials which form mirror sections 40*a*, 50*a* expand in size and end plates 1530, 1540 tend to move apart from one another; central pillar 1500 likewise expands. However, auxiliary pillar A 1570 comprises a material with a larger thermal expansion coefficient than the materials used to form the mirror sections 40*a*, 50*a*, and that used to form central pillar 1500, and auxiliary pillar A 1570 expands in length by a larger amount than do the mirror sections 40*a*, 50*a* and central pillar 1500. Being fixed within upper collar 1550, the expansion of auxiliary pillar A 1570 forces lower collar 1560 towards the z=0 plane. Auxiliary pillar B 1580 comprising a material having a low coefficient of thermal expansion is attached to lower collar 1560 and is also attached to end plate 1540. The movement of lower collar 1560 towards the z=0 plane thus also moves end plate 1540 towards the z=0 plane, via auxiliary pillar B 1580. This motion causes end plates 1530, 1540 to move towards each other with a rise in temperature, compressing material 1600. The flight path length in mirror sections 40*a*, 50*a* is longer, but the flight path length in mirror sections 40*b*, 50*b* is shorter and these movements are arranged, by choosing appropriate materials for the mirrors and pillars, such that the overall flight time is invariant with temperature.

Alternatively, other known methods of temperature compensation may be used. For example, a thermally length-invariant spacing structure may be used as described in U.S. Pat. No. 6,049,077, or the obtained mass spectrum may be adjusted to account for the changes in the flight path due to thermal expansion as described in U.S. Pat. No. 6,700,118.

Figure 31A:
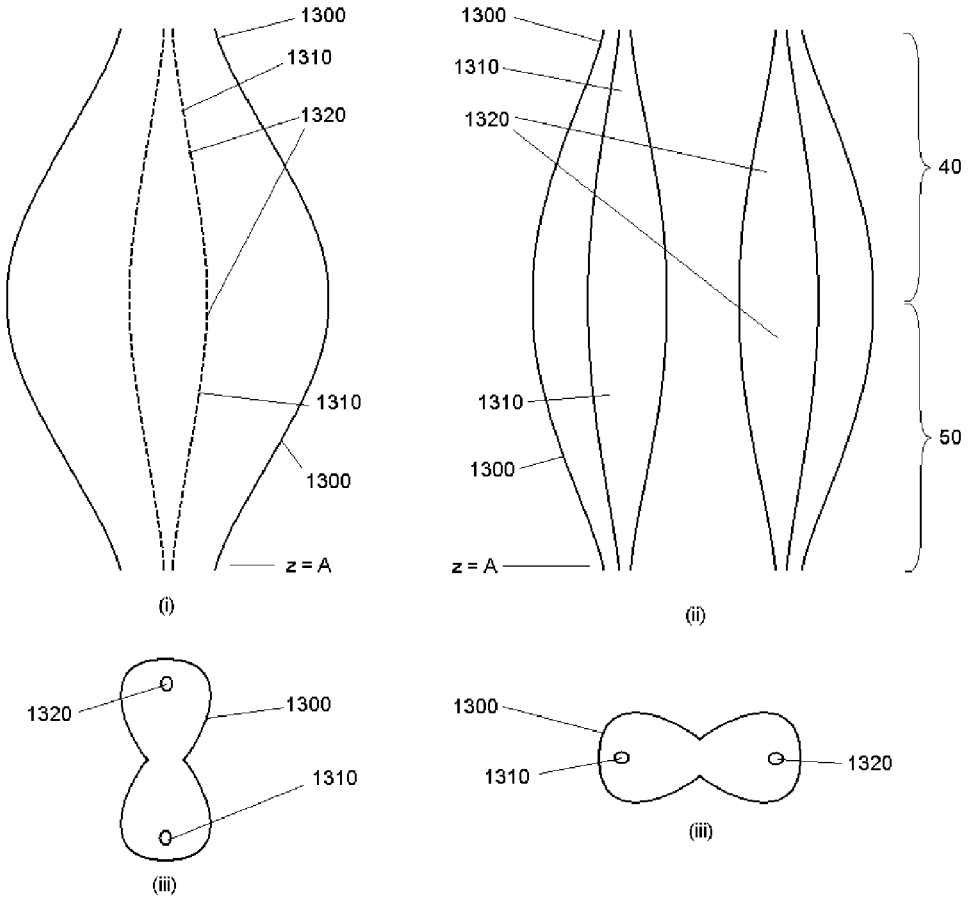
FIG. 31 shows schematic views of the electrode structures for various further embodiments of the invention.
Figure 31B:
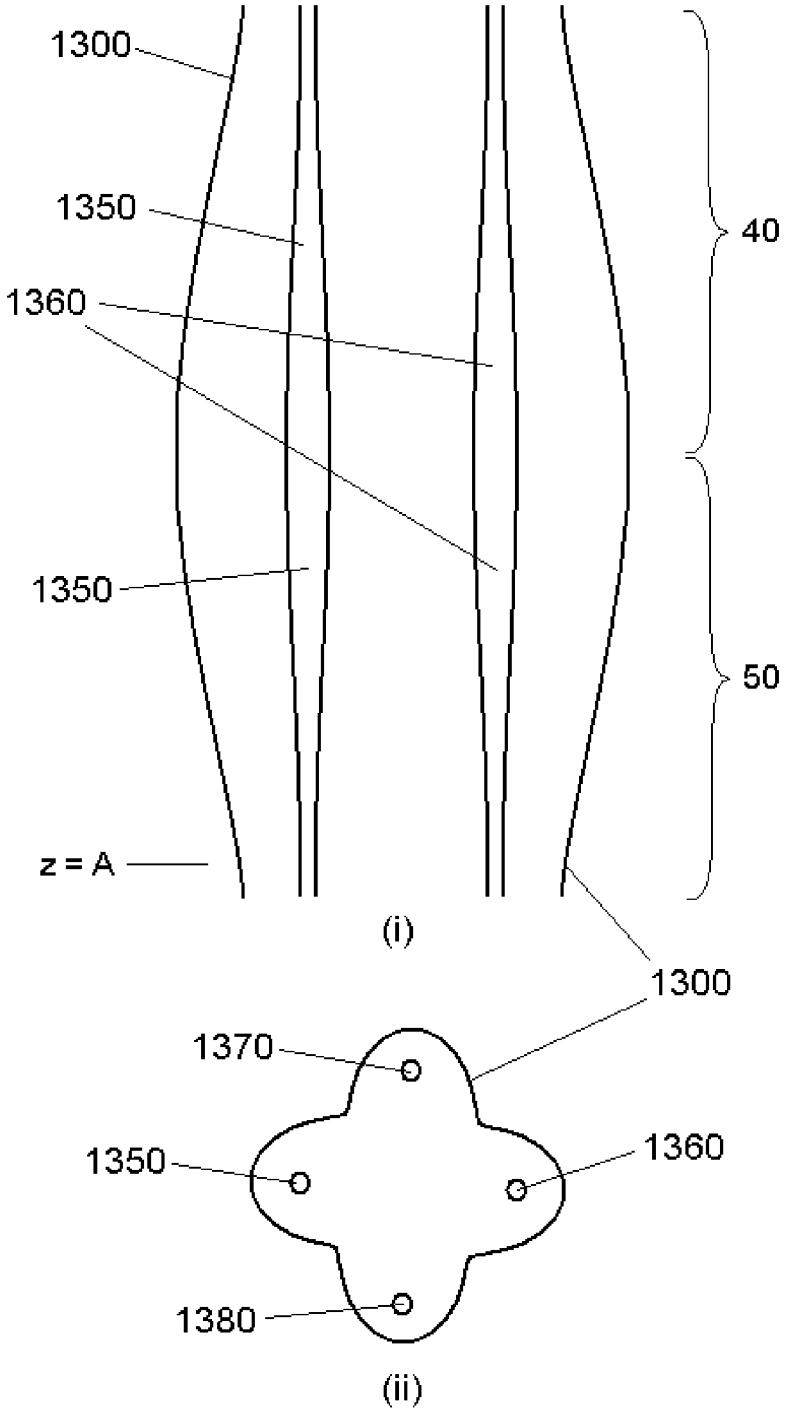

Examples of some embodiments described by equations (6a-c) are shown in FIG. 31. FIG. 31*a* shows cross sections through the mirror structure at the x=0 plane (i), at the y=0 plane (ii) and at the plane z=A (iii). Opposing mirrors 40, 50 each comprise an outer field defining electrode structure 1300 which surrounds two inner field defining electrode structures 1310, 1320. Inner field defining electrodes 1310, 1320 do not lie upon the x=0 plane and are shown dashed in FIG. 31*a*(i). FIG. 31*b* shows a further embodiment described by equation (6a), in which a cross section through the mirror structure is provided at the x=0 plane (i) and at the plane z=A (ii). Opposing mirrors 40, 50 each comprise an outer field defining electrode structure 1300 which surrounds four inner field defining electrode structures, 1350, 1360, 1370, 1380.

Figure 31C:
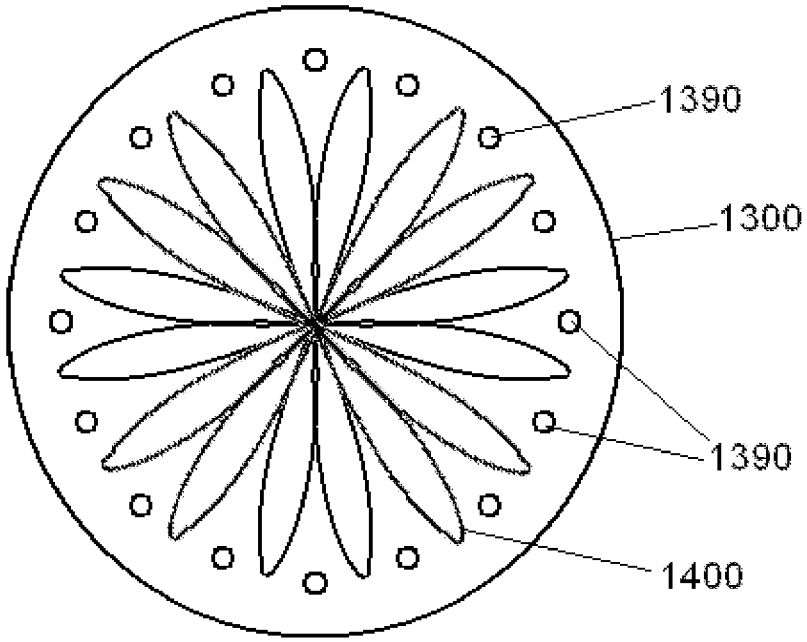

Similar structures are shown in C. Köster, Int. J. Mass Spectrom. Volume 287, Issues 1-3, pages 114-118 (2009), FIGS. 1 and 2 showing perspective views of embodiments similar to those shown in FIGS. 31*a* and 31*b*. This publication also provides illustrations of charged particle trajectories within the electrostatic traps described therein in FIGS. 3, 4 and 5. Similar trajectories may be executed within embodiments of the TOF analysers of the present invention. A further trajectory is shown schematically in FIG. 31*c* in relation to a further solution to equations 6(a-c) in which 16 inner field-defining spindle-like structures 1390 are surrounded by an outer field defining electrode structure 1300 in each mirror, the structures 1300, 1390 extending in the z direction. FIG. 31*c* shows a cross section through the electrode structure at a plane of constant z, and a beam envelope 1400 schematically indicating ion trajectories is depicted describing substantially linear motion in a plane perpendicular to the z axis the substantially linear motion rotating about the z axis producing a star-shaped beam envelope 1400.

As used herein, including in the claims, unless the context indicates otherwise, singular forms of the terms herein are to be construed as including the plural form and vice versa. For instance, unless the context indicates otherwise, a singular reference herein including in the claims, such as "a" or "an" means "one or more".

Throughout the description and claims of this specification, the words "comprise", "including", "having" and "contain" and variations of the words, for example "comprising" and "comprises" etc, mean "including but not limited to", and are not intended to (and do not) exclude other components.

It will be appreciated that variations to the foregoing embodiments of the invention can be made while still falling within the scope of the invention. Each feature disclosed in this specification, unless stated otherwise, may be replaced by alternative features serving the same, equivalent or similar purpose. Thus, unless stated otherwise, each feature disclosed is one example only of a generic series of equivalent or similar features.

The use of any and all examples, or exemplary language ("for instance", "such as", "for example" and like language) provided herein, is intended merely to better illustrate the invention and does not indicate a limitation on the scope of the invention unless otherwise claimed. No language in the specification should be construed as indicating any non-claimed element as essential to the practice of the invention.

The invention claimed is:

1. A method of separating charged particles using an analyser, the method comprising:

causing a beam of charged particles to fly through the analyser and undergo within the analyser at least one full oscillation in the direction of an analyser axis (z) of the analyser whilst orbiting about the axis (z) along a main flight path;

constraining the arcuate divergence of the beam as it flies through the analyser; and separating the charged particles according to their flight time.

2. A method as claimed in claim 1 wherein the analyser comprises two opposing mirrors each mirror comprising inner and outer field-defining electrode systems elongated along the axis z, the outer system surrounding the inner and defining therebetween an analyser volume, whereby when the electrode systems are electrically biased the mirrors create an electrical field comprising opposing electrical fields along z and the beam of charged particles undergoes the at least one full oscillation in the direction of the analyser axis (z) within the analyser volume, by reflecting between the mirrors.

3. A method as claimed in claim 1 which further comprises ejecting at least some of the charged particles having a plurality of m/z from the analyser or detecting the at least some of charged particles having a plurality of m/z, the ejecting or detecting being performed after the particles have undergone the same number of orbits around the axis z.

4. A method as claimed in claim 1 which further comprises measuring the flight time of at least some of the charged particles after the particles have undergone the same number of orbits around the axis z.

5. A method as claimed in claim 1 wherein the at least one full oscillation in the direction of the z axis is of substantially simple harmonic motion.

6. A method as claimed in claim 1 wherein the analyser comprises at least one arcuate focusing lens for constraining the arcuate divergence of the beam of charged particles within the analyser, the method comprising passing the beam of charged particles through the at least one arcuate focusing lens to constrain the arcuate divergence of the beam.

7. A method as claimed in claim 6 wherein one or more arcuate focusing lenses are located at or near the z=0 plane.

8. A method as claimed in claim 6 wherein one or more arcuate focusing lenses are located adjacent one or both of the maximum turning points of the beam along z.

9. A method as claimed in claim 1 wherein the method comprises constraining the arcuate divergence of the beam a plurality of times as it flies through the analyser.

10. A method as claimed in claim 9 wherein the beam has its arcuate divergence constrained after substantially each oscillation between the mirrors.

11. A method as claimed in claim 10 wherein the beam has its arcuate divergence constrained after substantially each reflection from the mirrors.

12. A method as claimed in claim 6 wherein the apparatus comprises a plurality of arcuate focusing lenses.

13. A method as claimed in claim 12 wherein the plurality of arcuate focusing lenses form an array of arcuate focusing lenses located at substantially the same z coordinate, the array extending at least partially around the z axis in the arcuate direction.

14. A method as claimed in claim 13 wherein the array of arcuate focusing lenses is located offset from z=0 to a coordinate where the main flight path crosses over itself during an oscillation.

15. A method as claimed in claim 13 wherein the spacing apart of the plurality of arcuate focusing lenses in the arcuate direction is periodic.

16. A method as claimed in claim 15 wherein the plurality of arcuate focusing lenses are spaced apart in the arcuate direction by a distance that the beam advances in the arcuate direction at the z coordinate at which the lenses are placed after each oscillation along z.

17. A method as claimed in claim 15 wherein the plurality of arcuate focusing lenses are spaced apart in the arcuate direction by an angle $\theta$ radians, where $\theta \ll 2\pi$, and the beam orbits the analyser axis in the arcuate direction by an angle $4\pi+/-\theta$ radians for each full oscillation.

18. A method as claimed in claim 15 wherein the plurality of arcuate focusing lenses are spaced apart in the arcuate direction by an angle $\theta$ radians, where $\theta \ll 2\pi$, and the beam orbits the analyser axis in the arcuate direction by an angle $2\pi+/-\theta$ radians for each half oscillation.

19. A method as claimed in claim 6 wherein the at least one arcuate focusing lens comprises a pair of opposed electrodes located either side of the beam.

20. A method as claimed in claim 19 wherein each electrode of the pair of opposed electrodes is substantially circular in shape and/or has smooth arc-shaped edges.

21. A method as claimed in claim 19 wherein the pair of opposed electrodes comprises a pair of single-piece lens electrode assemblies which are shaped to provide a plurality of arcuate focusing lenses.

22. A method as claimed in claim 21 wherein the single-piece lens electrode assemblies have edges comprising a plurality of smooth arc shapes.

23. A method as claimed in claim 21 wherein the single-piece lens electrode assemblies extend at least partially around the z axis in the arcuate direction.

24. A method as claimed in claim 6 wherein the one or more arcuate focusing lenses each comprise a plurality of radially stacked electrodes electrically insulated from each other.

25. A method as claimed in claim 1 wherein the analyser comprises one or more one belt electrode assemblies which extend at least partially around the z axis in an arcuate direction.

26. A method as claimed in claim 25 wherein the analyser comprises at least two belt electrode assemblies with a belt electrode assembly placed either side of the main flight path.

27. A method as claimed in claim 25 wherein the one or more belt electrode assemblies are electrically insulated from the arcuate focusing lenses and extend beyond the edges of the arcuate focusing lenses in the z direction.

28. A method as claimed in claim 25 wherein the one or more belt electrode assemblies are in the form of cylinders or sections having a shape which approximates the equipotentials of the analyser electrical field at the place the one or more belt electrode assemblies are located.

29. A method of separating charged particles as claimed in claim 1 wherein ions are deflected off the main flight path so that they impinge upon a detection surface within the analyser volume.

30. A method of separating charged particles as claimed in claim 29 wherein the method includes detecting the ions that impinge upon the detection surface as part of a process to optimise the position of the ion beam as it travels through the analyser and/or as part of a process of automatic gain control and/or as part of a process to adjust the gain of a detector.

31. A method of separating charged particles as claimed in claim 1 further comprising measuring the flight times through the analyser of the at least some of the charged particles after the particles have undergone the same number of orbits around the axis z and constructing a mass spectrum from the measured flight times.

32. A charged particle analyser comprising two opposing mirrors each mirror comprising inner and outer field-defining electrode systems elongated along an axis z, the outer system surrounding the inner, whereby when the electrode systems are electrically biased the mirrors create an electrical field comprising opposing electrical fields along z; and at least one arcuate focusing lens for constraining the arcuate divergence of a beam of charged particles within the analyser whilst the beam orbits around the axis z.

33. An analyser as claimed in claim 32 wherein one or more arcuate focusing lenses are located at or near the z=0 plane.

34. An analyser as claimed in claim 32 wherein one or more arcuate focusing lenses are located adjacent one or both of the maximum turning points of the beam along z.

35. An analyser as claimed in claim 32 wherein the apparatus comprises a plurality of arcuate focusing lenses which form an array of arcuate focusing lenses located at substantially the same z coordinate, the arcuate focusing lenses being spaced apart in the arcuate direction and the array extending at least partially around the z axis in the arcuate direction.

36. An analyser as claimed in claim 35 wherein the array of arcuate focusing lenses is located offset from z=0 to a z coordinate where the main flight path crosses over itself during an oscillation.

37. An analyser as claimed in claim 35 wherein the spacing apart of the plurality of arcuate focusing lenses in the arcuate direction is periodic.

38. An analyser as claimed in claim 37 wherein the plurality of arcuate focusing lenses are spaced apart in the arcuate direction by a distance that the beam advances in the arcuate direction at the z coordinate at which the lenses are placed after each oscillation along z.

39. An analyser as claimed in claim 32 wherein the at least one arcuate focusing lens comprises a pair of opposed electrodes located either side of the beam.

40. An analyser as claimed in claim 39 wherein each electrode of the pair of opposed electrodes is substantially circular in shape and/or has smooth arc-shaped edges.

41. An analyser as claimed in claim 39 wherein the pair of opposed electrodes comprises a pair of single-piece lens electrode assemblies which are shaped to provide a plurality of arcuate focusing lenses.

42. An analyser as claimed in claim 41 wherein the single-piece lens electrode assemblies have edges comprising a plurality of smooth arc shapes.

43. An analyser as claimed in claim 41 wherein the single-piece lens electrode assemblies extend at least partially around the z axis in the arcuate direction.

44. An analyser as claimed in claim 32 wherein the one or more arcuate focusing lenses each comprise a plurality of radially stacked electrodes electrically insulated from each other.

45. An analyser as claimed in claim 32 wherein the analyser comprises one or more one belt electrode assemblies which extend at least partially around the z axis in an arcuate direction.

46. An analyser as claimed in claim 45 wherein the analyser comprises at least two belt electrode assemblies with a belt electrode assembly placed either side of the main flight path of the beam.

47. An analyser as claimed in claim 45 wherein the one or more belt electrode assemblies are electrically insulated from the arcuate focusing lenses and extend beyond the edges of the arcuate focusing lenses in the z direction.

48. An analyser as claimed in claim 45 wherein the one or more belt electrode assemblies are in the form of cylinders or sections having a shape which approximates the equipotentials of the analyser electrical field at the place the one or more belt electrode assemblies are located.

49. An analyser as claimed in claim 32 further comprising a deflector arranged in use to deflect ions off the main flight path so that they impinge upon a detector located within the analyser volume.

50. A mass spectrometer comprising:

an ion source for producing ions for analysis;

at least one ion guide for transporting the ions within the mass spectrometer; and a charged particle analyser comprising two opposing mirrors each mirror comprising inner and outer field-defining electrode systems elongated along an axis z, the outer system surrounding the inner, whereby when the electrode systems are electrically biased the mirrors create an electrical field comprising opposing electrical fields along z; and at least one arcuate focusing lens for constraining the arcuate divergence of a beam of ions within the analyser whilst the beam orbits around the axis z.

51. The mass spectrometer of claim 50 arranged to be suitable for tandem mass spectrometry wherein the analyser is arranged to perform high mass resolution time-of-flight analysis of precursor or fragmented ions.

* * * * *